US008847861B2

(12) United States Patent
Kimura

(10) Patent No.: US 8,847,861 B2
(45) Date of Patent: Sep. 30, 2014

(54) ACTIVE MATRIX DISPLAY DEVICE, METHOD FOR DRIVING THE SAME, AND ELECTRONIC DEVICE

(75) Inventor: Hajime Kimura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 786 days.

(21) Appl. No.: 11/430,129

(22) Filed: May 8, 2006

(65) Prior Publication Data

US 2006/0267889 A1 Nov. 30, 2006

(30) Foreign Application Priority Data

May 20, 2005 (JP) ..... 2005-148801

(51) Int. Cl.

| | |
|---|---|
| ***G09G 3/20*** | (2006.01) |
| ***G09G 5/395*** | (2006.01) |
| *G09G 3/32* | (2006.01) |
| *G09G 5/399* | (2006.01) |

(52) U.S. Cl.

CPC ..... *G09G 3/3233* (2013.01); *G09G 3/3266* (2013.01); *G09G 2320/10* (2013.01); *G09G 3/2022* (2013.01); *G09G 2320/103* (2013.01); *G09G 2300/0842* (2013.01); *G09G 2300/0408* (2013.01); *G09G 2300/0861* (2013.01); *G09G 3/3275* (2013.01); *G09G 5/399* (2013.01); *G09G 2330/021* (2013.01); *G09G 5/395* (2013.01); *G09G 3/3258* (2013.01); *G09G 2310/0221* (2013.01)

USPC ..... 345/84; 345/76; 345/89; 345/100

(58) Field of Classification Search

CPC ..... G09G 3/30

USPC ..... 345/76–83, 87–104

See application file for complete search history.

(56) References Cited

U.S. PATENT DOCUMENTS 5,917,471 A * 6/1999 Choi ..... 345/690
6,670,771 B2 12/2003 Shin et al.

(Continued)

FOREIGN PATENT DOCUMENTS

CN 1447305 A 10/2003
CN 1467696 A 1/2004

(Continued)

OTHER PUBLICATIONS

Office Action re Chinese Patent Application No. CN 200610082441.6, dated Feb. 20, 2009 (with English translation).

(Continued)

*Primary Examiner* — Sumati Lefkowitz
*Assistant Examiner* — Peijie Shen
(74) *Attorney, Agent, or Firm* — Husch Blackwell LLP

(57) ABSTRACT

An object of the invention is to provide a display device which can reduce the number of times signal writing to a pixel is carried out and power consumption. A display device which can reduce the number of times signal writing to a pixel is carried out and power consumption can be provided. According to an active matrix display device of the invention, in the case a signal to be written to a pixel row is identical with a signal stored in the pixel row, the scan line driver circuit does not output a selecting pulse to a scan line corresponding to the pixel row, and the signal line driver circuit makes the signal lines in a floating state or keeps without changing the state of the signal line from the previous state.

5 Claims, 104 Drawing Sheets

(56) References Cited

U.S. PATENT DOCUMENTS

| | | | | |
|---|---|---|---|---|
| 6,784,878 | B2 | 8/2004 | Hanari et al. | |
| 6,809,482 | B2 | 10/2004 | Koyama | |
| 6,828,950 | B2 * | 12/2004 | Koyama | 345/76 |
| 6,853,371 | B2 | 2/2005 | Miyajima et al. | |
| 6,952,298 | B2 | 10/2005 | Hara et al. | |
| 7,019,738 | B2 | 3/2006 | Tsutsui | |
| 7,061,014 | B2 | 6/2006 | Hosono et al. | |
| 7,116,291 | B1 | 10/2006 | Suzuki et al. | |
| 7,119,782 | B2 * | 10/2006 | Sunohara et al. | 345/100 |
| 7,808,495 | B2 | 10/2010 | Tsutsui | |
| 2001/0035849 | A1 * | 11/2001 | Kimura et al. | 345/76 |
| 2002/0024489 | A1 | 2/2002 | Koyama et al. | 345/87 |
| 2003/0030614 | A1 | 2/2003 | Tajima et al. | 345/89 |
| 2003/0090481 | A1 * | 5/2003 | Kimura | 345/211 |
| 2003/0132930 | A1 * | 7/2003 | Kimura et al. | 345/211 |
| 2004/0047530 | A1 | 3/2004 | Hara et al. | |
| 2004/0095305 | A1 * | 5/2004 | Kimura et al. | 345/92 |
| 2005/0012732 | A1 | 1/2005 | Koyama et al. | 345/205 |
| 2005/0017928 | A1 * | 1/2005 | Osame et al. | 345/76 |
| 2005/0116914 | A1 * | 6/2005 | Nagao et al. | 345/92 |
| 2005/0225526 | A1 | 10/2005 | Chiu et al. | 345/98 |
| 2006/0071897 | A1 | 4/2006 | Moon | |
| 2007/0035488 | A1 | 2/2007 | Kimura | |

FOREIGN PATENT DOCUMENTS

| | | | |
|---|---|---|---|
| EP | 1 189 192 | A2 | 3/2002 |
| EP | 1 189 193 | A2 | 3/2002 |
| EP | 1 443 130 | A1 | 8/2004 |
| JP | 10-83165 | | 3/1998 |
| JP | 2784615 | B2 | 5/1998 |
| JP | 2784615 | B2 | 8/1998 |
| JP | 2000-194305 | | 7/2000 |
| JP | 2001-83907 | | 3/2001 |
| JP | 2001-305511 | A | 10/2001 |
| JP | 2002-082659 | A | 3/2002 |
| JP | 2002-091366 | A | 3/2002 |
| JP | 2002-091395 | A | 3/2002 |
| JP | 2002-091396 | A | 3/2002 |
| JP | 2002-149104 | | 5/2002 |
| JP | 2002-358031 | | 12/2002 |
| JP | 2003-99018 | | 4/2003 |
| JP | 2003-150132 | | 5/2003 |
| JP | 2003-167561 | A | 6/2003 |
| JP | 2004-103957 | A | 4/2004 |
| JP | 2006-184884 | | 7/2006 |
| KR | 2003-0095272 | | 12/2003 |
| WO | WO 03/094362 | A2 | 11/2003 |

OTHER PUBLICATIONS

Office Action re Chinese Patent Application No. CN 200610082441.6, dated Sep. 11, 2009 (with English translation).

Office Action re Korean Patent Application No. KR 10-2006-0045766, dated Aug. 2, 2012 (English translation).

Nomura, K. et al., "31a-ZA-6 Carrier Transport in Transparent Amorphous Oxide Semiconductor $InGaZnO_4$," Extended Abstracts (The 51st Spring Meeting 2004), The Japan Society of Applied Physics and Related Societies, No. 2, Mar. 28, 2004, pp. 669 (with English translation).

* cited by examiner

FIG. 27

| | SF1 | SF2 | SF3 | SF4 | SF5 | SF6 | SF7 |
|---|---|---|---|---|---|---|---|
| | 1 | 1 | 1 | 1 | 1 | 1 | 1 |
| 0 | × | × | × | × | × | × | × |
| 1 | ○ | × | × | × | × | × | × |
| 2 | ○ | ○ | × | × | × | × | × |
| 3 | ○ | ○ | ○ | × | × | × | × |
| 4 | ○ | ○ | ○ | ○ | × | × | × |
| 5 | ○ | ○ | ○ | ○ | ○ | × | × |
| 6 | ○ | ○ | ○ | ○ | ○ | ○ | × |
| 7 | ○ | ○ | ○ | ○ | ○ | ○ | ○ |

○ : lighting
× : non-lighting

FIG. 28

| | SF1 | SF2 | SF3 | SF4 | SF5 | SF6 | SF7 |
|---|---|---|---|---|---|---|---|
| | 8 | 8 | 8 | 2 | 2 | 2 | 1 |
| 0 | × | × | × | × | × | × | × |
| 1 | × | × | × | × | × | × | ○ |
| 2 | × | × | × | ○ | × | × | × |
| 3 | × | × | × | ○ | × | × | ○ |
| 4 | × | × | × | ○ | ○ | × | × |
| 5 | × | × | × | ○ | ○ | × | ○ |
| 6 | × | × | × | ○ | ○ | ○ | × |
| 7 | × | × | × | ○ | ○ | ○ | ○ |
| 8 | ○ | × | × | × | × | × | × |
| 9 | ○ | × | × | × | × | × | ○ |
| 10 | ○ | × | × | ○ | × | × | × |
| 11 | ○ | × | × | ○ | × | × | ○ |
| 12 | ○ | × | × | ○ | ○ | × | × |
| 13 | ○ | × | × | ○ | ○ | × | ○ |
| 14 | ○ | × | × | ○ | ○ | ○ | × |
| 15 | ○ | × | × | ○ | ○ | ○ | ○ |
| 16 | ○ | ○ | × | × | × | × | × |
| 17 | ○ | ○ | × | × | × | × | ○ |
| 18 | ○ | ○ | × | ○ | × | × | × |
| 19 | ○ | ○ | × | ○ | × | × | ○ |
| 20 | ○ | ○ | × | ○ | ○ | × | × |
| 21 | ○ | ○ | × | ○ | ○ | × | ○ |
| 22 | ○ | ○ | × | ○ | ○ | ○ | × |
| 23 | ○ | ○ | × | ○ | ○ | ○ | ○ |
| 24 | ○ | ○ | ○ | × | × | × | × |
| 25 | ○ | ○ | ○ | × | × | × | ○ |
| 26 | ○ | ○ | ○ | ○ | × | × | × |
| 27 | ○ | ○ | ○ | ○ | × | × | ○ |
| 28 | ○ | ○ | ○ | ○ | ○ | × | × |
| 29 | ○ | ○ | ○ | ○ | ○ | × | ○ |
| 30 | ○ | ○ | ○ | ○ | ○ | ○ | × |
| 31 | ○ | ○ | ○ | ○ | ○ | ○ | ○ |

○ : lighting
× : non-lighting

FIG. 29

| | SF1 | SF2 | SF3 | SF4 | SF5 | SF6 |
|---|---|---|---|---|---|---|
| | 8 | 8 | 8 | 4 | 2 | 1 |
| 0 | × | × | × | × | × | × |
| 1 | × | × | × | × | × | ○ |
| 2 | × | × | × | × | ○ | × |
| 3 | × | × | × | × | ○ | ○ |
| 4 | × | × | × | ○ | × | × |
| 5 | × | × | × | ○ | × | ○ |
| 6 | × | × | × | ○ | ○ | × |
| 7 | × | × | × | ○ | ○ | ○ |
| 8 | ○ | × | × | × | × | × |
| 9 | ○ | × | × | × | × | ○ |
| 10 | ○ | × | × | × | ○ | × |
| 11 | ○ | × | × | × | ○ | ○ |
| 12 | ○ | × | × | ○ | × | × |
| 13 | ○ | × | × | ○ | × | ○ |
| 14 | ○ | × | × | ○ | ○ | × |
| 15 | ○ | × | × | ○ | ○ | ○ |
| 16 | ○ | ○ | × | × | × | × |
| 17 | ○ | ○ | × | × | × | ○ |
| 18 | ○ | ○ | × | × | ○ | × |
| 19 | ○ | ○ | × | × | ○ | ○ |
| 20 | ○ | ○ | × | ○ | × | × |
| 21 | ○ | ○ | × | ○ | × | ○ |
| 22 | ○ | ○ | × | ○ | ○ | × |
| 23 | ○ | ○ | × | ○ | ○ | ○ |
| 24 | ○ | ○ | ○ | × | × | × |
| 25 | ○ | ○ | ○ | × | × | ○ |
| 26 | ○ | ○ | ○ | × | ○ | × |
| 27 | ○ | ○ | ○ | × | ○ | ○ |
| 28 | ○ | ○ | ○ | ○ | × | × |
| 29 | ○ | ○ | ○ | ○ | × | ○ |
| 30 | ○ | ○ | ○ | ○ | ○ | × |
| 31 | ○ | ○ | ○ | ○ | ○ | ○ |

○ : lighting
× : non-lighting

FIG. 30A

| column No. | 1 | 2 | 3 | 4 | 5 | 6 | 7 | 8 | 9 | 10 |
|---|---|---|---|---|---|---|---|---|---|---|
| sub frames | SF1 | SF1 | SF1 | SF1 | SF1 | SF1 | SF1 | SF1 | SF1 | SF1 |
| | SF2 | SF2 | SF2 | SF2 | SF2 | SF2 | SF2 | SF2 | SF2 | SF2 |
| | SF3 | SF3 | SF3 | SF3 | SF3 | SF3 | SF3 | SF3 | SF3 | SF3 |
| | SF4 | SF4 | SF4 | SF4 | SF4 | SF4 | SF4 | SF4 | SF4 | SF4 |
| | SF5 | SF5 | SF5 | SF5 | SF5 | SF5 | SF5 | SF5 | SF5 | SF5 |
| | SF6 | SF6 | SF6 | SF6 | SF6 | SF6 | SF6 | SF6 | SF6 | SF6 |
| | SF7 | SF7 | SF7 | SF7 | SF7 | SF7 | SF7 | SF7 | SF7 | SF7 |
| gray scale level | 28 | 31 | 29 | 28 | 30 | 31 | 29 | 30 | 28 | 30 |

FIG. 30B

| column No. | 1 | 2 | 3 | 4 | 5 | 6 | 7 | 8 | 9 | 10 |
|---|---|---|---|---|---|---|---|---|---|---|
| sub frames | SF1 | SF1 | SF1 | SF1 | SF1 | SF1 | SF1 | SF1 | SF1 | SF1 |
| | SF2 | SF2 | SF2 | SF2 | SF2 | SF2 | SF2 | SF2 | SF2 | SF2 |
| | SF3 | SF3 | SF3 | SF3 | SF3 | SF3 | SF3 | SF3 | SF3 | SF3 |
| | SF4 | SF4 | SF4 | SF4 | SF4 | SF4 | SF4 | SF4 | SF4 | SF4 |
| | SF5 | SF5 | SF5 | SF5 | SF5 | SF5 | SF5 | SF5 | SF5 | SF5 |
| | SF6 | SF6 | SF6 | SF6 | SF6 | SF6 | SF6 | SF6 | SF6 | SF6 |
| gray scale level | 28 | 31 | 29 | 28 | 3 | 1 | 0 | 2 | 28 | 30 |

FIG. 32

| | SF1 | SF2 | SF3 | SF4 | SF5 | SF6 | SF7 |
|---|---|---|---|---|---|---|---|
| | 1 | 1 | 1 | 1 | 1 | 1 | 1 |
| 0 | × | × | × | × | × | × | × |
| 1 | × | × | × | ○ | × | × | × |
| 2 | × | × | ○ | ○ | × | × | × |
| 3 | × | × | ○ | ○ | ○ | × | × |
| 4 | × | ○ | ○ | ○ | ○ | × | × |
| 5 | × | ○ | ○ | ○ | ○ | ○ | × |
| 6 | ○ | ○ | ○ | ○ | ○ | ○ | × |
| 7 | ○ | ○ | ○ | ○ | ○ | ○ | ○ |

○ : lighting
× : non-lighting

ACTIVE MATRIX DISPLAY DEVICE, METHOD FOR DRIVING THE SAME, AND ELECTRONIC DEVICE

BACKGROUND OF THE INVENTION

1. Field of the Invention

The present invention relates to a semiconductor device having a function to control a current supplied to a load by a transistor, and to a display device including a pixel formed with a current-drive display element of which luminance is changed by a signal, a pixel formed with a voltage-drive display element of which luminance is changed by a voltage, and a signal line driver circuit and a scan line driver circuit thereof. The present invention also relates to a method for driving the same. The present invention further relates to an electronic device including the display device in a display portion.

2. Description of the Related Art

In recent years, a so-called self-luminous display device in which a pixel is formed using a display element such as a light emitting diode (LED) has attracted attention. As a display element used for such a self-luminous display device, an organic light emitting diode (also referred to as an OLED, an organic EL element, an electroluminescent (EL) element, or the like) has attracted attention, and has been used for an EL display and the like. Since a display element such as an OLED is of self-luminous type, it has advantages such as higher pixel visibility, no backlight required, and higher response speed compared to a liquid crystal display. Note that the luminance of the display element is controlled by the value of current flowing therethrough.

As a method for driving such a display device to express a gray scale, there are an analog gray scale method and a digital gray scale method. The analog gray scale method includes a method to control the light emission intensity of a display element in an analog manner and a method to control the light emission time of a display element in an analog manner. As the analog gray scale method, the method to control the light emission intensity of a display element in an analog manner is often used. However, the method to control the light emission intensity in an analog manner is easily affected by variations in characteristics of a thin film transistor (hereinafter also referred to as a TFT) of each pixel, which causes variations also in luminance of each pixel. On the other hand, in the digital gray scale method, a display element is turned on/off by control in a digital manner to express a gray scale. In the case of the digital gray scale method, the uniformity of luminance of each pixel is excellent. However, there are only two states, that is, a light emitting state and a non-light emitting state, so that only two gray scale levels can be expressed. Therefore, multiple level gray scale display is attempted by using another method in combination. As a technique for multiple level gray scale display, there are an area gray scale method in which light emission area of a pixel is weighted and selected to perform gray scale display and a time gray scale method in which light emission time is weighted and selected to perform gray scale display. In the case of the digital gray scale method, the time gray scale method, which is also suitable to obtain higher definition, is often used.

[Patent Reference 1] Japanese Patent Publication No. 2784615

Here, improvement in definition can be achieved by using the time gray scale method in the digital gray scale method. However, as improvement in definition proceeds, the number of pixels is increased. Therefore, the number of pixels to which a signal is written is also increased.

In addition, the number of subframes needs to be increased to perform high level gray scale display. Therefore, the number of times signal writing to a pixel is carried out is increased.

Thus, with improvements in definition and level of gray scale display, the number of times charging and discharging are carried out, associated with signal writing operation, is also increased. An increase in power consumption becomes problem.

SUMMARY OF THE INVENTION

In view of the above, it is an object of the present invention to provide a display device which can reduce the number of times signal writing to a pixel is carried out and power consumption.

A display device of the present invention includes a means to stop signal inputting to a pixel when a signal to be written to the pixel is identical with a signal already written to the pixel.

In other words, a pixel row is not selected when a signal for pixels of the pixel row to which writing is to be performed is identical with a signal already written to the pixel row. In other words, a signal for not selecting the pixels continues to be input to a scan line connected to the pixel row, or the scan line is put in a floating state.

A display device of the present invention includes a pixel portion where a plurality of pixels is arranged in matrix relative to a row direction and a column direction, a signal line driver circuit which inputs a signal controlling lighting and non-lighting of a pixel to a signal line, and a scan line driver circuit which selects a pixel to which a signal is to be written, in which each of the pixels includes a means to store the signal written thereto, and the scan line driver circuit includes a means to stop signal writing to the pixel when a signal to be written to the pixel is identical with a signal stored in the pixel.

A display device of the present invention includes a pixel portion where a plurality of pixels is arranged in matrix relative to a row direction and a column direction, a signal line driver circuit which inputs a signal controlling lighting and non-lighting of a pixel to a signal line, and a scan line driver circuit which selects a pixel to which the signal is to be written, in which each of the pixels includes a means to store the signal written thereto, and the scan line driver circuit includes a means to stop selecting the pixel when a signal to be written to the pixel is identical with a signal stored in the pixel.

A display device of the present invention includes a pixel portion where a plurality of pixels is arranged in matrix relative to a row direction and a column direction, a signal line driver circuit which inputs a signal controlling lighting and non-lighting of a pixel to a signal line, and a scan line driver circuit which selects a pixel row to which the signal is to be written, in which each of the pixels includes a means to store the signal written thereto, and the scan line driver circuit includes a means to stop signal writing to a pixel row when a signal to be written to the pixel row is identical with a signal stored in the pixel row.

A display device of the present invention includes a pixel portion where a plurality of pixels is arranged in matrix relative to a row direction and a column direction, a signal line driver circuit which inputs a signal controlling lighting and non-lighting of a pixel to a signal line, and a scan line driver circuit which selects a pixel row to which the signal is to be written, in which each of the pixels includes a means to store the signal written thereto, and the scan line driver circuit includes a means to stop selecting a pixel row when a signal to be written to the pixel row is identical with a signal stored in the pixel row.

A display device of the present invention includes a pixel portion where a plurality of pixels is arranged in matrix relative to a row direction and a column direction, a signal line driver circuit which inputs a video signal controlling lighting and non-lighting of a pixel to a signal line, and a scan line driver circuit which selects a pixel row to which the video signal is to be written, in which each of the pixels includes a means to store the video signal written thereto, and the scan line driver circuit includes a means to stop video signal writing to a pixel row when a video signal to be written to the pixel row is identical with a video signal stored in the pixel row.

A display device of the present invention includes a pixel portion where a plurality of pixels is arranged in matrix relative to a row direction and a column direction, a signal line driver circuit which inputs a video signal controlling lighting and non-lighting of a pixel to a signal line, and a scan line driver circuit which selects a pixel row to which the video signal is to be written, in which each of the pixels includes a means to store the video signal written thereto, and the scan line driver circuit includes a means to stop selecting a pixel row when a video signal to be written to the pixel row is identical with a video signal stored in the pixel row.

A display device of the present invention includes a pixel portion where a plurality of pixels is arranged in matrix relative to a row direction and a column direction, a signal line driver circuit which inputs a video signal controlling lighting and non-lighting of a pixel to a signal line, a scan line driver circuit which selects a pixel row to which the video signal is to be written, and a controller which supplies a signal to the signal line driver circuit and the scan line driver circuit, in which each of the pixels includes a means to store the video signal written thereto, the scan line driver circuit includes a means to stop video signal writing to a pixel row when a video signal to be written to the pixel row is identical with a video signal stored in the pixel row, and the controller includes a means to stop video signal inputting to the signal line driver circuit when the video signal to be written to a pixel row is identical with the video signal stored in the pixel row.

A display device of the present invention is a display device which expresses a gray scale by dividing one frame period into a plurality of subframe periods, including a pixel portion where a plurality of pixels is arranged in matrix relative to a row direction and a column direction, a signal line driver circuit which inputs a digital video signal controlling lighting and non-lighting of a pixel to a signal line, and a scan line driver circuit which selects a pixel row to which the digital video signal is to be written, in which each of the pixels includes a means to store the digital video signal written thereto, and the scan line driver circuit includes a means to stop digital video signal writing to a pixel row when a digital video signal to be written to the pixel row in a certain subframe period is identical with a digital video signal for the pixel row in the preceding subframe period.

A display device of the present invention is a display device which expresses a gray scale by dividing one frame period into a plurality of subframe periods, including a pixel portion where a plurality of pixels is arranged in matrix relative to a row direction and a column direction, a signal line driver circuit which inputs a digital video signal controlling lighting and non-lighting of a pixel to a signal line, and a scan line driver circuit which selects a pixel row to which the digital video signal is to be written, in which each of the pixels includes a means to store the digital video signal written thereto, and the scan line driver circuit includes a means to stop selecting a pixel row when a digital video signal to be written to the pixel row in a certain subframe period is identical with a digital video signal for the pixel row in the preceding subframe period.

A display device of the present invention is a display device which expresses a gray scale by dividing one frame period into a plurality of subframe periods, including a pixel portion where a plurality of pixels is arranged in matrix relative to a row direction and a column direction, a signal line driver circuit which inputs a digital video signal controlling lighting and non-lighting of a pixel to a signal line, a scan line driver circuit which selects a pixel row to which the digital video signal is to be written, and a controller which supplies a signal to the signal line driver circuit and the scan line driver circuit, in which each of the pixels includes a means to store the digital video signal written thereto, the scan line driver circuit includes a means to stop digital video signal writing to a pixel row when a digital video signal to be written to the pixel row in a certain subframe period is identical with a digital video signal for the pixel row in the preceding subframe period, and the controller includes a means to stop inputting the digital video signal to the signal line driver circuit when the digital video signal to be written to a pixel row is identical with the digital video signal stored in the pixel row.

A display device of the present invention includes a scan line driver circuit, a signal line driver circuit, a plurality of scan lines extended from the scan line driver circuit in a row direction, a plurality of signal lines extended from the signal line driver circuit in a column direction, and a pixel portion where a plurality of pixels is arranged in matrix relative to the plurality of scan lines and the plurality of signal lines, in which each of the pixels includes a means to store a signal written thereto, the scan line driver circuit includes an output control circuit, and the output control circuit inputs a signal for deselecting a pixel row to a scan line connected to the pixel row when a signal to be written to the pixel row is identical with a signal stored in the pixel row.

A display device of the present invention includes a scan line driver circuit, a signal line driver circuit, a plurality of scan lines extended from the scan line driver circuit in a row direction, a plurality of signal lines extended from the signal line driver circuit in a column direction, and a pixel portion where a plurality of pixels is arranged in matrix relative to the plurality of scan lines and the plurality of signal lines, in which each of the pixels includes a means to store a signal written thereto, the scan line driver circuit includes an output control circuit, and the output control circuit puts a scan line connected to a pixel row in a floating state when a signal to be written to the pixel row is identical with a signal stored in the pixel row.

A display device of the present invention includes a pixel portion where a plurality of pixels is arranged in matrix relative to a row direction and a column direction, a signal line driver circuit which inputs a video signal controlling lighting and non-lighting of a pixel to a signal line, and a scan line driver circuit selecting a pixel row to which the video signal is to be written, in which each of the pixels includes a means to store the video signal written thereto, the scan line driver circuit includes a pulse output circuit and an output control circuit, the pulse output circuit inputs a pulse determining timing at which the pixel row is selected to the output control circuit, and the output control circuit controls whether or not the pulse is output to a scan line connected to the pixel row.

A display device of the present invention includes a pixel portion where a plurality of pixels is arranged in matrix relative to a row direction and a column direction, a signal line driver circuit which inputs a video signal controlling lighting and non-lighting of a pixel to a signal line, and a scan line driver circuit selecting a pixel row to which the video signal is to be written, in which each of the pixels includes a means to store the video signal written thereto, the scan line driver circuit includes a pulse output circuit and a pulse output control circuit, the signal line driver circuit includes a signal output control circuit, the pulse output circuit inputs a pulse determining timing at which the pixel row is selected to the pulse output control circuit, the pulse output control circuit controls whether or not the pulse is output to a scan line connected to the pixel row, and the signal output control circuit put the signal line in a floating state when the pulse is not output.

In addition, a specific structure of a method for driving a display device of the present invention is described below.

A first structure is a display device which inputs a signal for preventing a scan line driver circuit from selecting a pixel row in a horizontal period to a scan line in the case where data of a video signal for the pixel row in which signal writing to a pixel is to be performed in a certain subframe period in one frame period is identical with data of pixels of the pixel row already written thereto.

A second structure is a display device which puts a scan line of a pixel row in a floating state in a horizontal period in the case where data of a video signal for the pixel row in which signal writing to a pixel is to be performed in a certain subframe period in one frame period is identical with data of pixels of the pixel row already written thereto.

A third structure is a display device which inputs a signal for preventing a scan line driver circuit from selecting a pixel row in a horizontal period and sets a fixed potential to all signal lines in a writing time of the pixel row in the case where data of a video signal for the pixel row in which signal writing to a pixel is to be performed in a certain subframe period in one frame period is identical with data of pixels of the pixel row already written thereto.

A fourth structure is a display device which puts a scan line of a pixel row in a floating state in a horizontal period and sets a fixed potential to all signal lines in a writing time of the pixel row in the case where data of a video signal for the pixel row in which signal writing to a pixel is to be performed in a certain subframe period in one frame period is identical with data of pixels of the pixel row already written thereto.

A fifth structure is a display device which inputs a signal for preventing a scan line driver circuit from selecting a pixel row in a horizontal period and puts all signal lines in a floating state in a writing time of the pixel row in the case where data of a video signal for the pixel row in which signal writing to a pixel is to be performed in a certain subframe period in one frame period is identical with data of pixels of the pixel row already written thereto.

A sixth structure is a display device which puts a scan line of a pixel row in a floating state in a horizontal period and puts all signal lines in a floating state in a writing time of the pixel row in the case where data of a video signal for the pixel row in which signal writing to a pixel is to be performed in a certain subframe period in one frame period is identical with data of pixels of the pixel row already written thereto.

A seventh structure is a display device which inputs a signal for preventing a scan line driver circuit from selecting a pixel row in a horizontal period in the case where data of a video signal for the pixel row in which signal writing to a pixel is to be performed in a certain subframe period in one frame period is identical with data of pixels of the pixel row in the last subframe period.

An eighth structure is a display device which puts a scan line of a pixel row in a floating state in a horizontal period in the case where data of a video signal for the pixel row in which signal writing to a pixel is to be performed in a certain subframe period in one frame period is identical with data of a video signal for the pixel row in the last subframe period.

A ninth structure is a display device which inputs a signal for preventing a scan line driver circuit from selecting a pixel row in a horizontal period and sets a fixed potential to all signal lines in a writing time of the pixel row in the case where data of a video signal for the pixel row in which signal writing to a pixel is to be performed in a certain subframe period in one frame period is identical with data of a video signal for the pixel row in the last subframe period.

A tenth structure is a display device which puts a scan line of a pixel row in a floating state in a horizontal period and sets a fixed potential to all signal lines in a writing time of the pixel row in the case where data of a video signal for the pixel row in which signal writing to a pixel is to be performed in a certain subframe period in one frame period is identical with data of a video signal for the pixel row in the last subframe period.

An eleventh structure is a display device which inputs a signal for preventing a scan line driver circuit from selecting a pixel row in a horizontal period and puts all signal lines of the pixel row in a floating state in a writing period of the pixel row in the case where data of a video signal for the pixel row in which signal writing to a pixel is to be performed in a certain subframe period in one frame period is identical with data of a video signal for the pixel row in the last subframe period.

A twelfth structure is a display device which puts a scan line of a pixel row in a floating state in a horizontal period and puts all signal lines in a floating state in a writing time of the pixel row in the case where data of a video signal for the pixel row in which signal writing to a pixel is to be performed in a certain subframe period in one frame period is identical with data of a video signal for a single row in the last subframe period.

Note that a switch to be described in this specification can be of various types, one example of which is an electric switch, a mechanical switch, or the like. In other words, any switch that can control current flow can be used, and there is no particular limitation. Various switches can be used. For example, the switch may be a transistor, a diode (such as a PN diode, a PIN diode, a Schottky diode, or a diode-connected transistor), or a logic circuit that is a combination thereof. In the case of using a transistor as the switch, the transistor operates as a mere switch. Therefore, the polarity (conductivity type) of the transistor is not particularly limited. However, in the case where lower off-current is desired, it is desirable to use a transistor having a polarity with lower off-current. As the transistor with low off-current, a transistor provided with an LDD region, a transistor having a multigate structure, or the like can be used. In addition, it is desirable to use an n-channel transistor when a transistor to be operated as a switch operates in a state where the potential of a source terminal thereof is close to a lower potential side power source (such as Vss, GND, or 0V), whereas it is desirable to use a p-channel transistor when the transistor operates in a state where the potential of a source terminal thereof is close to a higher potential side power source (such as Vdd). This is because the absolute value of a gate-source voltage can be increased, so that the transistor easily operates as a switch. Note that the switch may be of CMOS type using both an n-channel transistor and a p-channel transistor. If the switch is of CMOS type, it can operate appropriately even when conditions change, for example, a voltage output through the switch (in other words, an input voltage to the switch) is higher or lower than an output voltage.

Note that in the present invention, the phrase "being connected" means the case of being electrically connected and the case of being directly connected. Therefore, in the constitution disclosed by the invention, another element (such as a switch, a transistor, a capacitor, an inductor, a resistor, or a diode) which enables electrical connection may be interposed in a predetermined connection. Alternatively, components may be directly connected in the arrangement without another element interposed therebetween. Note that only the case where components are directly connected without another element enabling electrical connection interposed therebetween, not including the case of being electrically connected, is referred to as "being directly connected". Note also that the phrase "being electrically connected" means both the case where components are electrically connected and the case where components are directly connected.

Note that a display element arranged in a pixel is not limited to a specific one. As an example of a display element arranged in a pixel, a display medium in which contrast varies by an electromagnetic action can be used, such as an EL element (an organic EL element, an inorganic EL element, or an EL element containing an organic material and an inorganic material), an electron emitting element, a liquid crystal element, electronic ink, an optical diffractive element, a discharge element, a digital micromirror device (DMD), a piezoelectric element, or a carbon nanotube. Note that examples of display devices using the above display elements are as follows: an EL display, as an EL-panel display device using an EL element; a field emission display (FED) or an SED flat-panel display (SED: surface-conduction electron-emitter display), as a display device using an electron emitting element; a liquid crystal display, as a liquid-crystal panel display device using a liquid crystal element; electronic paper, as a digital-paper display device using electronic ink; a grating light valve (GLV) display, as a display device using an optical diffractive element; a plasma display, as a PDP (Plasma Display Panel) display using a discharge element; a digital light processing (DLP) display device, as a DMD-panel display device using a digital micromirror device; a piezoelectric ceramic display, as a display device using a piezoelectric element; a nano emissive display (NED), as a display device using a carbon nanotube; and the like. Note that the display element of the invention is suitable for a display device using a time gray scale method or including a pixel having a memory characteristic (including an SRAM, a DRAM, or the like in a pixel, or including a memory element (an element that can store signals)).

Note that as the transistor, transistors of various types can be employed in the invention. Therefore, there is no limitation on the kind of applicable transistor. Thus, a thin film transistor (TFT) using a non-single crystal semiconductor film typified by an amorphous silicon film or a polycrystalline silicon film, a MOS transistor formed using a semiconductor substrate or an SOI substrate, a junction transistor, a bipolar transistor, a transistor using a compound semiconductor such as ZnO or a-InGaZnO, a transistor using an organic semiconductor or a carbon nanotube, or another transistor can be used. Note that the non-single crystal semiconductor film may contain hydrogen or halogen. In addition, the transistor may be located on various kinds of substrates, and the kind of substrate is not limited to a specific one. Therefore, the transistor can be located on, for example, a single-crystal substrate, an SOI substrate, a glass substrate, a quartz substrate, a plastic substrate, a paper substrate, a cellophane substrate, a stone substrate, or the like. Further, the transistor may be formed on a certain substrate, and later, may be transferred to and located on another substrate.

Note that the structure of a transistor can be of various types and is not limited to a specific structure. For example, it is possible to use a multigate structure having two or more gates. When using the multigate structure, an off-current can be reduced, the withstand voltage of a transistor can be increased to improve reliability, and variations in characteristics can be suppressed when the transistor operates in the saturation region since a drain-source current does not change much even when a drain-source voltage changes. Alternatively, gate electrodes may be provided above and below a channel. The structure where gate electrodes are provided above and below a channel allows a channel region to be increased; therefore, a current value can be increased and a depletion layer is easily formed to increase the S value. Further, a gate electrode may be provided above a channel or below a channel. A staggered structure or an inverted staggered structure may be adopted. A channel region may be divided into a plurality of regions, and these regions may be connected in parallel or in series. A source electrode or a drain electrode may overlap a channel (or a part of it). The structure where a source electrode or a drain electrode overlaps a channel (or a part of it) prevents charges from being accumulated in a part of the channel, which may cause unstable operation. In addition, an LDD region may be provided. When the LDD region is provided, an off-current can be reduced, the withstand voltage of a transistor can be increased to improve reliability, and variations in characteristics can be suppressed when the transistor operates in the saturation region since a drain-source current does not change much even when a drain-source voltage changes.

Note that as described above, the transistor in the invention may be of any type and may be formed on any type of substrate. Accordingly, all circuits may be formed on a glass substrate, a plastic substrate, a single crystalline substrate, an SOI substrate, or any other substrate. Alternatively, a part of the circuits may be formed on a substrate, and another part of the circuits may be formed on another substrate. In other words, all the circuits are not necessarily formed on the same substrate. For example, a part of the circuits may be formed on a glass substrate using TFTs, another part of the circuits may be formed as an IC chip on a single crystalline substrate, and the IC chip may be connected onto the glass substrate by COG (Chip On Glass). Alternatively, the IC chip may be connected to the glass substrate by TAB (Tape Automated Bonding) or using a printed circuit board.

Note that the transistor is an element having at least three terminals including a gate, a drain, and a source. The gate means the whole or part of a gate electrode and a gate wire (also referred to as a gate line, a gate signal line, or the like). The gate electrode means a part of a conductive film that overlaps a semiconductor in which a channel region, an LDD (Lightly Doped Drain) region, and the like are formed, with a gate insulating film interposed therebetween. The gate wire means a wire for connecting gate electrodes of pixels or connecting the gate electrode to another wire.

However, there is also a portion that functions both as a gate electrode and as a gate wire. Such a portion may be referred to as a gate electrode or a gate wire. That is to say, there is no clear distinction between a gate electrode and a gate wire in some regions. For example, when a channel region overlaps an extending gate wire, the region functions both as a gate wire and as a gate electrode. Accordingly, such a region may be referred to as a gate electrode or a gate wire.

In addition, a region that is formed of the same material as a gate electrode and connected to the gate electrode may also be referred to as a gate electrode. Similarly, a region that is formed of the same material as a gate wire and connected to the gate wire may also be referred to as a gate wire. In a strict sense, there may be a case where such a region does not overlap a channel region or does not have a function to connect a gate electrode to another gate electrode. However, some regions are formed of the same material as a gate electrode or a gate wire and connected to the gate electrode or the gate wire depending on manufacturing margins and the like. Therefore, such a region may be referred to as a gate electrode or a gate wire.

For example, in a multigate transistor, a gate electrode of one transistor is often connected to a gate electrode of another transistor with a conductive film that is formed of the same material as the gate electrode. Such a region may be referred to as a gate wire since it connects gate electrodes to each other, or may be referred to as a gate electrode since a multigate transistor can be considered to be one transistor. In other words, a region that is formed of the same material as a gate electrode or a gate wire and connected thereto may be referred to as a gate electrode or a gate wire. In addition, for example, a part of a conductive film which connects a gate electrode and a gate wire may be referred to as a gate electrode or a gate wire.

Note that a gate terminal means part of a gate electrode region or part of a region that is electrically connected to a gate electrode.

Note that the source means the whole or part of a source region, a source electrode, and a source wire (also referred to as a source line, a source signal line, or the like). The source region means a semiconductor region containing a high concentration of a p-type impurity (such as boron and gallium) or an n-type impurity (such as phosphorus and arsenic). Accordingly, the source region does not include a region containing a low concentration of a p-type impurity or an n-type impurity, namely a so-called LDD (Lightly Doped Drain) region. The source electrode means a part of a conductive layer that is formed of a material different from that of a source region and electrically connected to the source region. The source electrode includes a source region in some cases. The source wire means a wire for connecting source electrodes of pixels or connecting a source electrode to another wire.

However, there is a portion that functions both as a source electrode and as a source wire. Such a portion may be referred to as a source electrode or a source wire. That is to say, there is no clear distinction between a source electrode and a source wire in some regions. For example, when a source region overlaps an extending source wire, the region functions both as a source wire and as a source electrode. Accordingly, such a region may be referred to as a source electrode or a source wire.

In addition, a region that is formed of the same material as a source electrode and connected to the source electrode, or a portion connecting source electrodes to each other may also be referred to as a source electrode. Further, a portion that overlaps a source region may be referred to as a source electrode. Similarly, a region that is formed of the same material as a source wire and connected to the source wire may also be referred to as a source wire. In a strict sense, there may be a case where such a region does not have a function to connect a source electrode to another source electrode. However, some regions are formed of the same material as a source electrode or a source wire and connected to the source electrode or the source wire depending on manufacturing margins and the like. Therefore, such a region may also be referred to as a source electrode or a source wire.

In addition, for example, a portion of a conductive film which connects a source electrode and a source wire may be referred to as a source electrode or a source wire.

Note that a source terminal means part of a source region, a source electrode, or a region that is electrically connected to a source electrode.

The description of the source applies to the drain.

In the invention, the word "on", such as in the phrase "formed on something" is not limited to the case of being directly in contact with something, and includes the case of being not directly in contact, that is, the case where another thing is interposed. Accordingly, the phrase "a layer B is formed on a layer A" includes the case where the layer B is formed directly on the layer A and the case where another layer (such as a layer C and a layer D) is formed directly on the layer A and the layer B is formed directly on the layer. The same applies to the word "over", and the word is not limited to the case of being directly in contact with something, and includes the case where another thing is interposed. Accordingly, the phrase "a layer B is formed over a layer A" includes the case where the layer B is formed directly on the layer A and the case where another layer (such as a layer C and a layer D) is formed directly on the layer A and the layer B is formed directly on the layer. Note that the same applies to the word "under" or the word "below", and these words include the case of being directly in contact with something, and the case of being not in contact.

In the invention, one pixel means one element capable of controlling brightness. As an example, one pixel means one color element, which expresses the brightness. Accordingly, in the case of a color display device including R (red), G (green), and B (blue) color elements, the smallest unit of an image is constituted by three pixels: R pixel, G pixel, and B pixel. Note that the number of color elements is not limited to three, and more color elements may be used. For example, RGBW (W: white), RGB to which yellow, cyan, or magenta is added, and the like may be employed. As another example, when the brightness of one color element is controlled using a plurality of regions, one of the regions is referred to as one pixel. In the case of performing an area gray scale where the brightness of each color element is controlled using a plurality of regions and a gray scale is expressed by all the regions, one pixel means one of the regions for controlling brightness. In that case, one color element is constituted by a plurality of pixels. Further, in that case, each pixel may have a different size area that contributes to display. In addition, slightly different signals may be supplied to a plurality of regions for controlling the brightness of one color element, namely, a plurality of pixels constituting one color element, thereby increasing the viewing angle.

In the invention, pixels may be arranged (arrayed) in matrix. The phrase "pixels are arranged (arrayed) in matrix" includes the case where pixels are arranged in a striped grid pattern. It also include the case where three color elements (e.g., RGB) are used for full color display and dots of the three color elements are arranged in a delta pattern, or a Bayer pattern. The size of a light emitting region may be different for each dot of color elements.

Note that the term "semiconductor device" in this specification means a device including a circuit including a semiconductor element (such as a transistor or a diode).

A display device which can reduce the number of times signal writing to a pixel is carried out and power consumption can be provided.

In other words, the display device of the invention can reduce power consumption by reducing the number of charging and discharging in writing a signal to a pixel.

BRIEF DESCRIPTION OF DRAWINGS

FIG. 27 is a diagram explaining a method for driving a display device of the present invention.

FIG. 28 is a diagram explaining a method for driving a display device of the present invention.

FIG. 29 is a diagram explaining a method for driving a display device of the present invention.

FIGS. 30A and 30B are diagrams explaining a method for driving a display device of the present invention.

FIG. 32 is a diagram explaining a method for driving a display device of the present invention.

DETAILED DESCRIPTION OF THE INVENTION

Hereinafter, embodiment modes of the present invention are explained with reference to the drawings. However, the present invention is not limited to the following description. As is easily known to a person skilled in the art, the mode and the detail of the invention can be variously changed without departing from the spirit and the scope of the present invention. Thus, the present invention is not interpreted while limiting to the following description of the embodiment modes.

A display device of the present invention includes a scan line driver circuit, a signal line driver circuit, and a pixel portion where a plurality of pixels is arranged in matrix relative to a scan line and a signal line, and each pixel includes a means to store a signal written thereto.

The scan line driver circuit inputs a signal, which selects a pixel row to which a signal is to be written, to the scan line. The signal line driver circuit inputs a signal to be written to a pixel to the signal line.

The operation of the display device of the present invention is explained. In a writing period (address period), a pixel row connected to the scan line to which the signal selecting a pixel is input is selected by the scan line driver circuit. A signal is written to each pixel of the selected pixel row from a signal line of each column. Then, each pixel stores the signal written thereto. In this manner, the pixel maintains a state controlled by the signal written thereto (a lighting state, a non-lighting state, or the like) in a light emitting period (sustain period).

By repeating this operation, moving image display and still image display can be rewritten.

In addition, the display device of the present invention includes a means which does not input a signal to a pixel when data of the signal for a pixel to which the signal is to be written is identical with data of the pixel already written thereto (in other words, data stored in the pixel).

Note that a plurality of pixels is connected to a scan line. Then, when the pixels are selected by the scan line, a signal can be written to the pixels. Thus, the display device of the present invention includes a means which does not input a signal to a pixel row when data of the signal for a pixel row connected to a scan line, to which the signal to be written, is identical with data of a signal already written to the pixel row. In other words, the display device includes a means which determines whether or not data of a signal for pixels to which writing is to be performed matches data of a signal already written to the pixels by a plurality of pixels connected to one scan line, and if they match, stops signal inputting to the pixels.

In addition, the scan line driver circuit includes a means which does not input a signal selecting a pixel row to a scan line connected to the pixel row when data of the signal for the pixel row to which the signal is to be written is identical with data of a signal already written to the pixel row.

Figure 71:
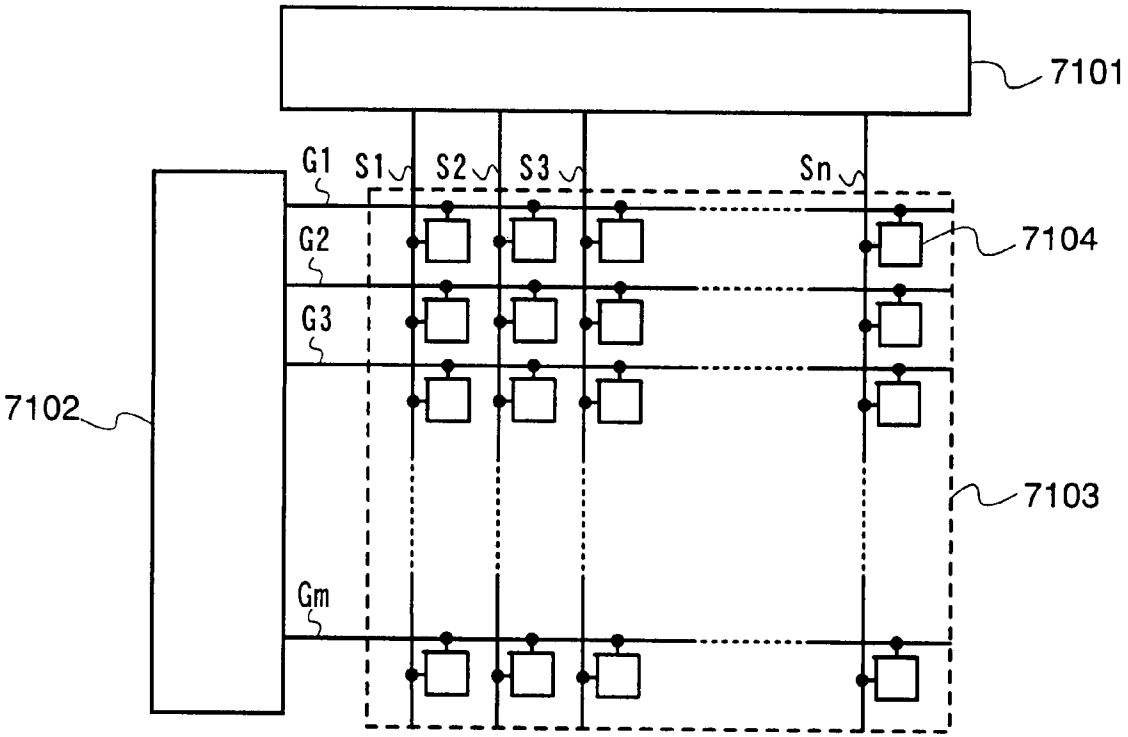
FIG. 71 is a diagram explaining a display device of the present invention.

A basic structure of the display device of the present invention is shown in FIG. 71. The display device of the present invention includes a signal line driver circuit 7101, a scan line driver circuit 7102, and a pixel portion 7103. In the pixel portion 7103, pixels 7104 are arranged in matrix relative to scan lines G1 to Gm and signal lines S1 to Sn. Note that each pixel 7104 includes a means to store a signal written thereto.

The scan line driver circuit 7102 selects a pixel to which a signal is to be written by inputting a signal to any one scan line Gi of the scan lines G1 to Gm. In other words, a pixel row connected to the scan line Gi (any one of the scan lines G1 to Gm), to which a signal selecting a pixel is input, is selected.

A video signal (Video Data) is input to the signal line driver circuit 7101. Then, the signal line driver circuit 7101 inputs video signals corresponding to pixels of respective columns to the signal lines S1 to Sn. Note that the signals input to the signal lines S1 to Sn from the signal line driver circuit 7101 are not limited to video signals. For example, a signal forcing pixels of all columns to be in a non-lighting state (erasing signal) may be input to the pixels.

The operation of the display device is explained.

At the time of signal writing operation to a pixel, a pixel row to which a signal is to be written is selected by the scan line driver circuit 7102. Then, the signal is written to the pixels 7104 of each column in the selected pixel row from the signal line driver circuit 7101 through the signal lines S1 to Sn. Note that when the signal is written to the pixels 7104, each pixel stores the signal written thereto.

In a similar manner, the pixels 7104 are sequentially selected, and the signal is written to the pixels 7104. When the signal is written to all of the pixels 7104 in the pixel portion 7103, a writing period to the pixels 7104 is completed.

The pixel 7104 stores the signal written thereto for a certain period. Therefore, at the time of light emitting operation of the pixel, the state of each pixel (lighting or non-lighting) in according with the signal written to the pixel can be maintained.

A moving image can be displayed by repeating the write operation and the light emitting operation. Also in the case of displaying a still image, the write operation and the light emitting operation are performed every time the image is rewritten.

Here, the display device of the invention stops signal writing to a pixel in the case where data of a signal for the pixel to which the signal is to be written matches data of a signal already written to the pixel. In other words, when a pixel row is not selected at the time of signal writing operation to the pixel row, the display device continues inputting a signal which does not select the pixel row to a scan line of the pixel row or puts the scan line of the pixel row in a floating state. Accordingly, signal writing to the pixel row is stopped. In other words, signal writing to the pixel is stopped only when data of a signal written to pixels connected to one scan line all matches data of a signal to be written to the pixels. Therefore, in the case where data of the signal for any one of the pixels is different, the signal is written to all of the pixels connected to the scan line. This is because a potential of a signal line is forced to be input to the pixels when the signal selecting the pixels is input to the scan line. Then, the data of the pixels is rewritten. Thus, the scan line is prevented from being selected only in the case where data of all signals matches.

Here, when a signal selecting a pixel is input to the scan line, load capacitance typified by wire cross capacitance of the scan line or gate capacitance of a transistor connected to the scan line is charged and discharged with a charge. Thus, like the display device of the invention, a signal selecting a pixel row is prevented from being input to a scan line connected to the pixel row when data of a signal for the pixel row connected to the scan line to which the signal is to be written is identical with data of a signal already written to the pixel row. Then, the number of times charging and discharging are carried out can be reduced, so that power consumption can be reduced.

In the case where data of a signal for a pixel row connected to a scan line to which the signal is to be written is identical with data of a signal already written to the pixel row, power consumption can be reduced further significantly by putting the signal line for the pixel row in a floating state at the time of signal writing operation to the pixel row. This is because it is possible to omit charging and discharging of wire cross capacitance of signal lines of the same number as the pixels connected to one scan line. Note that the previous state of the signal line may be kept without putting the signal line in a floating state. This is because charging and discharging of the wire cross capacitance is already completed and the signal line does not consume much power. If power consumption can be suppressed, another potential may be set. For example, such a potential hardly causing the signal written to the pixel to leak may be input.

Furthermore, when data of a video signal for a pixel row connected to a scan line, to which the video signal is to be input, is identical with data of a signal already written to the pixel row, the input of the video signal to a signal line driver circuit may be stopped. Even if the video signal is not input, the same video signal is already stored in the pixel row and does not need to be rewritten. Therefore, the signal line driver circuit can be operated without problem. This can further reduce power consumption. If the video signal is input to the signal line driver circuit 7101 as serial data, a video signal having a high frequency is input to a video signal line transmitting the video signal; thus, the power consumption becomes high. Accordingly, power consumption can further be reduced by reducing the input of the video signal.

In particular, the present invention is suitable for a display device having a resolution (vertical×horizontal) of VGA (640×480) or more. This is because as the resolution increases, the number of pixels increases and the number of scan lines and that of pixel lines also increase accordingly. In other words, when 640 pixels are connected to one scan line, the gate capacitance of 640 transistors, for example, in addition to the wire cross capacitance of the scan line are charged and discharged with charges in order to select the pixels. In addition, the gate capacitance of 1920 (640×3) transistors needs to be charged and discharged when one pixel includes color elements of R (red), G (green), and B (blue). Furthermore, the number of signal lines is 640 (1920 in the case where a single pixel includes color elements of RGB).

If the number of times charging and discharging of the scan line is carried out is decreased, power consumption can be reduced significantly. At that time, power consumption can be reduced further significantly by putting the signal line in a floating state or inputting a signal input to the preceding row.

Examples of the resolutions (vertical×horizontal) of VGA or more are as follows: SVGA (800×600), XGA (1024×768), Quad-VGA (1380×960), SXGA (1280×1024), SXGA+ (1400×1050), UXGA (1600×1200), QXGA (2048×1536), QUXGA (3200×2400), QUXGA Wide (3840×2400), and the like. Note that the resolutions described here are examples, and the invention is not limited thereto.

Figure 79:
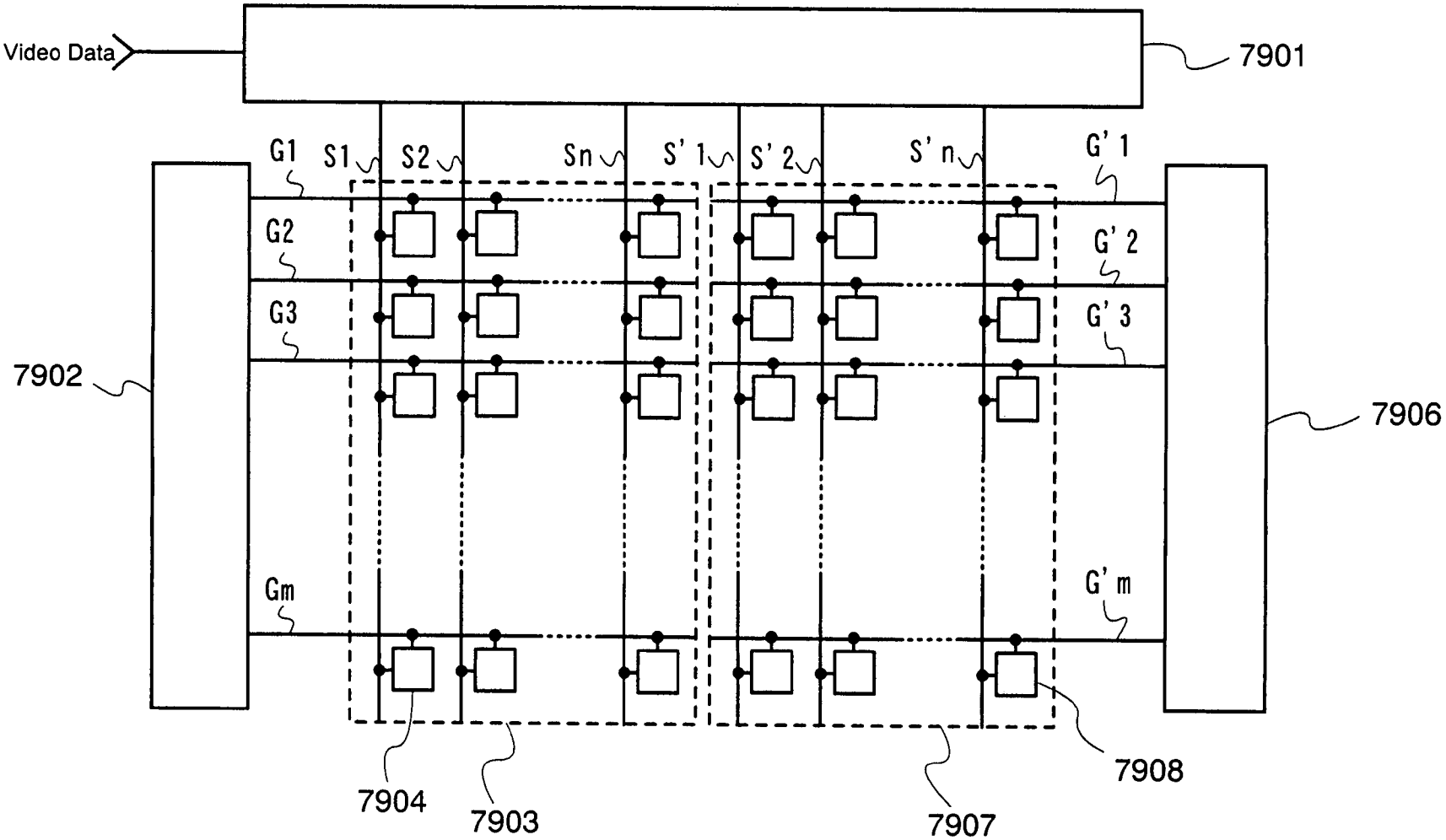
FIG. 79 is a diagram explaining a display device of the present invention.

Note that in the case where a display device including pixels arranged in matrix in a pixel portion in a row direction and a column direction includes a plurality of scan lines selecting pixels for inputting a signal to the pixels of a single row, data of pixels connected to each scan line among the pixels of a single row are compared to each other. For example, the case of including two scan lines selecting pixels for inputting a signal to pixels of a single row is shown in FIG. 79. A display device includes a signal line driver circuit 7901, a first scan line driver circuit 7902, a second scan line driver circuit 7906, and a pixel portion, and the pixel portion includes a first pixel region 7903 and a second pixel region 7907. Signal lines S1 to Sn and signal lines S'1 to S'n are extended from the signal line driver circuit 7901 to the pixel portion. Scan lines G1 to Gm are extended from the first scan line driver circuit 7902 to the first pixel region 7903. Scan lines G'1 to G'm are extended from the second scan line driver circuit 7906 to the second pixel region 7907. In other words, in the first pixel region 7903, a pixel row of the first pixel region 7903 is selected by inputting a signal selecting a pixel to any one of the scan lines G1 to Gm from the first scan line driver circuit 7902. At this time, a signal input to the scan lines S1 to Sn from the signal line driver circuit 7901 is written to each pixel 7904. In the second pixel region 7907, a pixel row of the second pixel region 7907 is selected by inputting a signal selecting a pixel to any one of the scan lines G'1 to G'm from the second scan line driver circuit 7906. At this time, a signal input to the signal lines S'1 to S'n from the signal line driver circuit 7901 is written to each pixel 7904. In the case of such a structure, whether or not data for a pixel row to which a signal is to be written is identical with data already input to the pixel row is compared in each pixel region. If the data is identical, signal writing to the pixel row is stopped.

In other words, the display device of the invention stops signal inputting to a pixel row when data of a signal to be written to the pixel row of the first pixel region 7903 is identical with data already written to the pixel row. In addition, the display device stops signal inputting to a pixel row when data of a signal to be written to the pixel row of the second pixel region 7907 is identical with data already written to the pixel row. Therefore, in pixels of a single row in the pixel portion, data of a signal to be input to a pixel row of the first pixel region 7903 or a pixel row of the second pixel region 7907 is compared with data of a signal already written to each pixel row. When the data of a signal to be written is identical with the data of a signal already written only in the pixel row of the first pixel region 7903, the pixel row of the first pixel region 7903 is not selected, whereas the pixel row of the second pixel region 7907 is selected. On the contrary, when the data of a signal to be written is identical with the data of a signal already written only in the pixel row of the second pixel region 7907, the pixel row of the second pixel region 7907 is not selected, whereas the pixel row of the first pixel region 7903 is selected.

Note that the number of the scan lines G1 to Gm in the first pixel region is not necessarily the same as that of the scan lines G'1 to G'm in the second pixel region. In addition, the number of the signal lines S1 to Sn is also not necessarily the same as that of the signal lines S'1 to S'n. Furthermore, the pixel portion is not limited to the case of including two pixel regions. In other words, the pixel portion may include three or more pixel regions.

As described above, the display device of the invention stops signal inputting to a pixel row connected to one scan line when data of a signal to be input to the pixel row is identical with data of a signal already input to the pixel row.

Thus, the frequency of stopping signal input becomes high when using two scan lines selecting a pixel for writing a signal to pixels of a single row. This is because the number of pixels is decreased, in which data already input thereto is compared with data to be input thereto to find whether or not they are identical. Since the number is small, data easily becomes identical. Therefore, power consumption can be easily reduced.

Embodiment Mode 1

In this embodiment mode, detailed explanation is made on a display device and operation thereof in the case of applying the present invention to a time gray scale method.

Figure 1:
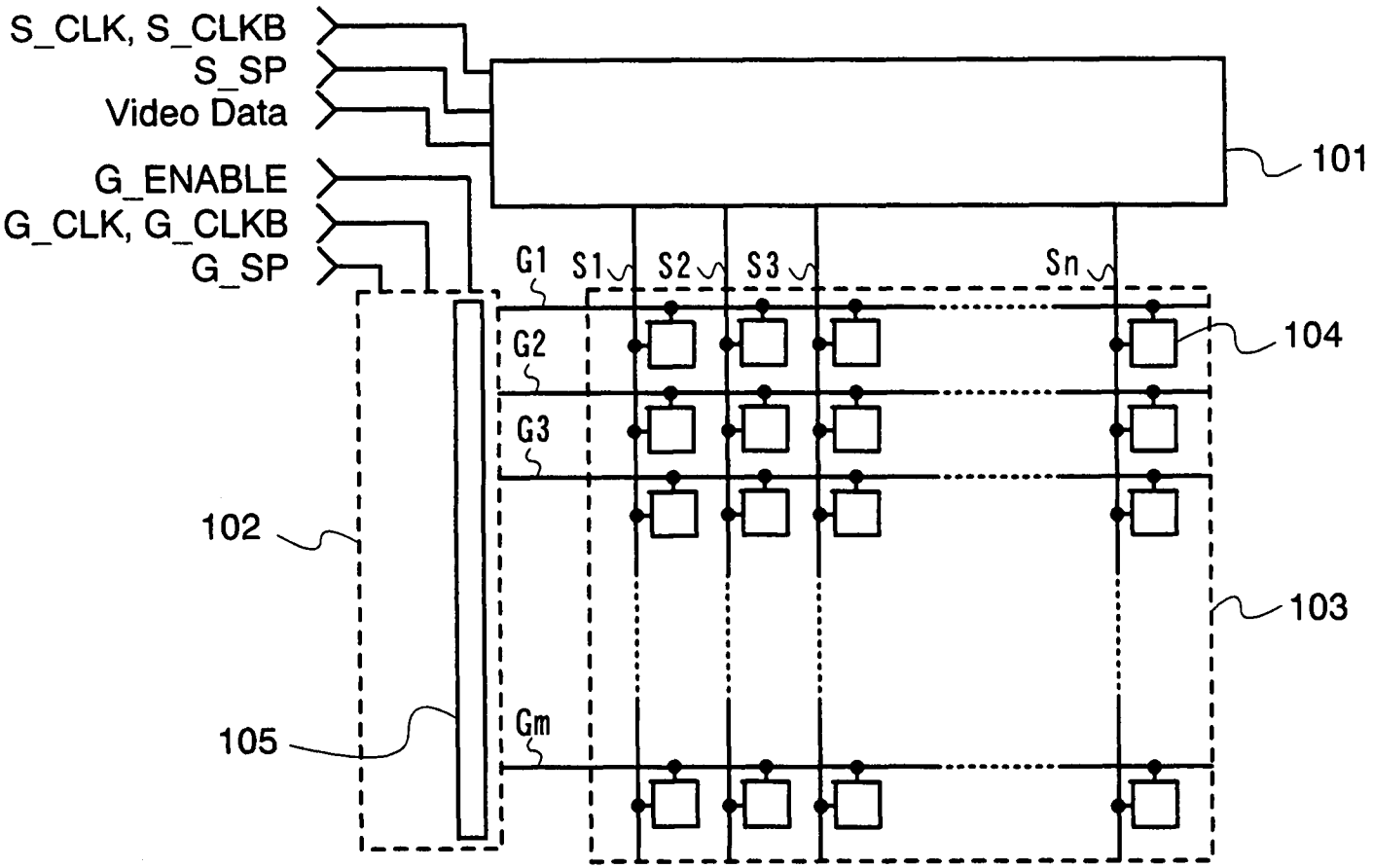
FIG. 1 is a diagram explaining a display device of the present invention.

A display device shown in FIG. 1 includes a signal line driver circuit 101, a scan line driver circuit 102, and a pixel portion 103. In addition, a plurality of pixels 104 is arranged in matrix in the pixel portion 103 relative to signal lines S1 to Sn extended from the signal line driver circuit 101 in a column direction and scan lines G1 to Gm extended from the scan line driver circuit 102 in a row direction. In addition, the scan line driver circuit 102 includes an output control circuit 105.

Signals such as a clock signal (G_CLK), an inverted clock signal (G_CLKB), a start pulse signal (G_SP), and an output control signal (G_ENABLE) are input to the scan line driver circuit 102.

The clock signal (G_CLK) is a signal alternating between H (High) and L (Low) at regular intervals, and the inverted clock signal (G_CLKB) is a signal having an inverted polarity of the clock signal (G_CLK). In accordance with these signals, the scan line driver circuit 102 is synchronized and the timing of execution of processing is controlled. Therefore, when the start pulse signal (G_SP) is input to the scan line driver circuit 102, a scan signal selecting each pixel row is generated in each of the scan lines G1 to Gm connected to the pixel row in accordance with the clock signal (G_CLK) and the inverted clock signal (G_CLKB). In other words, the scan signal is a signal sequentially selecting the pixel rows one by one through the scan lines connected to the scan line driver circuit 102.

Signals such as a clock signal (S_CLK), an inverted clock signal (S_CLKB), a start pulse signal (S_SP), and a video signal (video Data) are input to the signal line driver circuit 101.

The clock signal (S_CLK) is a signal alternating between H (High) and L (Low) at regular intervals, and the inverted clock signal (S_CLKB) is a signal having an inverted polarity of the clock signal (S_CLK). In accordance with these signals, the signal line driver circuit 101 is synchronized and the timing of execution of processing is controlled. Thus, when the start pulse signal (S_SP) is input to the signal line driver circuit 101, a sampling pulse corresponding to a column of a pixel is generated in accordance with the clock signal (S_CLK) and the inverted clock signal (S_CLKB). In other words, the sampling pulse is a signal controlling the timing to convert a video signal to be written to a pixel as data of a column of the pixel when the video signal is input to the signal line driver circuit 101. Therefore, in accordance with this sampling pulse, a video signal (Video Data) input to the signal line driver circuit 101 as serial data can be converted to parallel data. Note that in the case of a line sequential display device, this parallel data of the video signal is stored in the signal line driver circuit 101 and input simultaneously to each of the signal lines S1 to Sn. In addition, in the case of a dot sequential display device, serial data of the video signal is converted to parallel data of the video signal and input to each of the signal lines S1 to Sn in accordance with the timing of the sampling pulse. In this manner, the signal line driver circuit 101 inputs a video signal corresponding to pixels of each column to each of the signal lines S1 to Sn.

Accordingly, a pixel row to which a signal is to be written is normally selected at the timing of the scan signal generated by the scan line driver circuit 102. Then, the video signal input to the signal lines S1 to Sn from the signal line driver circuit 101 is written to the pixels 104 of each column in the selected pixel row. Each pixel 104 stores data of the video signal written thereto for a certain period.

Pixel rows are sequentially selected, and signal writing to the pixels is completed when the video signal corresponding to each pixel 104 is written to all pixels 104. Note that each pixel 104 can maintain a lighting or non-lighting state by holding data of the signal written thereto for a certain period.

Lighting and non-lighting of each pixel 104 are controlled by the data of the video signal written to each pixel 104 to express a gray scale depending on the length of light emitting time. Note that a period for completely displaying an image of one display region (one frame) is referred to as one frame period, and the display device of this embodiment mode includes a plurality of subframe periods in one frame period. The lengths of the subframe periods in one frame period may be approximately equal to each other or may be different. In other words, lighting and non-lighting of each pixel 104 are controlled in each subframe period in one subframe period to express a gray scale with a difference in total lighting time of each pixel 104.

As described above, all pixel rows connected to respective scan lines are normally selected through the scan lines G1 to Gm connected to the scan line driver circuit 102. However, the display device of the present invention does not select a pixel connected to a certain scan line when a signal to be written to the pixel is identical with a signal already written to the pixel. In other words, in a certain subframe period in one frame period, a signal is not input to a pixel row when data of a signal for the pixel row in which signal writing to a pixel is to be performed is identical with data of a signal for a single pixel row already written thereto. Even if the signal is not input, there is no problem since the signal is the same as that already written.

Then, an output control signal (G_ENABLE) is input to the scan line driver circuit 102, which shows whether or not data of a signal for a single pixel row in which the signal writing to a pixel is to be performed in a certain subframe period in one frame period matches data of a signal for a single row already written to the pixel row. In the case where an output control signal (G_ENABLE(L)) showing a match is input to the scan line driver circuit 102, a signal is prevented from being input to the pixel row. Therefore, the scan line driver circuit 102 is prevented from inputting a signal selecting the pixel row to a scan line connected to the pixel row. In other words, an L signal for not selecting the pixel row is input to a scan line of the pixel row, or the scan line of the pixel row is put in a floating state. As a result, a signal is not input to a pixel connected to the scan line.

Figure 72:
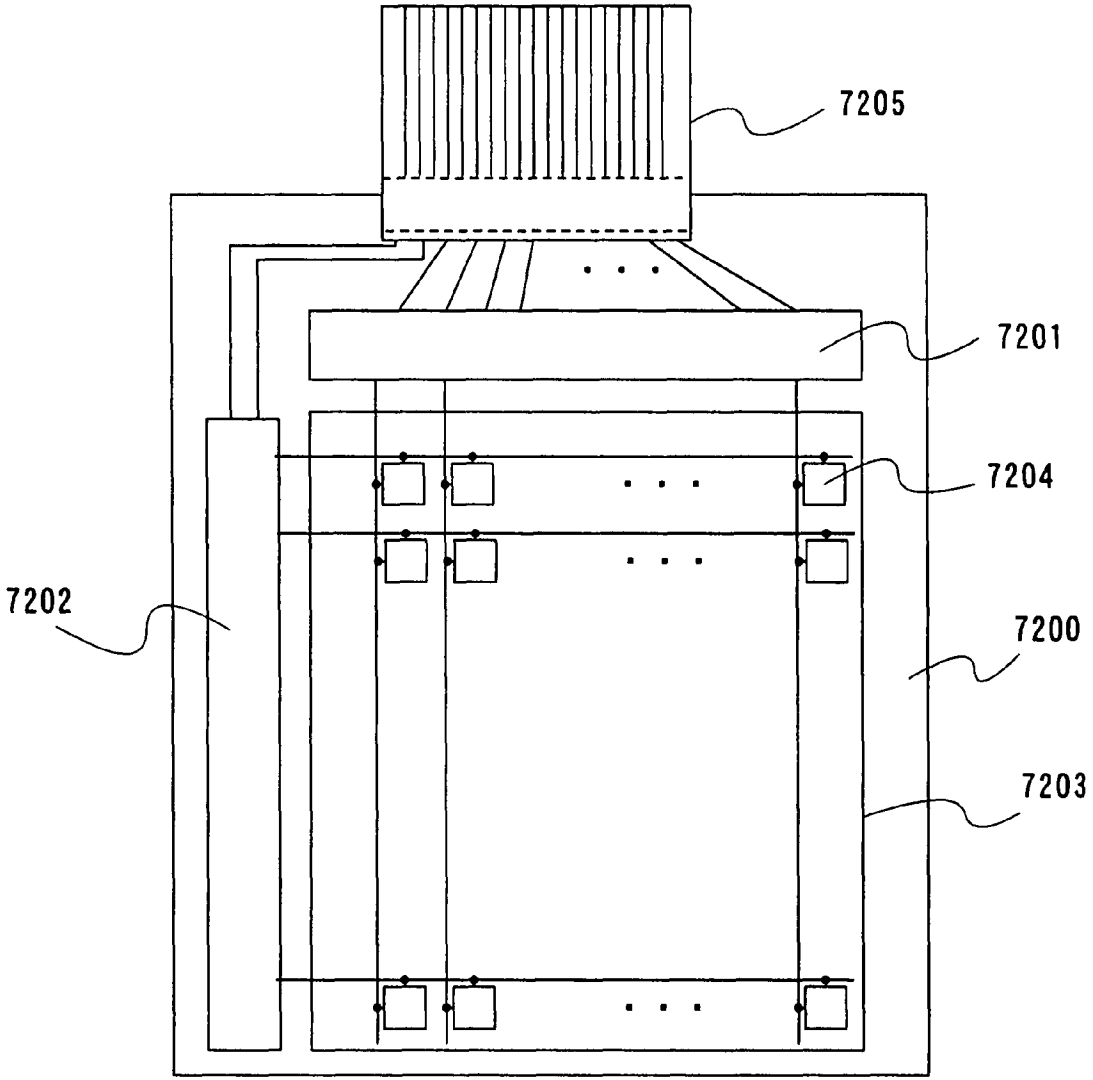
FIG. 72 is a diagram explaining a display device of the present invention.

Furthermore, a video signal (video Data) is preferably not input to the signal line driver circuit when data of a signal for a single pixel row in which signal writing to a pixel is to be performed in a subframe period within one frame period is the same as data of a signal for the pixel row already written thereto. This can further reduce power consumption. This is because the video signal is input as serial data to the signal line driver circuit 101 through a video signal line, so a signal with high frequency is input to the video signal line. Therefore, the power consumption becomes high. Thus, power consumption can further be reduced by reducing the input of this video signal. Note that the video signal and the like are normally supplied to the signal line driver circuit through an FPC or the like. Here, an example of the structure of a display panel of the display device of the present invention is shown in FIG. 72. A signal line driver circuit 7201, a scan line driver circuit 7202, and a pixel portion 7203 are formed on a substrate 7200, and pixels 7204 are arranged in matrix in the pixel portion 7203 relative to scan lines and signal lines. In addition, an FPC 7205 is connected to the display panel. In other words, from the FPC 7205, a clock signal (G_CLK), an inverted clock signal (G_CLKB), a start pulse signal (G_SP), and the like are input to the scan line driver circuit 7202 of the display panel, and a clock signal (S_CLK), an inverted clock signal (S_CLKB), a start pulse signal (S_SP), a video signal (Digital Video Data), and the like are input to the signal line driver circuit 7201. In other words, power consumption can be reduced by preventing data of a video signal for a pixel row in which the signal is not to be written from being input to the signal line driver circuit 7201 from the FPC 7205.

Figure 6B:
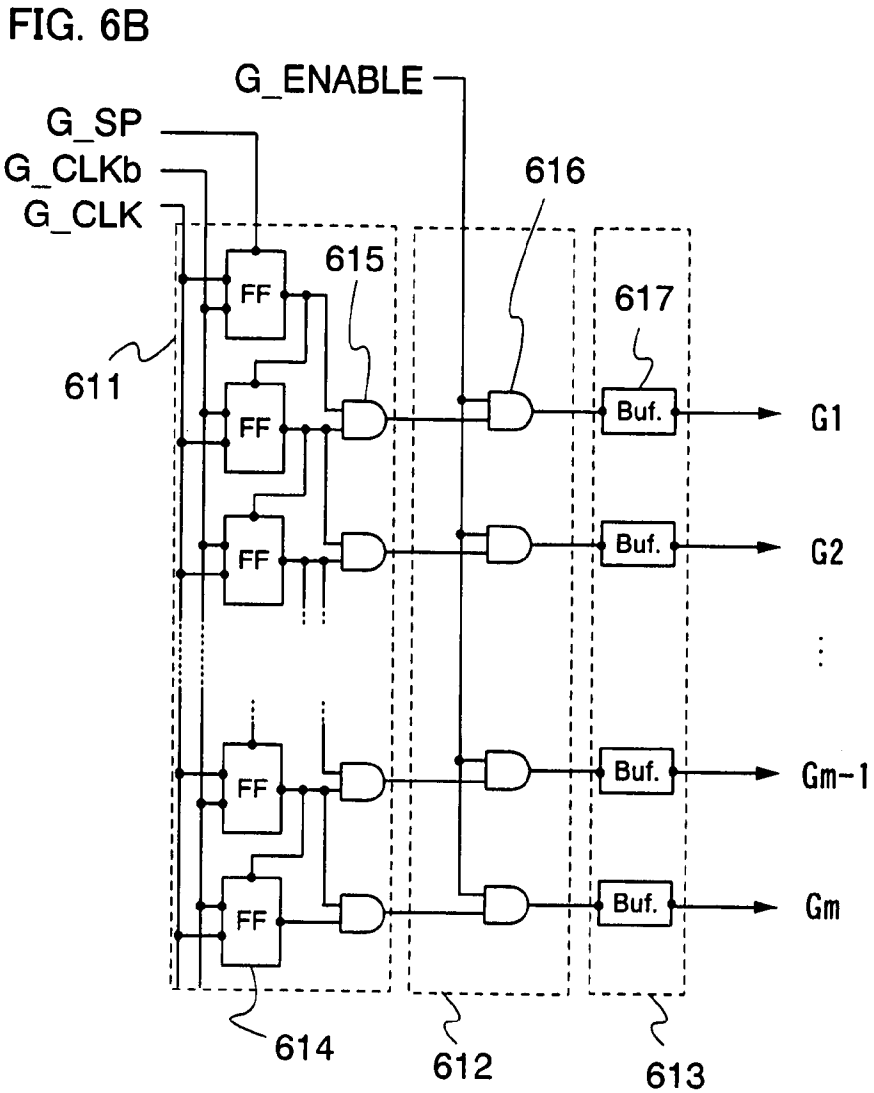
FIGS. 6A and 6B are diagrams explaining a scan line driver circuit applicable to a display device of the present invention.
Figure 6A:
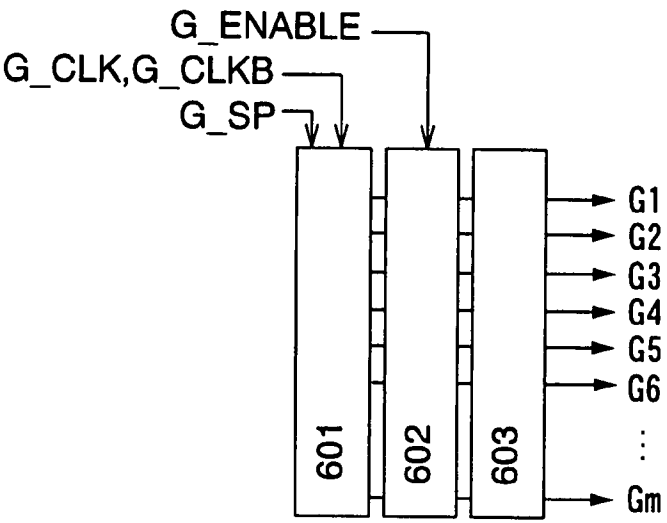

Here, an example of a scan line driver circuit applicable to the scan line driver circuit 102 of the display device in this embodiment mode is shown in FIG. 6A.

First, the scan line driver circuit shown in FIG. 6A includes a pulse output circuit 601, an output control circuit 602, and a buffer circuit 603. A clock signal (G_CLK), an inverted clock signal (G_CLKB), a start pulse signal (G_SP), and the like are input to the pulse output circuit 601. Then, scan signals (SC.1 to SC.m) are input to the output control circuit 602 in accordance with the timing of these signals.

Here, an output control signal (G_ENABLE) is input to the output control circuit 602. Then, the output control signal (G_ENABLE) performs control so as to stop selecting a pixel row to which signal writing is to be stopped. The scan signals (SC.1 to SC.m) output from the output control circuit 602 are converted by the buffer circuit 603 into pixel selection signals (G.1 to G.m) having high current supply capability and input to scan lines G1 to Gm.

Subsequently, a more detailed structure example of FIG. 6A is shown in FIG. 6B. In addition, operation of this scan line driver circuit is explained using the timing chart in FIG. 33.

A pulse output circuit 611 includes plural stages of flip-flop circuits (FF) 614 and AND gates 615, and two input terminals of the AND gate 615 are separately connected to output terminals of adjacent flip-flop circuits (FF) 614. In other words, one redundant flip-flop circuit (FF) 614 with respect to the AND gates 615 is provided in each stage, and outputs from the adjacent flip-flop circuits (FF) 614 are input to the AND gate 615 of each stage provided relative to the scan lines G1 to Gm.

A clock signal (G_CLK) and an inverted clock signal (G_CLKB) are input to each flip-flop circuit (FF) 614, and a start pulse signal (G_SP) is input to the flip-flop circuit 614 of the first stage. A pulse 3301 is the start pulse signal in FIG. 33. The pulse 3301 is delayed for one pulse of the clock signal when input to the flip-flop circuit 614 in the next stage. Therefore, an output from the AND gate 615 of the first stage, to which the outputs from the redundant flip-flop circuit 614 of the first stage and the flip-flop circuit 614 of the next stage are input, is delayed for one pulse of the clock signal like a pulse 3302. The pulses 3302 is input as the scan signal SC.1 to one input terminal of the AND gate 616 corresponding to an output control circuit 612 of the first stage. Similarly, an output from the AND gate 615 of i-th row and an output from the AND gate 615 of m-th row are input to respective one input terminal of the AND gate 616 of each stage of the output control circuit 612 as scan signals SC.i and SC.m like pulses 3303 and 3304, respectively.

In addition, an output control signal (G_ENABLE) is input to the other input terminal of the AND gate 616 of each stage in the output control circuit 612. It is controlled in accordance with the output control signal whether or not a pixel is selected at the timing of the scan signals SC.1 to SC.m input to the AND gates 616 of respective stages. In other words, in the case of selecting a pixel at the timing of the scan signals SC.1 to SC.m input to the AND gates 616, the scan signals SC.1 to SC.m are converted into pixel selection signals G.1 to G.m having high current supply capability by a buffer circuit 617 of each stage of the buffer circuit 613. Then, the pixel selection signals G.1 to G.m are input to respective scan lines G1 to Gm.

Figure 33:
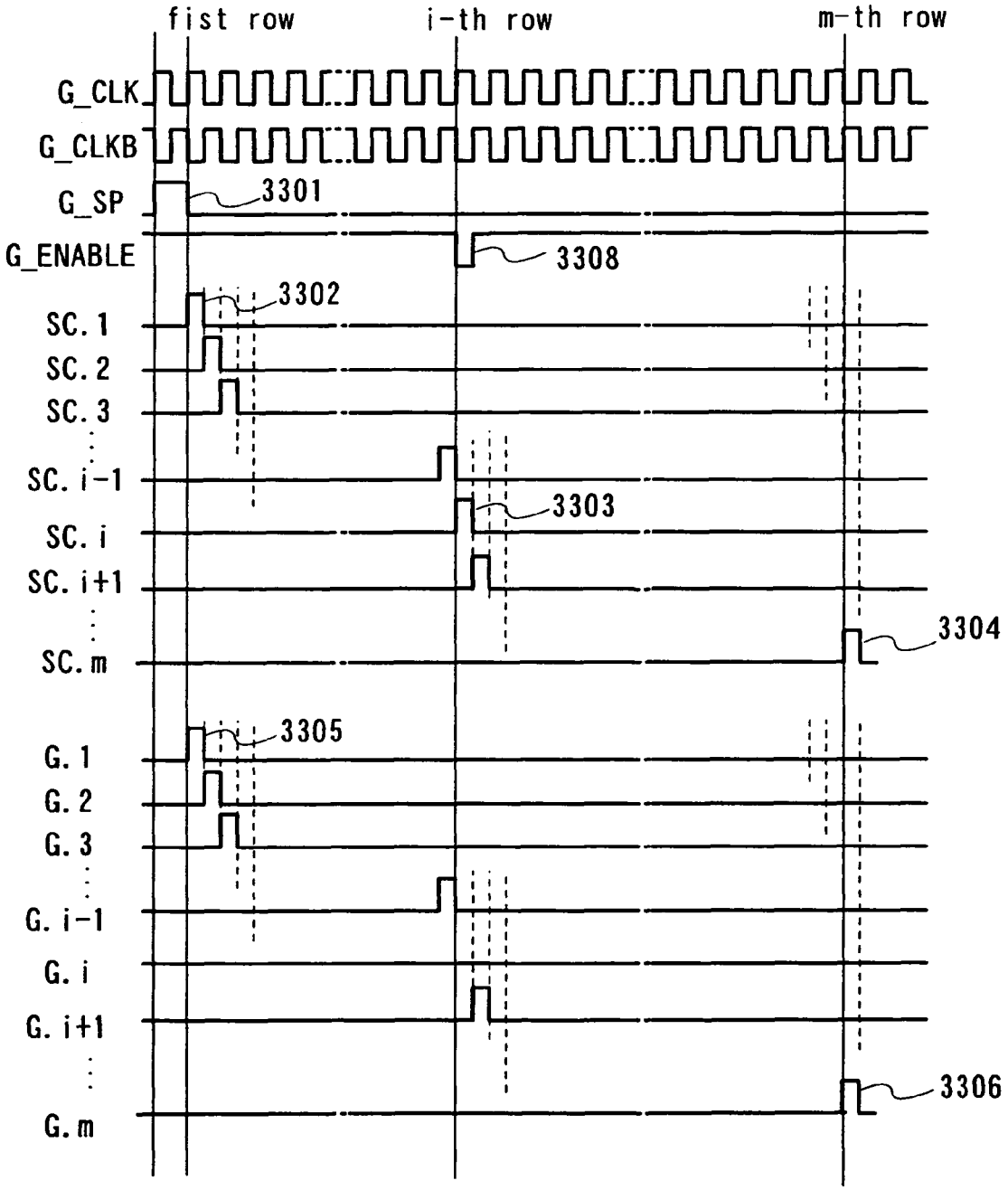
FIG. 33 is a diagram explaining operation of a scan line driver circuit applicable to a display device of the present invention.

On the other hand, in the case of not outputting the scan signals SC.1 to SC.m input to the AND gates 616, a pulse 3308 is input to the output control signal (G_ENABLE) at the same when the scan signal SC.i of i-th row is output, and a pulse of the pixel selection signal G.i selecting a pixel of i-th row is not output, as shown in FIG. 33. Note that the pulse 3308 is an L level signal and a signal input in the case where data of a signal for pixels in i-th row in which a signal is written to a pixel in certain subframe period in one frame period is the same as data of a signal already written to the pixels in i-th row. Thus, the pulse of the pixel selection signal G.i is not input to the scan line connected to the pixels in i-th row, and the pixels in i-th row are not selected.

Note that the structure of the scan line driver circuit 102 applicable to this embodiment mode is not limited to the structure in FIGS. 6A and 6B. It may be a structure in which a certain scan line is put in a floating state when a pixel connected to the scan line is not selected.

Note that when a signal selecting a pixel is input to the scan line, load capacitance typified by wire cross capacitance of the scan line or gate capacitance of a transistor connected to the scan line is charged and discharged with a charge. Thus, like the display device described in this embodiment mode, a signal selecting a pixel row is prevented from being input to the scan line connected to the pixel row when data of a signal for the pixel row connected to the scan line in which a signal is to be written is identical with data of a signal already written to the pixel row. Then, the number of times charging and discharging are carried out can be reduced, so that power consumption can be reduced.

In the display device of the present invention, it is preferable that the signal line driver circuit 101 also includes an output control circuit. In addition, it is preferable that the output control circuit of the signal line driver circuit 101 is also prevented from outputting a video signal in the case where data of a signal for a single pixel row in which the signal is to be written to a pixel in a certain subframe period in one frame period is the same as data of a signal for the pixel row already written thereto. The output from the signal line driver circuit 101 at that time may be a signal which puts a pixel in a lighting state or a signal which puts a pixel in a non-lighting state. The same signal as that for one row before may be input. Since charging and discharging are not performed in the case of the same signal, power is not consumed. A signal which consumes as little power as possible may be input to the signal line. In addition, the signal lines S1 to Sn may be put in a floating state. This is because a signal is not input to the pixel, so that a potential of the signal line may be of any value. Therefore, such a state having the lowest power consumption may be preferable.

Thus, power consumption can be reduced further significantly by putting the signal lines for the pixel row in a floating state. This is because charging and discharging of wire cross capacitance of the signal lines of the same number as the pixels connected to the scan lines can be omitted. Note that a signal input to the signal line right before may be directly output without putting in a floating state. Charging and discharging of the wire cross capacitance is already completed, so the signal lines do not consume much power.

Note that the display device of the present invention may employ a dot sequential method in which a video signal is input to each column of the signal lines from the signal line driver circuit and a signal is written to each pixel one by one, or a line sequential method in which a signal is simultaneously written to all pixels in a selected pixel row.

Figure 76A:
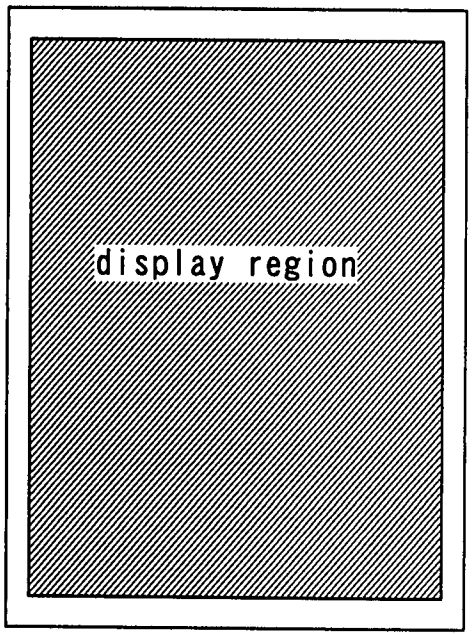
FIGS. 76A to 76C are diagrams explaining a display method of the present invention.
Figure 76B:
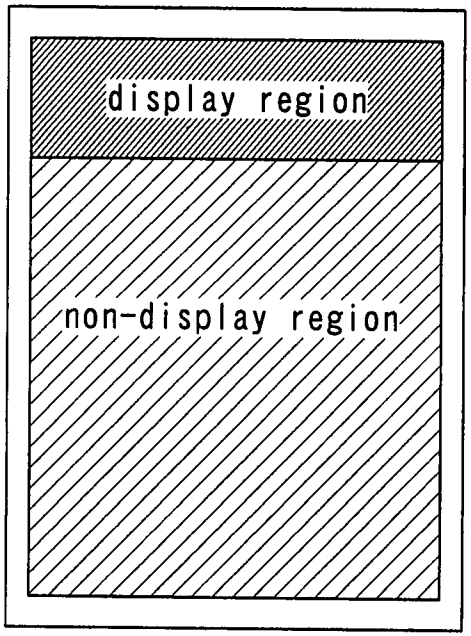
Figure 76C:
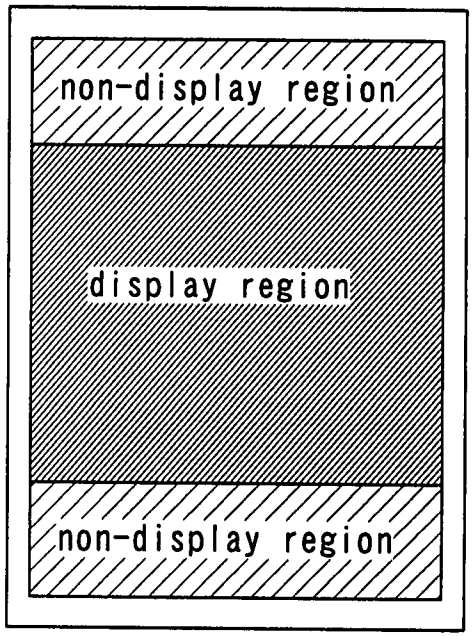

Note that the driving method explained in this embodiment mode can be used also in the case of performing partial display. FIG. 76A shows the case of performing display on the entire screen, FIG. 76B shows the case of performing display in an upper portion and not performing display in a lower portion, and FIG. 76C shows the case of not performing display in an upper portion and a lower portion and performing display in a middle portion. Power consumption can be reduced if a pixel in a non-display region is not selected in the case of repeatedly writing a signal to a pixel in a display region once a signal for non-display is written to a pixel in the non-display region. Note that, as refresh operation, a signal for non-display may be written to a pixel in a non-display region after signals are written to a pixel in a display region several times.

Embodiment Mode 2

In this embodiment mode, explanation is made on a line sequential display device of the present invention and operation thereof.

Figure 3:
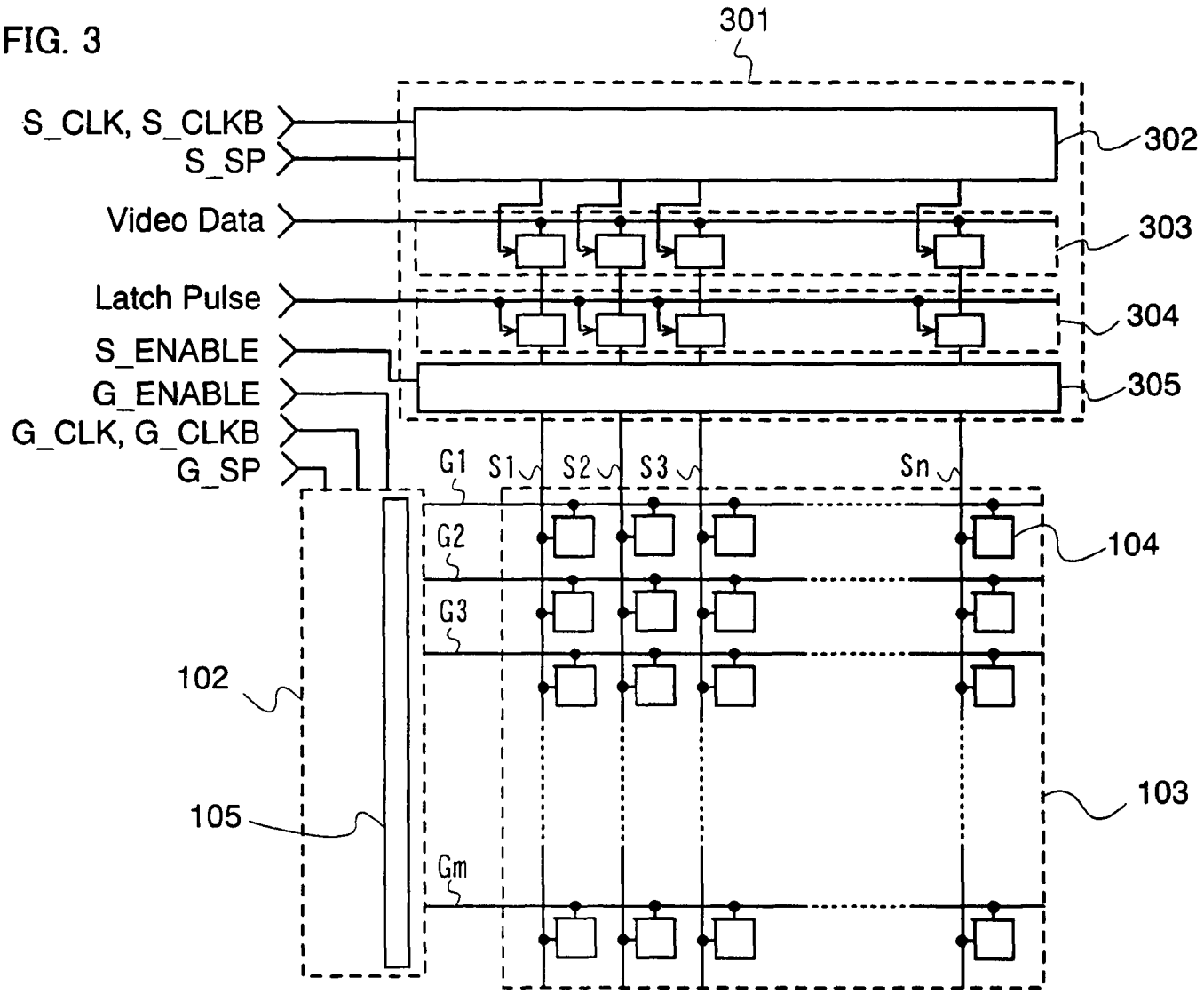
FIG. 3 is a diagram explaining a display device of the present invention.

FIG. 3 shows a schematic diagram of a line sequential display device. A signal line driver circuit 301 corresponds to the signal line driver circuit 101 of the display device in FIG. 1. Other common components are denoted by reference numerals in common with those in FIG. 1, and explanation thereof is omitted.

The signal line driver circuit 301 includes a pulse output circuit 302, a first latch circuit 303, a second latch circuit 304, and an output control circuit 305.

A clock signal (S_CLK), an inverted clock signal (S_CLKB), a start pulse signal (S_SP), and the like are input to the pulse output circuit 302. Then, a sampling pulse is output in accordance with the timing of these signals.

A sampling pulse output from the pulse output circuit 302 is input to the first latch circuit 303. A video signal (Video Data) is input to the first latch circuit 303, and data of the video signal is held in each stage of the first latch circuit 303 in accordance with the timing at which the sampling pulse is input.

When the data holding of the video signal is completed to the last stage in the first latch circuit 303, a latch pulse signal (Latch Pulse) is input to the second latch circuit 304 in a horizontal flyback period, and the data of the video signal held in the first latch circuit 303 is simultaneously transferred to the second latch circuit 304. Thereafter, the data of the video signal held in the second latch circuit 304 for a single pixel row is simultaneously output to the output control circuit 305.

An output control signal (S_ENABLE) is input to the output control circuit 305. Then, it is determined according to the level of the output control signal whether or not the output control circuit 305 outputs the video signal. In other words, it is determined whether or not the video signal is input to signal lines S1 to Sn. Note that the display device of this embodiment mode can reduce power consumption even if it does not include the output control circuit 305 in the signal line driver circuit. However, power consumption can further be reduced when the display device includes the output control circuit 305. In the case where the output control circuit 305 does not output the video signal, the signal lines S1 to Sn may be put in a floating state, a fixed potential may be output to the signal lines S1 to Sn, or the same signal as that input to pixels in the preceding row may be kept being output. In other words, such a potential as to reduce power consumption may be output. In order to reduce power consumption, charging and discharging with a charge is preferably not performed. Since the charging and discharging with the charge are performed when a potential is changed, a potential is preferably not changed.

Figure 8A:
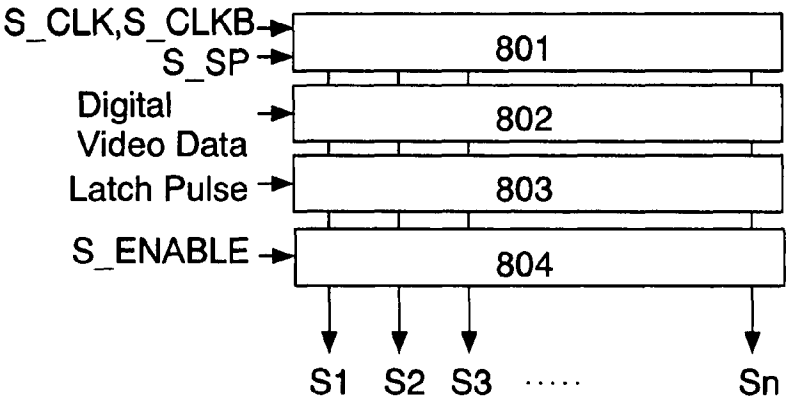
FIGS. 8A and 8B are diagrams explaining a signal line driver circuit applicable to a display device of the present invention.

Here, FIG. 8A shows an example of a signal line driver circuit applicable to the signal line driver circuit 301 of the line sequential display device in this embodiment mode.

The signal line driver circuit shown in FIG. 8A includes a pulse output circuit 801, a first latch circuit 802, a second latch circuit 803, and an output control circuit 804. A clock signal (S_CLK), an inverted clock signal (S_CLKB), and a start pulse signal (S_SP) are input to the pulse output circuit 801. A sampling pulse is sequentially output in accordance with these signals.

The sampling pulse output from the pulse output circuit 801 is input to the first latch circuit 802, and a video signal (Digital Video Data) is held in the first latch circuit 802 in accordance with the timing of the signal.

When the data holding of the video signal is completed to the last stage in the first latch circuit 802, a latch pulse (Latch Pulse) is input to the second latch circuit 803 in a horizontal flyback period, and the video signal held in the first latch circuit 802 is simultaneously transferred to the second latch circuit 803.

The video signal transferred to the second latch circuit 803 is input to the output control circuit 804. Furthermore, an output control signal (S_ENABLE) is input to the output control circuit 804, and this signal controls whether or not the video signal is output to signal lines S1 to Sn.

Note that when the output control circuit 804 does not output the video signal, the signal lines S1 to Sn may be put in a floating state or a fixed potential may be set. As the fixed potential, such a potential as to reduce power consumption may be set.

Note that the output control signal (S_ENABLE) is at an L level when data of a video signal for a single pixel row in which the signal is to be written to a pixel in a subframe period in one frame period is identical with data of a video signal for a single row in the last subframe period, and the output control signal is at an H level when any one part of the data for a single row is different.

In other words, the video signal is not output from the output control circuit 804 when the output control signal (S_ENABLE) is at an L level, and the video signal is output from the output control circuit 804 when the output control signal (S_ENABLE) is at an H level.

Figure 8B:
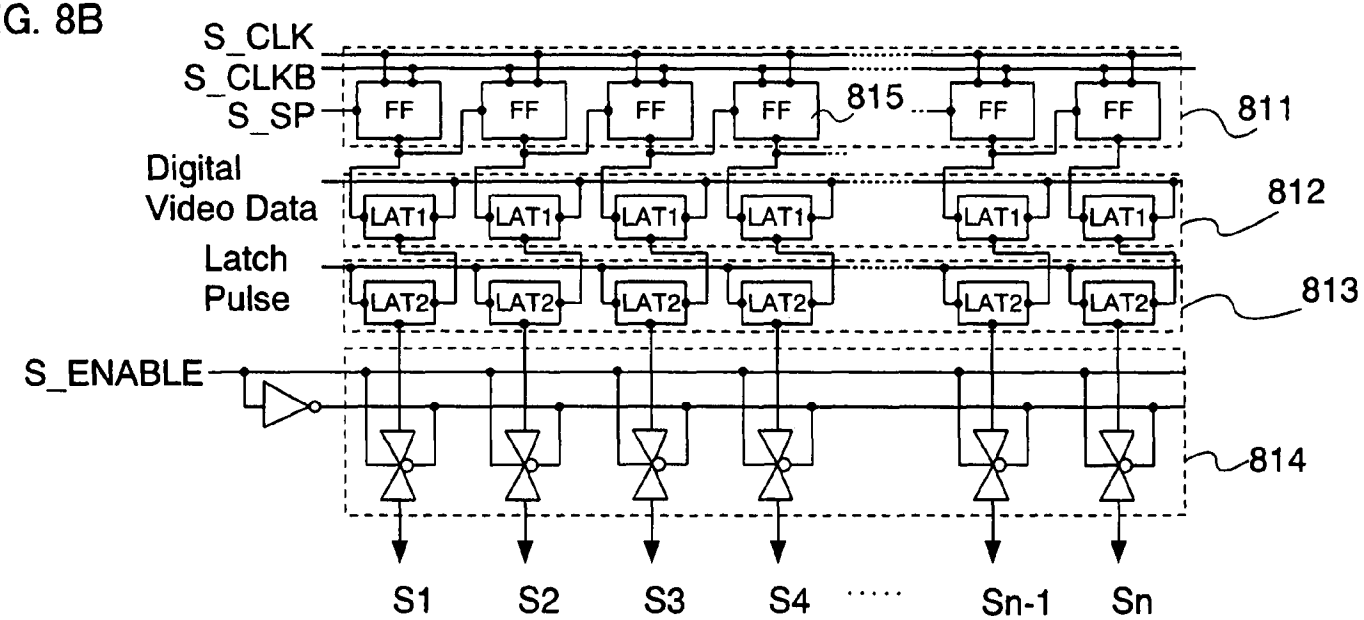

FIG. 8B shows a more detailed structure of the signal line driver circuit. In addition, operation of the signal line driver circuit is explained using the timing chart of FIG. 34.

A pulse output circuit 811 is formed using plural stages of flip-flop circuits (FF) 815 and the like, to which a clock signal (S_CLK), an inverted clock signal (S_CLKB), and a start pulse signal (S_SP) are input.

Figure 34:
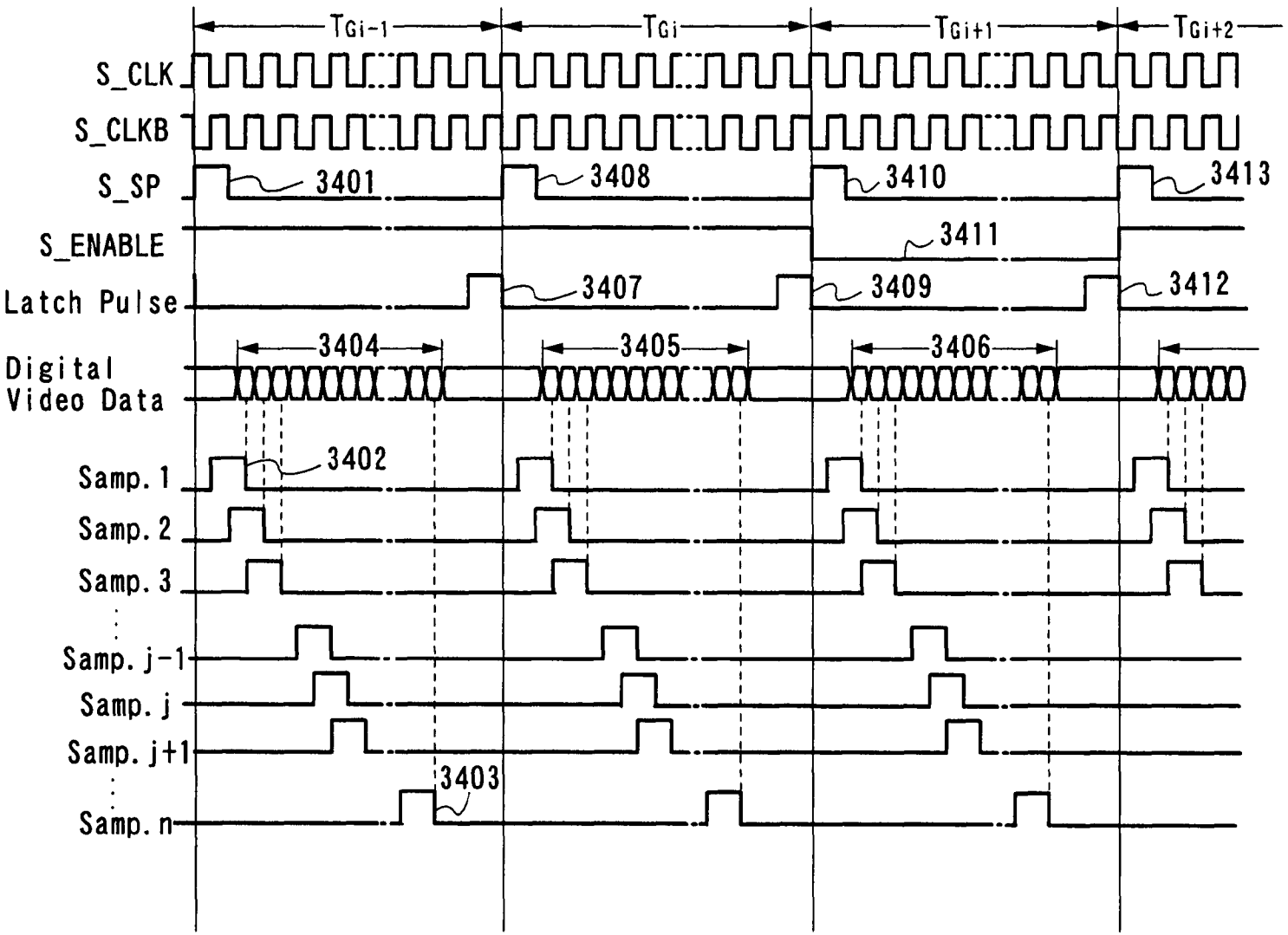
FIG. 34 is a diagram explaining operation of a signal line driver circuit applicable to a display device of the present invention.

Note that $T_{Gi-1}$, $T_{Gi}$, $T_{Gi+1}$, and $T_{Gi+2}$ in FIG. 34 denote periods for which video signals input to pixels in (i-1)-th row, i-th row, (i+1)-th row, and row i+2 are latched in a first latch circuit 812 of the signal line driver circuit in a certain subframe period, respectively. In other words, these periods correspond to one gate selection period. Then, data 3404 of a video signal, data 3405 of a video signal, and data 3406 of a video signal are input to the first latch circuit 812 in $T_{Gi-1}$, $T_{Gi}$, and $T_{Gi+1}$, respectively.

First, operation of $T_{Gi-1}$ is explained. A clock signal (S_CLK) and an inverted clock signal (S_CLKB) are input to each flip-flop circuit (FF) 815, and a start pulse signal (S_SP) is input to the flip-flop circuit 815 of the first stage. In FIG. 34, a pulse 3401 corresponds to the start pulse signal of $T_{Gi-1}$.

The pulse 3401 is delayed for a pulse of the clock signal when input to the flip-flop circuit 815 of the next stage. This pulse 3402 is input to a LAT1 corresponding to a pixel of the first column in the first latch circuit 812 as a sampling pulse Samp.1. Similarly, an output from the flip-flop circuit 815 of stage n is input to a LAT1 corresponding to a pixel of n-th column in the first latch circuit 812 as a sampling pulse Samp.n.

In $T_{Gi-1}$, the data 3404 of the video signal is input to the first latch circuit 812, and the video signal is held in the LAT1 of each stage corresponding to a pixel of each column in accordance with the timing at which the sampling pulse is input. Note that the timing at which the sampling pulse is input means the timing at which the sampling pulse falls from an H level to an L level. At this time, the video signal input to the first latch circuit 812 is held in each stage of the first latch circuit 812.

When the video signal holding is completed to the last stage in the first latch circuit 812, a latch pulse (Latch Pulse) 3407 is input to the second latch circuit 813 in a horizontal flyback period, and the video signal held in the first latch circuit 812 is simultaneously transferred to the second latch circuit 813. Thereafter, the video signal held in the second latch circuit 813 for a single pixel row is simultaneously input to the output control circuit 814.

Note that an output control signal (S_ENABLE) is input to the output control circuit 814, and whether or not the video signal is output to the signal lines S1 to Sn is controlled by the level of the output control signal.

Note that the output control signal (S_ENABLE) is at an L level when data of a video signal for a single pixel row in which the signal is to be written to a pixel in a subframe period in one frame period is identical with data of a video signal for a single row in the last subframe period, and the output control signal is at an H level when any one part of the data for the pixel row is different.

In other words, the video signal is not output from the output control circuit 814 when the output control signal (S_ENABLE) is at an L level since an analog switch provided in each stage of the output control circuit 814 is turned off, and the video signal is output from the output control circuit 814 when the output control signal (S_ENABLE) is at an H level since the analog switch provided in each stage is turned on.

Subsequently, the operation proceeds to $T_{Gi}$. Since the output control signal (S_ENABLE) is at an H level, the data 3404 of the video signal held in the second latch circuit 813 is output to the signal lines S1 to Sn through the output control circuit 814. Then, the start pulse signal (S_SP) is input again to the flip-flop circuit 815 of the first stage. A pulse 3408 is the start pulse signal of $T_{Gi}$. Thereafter, the sampling pulse is output again. In accordance with the timing of the sampling pulse, the data 3405 of the video signal is held in each stage of the first latch circuit 812. When a latch pulse 3409 is input, the data 3405 of the video signal is simultaneously transferred to the second latch circuit 813. The data 3405 of the video signal for a single pixel row is simultaneously input to the output control circuit 814.

Subsequently, the operation proceeds to $T_{Gi+1}$. Since the output control signal (S_ENABLE) is at an L level, the data 3405 of the video signal held in the second latch circuit 813 is not output from the output control circuit 814. In other words, the signal lines S1-Sn are put in a floating state. Then, the start pulse signal (S_SP) is input again to the flip-flop circuit 815 of the first stage. A pulse 3410 is the start pulse signal of $T_{Gi+1}$. Thereafter, the sampling pulse is output again. In accordance with the timing of the sampling pulse, the data 3406 of the video signal is held in each stage of the first latch circuit 812. When a latch pulse 3412 is input, the data 3406 of video signal is simultaneously transferred to the second latch circuit 813. The data 3406 of the video signal for a single pixel row is simultaneously input to the output control circuit 814.

Subsequently, the operation proceeds to $T_{Gi+2}$. Since the output control signal (S_ENABLE) is at an H level, the video signal 3406 held in the second latch circuit 813 is output to the signal lines S1 to Sn through the output control circuit 814. Then, the start pulse signal (S_SP) is input again to the flip-flop circuit 815 of the first stage. A pulse 3413 is the start pulse signal of $T_{Gi+2}$.

In a writing period, the above-described operation is repeated to process video signals for subframes. Furthermore, an image of one frame can be displayed by repeating the processing for subframes.

Note that the signal lines S1 to Sn are put in a floating state during a signal writing period to the pixels in i-th row, in other words, during $T_{Gi+1}$ since data of the video signal to be written to the pixel in i-th row is identical with data of the signal already written to the pixel in i-th row. Accordingly, charging and discharging of the signal lines can be omitted, so that power consumption can be reduced.

Figure 68:
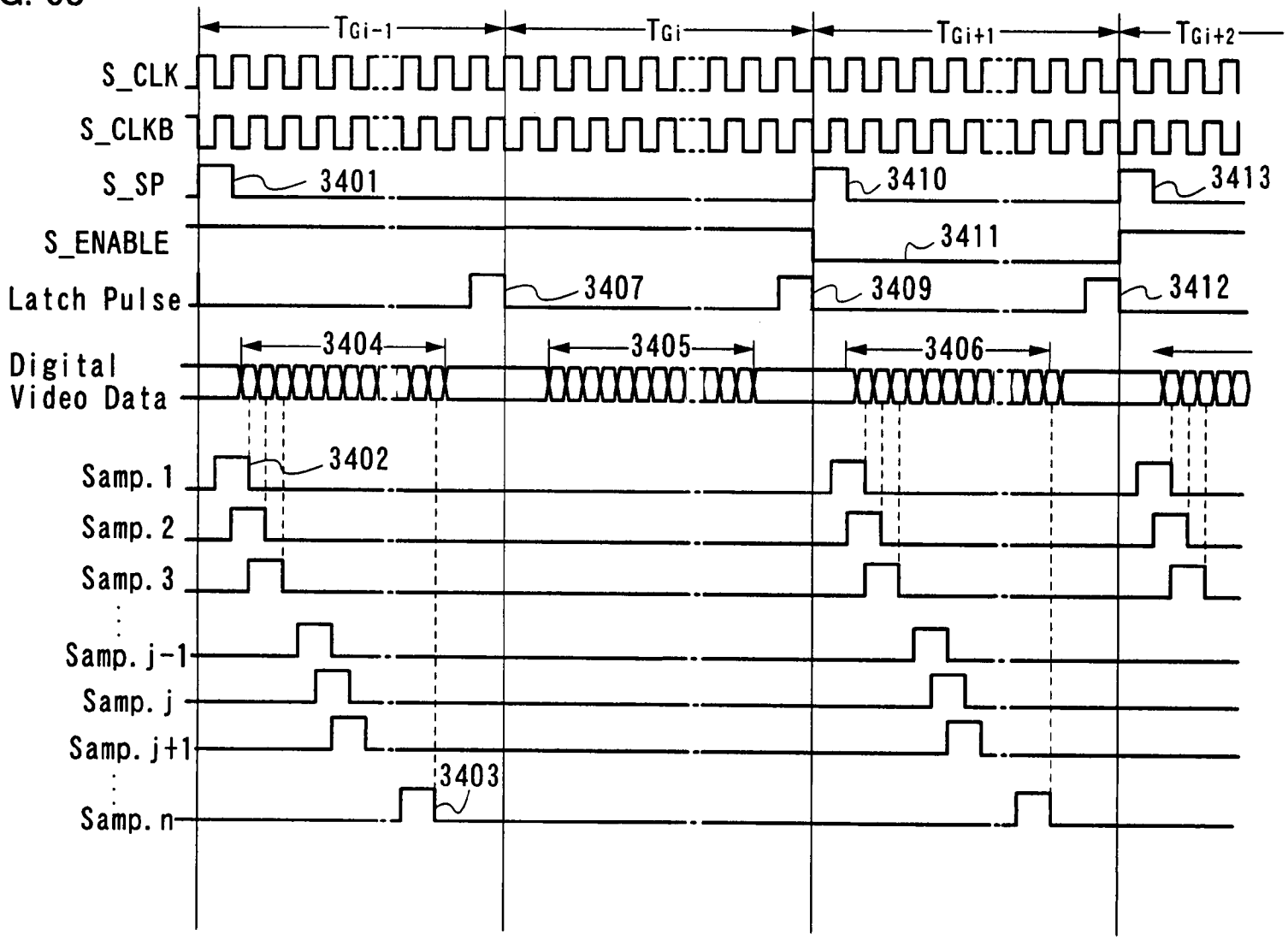
FIG. 68 is a diagram explaining operation of a signal line driver circuit applicable to a display device of the present invention.

In a period for which the video signal for a pixel row in which signal writing is to be stopped is converted from serial into parallel, a pulse of a start pulse signal (S_SP) which triggers a start of holding signal data may be prevented from being input. In other words, the pulse of the start pulse signal (S_SP) is not input during $T_{Gi}$ as shown in FIG. 68. Since the sampling pulse is accordingly not output from the pulse output circuit 811, the data 3405 of the video signal is not held in the first latch circuit 812. Thus, charging and discharging of the first latch circuit 812 with a charge can be omitted. Therefore, power consumption can further be reduced. Since other signals are similar to those in FIG. 34, explanation thereof is omitted.

Figure 69:
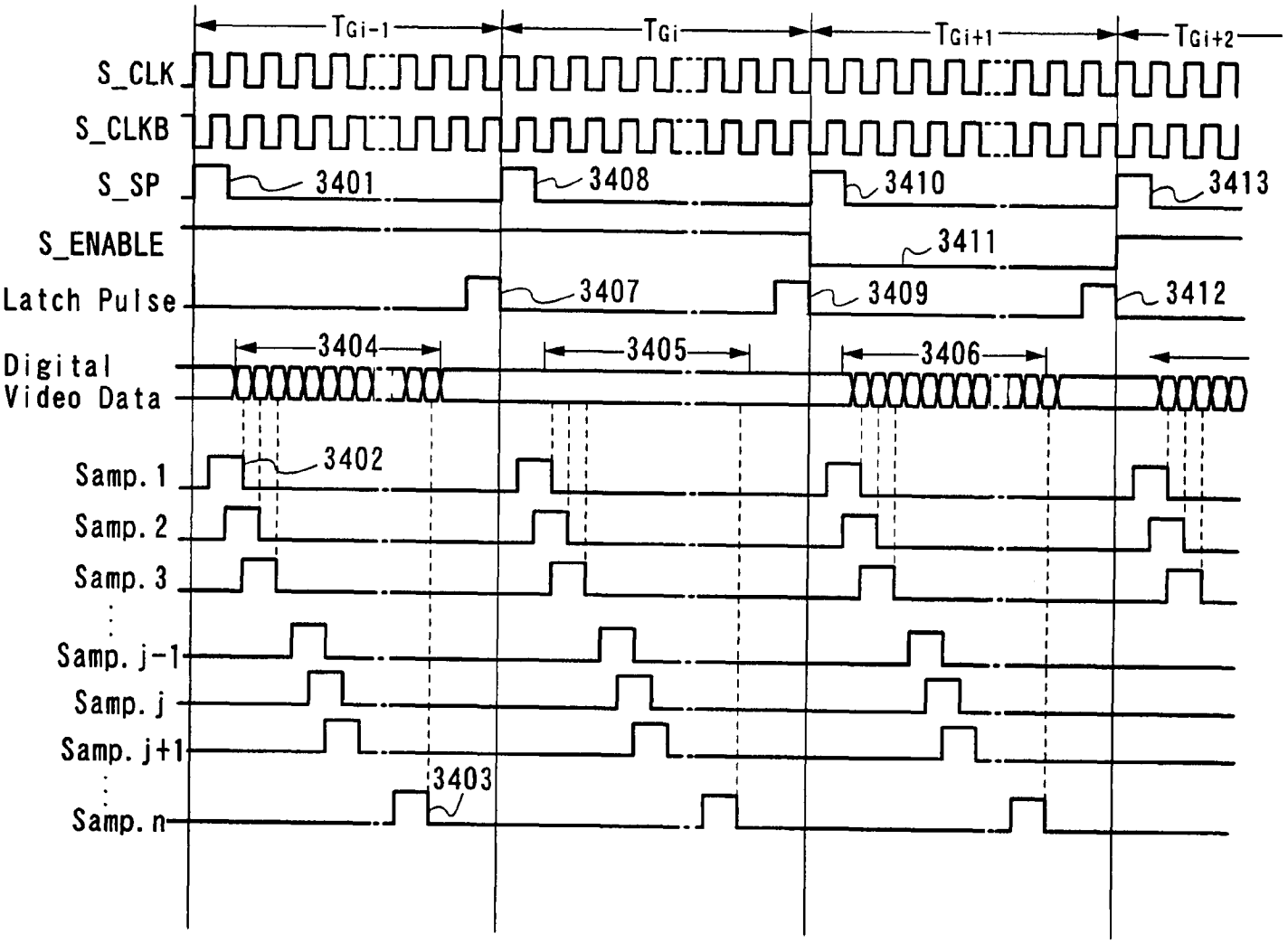
FIG. 69 is a diagram explaining operation of a signal line driver circuit applicable to a display device of the present invention.
Figure 80:
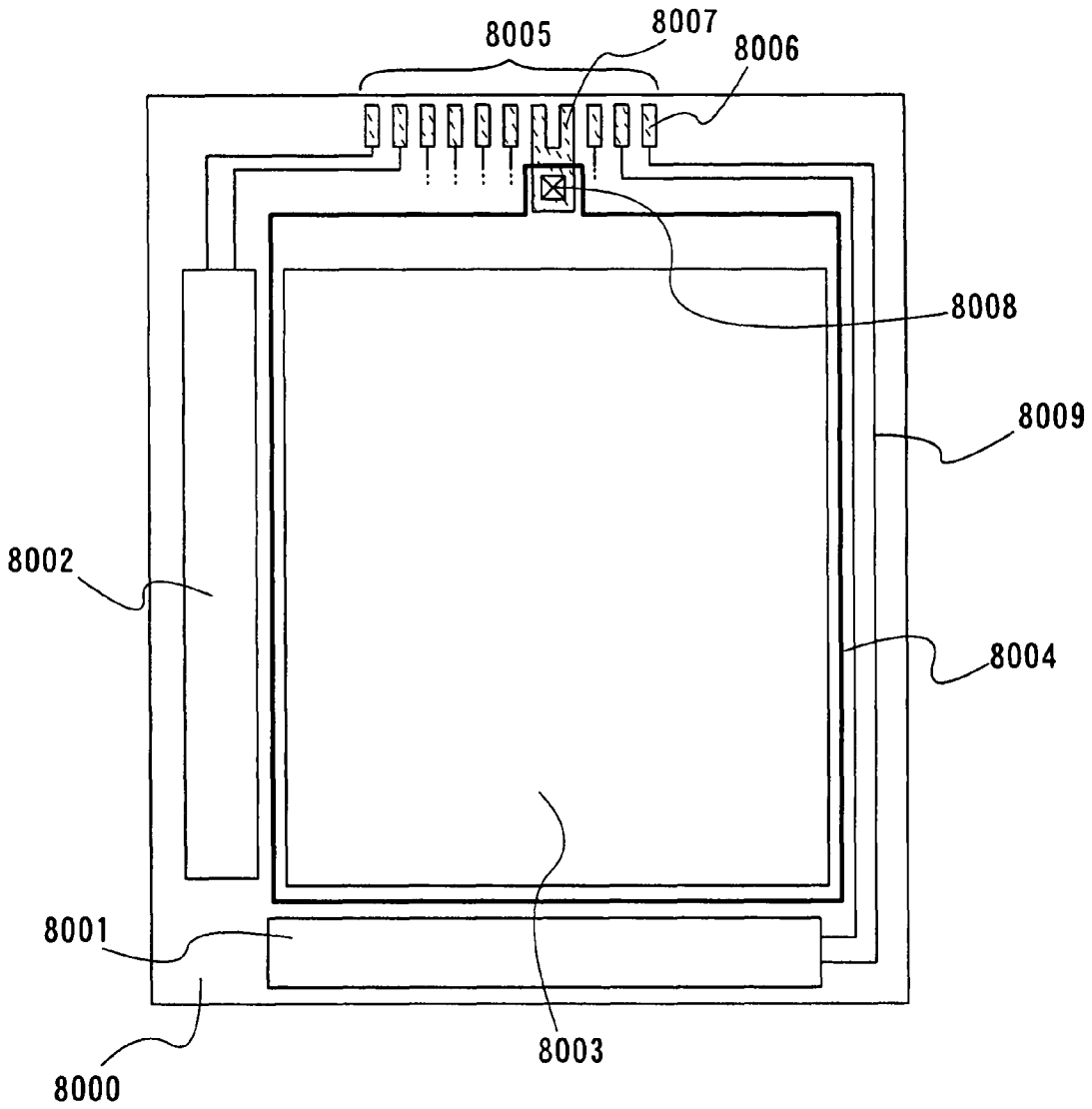
FIG. 80 is a diagram explaining a display panel of the present invention.

In a period for which the video signal for a pixel row in which signal writing is to be stopped is converted from serial into parallel, an input of the video signal to the signal line driver circuit may be stopped. In other words, the video signal (Video Data) may be prevented from being input to the signal line driver circuit during $T_{Gi}$ as shown in FIG. 69. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. Alternatively, the video signal may be put in a floating state. Since other signals are similar to those in FIG. 34, explanation thereof is omitted. Note that such a case is particularly effective when a connection terminal to which a signal is input from outside and a signal line driver circuit are formed with a pixel portion interposed therebetween. Such a structure is shown in FIG. 80. In FIG. 80, a signal line driver circuit 8001, a scan line driver circuit 8002, a pixel portion 8003, and a connection terminal portion 8005 are provided on a substrate 8000. On the pixel portion 8003, an opposite electrode 8004 is formed so as to cover the pixel portion 8003. The opposite electrode 8004 is connected through a contact hole 8008 to a wire wider than pads of a plurality of connection terminals 8007 extended from the connection terminals 8007 to which a low power supply potential of the opposite electrode formed in the connection terminal portion is input. The connection terminal 8006 to which the video signal is input is connected to the signal line driver circuit 8001 by a video line 8009. In the case of using this structure, the resistance of the power supply line to the opposite electrode 8004 (such as the contact resistance of the connection terminal 8007 and an FPC terminal or the wire resistance between the opposite electrode 8004 and the connection terminal 8007) can be reduced. Thus, a voltage drop in the power supply line is reduced, and the potential of the opposite electrode can be set to normal. Even if a lead wiring becomes long like the video line 8009, charging and discharging of the video line 8009 can be reduced. Therefore, power consumption can be reduced.

Figure 70:
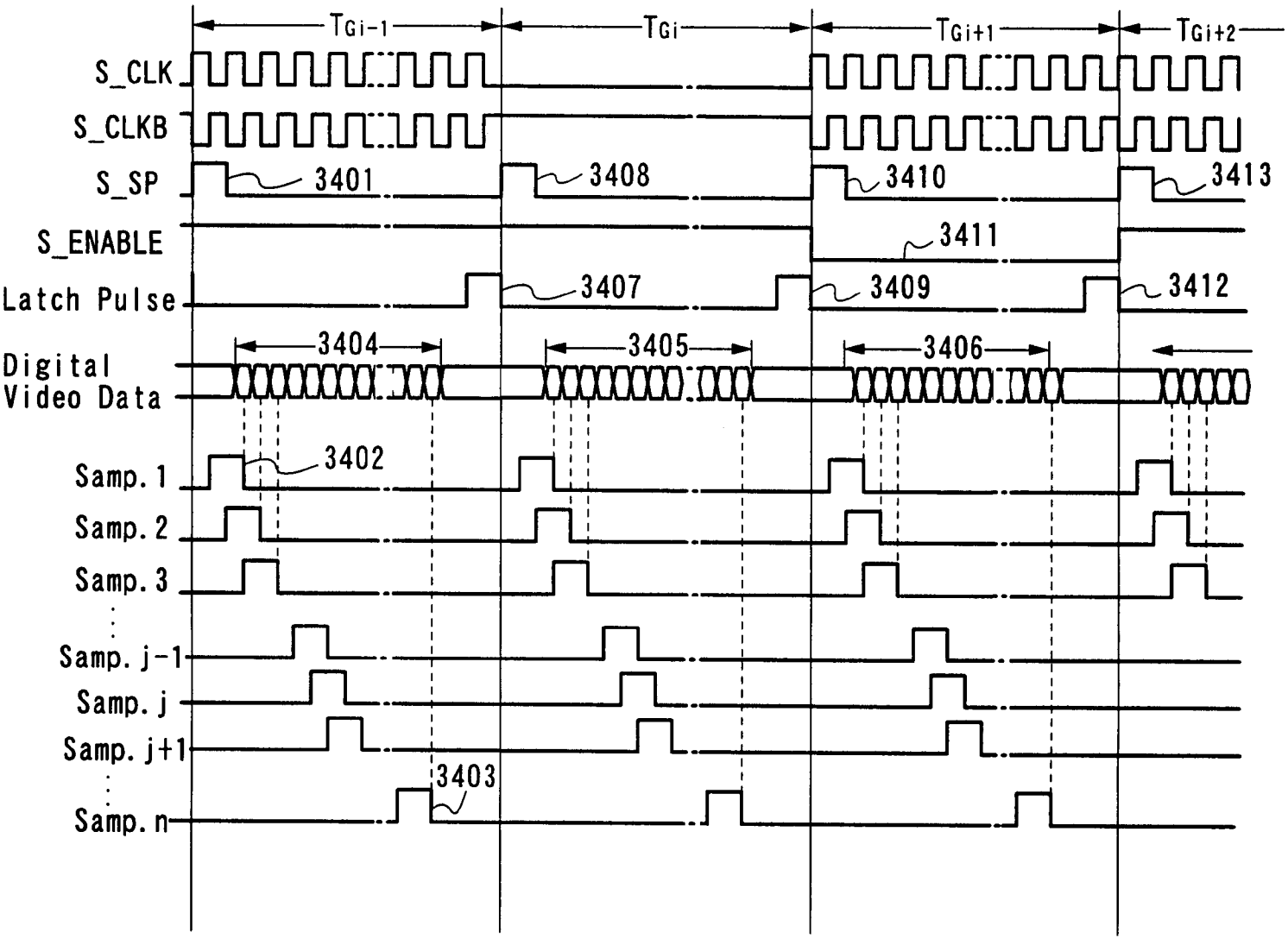
FIG. 70 is a diagram explaining operation of a signal line driver circuit applicable to a display device of the present invention.

In a period for which the video signal for a pixel row in which signal writing is to be stopped is converted from serial into parallel, an input of the clock signal (S_CLK), the inverted clock signal (S_CLKB), and the like may be stopped. In other words, the clock signal (S_CLK) or the inverted clock signal (S_CLKB) may be prevented from being input to the signal line driver circuit during $T_{Gi}$ as shown in FIG. 70. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential, so power consumption can be reduced. Since other signals are similar to those in FIG. 34, explanation thereof is omitted.

Figure 104:
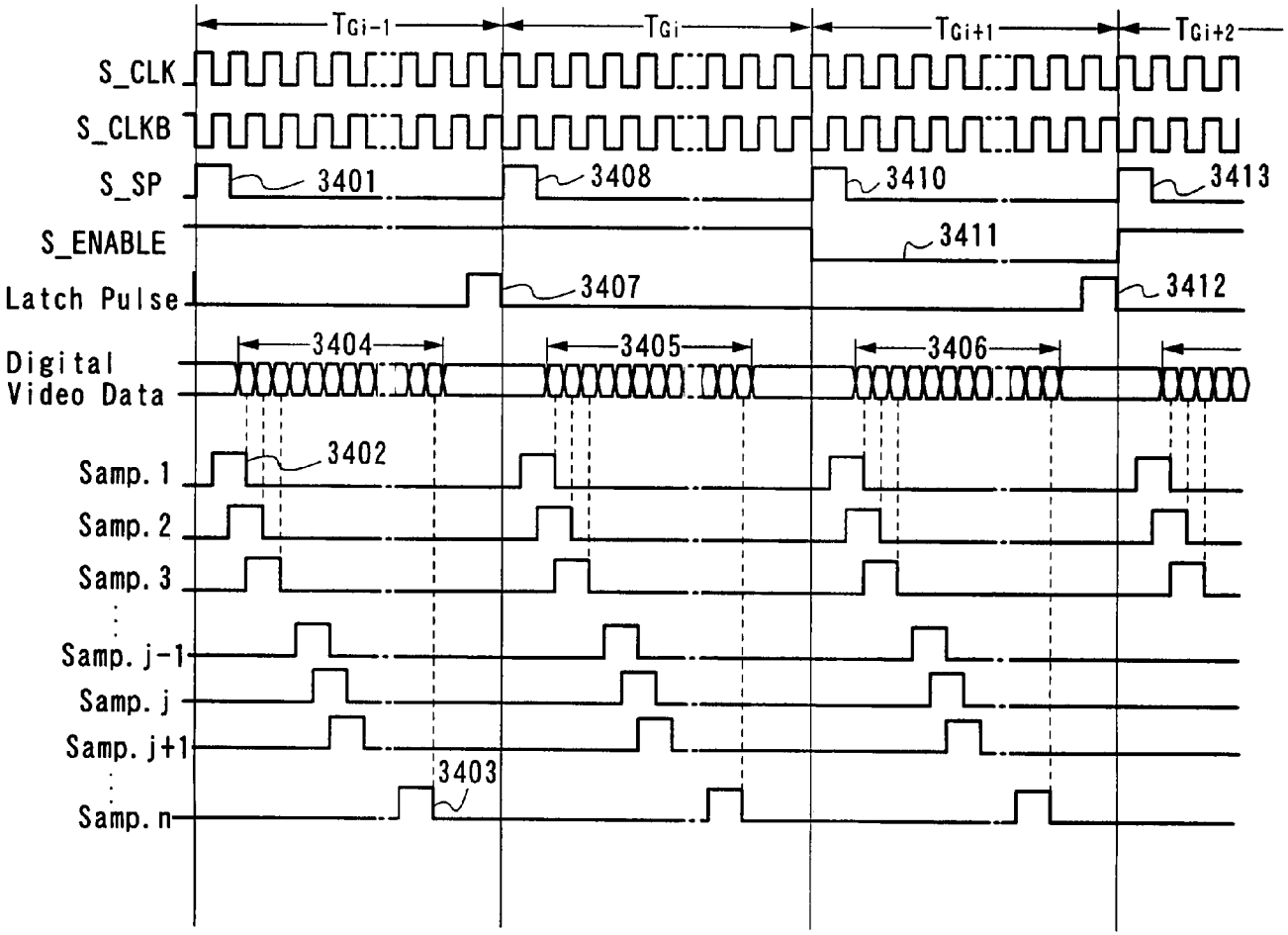
FIG. 104 is a diagram explaining operation of a signal line driver circuit applicable to a display device of the present invention.

In a period for which the video signal for a pixel row in which signal writing is to be stopped is converted from serial into parallel, the input of the latch pulse may be stopped. In other words, the latch pulse (Latch Pulse) may be prevented from being input to the signal line driver circuit during $T_{Gi}$ as shown in FIG. 104. Since a signal is not transferred from the first latch circuit 812 to the second latch circuit 813 in that case, charging and discharging with a charge can be omitted. Thus, power consumption can be reduced. Since other signals are similar to those in FIG. 34, explanation thereof is omitted.

Figure 82:
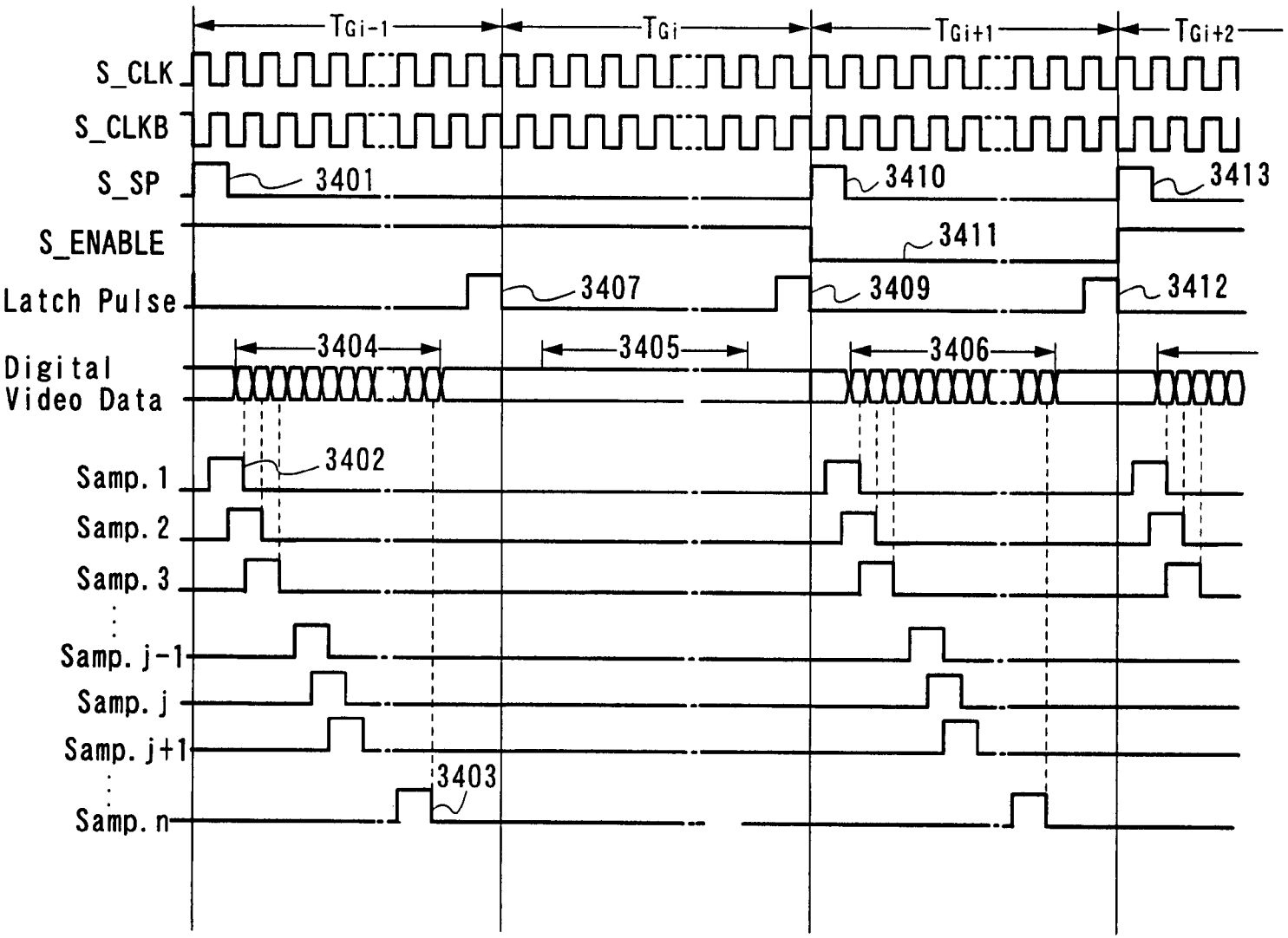
FIG. 82 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In addition, the input of the video signal to the signal line driver circuit may be stopped. In other words, the pulse of the start pulse signal (S_SP) is not input during $T_{Gi}$ as shown in FIG. 82. Since the sampling pulse is accordingly not output from the pulse output circuit 811, the data 3405 of the video signal is not held in the first latch circuit 812. Thus, charging and discharging of the first latch circuit 812 with a charge can be omitted. In addition, the video signal (Video Data) is not input to the signal line driver circuit. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. Therefore, power consumption can be reduced. Since other signals are similar to those in FIG. 34, explanation thereof is omitted.

Figure 83:
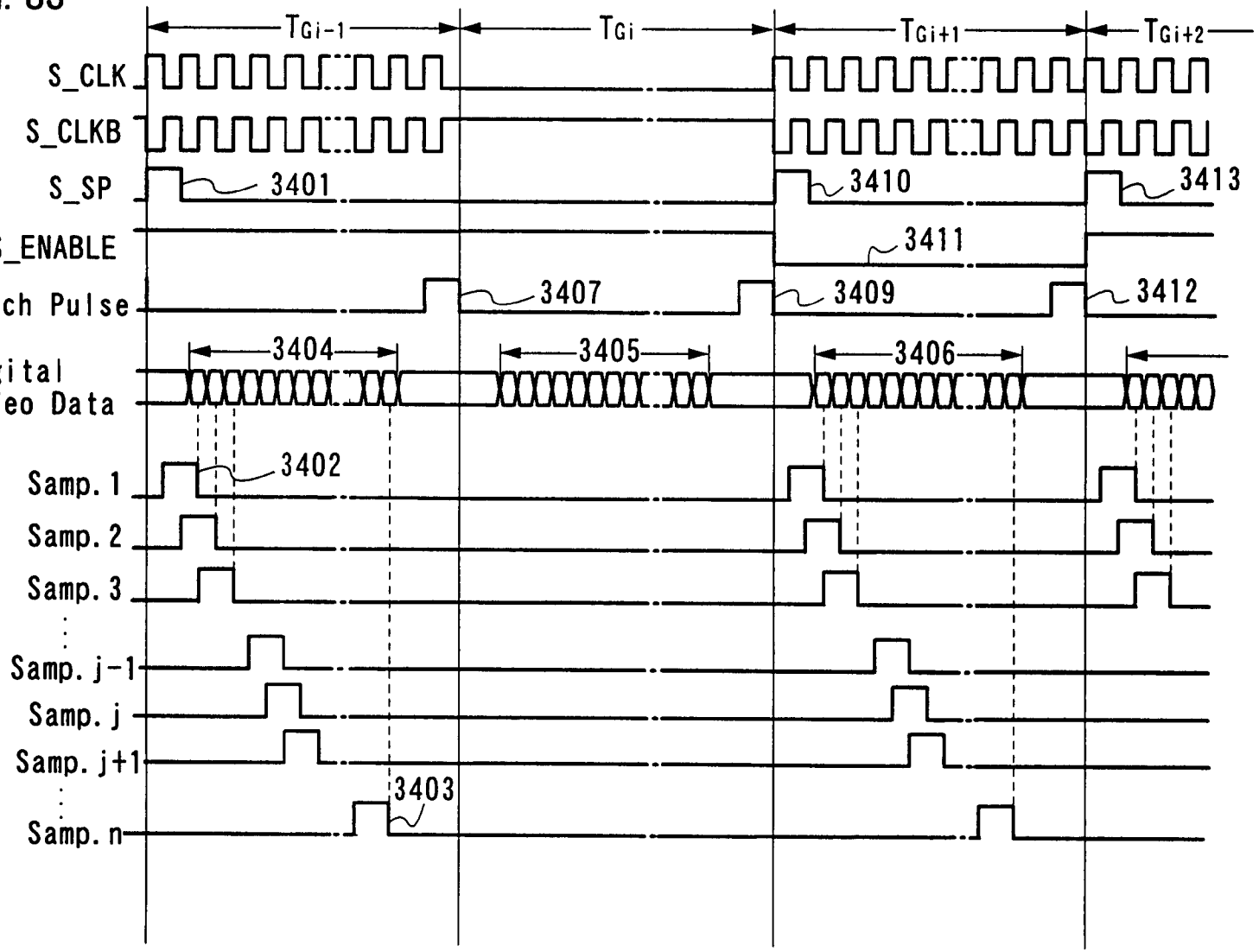
FIG. 83 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In addition, an input of the clock signal (S_CLK), the inverted clock signal (S_CLKB), and the like may be stopped. In other words, the pulse of the start pulse signal (S_SP) is not input during $T_{Gi}$ as shown in FIG. 83. Since the sampling pulse is accordingly not output from the pulse output circuit 811, the data 3405 of the video signal is not held in the first latch circuit 812. Thus, charging and discharging of the first latch circuit 812 with a charge can be omitted. Therefore, power consumption can be reduced. In addition, a clock signal (S_CLK) and an inverted clock signal (S_CLKB) are not input to the signal line driver circuit. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential. Thus, power consumption can be reduced. Since other signals are similar to those in FIG. 34, explanation thereof is omitted.

Figure 84:
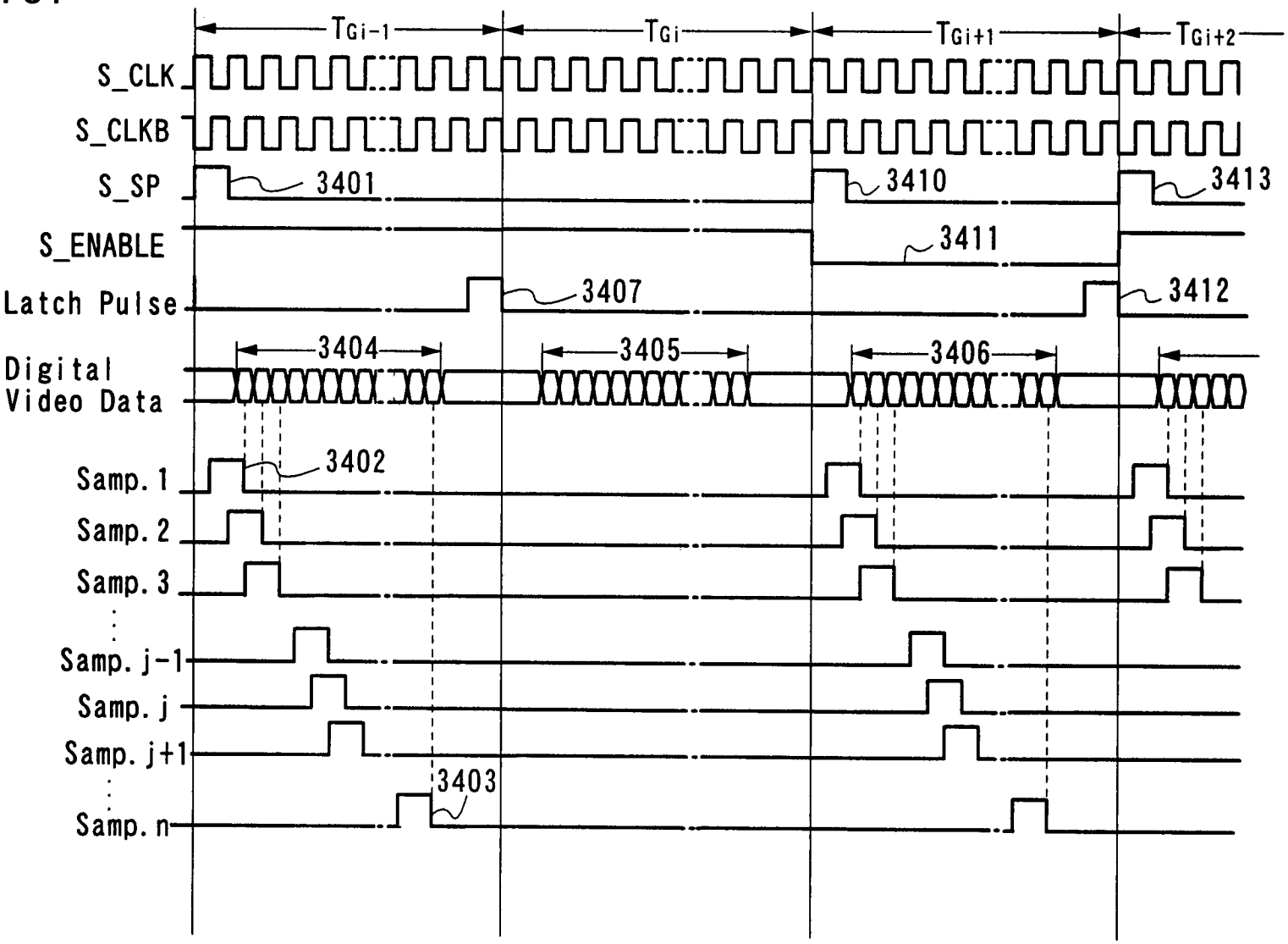
FIG. 84 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In addition, the input of the latch pulse may be stopped. In other words, the pulse of the start pulse signal (S_SP) is not input during $T_{Gi}$ as shown in FIG. 84. Since the sampling pulse is accordingly not output from the pulse output circuit 811, the data 3405 of the video signal is not held in the first latch circuit 812. Thus, charging and discharging of the first latch circuit 812 with a charge can be omitted. In addition, the latch pulse (Latch Pulse) is not input to the signal line driver circuit. Since a signal is not transferred from the first latch circuit 812 to the second latch circuit 813 in that case, charging and discharging with a charge can be omitted. Thus, power consumption can further be reduced. Since other signals are similar to those in FIG. 34, explanation thereof is omitted.

Figure 85:
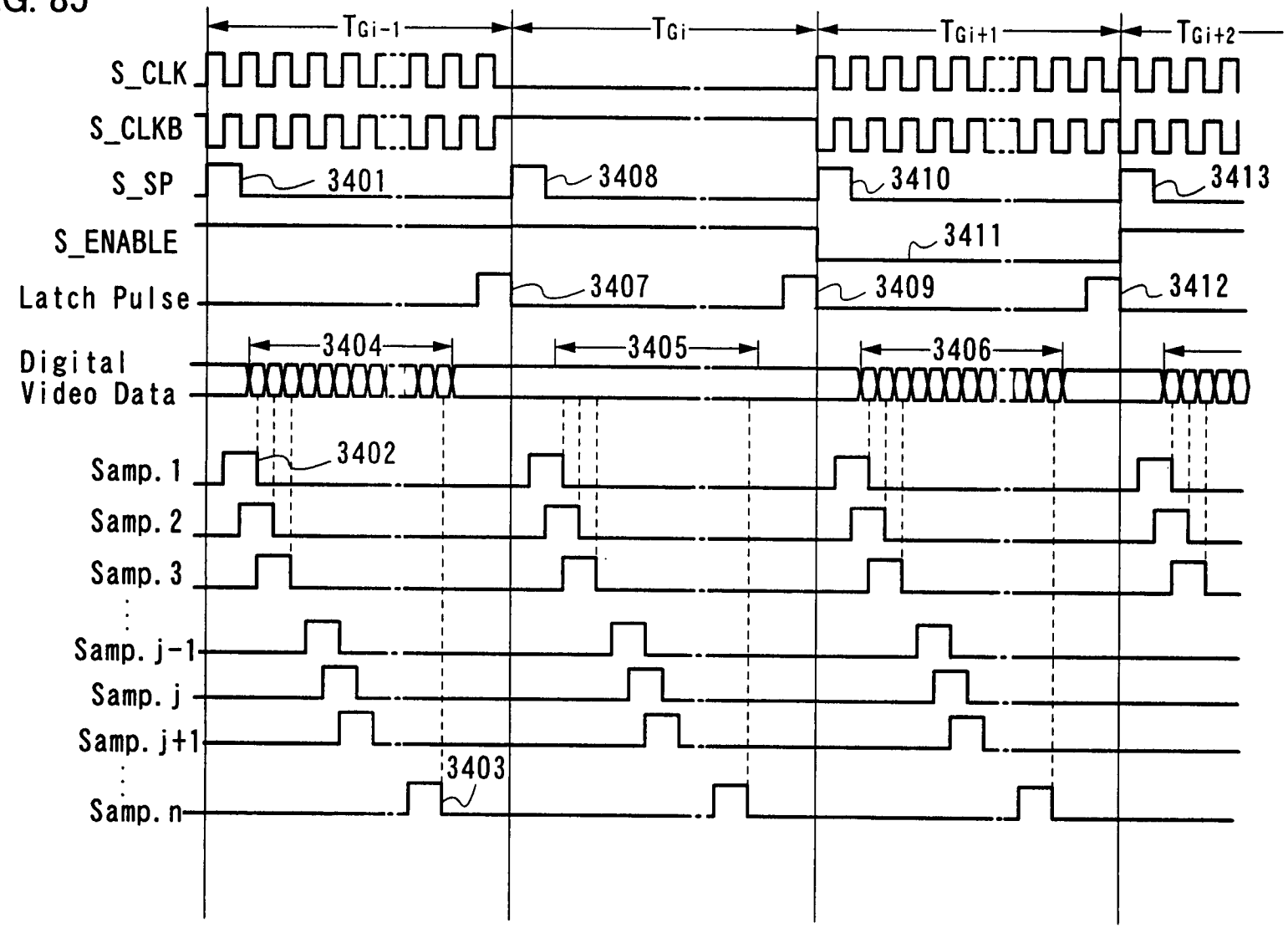
FIG. 85 is a diagram explaining operation of a signal line driver circuit applicable to a display device of the present invention.

In a period for which the video signal for a pixel row in which signal writing is to be stopped is converted from serial into parallel, the input of the video signal to the signal line driver circuit may be stopped. In addition, the input of the clock signal (S_CLK), the inverted clock signal (S_CLKB), and the like may be stopped. In other words, the video signal (video Data) may be prevented from being input to the signal line driver circuit during $T_{Gi}$ as shown in FIG. 85. This is because the video signal held during $T_{Gi}$ is not output to the signal lines S1 to Sn, and the video signal does not need to be input originally. Since charging and discharging of a video line with a charge can be omitted by stopping the input of the video signal, power consumption can be reduced. During $T_{Gi}$, such a potential as to reduce power consumption may be input to the video line. Furthermore, the clock signal (S_CLK) and the inverted clock signal (S_CLKB) are not input to the signal line driver circuit during $T_{Gi}$. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential, so power consumption can be reduced. Since other signals are similar to those in FIG. 34, explanation thereof is omitted.

Figure 86:
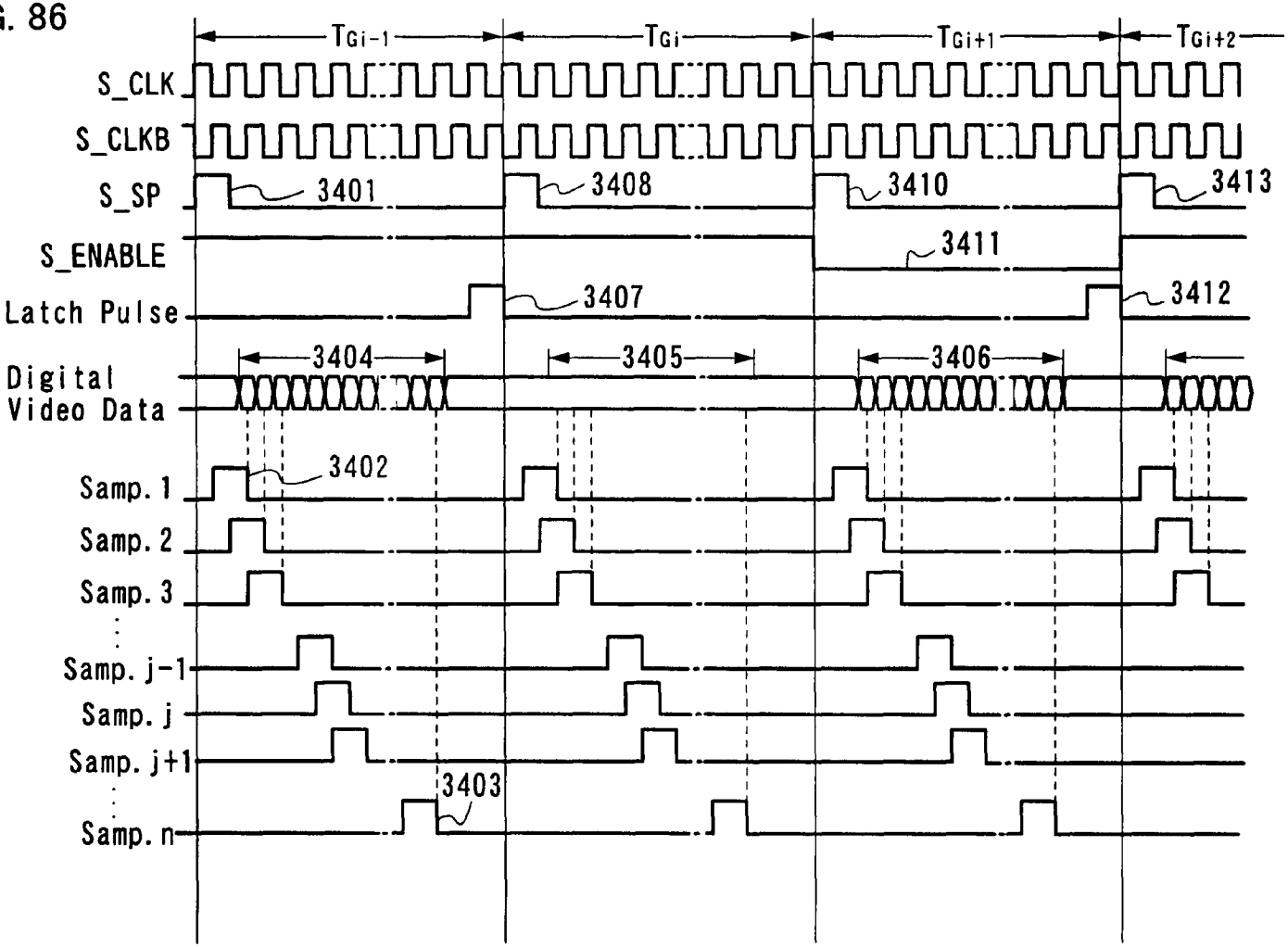
FIG. 86 is a diagram explaining operation of a signal line driver circuit applicable to a display device of the present invention.

In a period for which the video signal for a pixel row in which signal writing is to be stopped is converted from serial into parallel, the input of the video signal to the signal line driver circuit may be stopped. In addition, the input of the latch pulse may be stopped. In other words, the video signal (Video Data) may be prevented from being input to the signal line driver circuit during $T_{Gi}$ as shown in FIG. 86. This is because the video signal held during $T_{Gi}$ is not output to the signal lines S1 to Sn, and the video signal does not need to be input originally. Since charging and discharging of a video line with a charge can be omitted by stopping the input of the video signal, power consumption can be reduced. During $T_{Gi}$, such a potential as to reduce power consumption may be input to the video line. In addition, a latch pulse (Latch Pulse) is not input to the signal line driver circuit during $T_{Gi}$. Since a signal is not transferred from the first latch circuit 812 to the second latch circuit 813 in that case, charging and discharging with a charge can be omitted. Thus, power consumption can be reduced. Since other signals are similar to those in FIG. 34, explanation thereof is omitted.

Figure 87:
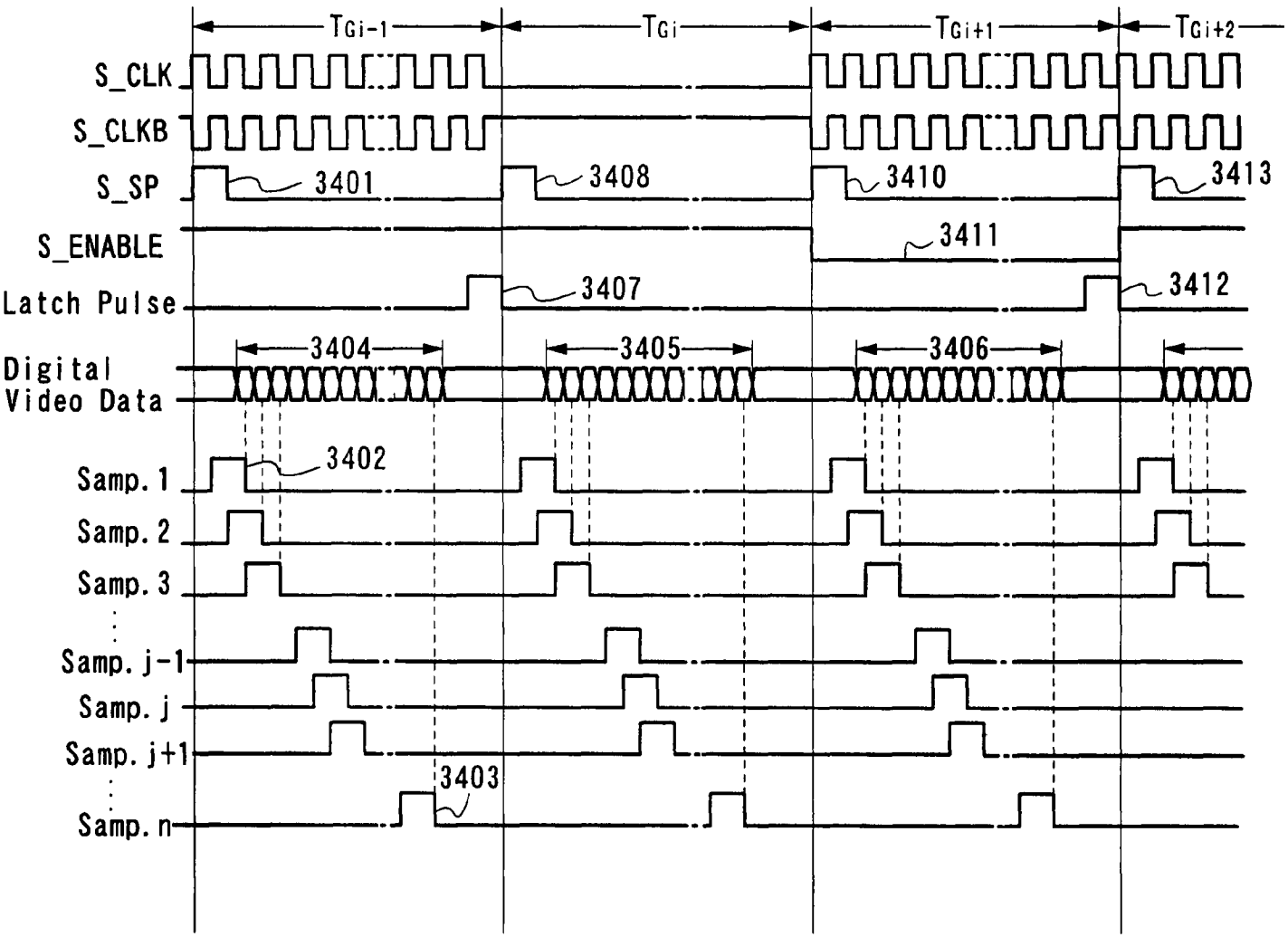
FIG. 87 is a diagram explaining operation of a signal line driver circuit applicable to a display device of the present invention.

In a period for which the video signal for a pixel row in which signal writing is to be stopped is converted from serial into parallel, the input of the clock signal (S_CLK), the inverted clock signal (S_CLKB), and the like may be stopped. In addition, the input of the latch pulse may be stopped. In other words, the clock signal (S_CLK) and the inverted clock signal (S_CLKB) may be prevented from being input to the signal line driver circuit during $T_{Gi}$ as shown in FIG. 87. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential, so power consumption can be reduced. Furthermore, the latch pulse (Latch Pulse) may be prevented from being input to the signal line driver circuit during $T_{Gi}$. Since a signal is not transferred from the first latch circuit 812 to the second latch circuit 813 in that case, charging and discharging with a charge can be omitted. Thus, power consumption can be reduced. Since other signals are similar to those in FIG. 34, explanation thereof is omitted.

Figure 88:
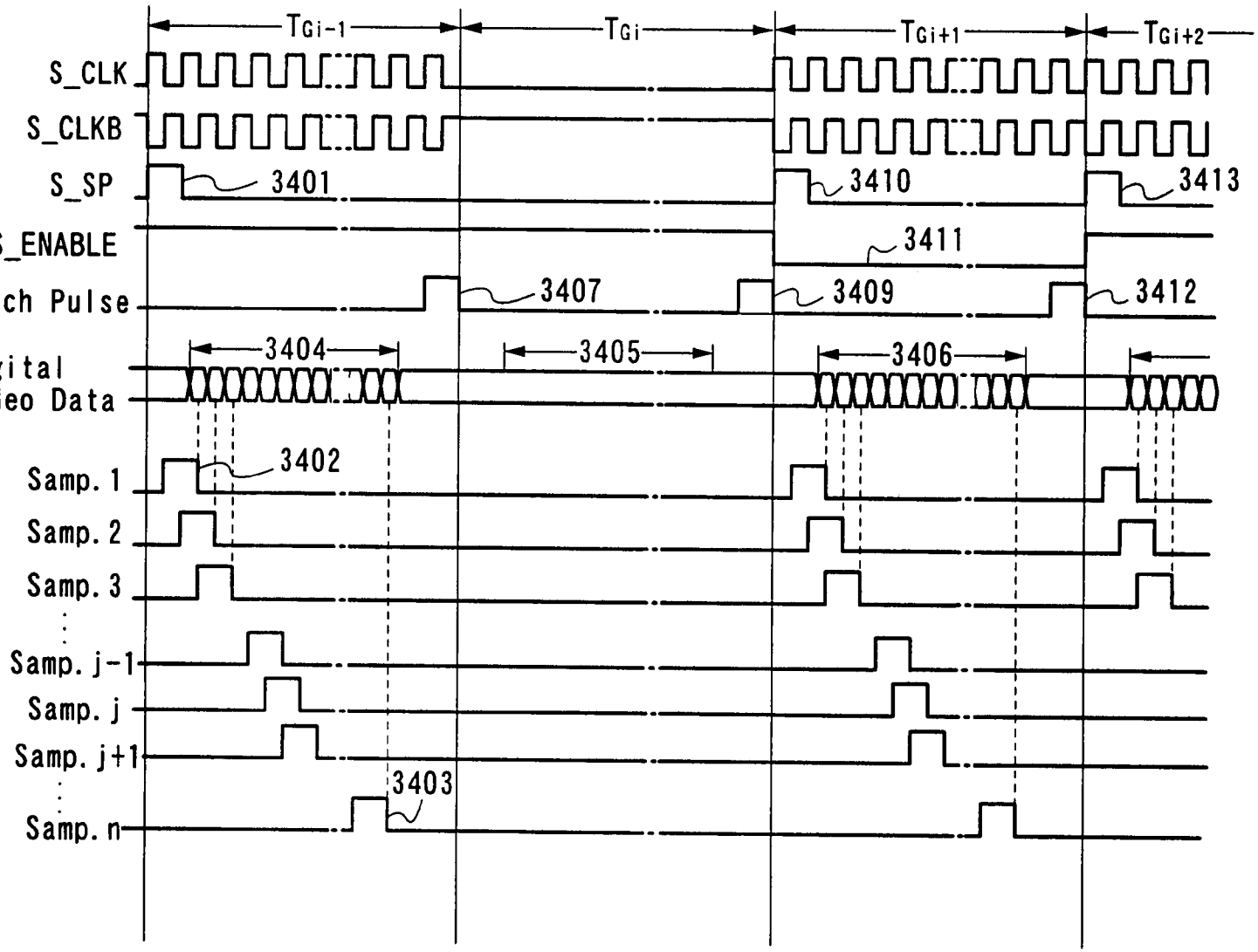
FIG. 88 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In addition, the input of the video signal to the signal line driver circuit may be stopped. In addition, the input of the clock signal (S_CLK), the inverted clock signal (S_CLKB), and the like may be stopped. In other words, the pulse of the start pulse signal (S_SP) is not input during $T_{Gi}$ as shown in FIG. 88. Since the sampling pulse is accordingly not output from the pulse output circuit 811, the data 3405 of the video signal is not held in the first latch circuit 812. Thus, charging and discharging of the first latch circuit 812 with a charge can be omitted. In addition, the video signal (video Data) is not input to the signal line driver circuit. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. Therefore, power consumption can be reduced. In addition, the clock signal (S_CLK) and the inverted clock signal (S_CLKB) may be prevented from being input to the signal line driver circuit during $T_{Gi}$. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential. Thus, power consumption can be reduced. Since other signals are similar to those in FIG. 34, explanation thereof is omitted.

Figure 89:
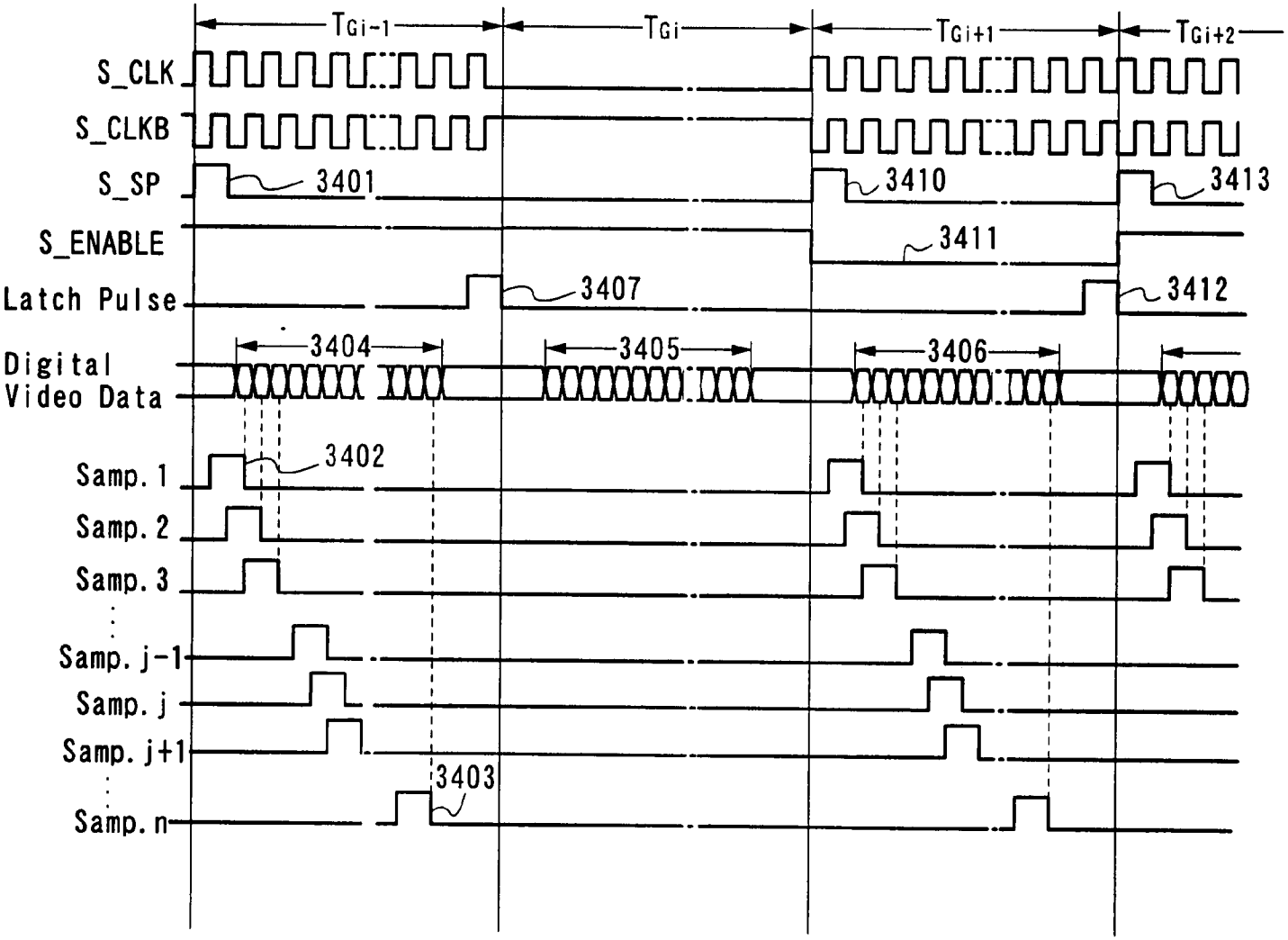
FIG. 89 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In addition, the clock signal (S_CLK) and the inverted clock signal (S_CLKB) may be prevented from being input. In addition, the input of the latch pulse may be stopped. In other words, the pulse of the start pulse signal (S_SP) is not input during $T_{Gi}$ as shown in FIG. 89. Since the sampling pulse is accordingly not output from the pulse output circuit 811, the data 3405 of the video signal is not held in the first latch circuit 812. Thus, charging and discharging of the first latch circuit 812 with a charge can be omitted. Accordingly, power consumption can be reduced. In addition, the clock signal (S_CLK) and the inverted clock signal (S_CLKB) are not input to the signal line driver circuit. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential, so power consumption can be reduced. In addition, the latch pulse (Latch Pulse) may be prevented from being input to the signal line driver circuit during $T_{Gi}$. Since a signal is not transferred from the first latch circuit 812 to the second latch circuit 813 in that case, charging and discharging with a charge can be omitted. Thus, power consumption can be reduced. Since other signals are similar to those in FIG. 34, explanation thereof is omitted.

Figure 90:
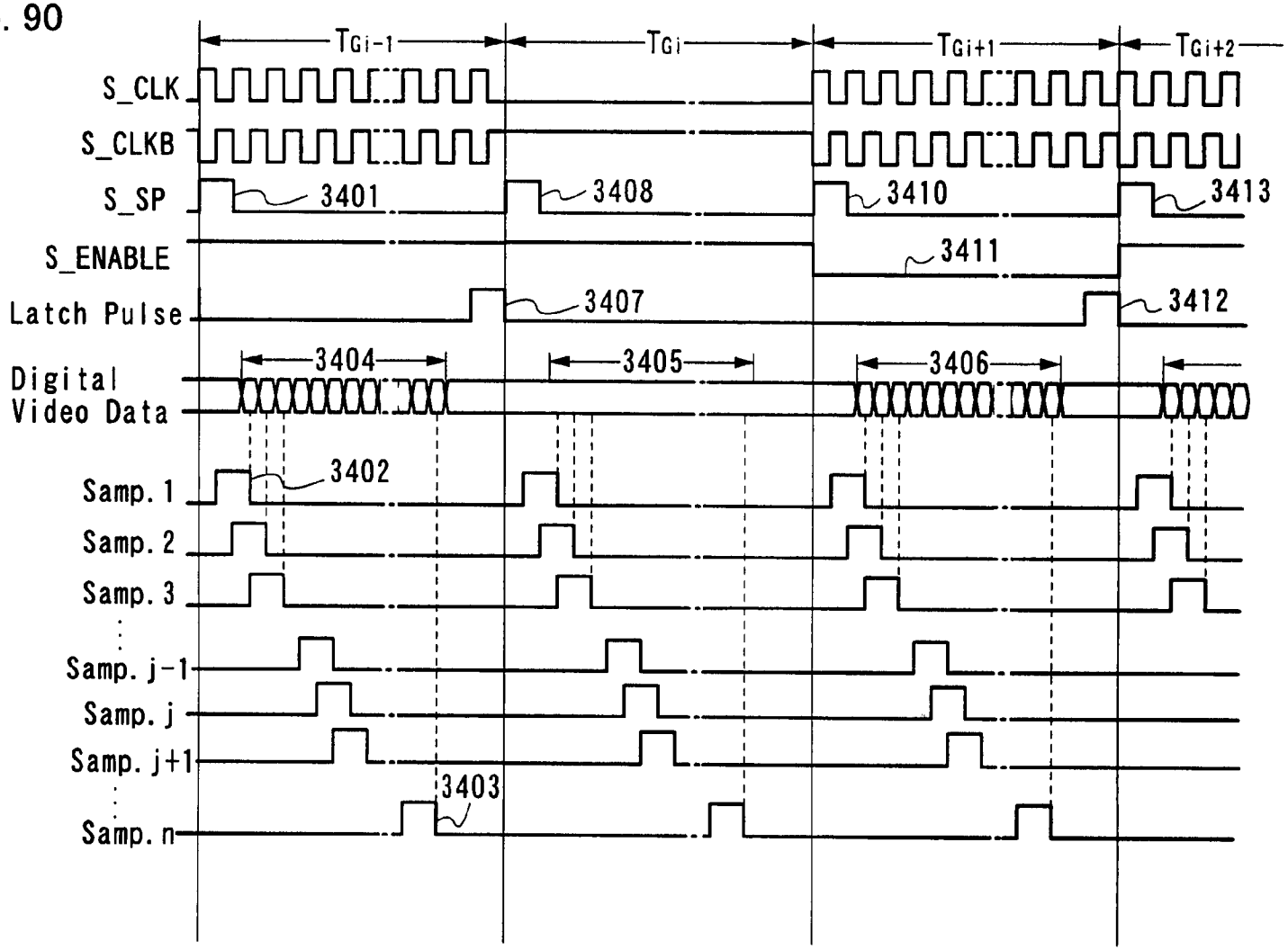
FIG. 90 is a diagram explaining operation of a signal line driver circuit applicable to a display device of the present invention.

In a period for which the video signal for a pixel row in which signal writing is to be stopped is converted from serial into parallel, the input of the video signal to the signal line driver circuit may be stopped. In addition, the input of the clock signal (S_CLK), the inverted clock signal (S_CLKB), and the like may be stopped. In addition, the input of the latch pulse may be stopped. In other words, the video signal (Video Data) may be prevented from being input to the signal line driver circuit during $T_{Gi}$ as shown in FIG. 90. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. Furthermore, the clock signal (S_CLK) and the inverted clock signal (S_CLKB) are not input to the signal line driver circuit during $T_{Gi}$. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential. Thus, power consumption can be reduced. In addition, the latch pulse (Latch Pulse) may be prevented from being input to the signal line driver circuit during $T_{Gi}$. Since a signal is not transferred from the first latch circuit 812 to the second latch circuit 813 in that case, charging and discharging with a charge can be omitted. Thus, power consumption can be reduced. Since other signals are similar to those in FIG. 34, explanation thereof is omitted.

Figure 91:
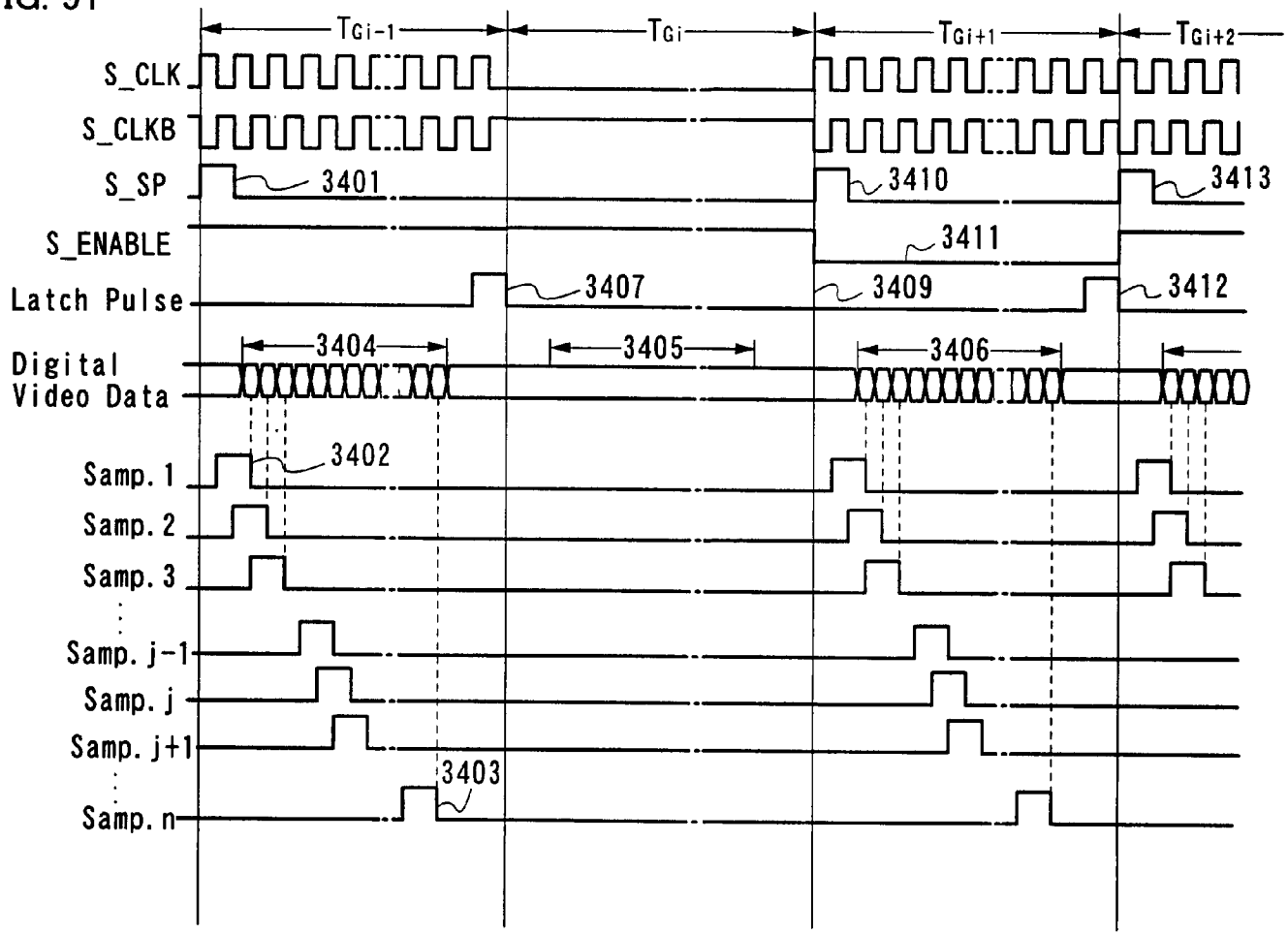
FIG. 91 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In addition, the input of the video signal to the signal line driver circuit may be stopped. In addition, the input of the clock signal (S_CLK), the inverted clock signal (S_CLKB), and the like may be stopped. In addition, the input of the latch pulse may be stopped. In other words, a pulse of the start pulse signal (S_SP) is not input during $T_{Gi}$ as shown in FIG. 91. Since the sampling pulse is accordingly not output from the pulse output circuit 811, the data 3405 of the video signal is not held in the first latch circuit 812. Thus, charging and discharging of the first latch circuit 812 with a charge can be omitted. In addition, the video signal (Video Data) is not input to the signal line driver circuit. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line.

Thus, power consumption can be reduced. In addition, the clock signal (S_CLK) and the inverted clock signal (S_CLKB) may be prevented from being input to the signal line driver circuit during $T_{Gi}$. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential, so power consumption can be reduced. In addition, the latch pulse (Latch Pulse) may be prevented from being input to the signal line driver circuit during $T_{Gi}$. Since a signal is not transferred from the first latch circuit 812 to the second latch circuit 813 in that case, charging and discharging with a charge can be omitted. Thus, power consumption can be reduced. Since other signals are similar to those in FIG. 34, explanation thereof is omitted.

Note that the signal line driver circuit applicable to the display device of the present invention is not limited thereto. In other words, a signal is not written to a pixel row when the pixel row is not selected in the case where data of a video signal for pixels of a single pixel row in which the signal is to be written to a pixel in a certain subframe period in one frame period is identical with data of a signal for the pixel row already written thereto. Thus, a structure may be used in which a signal input to pixels in the preceding row is kept being input to a signal line or such a potential as to reduce power consumption is kept being input to the signal line.

Therefore, the output control circuit 814 is not necessarily provided. However, since power consumption is further reduced by outputting the signal input to pixels in the preceding row, it is desirable that a pulse of the start pulse signal (S_SP) which triggers a start of holding signal data is prevented from being input or the input of the latch pulse is stopped in a period for latching a video signal for a pixel row in which signal writing is to be stopped in the first latch circuit 812.

Figure 92:
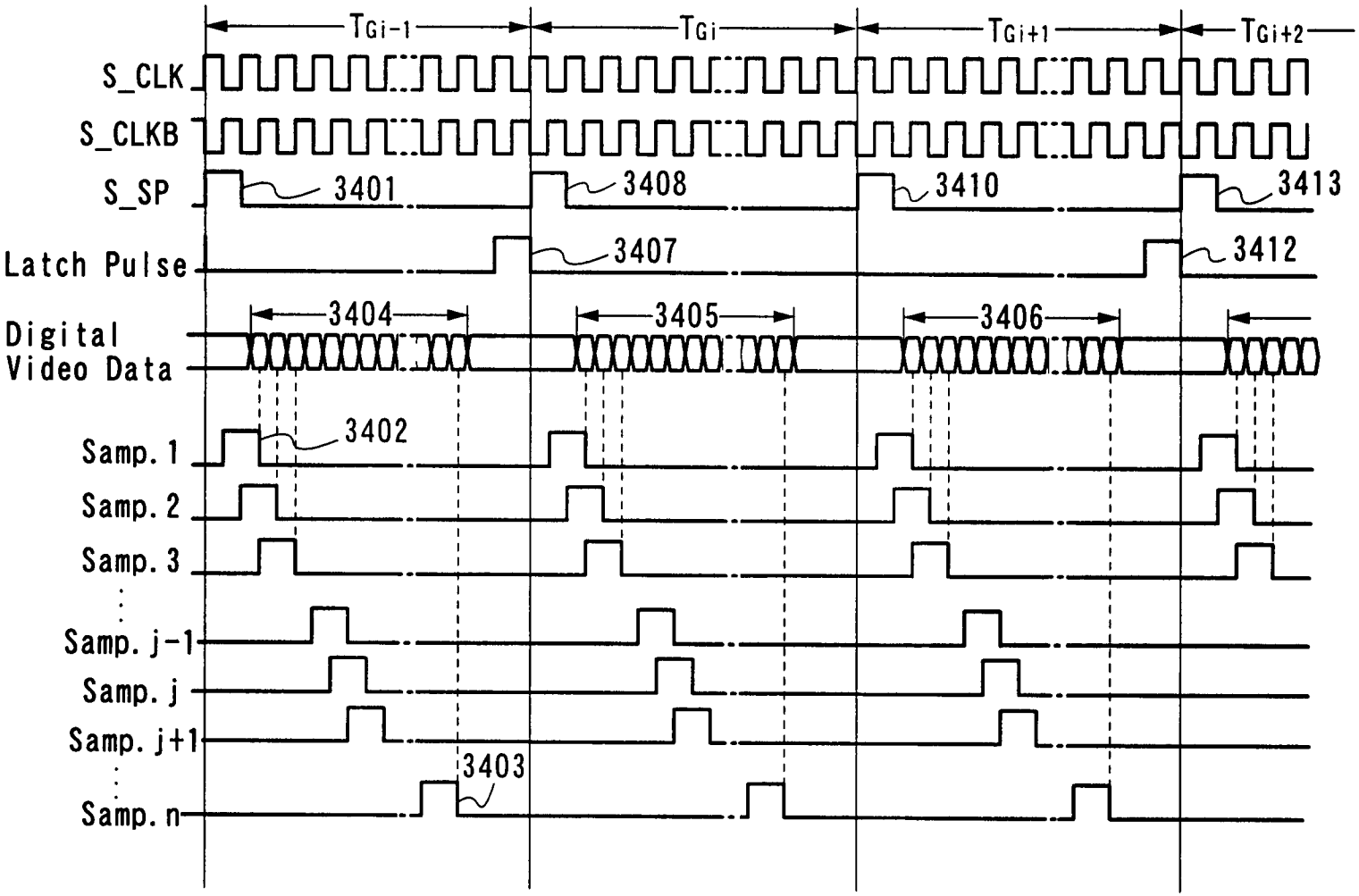
FIG. 92 is a diagram explaining operation of a signal line driver circuit applicable to a display device of the present invention.

In other words, in a period for which the video signal for a pixel row in which signal writing is to be stopped is converted from serial into parallel, the input of the latch pulse is stopped. In other words, the latch pulse (Latch Pulse) may be prevented from being input to the signal line driver circuit during $T_{Gi}$ as shown in FIG. 92. Since a signal is not transferred from the first latch circuit 812 to the second latch circuit 813 in that case, charging and discharging with a charge can be omitted. Thus, power consumption can be reduced. Since the latch pulse is not input during $T_{Gi}$, the data 3405 of the video signal is not transferred from the first latch circuit 812 to the second latch circuit 813. Therefore, the data 3404 of the video signal is kept held in the second latch circuit 813. Then, the signal is output to the signal lines S1 to Sn also during $T_{Gi+1}$. Accordingly, power consumption can be reduced since the charging and discharging of the signal lines S1 to Sn do not need to be performed again. Since other signals are similar to those in FIG. 34, explanation thereof is omitted.

Figure 93:
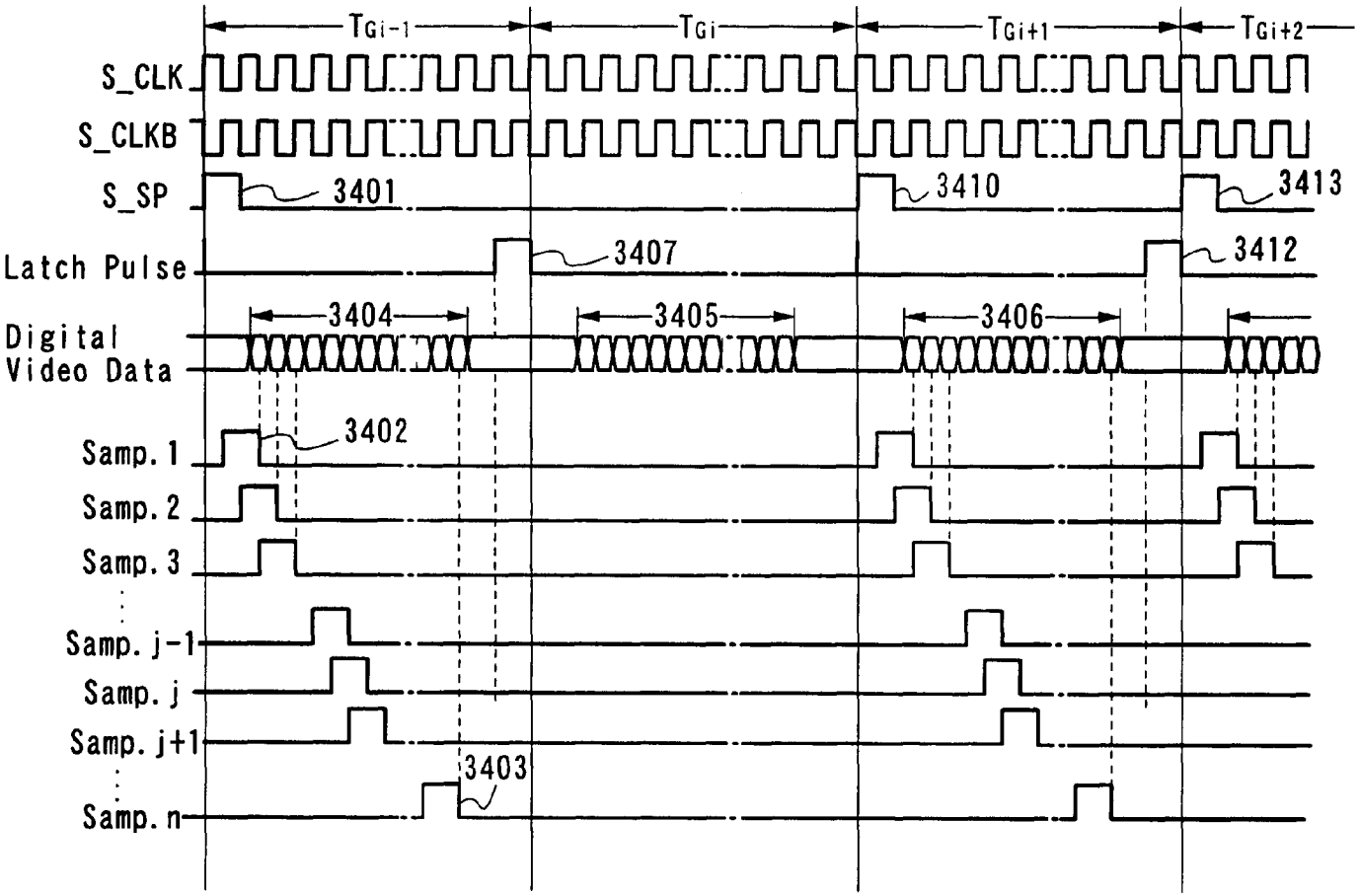
FIG. 93 is a diagram explaining operation of a signal line driver circuit applicable to a display device of the present invention.

In a period for which the video signal for a pixel row in which signal writing is to be stopped is converted from serial into parallel, the input of a latch pulse is stopped. In addition, a pulse of the start pulse signal (S_SP) which triggers a start of holding signal data may be prevented from being input. In other words, the latch pulse (Latch Pulse) may be prevented from being input to the signal line driver circuit during $T_{Gi}$ as shown in FIG. 93. Since a signal is not transferred from the first latch circuit 812 to the second latch circuit 813 in that case, charging and discharging with a charge can be omitted. Thus, power consumption can be reduced. Since the latch pulse is not input during $T_{Gi}$, the data 3405 of the video signal is not transferred from the first latch circuit 812 to the second latch circuit 813. Therefore, the data 3404 of the video signal is kept held in the second latch circuit 813. Then, the signal is output to the signal lines S1 to Sn also during $T_{Gi+1}$. Accordingly, power consumption can be reduced since the charging and discharging of the signal lines S1 to Sn do not need to be performed again. Since a signal is not transferred from the first latch circuit 812 to the second latch circuit 813 during $T_{Gi}$, a pulse of the start pulse signal (S_SP) is not input during $T_{Gi}$. Since the sampling pulse is accordingly not output from the pulse output circuit 811, the data 3405 of the video signal is not held in the first latch circuit 812. Thus, charging and discharging of the first latch circuit 812 with a charge can be omitted. Since other signals are similar to those in FIG. 34, explanation thereof is omitted.

Figure 94:
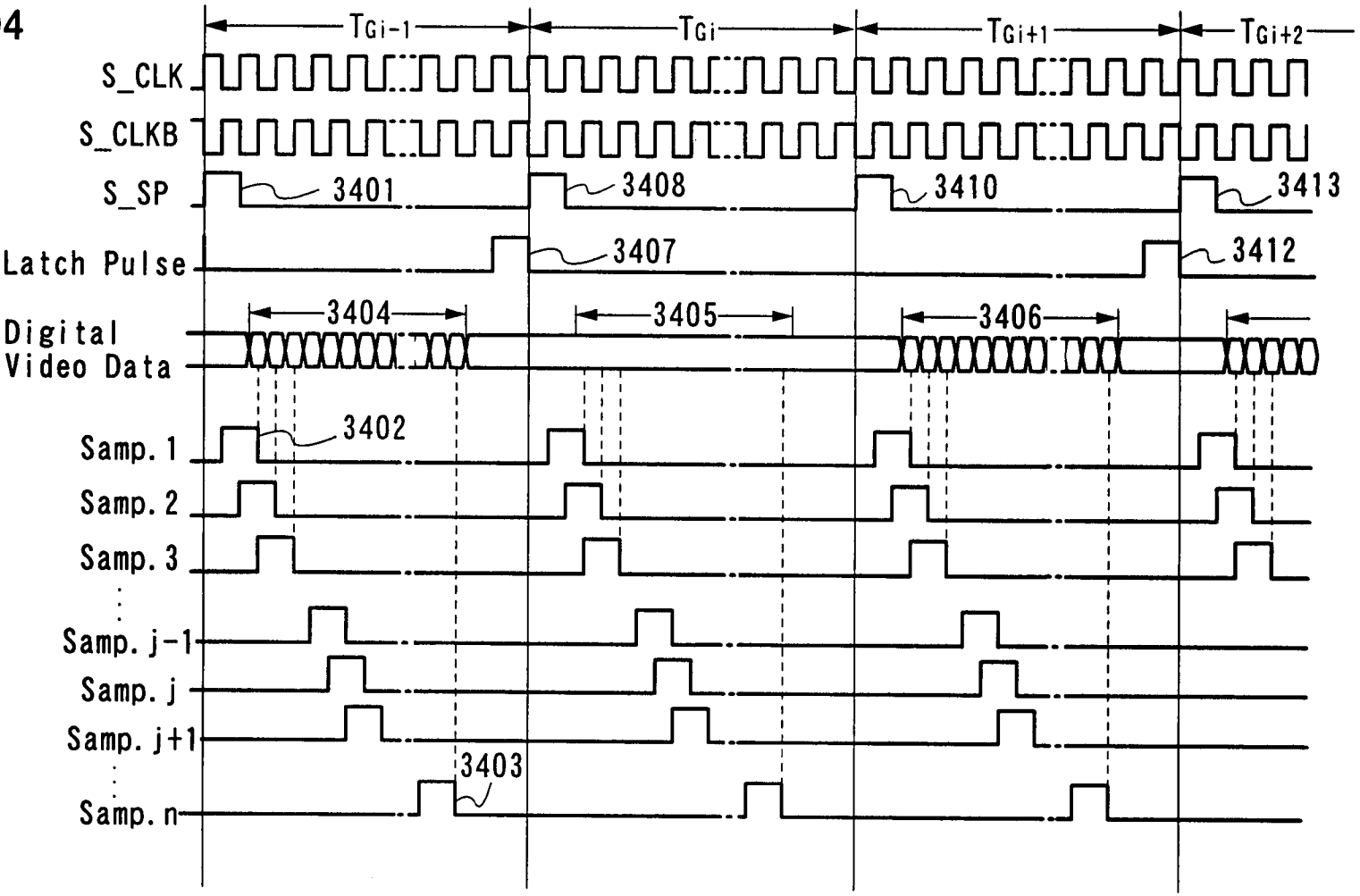
FIG. 94 is a diagram explaining operation of a signal line driver circuit applicable to a display device of the present invention.

In other words, in a period for which the video signal for a pixel row in which signal writing is to be stopped is converted from serial into parallel, the input of a latch pulse is stopped. In addition, the input of the video signal to the signal line driver circuit may be stopped. In other words, the latch pulse (Latch Pulse) is not input to the signal line driver circuit during $T_{Gi}$ as shown in FIG. 94. Since a signal is not transferred from the first latch circuit 812 to the second latch circuit 813 in that case, charging and discharging with a charge can be omitted. Thus, power consumption can be reduced. Since the latch pulse is not input during $T_{Gi}$, the data 3405 of the video signal is not transferred from the first latch circuit 812 to the second latch circuit 813. Therefore, the data 3404 of the video signal is kept held in the second latch circuit 813. Then, the signal is output to the signal lines S1 to Sn also during $T_{Gi+1}$. Accordingly, power consumption can be reduced since the charging and discharging of the signal lines S1 to Sn do not need to be performed again. During $T_{Gi}$, the video signal (Video Data) may be prevented from being input to the signal line driver circuit. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. Since other signals are similar to those in FIG. 34, explanation thereof is omitted.

Figure 95:
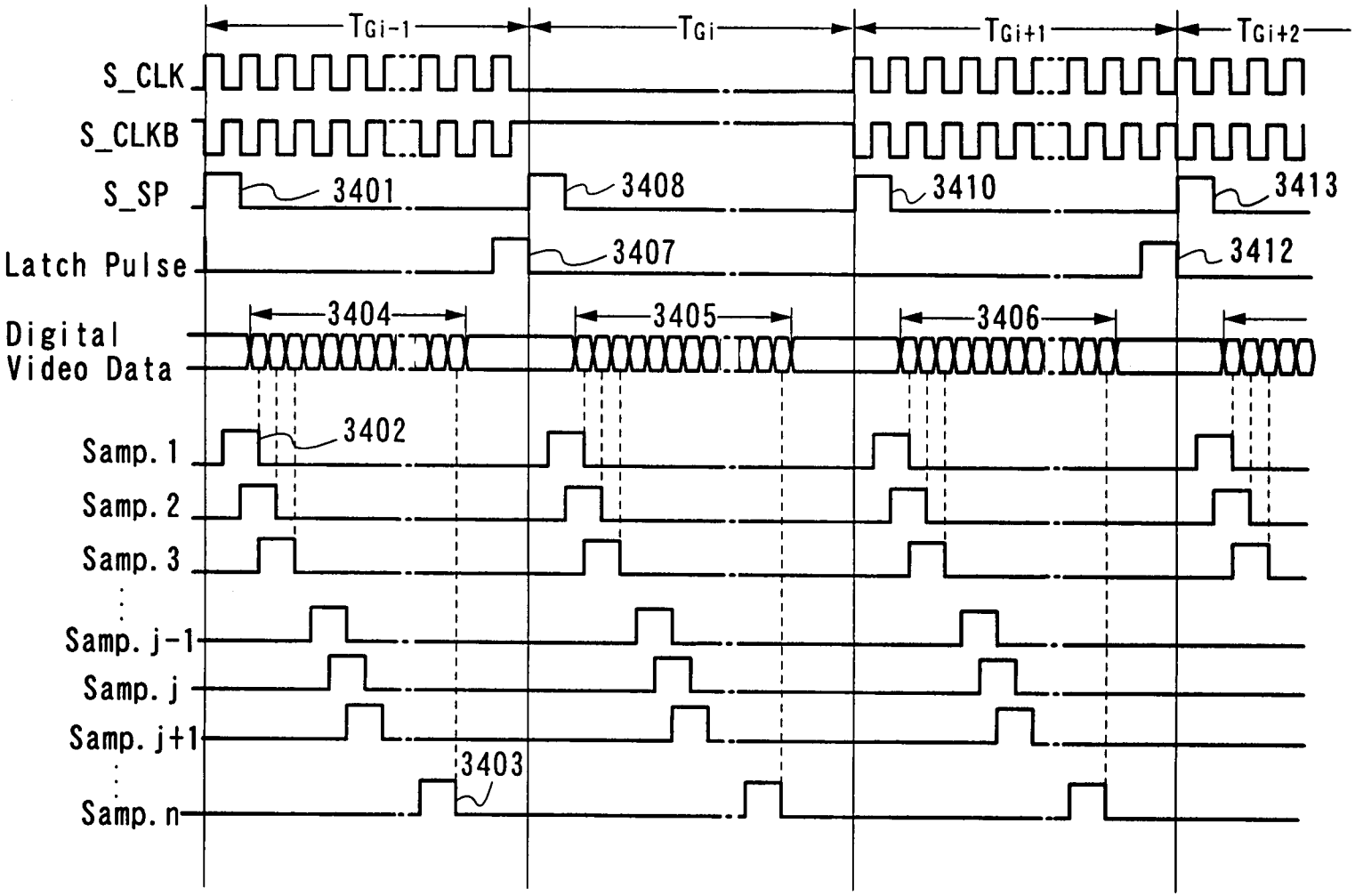
FIG. 95 is a diagram explaining operation of a signal line driver circuit applicable to a display device of the present invention.

In other words, in a period for which the video signal for a pixel row in which signal writing is to be stopped is converted from serial into parallel, the input of a latch pulse is stopped. In addition, the input of the clock signal (S_CLK), the inverted clock signal (S_CLKB), and the like is stopped. In other words, the latch pulse (Latch Pulse) may be prevented from being input to the signal line driver circuit during $T_{Gi}$ as shown in FIG. 95. Since a signal is not transferred from the first latch circuit 812 to the second latch circuit 813 in that case, charging and discharging with a charge can be omitted. Thus, power consumption can be reduced. Since the latch pulse is not input during $T_{Gi}$, the data 3405 of the video signal is not transferred from the first latch circuit 812 to the second latch circuit 813. Therefore, the data 3404 of the video signal is kept held in the second latch circuit 813. Then, the signal is output to the signal lines S1 to Sn also during $T_{Gi+1}$. Accordingly, power consumption can be reduced since the charging and discharging of the signal lines S1 to Sn do not need to be performed again. During $T_{Gi}$, the clock signal (S_CLK) and the inverted clock signal (S_CLKB) may be prevented from being input to the signal line driver circuit. For example, a certain potential that is inverted between the clock signal (S_CLK) and the inverted clock signal (S_CLKB) (one is at an H level and the other is at an L level) may be input. This is because charging and discharging with a charge are not performed in the case of inputting a fixed potential, so power consumption can be reduced. Since other signals are similar to those in FIG. 34, explanation thereof is omitted.

Figure 96:
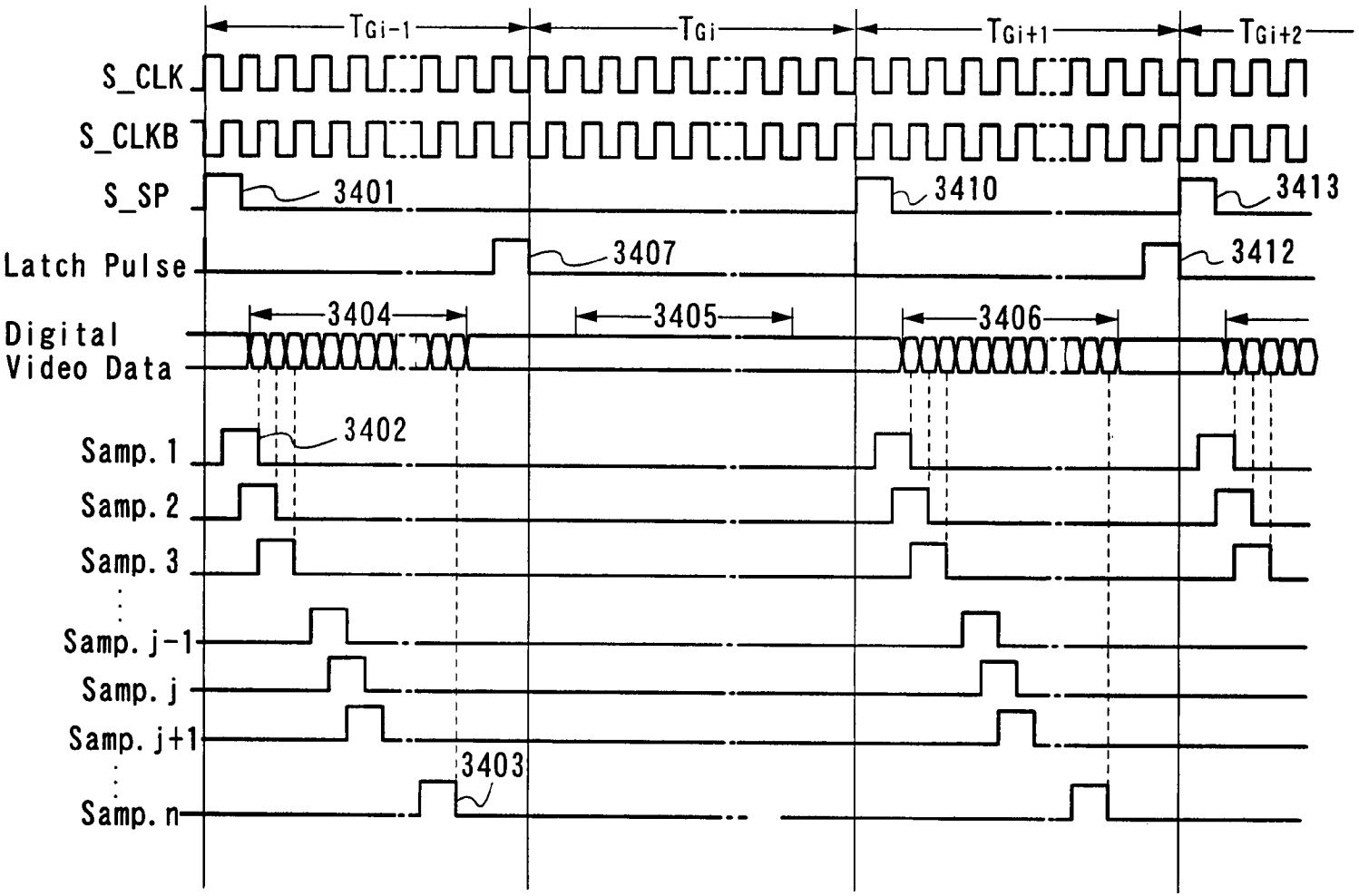
FIG. 96 is a diagram explaining operation of a signal line driver circuit applicable to a display device of the present invention.

In a period for which the video signal for a pixel row in which signal writing is to be stopped is converted from serial into parallel, the input of a latch pulse is stopped. In addition, a pulse of the start pulse signal (S_SP) which triggers a start of holding signal data may be prevented from being input. In addition, the input of the video signal to the signal line driver circuit is stopped. In other words, the latch pulse (Latch Pulse) may be prevented from being input to the signal line driver circuit during $T_{Gi}$ as shown in FIG. 96. Since a signal is not transferred from the first latch circuit 812 to the second latch circuit 813 in that case, charging and discharging with a charge can be omitted. Thus, power consumption can be reduced. Since the latch pulse is not input during $T_{Gi}$, the data 3405 of the video signal is not transferred from the first latch circuit 812 to the second latch circuit 813. Therefore, the data 3404 of the video signal is kept held in the second latch circuit 813. Then, the signal is output to the signal lines S1 to Sn also during $T_{Gi+1}$. Accordingly, power consumption can be reduced since the charging and discharging of the signal lines S1 to Sn do not need to be performed again. Since a signal is not transferred from the first latch circuit 812 to the second latch circuit 813 during $T_{Gi}$, a pulse of the start pulse signal (S_SP) is not input during $T_{Gi}$. Since a sampling pulse is accordingly not output from the pulse output circuit 811, the data 3405 of the video signal is not held in the first latch circuit 812. Thus, charging and discharging of the first latch circuit 812 with a charge can be omitted. During $T_{Gi}$, the video signal (Video Data) may be prevented from being input to the signal line driver circuit. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. Since other signals are similar to those in FIG. 34, explanation thereof is omitted.

Figure 97:
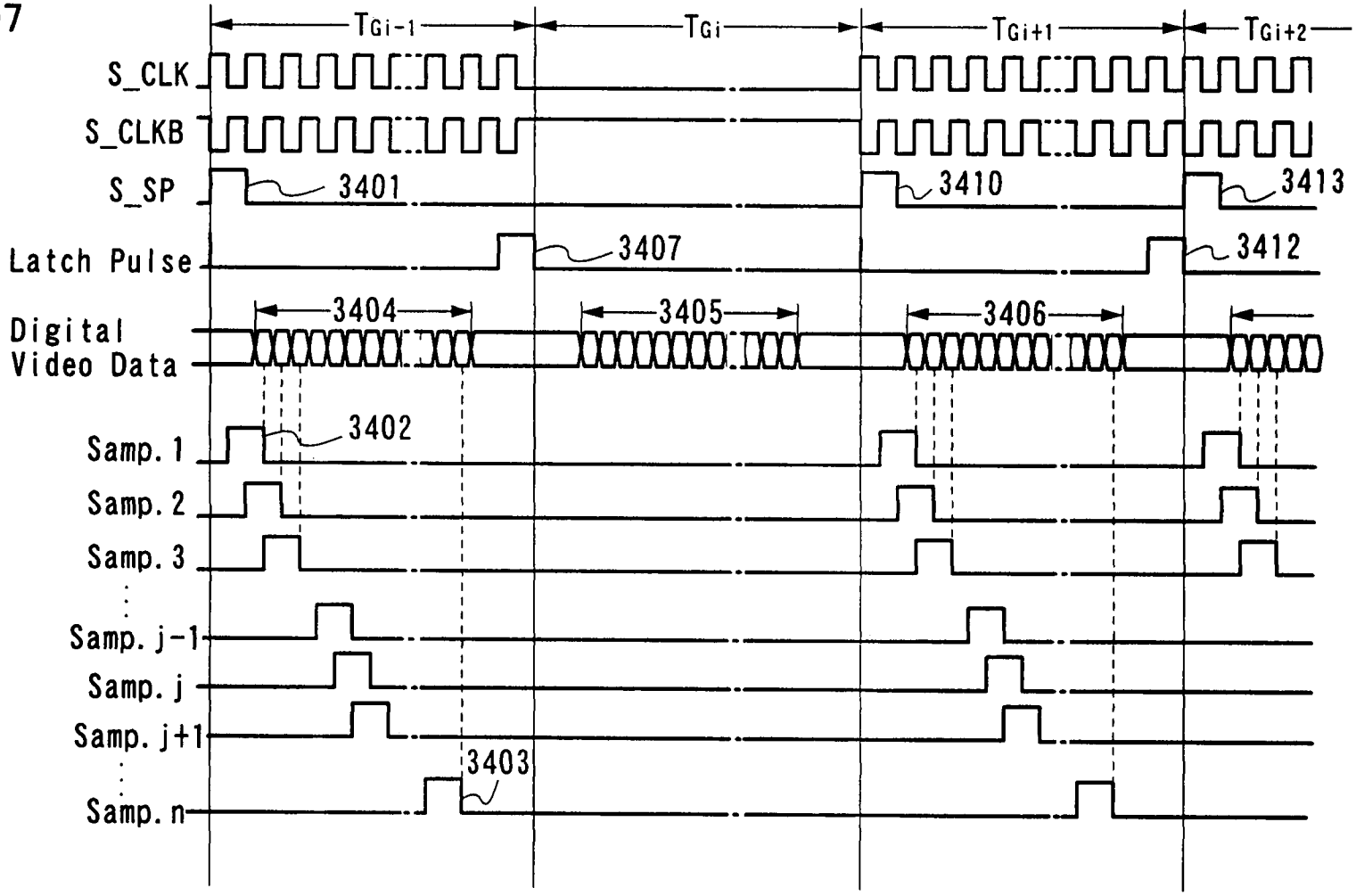
FIG. 97 is a diagram explaining operation of a signal line driver circuit applicable to a display device of the present invention.

In a period for which the video signal for a pixel row in which signal writing is to be stopped is converted from serial into parallel, the input of a latch pulse is stopped. In addition, a pulse of the start pulse signal (S_SP) which triggers a start of holding signal data may be prevented from being input. In addition, the input of the clock signal (S_CLK), the inverted clock signal (S_CLKB), and the like is stopped. In other words, the latch pulse (Latch Pulse) may be prevented from being input to the signal line driver circuit during $T_{Gi}$ as shown in FIG. 97. Since a signal is not transferred from the first latch circuit 812 to the second latch circuit 813 in that case, charging and discharging with a charge can be omitted. Thus, power consumption can be reduced. Since the latch pulse is not input during $T_{Gi}$, the data 3405 of the video signal is not transferred from the first latch circuit 812 to the second latch circuit 813. Therefore, the data 3404 of the video signal is kept held in the second latch circuit 813. Then, the signal is output to the signal lines S1 to Sn also during $T_{Gi+1}$. Accordingly, power consumption can be reduced since the charging and discharging of the signal lines S1 to Sn do not need to be performed again. Since a signal is not transferred from the first latch circuit 812 to the second latch circuit 813 during $T_{Gi}$, a pulse of the start pulse signal (S_SP) is not input during $T_{Gi}$. Since a sampling pulse is accordingly not output from the pulse output circuit 811, the data 3405 of the video signal is not held in the first latch circuit 812. Thus, charging and discharging of the first latch circuit 812 with a charge can be omitted. During $T_{Gi}$, the clock signal (S_CLK) and the inverted clock signal (S_CLKB) may be prevented from being input to the signal line driver circuit. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential. Thus, power consumption can be reduced. Since other signals are similar to those in FIG. 34, explanation thereof is omitted.

Figure 98:
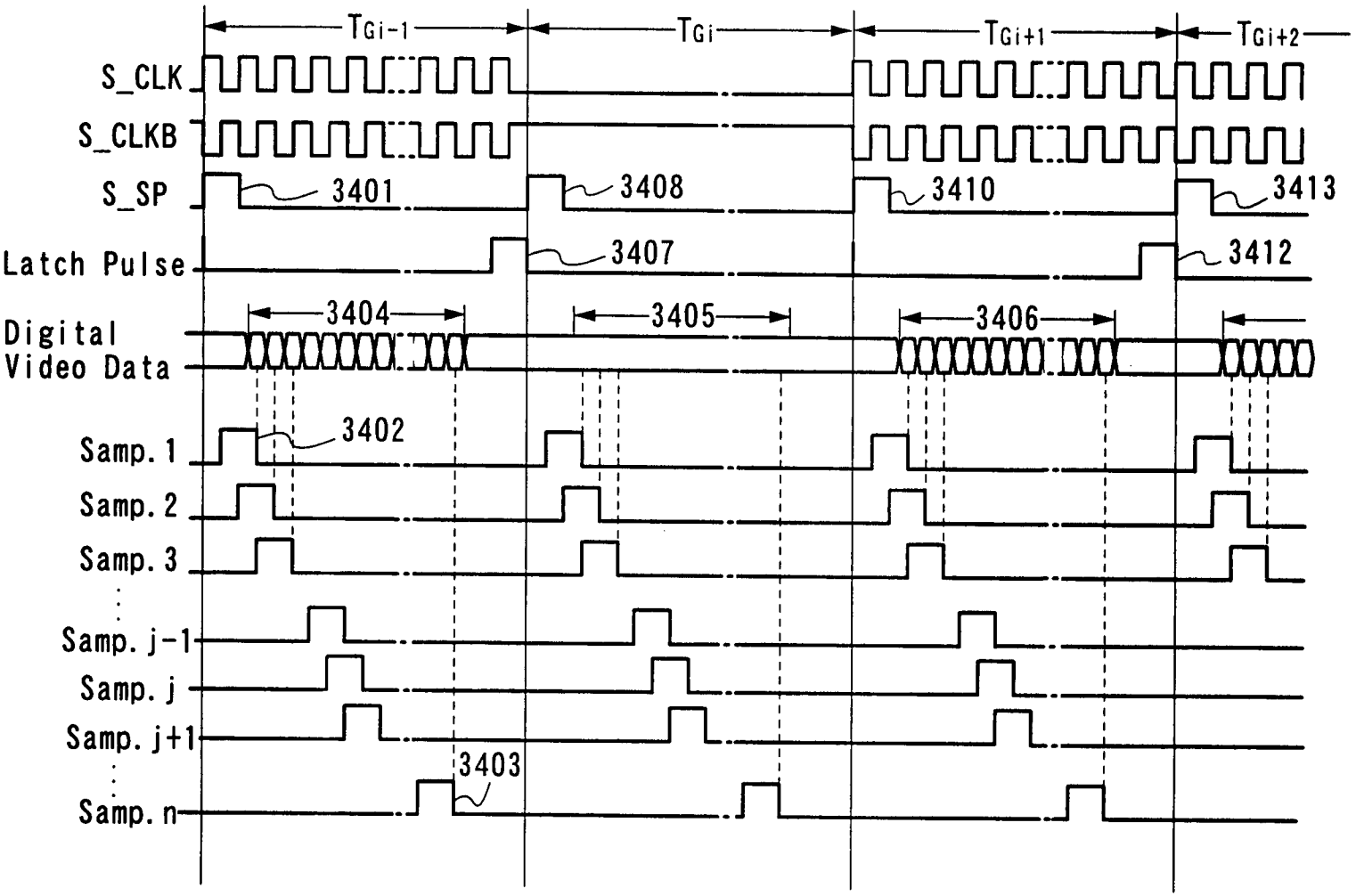
FIG. 98 is a diagram explaining operation of a signal line driver circuit applicable to a display device of the present invention.

In other words, in a period for which the video signal for a pixel row in which signal writing is to be stopped is converted from serial into parallel, the input of a latch pulse is stopped. In addition, the input of the video signal to the signal line driver circuit may be stopped. In addition, the input of the clock signal (S_CLK), the inverted clock signal (S_CLKB), and the like is stopped. In other words, the latch pulse (Latch Pulse) is not input to the signal line driver circuit during $T_{Gi}$ as shown in FIG. 98. Since a signal is not transferred from the first latch circuit 812 to the second latch circuit 813 in that case, charging and discharging with a charge can be omitted. Thus, power consumption can be reduced. Since the latch pulse is not input during $T_{Gi}$, the data 3405 of the video signal is not transferred from the first latch circuit 812 to the second latch circuit 813. Therefore, the data 3404 of the video signal is kept held in the second latch circuit 813. Then, the signal is output to the signal lines S1 to Sn also during $T_{Gi+1}$. Accordingly, power consumption can be reduced since the charging and discharging of the signal lines S1 to Sn do not need to be performed again. During $T_{Gi}$, the video signal (Video Data) may be prevented from being input to the signal line driver circuit. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. During $T_{Gi}$, the clock signal (S_CLK) and the inverted clock signal (S_CLKB) may be prevented from being input to the signal line driver circuit. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential, so power consumption is reduced. Since other signals are similar to those in FIG. 34, explanation thereof is omitted.

Figure 99:
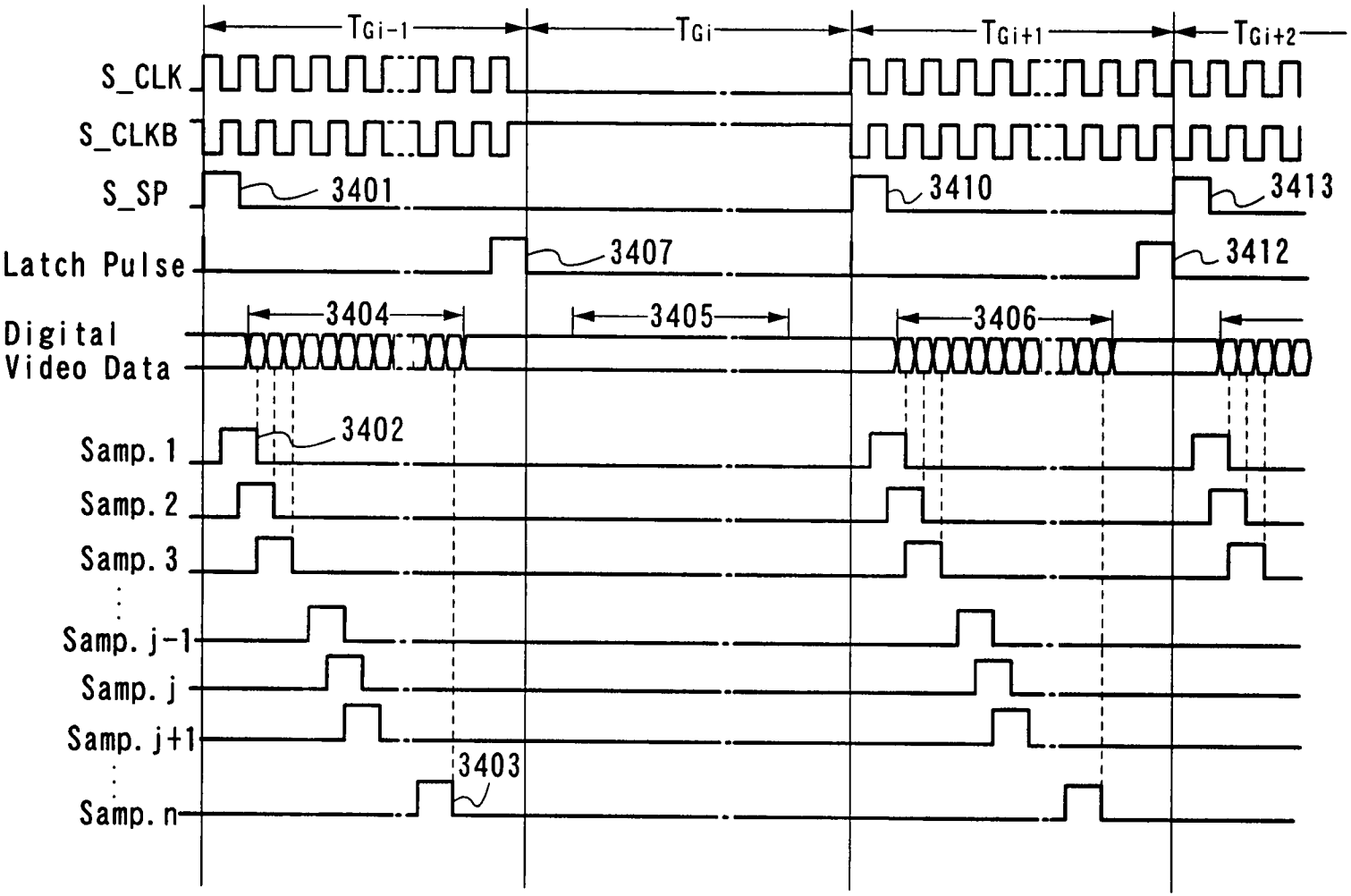
FIG. 99 is a diagram explaining operation of a signal line driver circuit applicable to a display device of the present invention.

In a period for which the video signal for a pixel row in which signal writing is to be stopped is converted from serial into parallel, the input of a latch pulse is stopped. In addition, a pulse of the start pulse signal (S_SP) which triggers a start of holding signal data may be prevented from being input. In addition, the input of the video signal to the signal line driver circuit is stopped. In addition, the input of the clock signal (S_CLK), the inverted clock signal (S_CLKB), and the like is stopped. In other words, a latch pulse (Latch Pulse) may be prevented from being input to the signal line driver circuit during $T_{Gi}$ as shown in FIG. 99. Since a signal is not transferred from the first latch circuit 812 to the second latch circuit 813 in that case, charging and discharging with a charge can be omitted. Thus, power consumption can be reduced. Since the latch pulse is not input during $T_{Gi}$, the data 3405 of the video signal is not transferred from the first latch circuit 812 to the second latch circuit 813. Therefore, the data 3404 of the video signal is kept held in the second latch circuit 813. Then, the signal is output to the signal lines S1 to Sn also during $T_{Gi+1}$. Accordingly, power consumption can be reduced since the charging and discharging of the signal lines S1 to Sn do not need to be performed again. Since a signal is not transferred from the first latch circuit 812 to the second latch circuit 813 during $T_{Gi}$, a pulse of the start pulse signal (S_SP) is not input during $T_{Gi}$. Since a sampling pulse is accordingly not output from the pulse output circuit 811, the data 3405 of the video signal is not held in the first latch circuit 812. Thus, charging and discharging of the first latch circuit 812 with a charge can be omitted. During $T_{Gi}$, the video signal (video Data) may be prevented from being input to the signal line driver circuit. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. During $T_{Gi}$, the clock signal (S_CLK) and the inverted clock signal (S_CLKB) may be prevented from being input to the signal line driver circuit. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential. Thus, power consumption can be reduced. Since other signals are similar to those in FIG. 34, explanation thereof is omitted.

Figure 100:
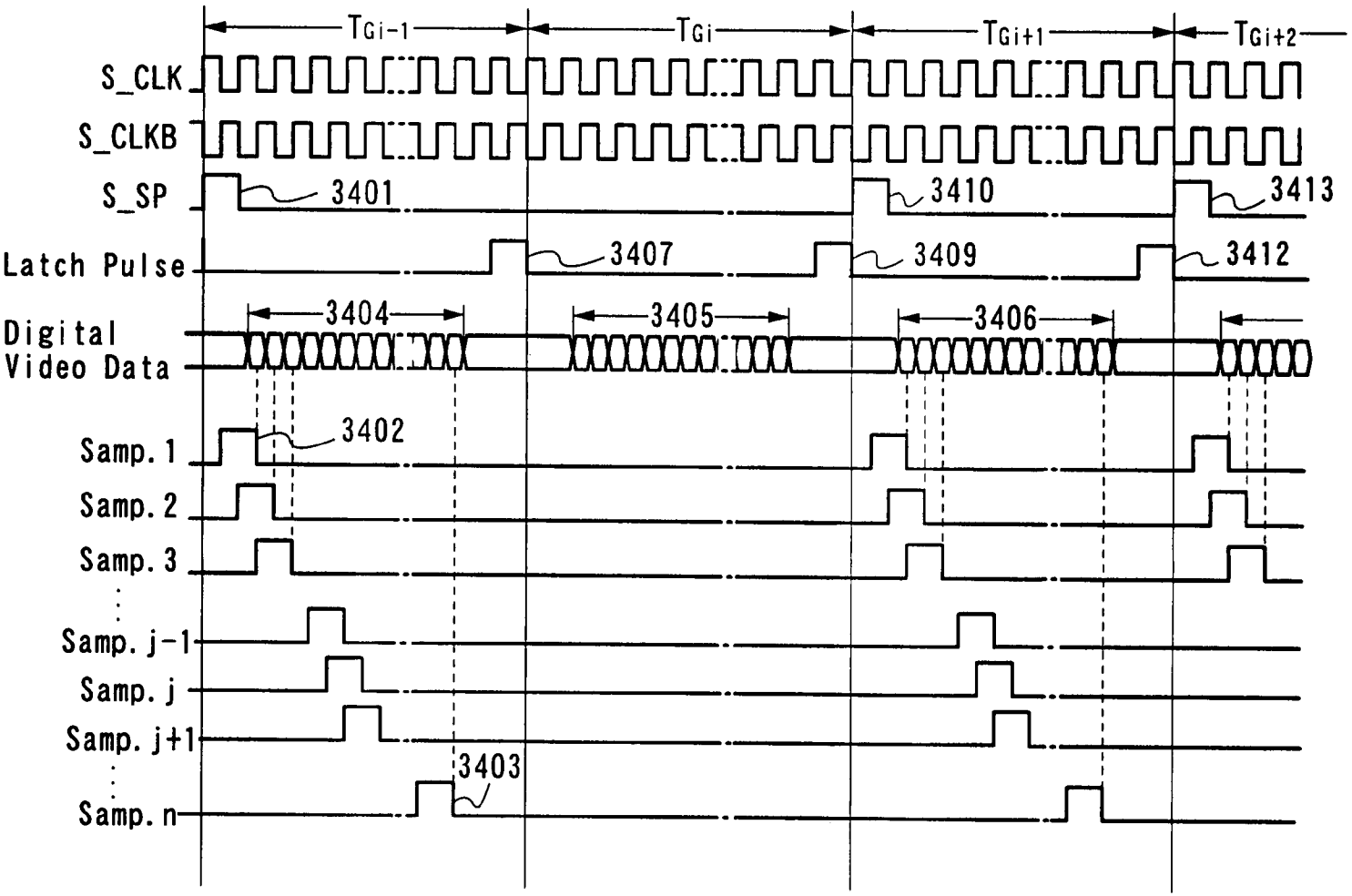
FIG. 100 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In other words, a pulse of the start pulse signal (S_SP) is not input during $T_{Gi}$ as shown in FIG. 100. Since a sampling pulse is accordingly not output from the pulse output circuit 811, the data 3405 of the video signal is not held in the first latch circuit 812. Thus, charging and discharging of the first latch circuit 812 with a charge can be omitted. Since the data of a signal transferred to the second latch circuit 813 is identical with data originally held in the second latch circuit 813, charging and discharging of the second latch circuit 813 are hardly performed when the latch pulse 3409 is input. Further, since data of a signal output to the signal lines S1 to Sn during $T_{Gi+1}$ is the data 3404 of the video signal output to the signal lines S1 to Sn during $T_{Gi}$, charging and discharging of the signal lines S to Sn with a charge are hardly performed. Thus, power consumption can be reduced. Since other signals are similar to those in FIG. 34, explanation thereof is omitted.

Figure 101:
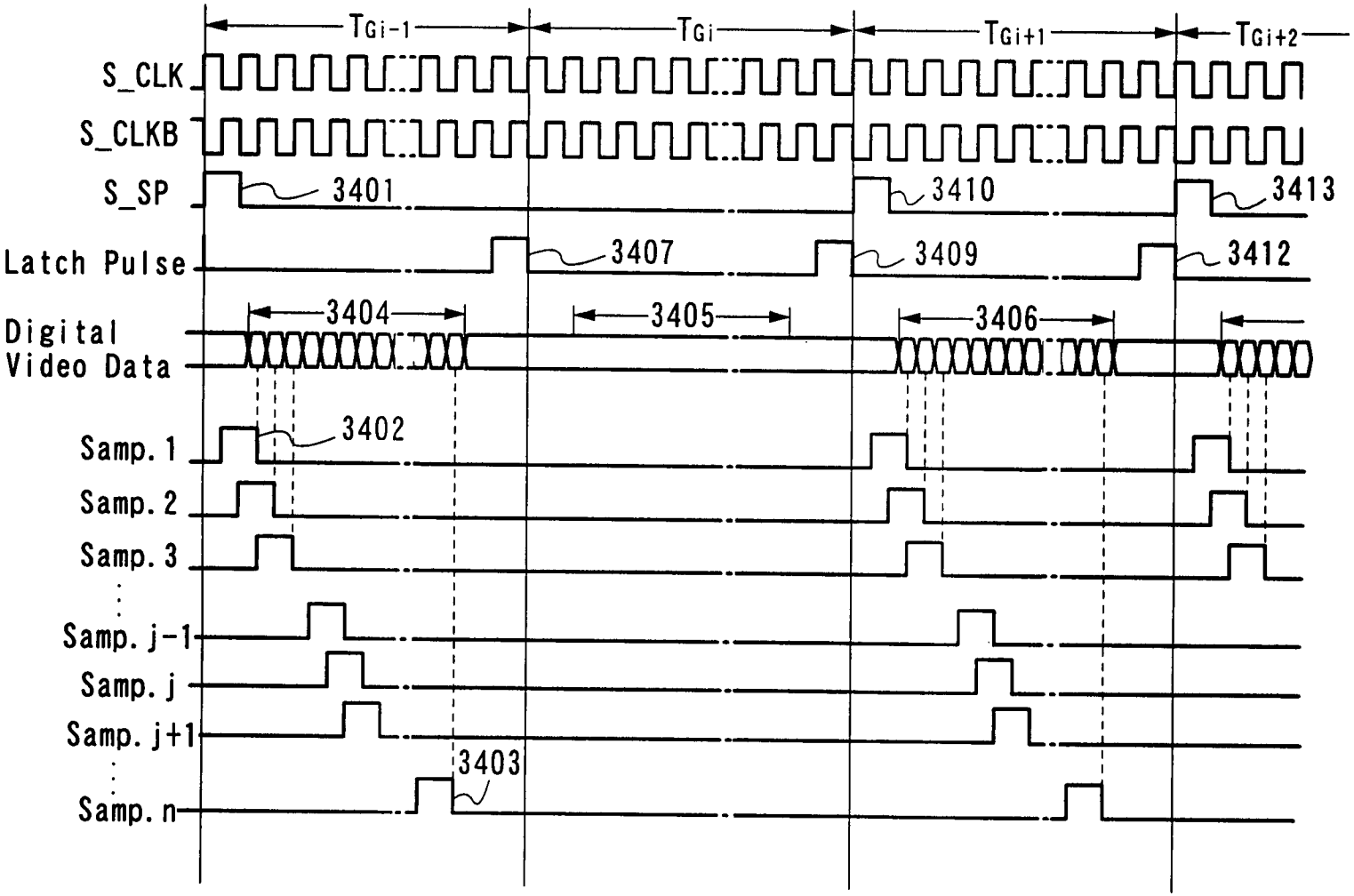
FIG. 101 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In addition, the input of the video signal to the signal line driver circuit is stopped. In other words, a pulse of the start pulse signal (S_SP) is not input during $T_{Gi}$ as shown in FIG. 101. Since a sampling pulse is accordingly not output from the pulse output circuit 811, the data 3405 of the video signal is not held in the first latch circuit 812. Thus, charging and discharging of the first latch circuit 812 with a charge can be omitted. Since the data of a signal transferred to the second latch circuit 813 is identical with data originally held in the second latch circuit 813, charging and discharging of the second latch circuit 813 are hardly performed when the latch pulse 3409 is input. Further, since data of a signal output to the signal lines S1 to Sn during $T_{Gi+1}$ is the data 3404 of the video signal output to the signal lines S to Sn, charging and discharging of the signal lines S to Sn with a charge are hardly performed. Thus, power consumption can be reduced. During $T_{Gi}$, the video signal (Video Data) may be prevented from being input to the signal line driver circuit. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. Since other signals are similar to those in FIG. 34, explanation thereof is omitted.

Figure 102:
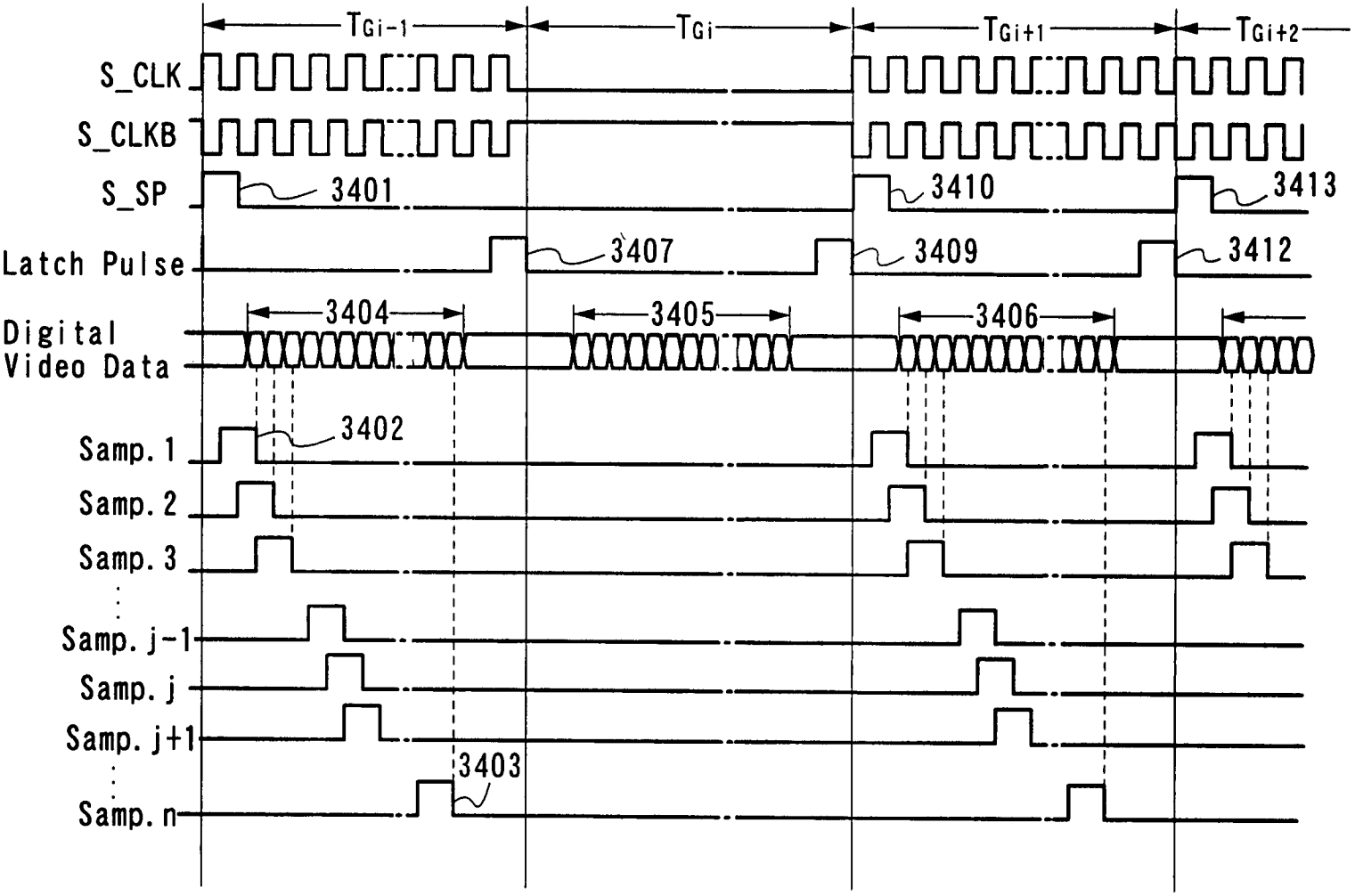
FIG. 102 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In addition, the input of the clock signal (S_CLK), the inverted clock signal (S_CLKB), and the like is stopped. In other words, a pulse of the start pulse signal (S_SP) is not input during $T_{Gi}$ as shown in FIG. 102. Since a sampling pulse is accordingly not output from the pulse output circuit 811, the data 3405 of the video signal is not held in the first latch circuit 812. Thus, charging and discharging of the first latch circuit 812 with a charge can be omitted. Since the data of a signal transferred to the second latch circuit 813 is identical with data originally held in the second latch circuit 813, charging and discharging of the second latch circuit 813 are hardly performed when the latch pulse 3409 is input. Further, since data of a signal output to the signal lines S1 to Sn during $T_{Gi+1}$ is the data 3404 of the video signal output to the signal lines S1 to Sn, charging and discharging of the signal lines S1 to Sn are hardly performed. Thus, power consumption can be reduced. During $T_{Gi}$, the clock signal (S_CLK) and the inverted clock signal (S_CLKB) may be prevented from being input to the signal line driver circuit. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential. Thus, power consumption can be reduced. Since other signals are similar to those in FIG. 34, explanation thereof is omitted.

Figure 103:
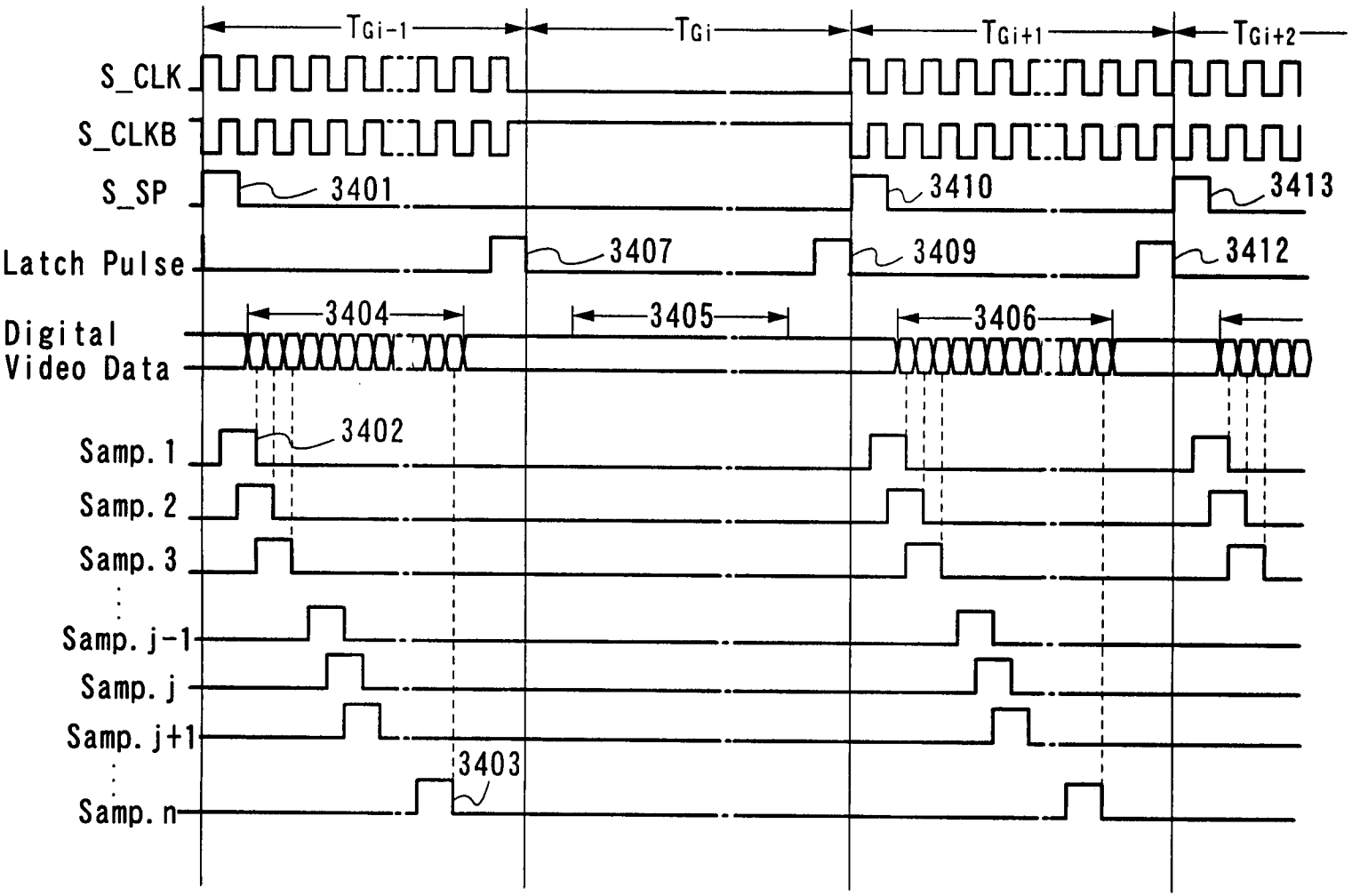
FIG. 103 is a diagram explaining operation of a signal line driver circuit applicable to a display device of the present invention.

In a period for which the video signal for a pixel row in which signal writing is to be stopped is converted from serial into parallel, a pulse of the start pulse signal (S_SP) which triggers a start of holding signal data may be prevented from being input. In addition, the input of the video signal to the signal line driver circuit is stopped. In addition, the input of the clock signal (S_CLK), the inverted clock signal (S_CLKB), and the like is stopped. In other words, a pulse of the start pulse signal (S_SP) is not input during $T_{Gi}$ as shown in FIG. 103. Since a sampling pulse is accordingly not output from the pulse output circuit 811, the data 3405 of the video signal is not held in the first latch circuit 812. Thus, charging and discharging of the first latch circuit 812 with a charge can be omitted. Since the data of a signal transferred to the second latch circuit 813 is identical with data originally held in the second latch circuit 813, charging and discharging of the second latch circuit 813 are hardly performed when the latch pulse 3409 is input. Further, since data of a signal output to the signal lines S1 to Sn during $T_{Gi+1}$ is the data 3404 of the video signal output to the signal lines S1 to Sn, charging and discharging of the signal lines S1 to Sn with a charge are hardly performed. Thus, power consumption can be reduced. During $T_{Gi}$, the video signal (Video Data) may be prevented from being input to the signal line driver circuit. This is because the video signal held during $T_{Gi}$ is not output to the signal lines S1 to Sn, so the video signal does not need to be input originally. Since charging and discharging of a video line with a charge can be omitted by stopping the input of the video signal, power consumption can be reduced. During $T_{Gi}$, such a potential as to reduce power consumption may be input to the video line. During $T_{Gi}$, the clock signal (S_CLK) and the inverted clock signal (S_CLKB) may be prevented from being input to the signal line driver circuit. For example, a fixed potential that is inverted between the clock signal (S_CLK) and the inverted clock signal (S_CLKB) (one is at an H level and the other is at an L level) may be input. This is because charging and discharging with a charge are not performed in the case of inputting a fixed potential. Thus, power consumption can be reduced. Since other signals are similar to those in FIG. 34, explanation thereof is omitted.

Embodiment Mode 3

Figure 4:
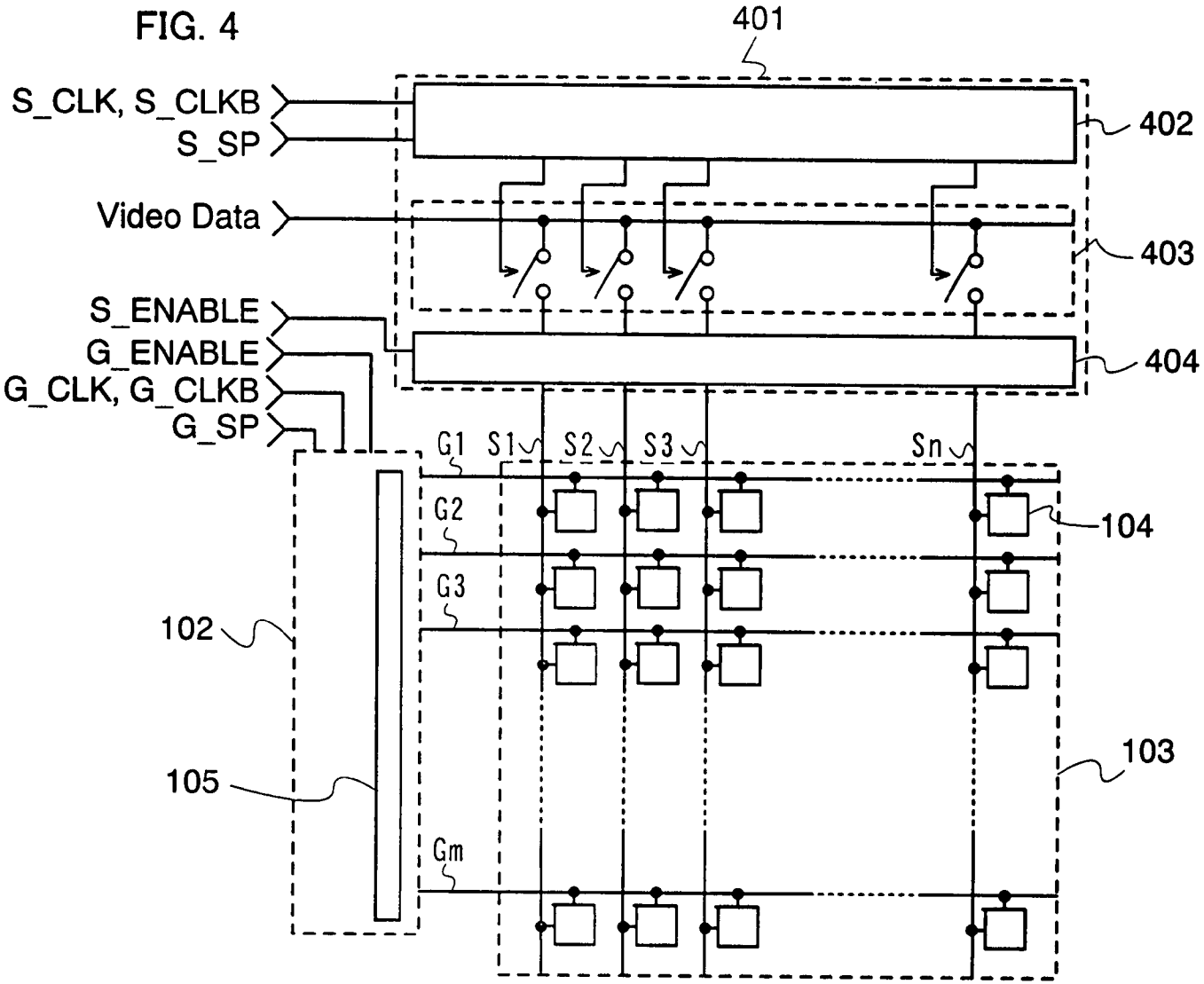
FIG. 4 is a diagram explaining a display device of the present invention.

Subsequently, FIG. 4 shows a schematic diagram of a dot sequential display device. A signal line driver circuit 401 corresponds to the signal line driver circuit 101 of the display device in FIG. 1. Other common components are denoted by reference numerals in common with those in FIG. 1, and explanation thereof is omitted.

The signal line driver circuit 401 includes a pulse output circuit 402, a switch group 403, and an output control circuit 404.

A clock signal (S_CLK), an inverted clock signal (S_CLKB), a start pulse signal (S_SP), and the like are input to the pulse output circuit 402. Then, a sampling pulse is output in accordance with the timing of these signals.

A sampling pulse output from the pulse output circuit 402 is input to the switch group 403. A video signal (Video Data) is input to respective one of terminals of switches in the switch group 403, and the respective other terminal is connected to respective one of signal lines S1 to Sn through the output control circuit 404. In the switch group 403, switches of respective stages are sequentially turned on in accordance with the timing at which the sampling pulse is input.

An output control signal (S_ENABLE) is input to the output control circuit 404. Then, it is determined according to the level of the output control signal whether or not the output control circuit 404 outputs the video signal. In the case where the video signal is not output to the signal lines S1 to Sn from the output control circuit 404, the signal lines S1 to Sn may be put in a floating state, a predetermined potential may be output to the signal lines S1 to Sn, or the same signal as that input to pixels in the preceding row may be input. In other words, such a potential as to reduce power consumption may be set. In order to reduce power consumption, charging and discharging of the signal lines with a charge are preferably not performed. Since charging and discharging with the charge are performed when a potential is changed, a potential is preferably not changed.

Note that the output control signal is a signal at an L level for not outputting a video signal when data of a video signal for a single pixel row in which the signal is to be written to a pixel in a subframe period in one frame period is identical with data of a video signal for the pixel row already written thereto, and the output control signal is a signal at an H level for outputting the video signal when any one part of the data for the pixel row is different.

Alternatively, a structure may be employed in which the output control circuit 404 is not provided. In that case, a start pulse signal (S_SP) input to output a signal which sequentially selects sampling switches is prevented from being input to the switch group 403 in the case where data of a video signal for a single pixel row in which the signal is to be written to a pixel in a certain subframe period in one frame period is identical with data of a video signal for the pixel row already written thereto. Then, the sampling pulse is not output from the pulse output circuit 402. Therefore, the switch group 403 is not turned on and is in an off state in all stages. Thus, the signal lines S1 to Sn can be put in a floating state. In this manner, charging and discharging necessary for turning on the switch of each stage in the switch group 403 can be omitted, so that power consumption can be reduced. In addition, at this time, it is preferable to prevent data of the video signal for the pixel row from being input to the switch group 403 because power consumption can be reduced.

Figure 9A:
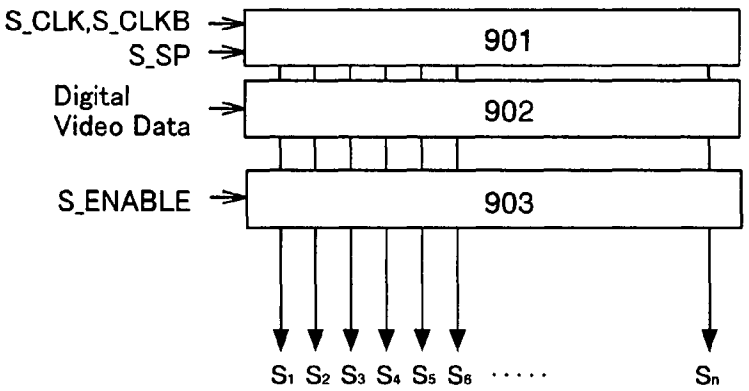
FIGS. 9A and 9B are diagrams explaining a signal line driver circuit applicable to a display device of the present invention.

Here, FIG. 9A shows an example of a signal line driver circuit applicable to the signal line driver circuit 401 of the dot sequential display device in this embodiment mode.

The signal line driver circuit shown in FIG. 9A includes a pulse output circuit 901, a switch group 902, and an output control circuit 903. A clock signal (S_CLK), an inverted clock signal (S_CLKB), and a start pulse signal (S_SP) are input to the pulse output circuit 901. A sampling pulse is sequentially output in accordance with these signals.

The sampling pulse output from the pulse output circuit 901 is input to the switch group 902, and a video signal (Video Data) is input to the output control circuit 903 in accordance with the timing of the signal.

Furthermore, an output control signal (S_ENABLE) is input to the output control circuit 903, and this signal controls whether or not the video signal is output to signal lines S1 to Sn.

Note that when the output control circuit 903 does not output the video signal, the signal lines S1 to Sn may be put in a floating state or a fixed potential may be set. As the fixed potential, such a potential as to reduce power consumption may be set.

Note that the output control signal (S_ENABLE) is at an L level when data of a video signal for a single pixel row in which the signal is to be written to a pixel in a certain subframe period in one frame period is identical with data of a video signal for the pixel row in the last subframe period, and the output control signal is at an H level when any one part of data for a single row is different.

In other words, the video signal is not output from the output control circuit 903 when the output control signal (S_ENABLE) is at an L level, and the video signal is output from the output control circuit 903 when the output control signal (S_ENABLE) is at an H level.

Figure 9B:
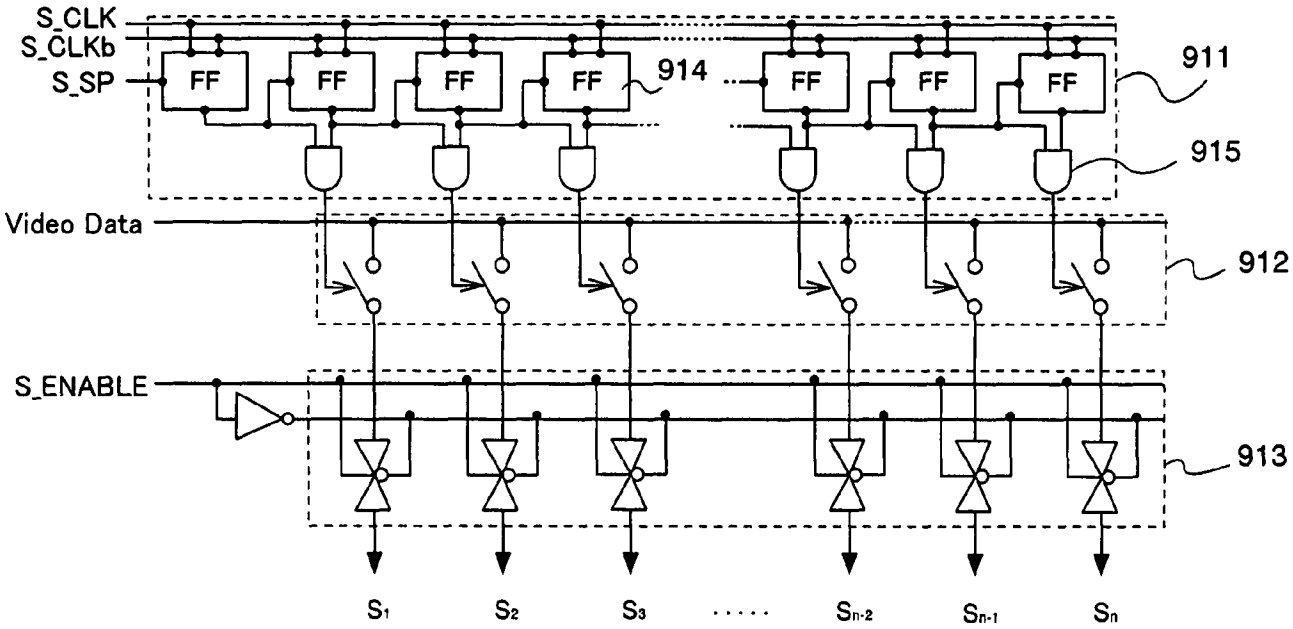

FIG. 9B shows a more detailed structure of the signal line driver circuit. In addition, operation of the signal line driver circuit is explained using the timing chart of FIG. 81.

A pulse output circuit 911 includes plural stages of flip-flop circuits (FF) 914 and AND gates 915, and two input terminals of the AND gate 915 are connected to output terminals of adjacent flip-flop circuits (FF) 914. In other words, one redundant flip-flop circuit (FF) 914 with respect to the AND gates 915 is provided in each stage, and outputs from adjacent flip-flop circuits (FF) 914 are input to the AND gate 915 of each stage provided relative to the signal lines S1 to Sn.

Figure 81:
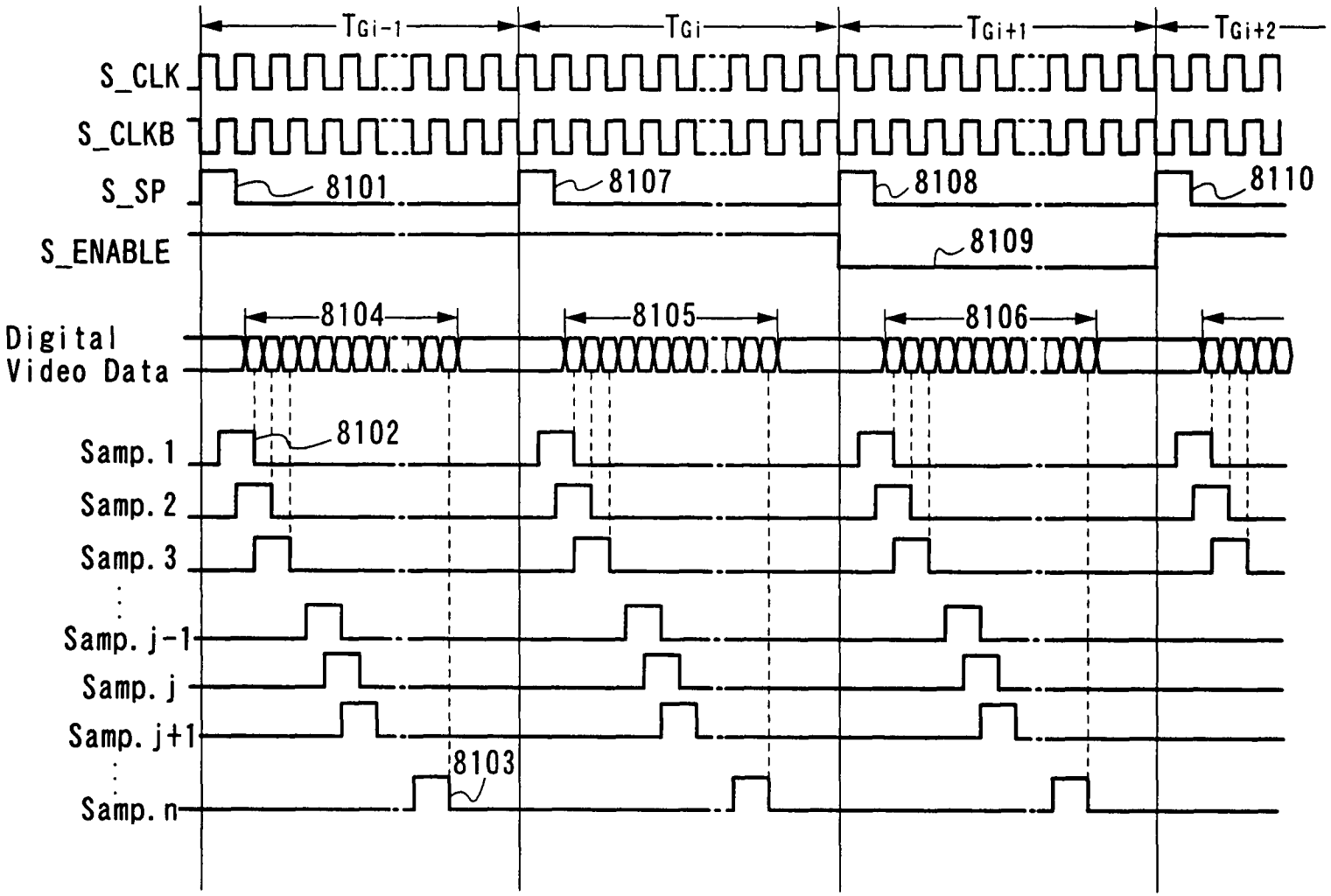
FIG. 81 is a diagram explaining operation of a signal line driver circuit applicable to a display device of the present invention.

Note that in FIG. 81, $T_{Gi-1}$, $T_{Gi}$, and $T_{Gi+1}$ denote periods for which video signals are input to pixels in (i−1)-th row, i-th row, and (i+1)-th row in a certain subframe period, respectively. Then, data 8106 of a video signal, data 8105 of a video signal, and data 8104 of a video signal are input to the signal line driver circuit in $T_{Gi-1}$, $T_{Gi}$, and $T_{Gi+1}$, respectively.

First, operation of $T_{Gi+1}$ is explained. A clock signal (S_CLK) and an inverted clock signal (S_CLKB) are input to each flip-flop circuit (FF) 914, and a start pulse signal (S_SP)

is input to the flip-flop circuit 914 of the first stage. In FIG. 81, a pulse 8101 corresponds to the start pulse signal of $T_{Gi+1}$.

The pulse 8101 is delayed for a pulse of the clock signal when input to the flip-flop circuit 914 of the next stage. Therefore, an output from the AND gate 915 of the first stage to which the outputs from the redundant flip-flop circuit 914 of the first stage and the flip-flop circuit 914 of the next stage is a frequency for a clock pulse like a pulse 8102. The pulses 8102 controls a switch corresponding to a pixel in the first column of the switch group 912 to be turned on or off as a sampling pulse Samp.1. Similarly, an output from the AND gate 915 of n-th column controls a switch corresponding to a pixel of n-th column of the switch group 912 to be turned on or off as a sampling pulse Samp.n like the pulse 8103.

In $T_{Gi+1}$, the data 8104 of the video signal is input to the switch group 912, and the switch of each stage corresponding to a pixel of each column is turned on in accordance with the timing at which the sampling pulse is input.

Note that an output control signal (S_ENABLE) is input to the output control circuit 913, and whether or not the video signal is output to the signal lines S1 to Sn is controlled by the level of the output control signal.

Note that the output control signal (S_ENABLE) is at an L level when data of a video signal for a single pixel row in which the signal is to be written to a pixel in a certain subframe period in one frame period is identical with data of a video signal for the pixel row in the last subframe period, and the output control signal is at an H level when any one part of data for a single row is different.

In other words, when the output control signal (S_ENABLE) is at an L level, the video signal is not output from the output control circuit 913 because an analog switch provided in each stage of the output control circuit 913 is turned off, and when the output control signal (S_ENABLE) is at an H level, the video signal can be output from the output control circuit 913 since the analog switch provided in each stage is turned on.

In $T_{Gi+1}$, the output control signal (S_ENABLE) is a signal at an H level; therefore, the analog switch in each stage of the output control circuit is in an on state. Accordingly, a video signal for pixels of each column is input to a signal line corresponding to a stage in which the switch group 912 is turned on.

Note that in FIG. 81, the start pulse signal (S_SP) is input to the flip-flop circuit 914 of the first stage also during $T_{Gi-1}$ as in $T_{Gi+1}$. In FIG. 81, a pulse 8108 is the start pulse signal of $T_{Gi-1}$. Then, the data 8106 of the video signal is output from the output control circuit 913.

However, the start pulse signal is not input during $T_{Gi}$ in FIG. 81. Therefore, the sampling pulse is not generated, and the switch in each stage of the switch group 912 is turned off and not turned on. Thus, the data 8105 of the video signal is not input to the output control circuit 913.

In addition, the output control signal (S_ENABLE) is at an L level. Therefore, the analog switch provided in each stage of the output control circuit 913 is turned off. Thus, the signal lines S1 to Sn are put in a floating state.

In other words, since the data of a signal input to the pixel in i-th row is identical with the data 8105 of the video signal, the signal writing to the pixel in i-th row is stopped. Charging and discharging of the signal line or the like is omitted to reduce power consumption.

Note that the output control circuit 913 is not necessarily provided. This is because the start pulse signal (S_SP) is not input during $T_{Gi}$, so the switch in each stage of the switch group 912 is not turned on and is put in a floating state.

In addition, the video signal for a pixel row in which signal writing is to be stopped may be stopped from being input to the signal line driver circuit. In other words, the video signal (Video Data) may be prevented from being input to the signal line driver circuit during $T_{Gi}$ as shown in FIG. 82. In addition, such a potential as to reduce power consumption may be input during $T_{Gi}$. Since other signals are similar to those in FIG. 81, explanation thereof is omitted.

In addition, the video signal for a pixel row in which signal writing is to be stopped may stop the input of the clock signal and the like to the signal line driver circuit. In other words, the clock signal (S_CLK) and the inverted clock signal (S_CLKB) may be prevented from being input to the signal line driver circuit during $T_{Gi}$ as shown in FIG. 83. Since other signals are similar to those in FIG. 81, explanation thereof is omitted.

In addition, the video signal for a pixel row in which signal writing is to be stopped may stop the input of the video signal, the clock signal, and the like to the signal line driver circuit. In other words, the clock signal (S_CLK), the inverted clock signal (S_CLKB), and the video signal (Video Data) may be prevented from being input to the signal line driver circuit during $T_{Gi}$ as shown in FIG. 84. Since other signals are similar to those in FIG. 81, explanation thereof is omitted.

Note that the signal line driver circuit applicable to the display device of the present invention is not limited thereto. In other words, signal writing is not performed to a pixel row when the pixel row is not selected in the case where data of a video signal for pixels of the pixel row in which the signal is to be written to the pixels in a certain subframe period in one frame period is identical with data of a signal for the pixel row already written thereto. Thus, a structure may be employed in which a signal input to pixels in the preceding row is kept being input to a signal line or such a potential as to reduce power consumption is kept being input to the signal line.

Embodiment Mode 4

In this embodiment mode, description is made on another structure applicable to a peripheral driver circuit (such as a scan line driver circuit or a signal line driver circuit) of the display devices described in Embodiment Modes 1 to 3.

Figure 5C:
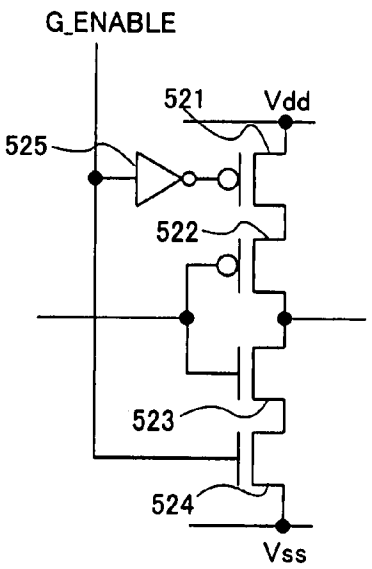
FIGS. 5A to 5C are diagrams explaining a scan line driver circuit applicable to a display device of the present invention.
Figure 5B:
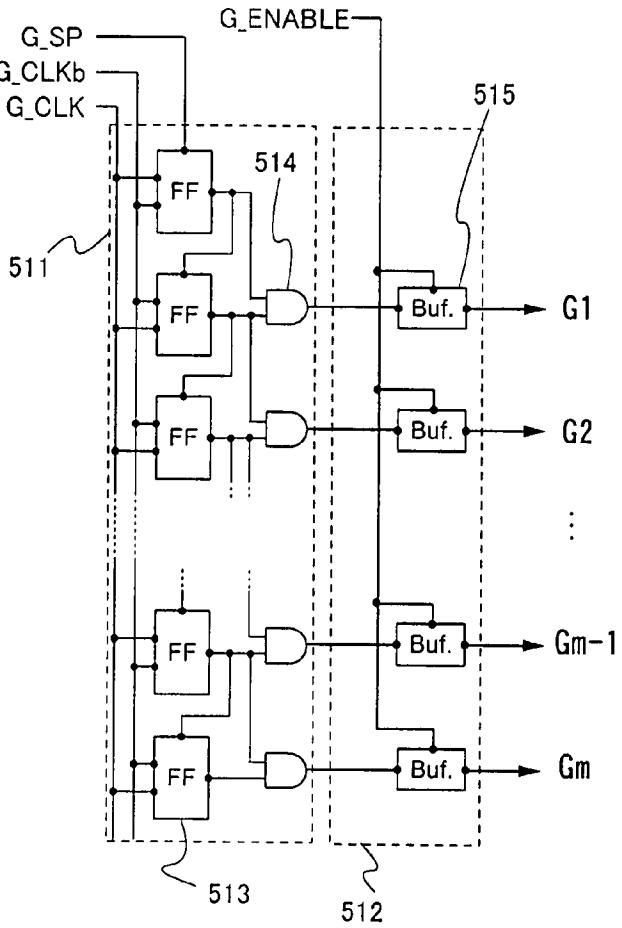
Figure 5A:
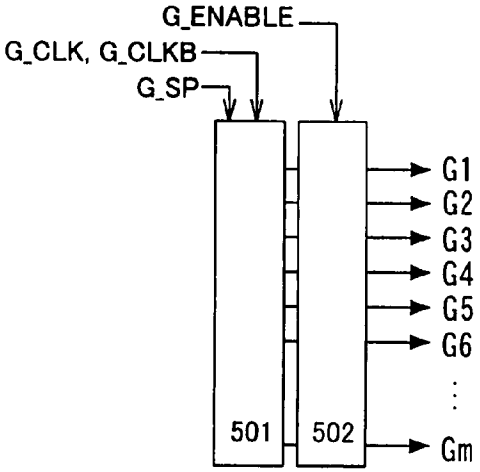

A structure of a scan line driver circuit applicable to the display device of the present invention is shown in FIG. 5A.

First, the scan line driver circuit shown in FIG. 5A includes a pulse output circuit 501 and a buffer circuit 502. A clock signal (G_CLK), an inverted clock signal (G_CLKB), a start pulse signal (G_SP), and the like are input to the pulse output circuit 501. Then, scan signals (SC.1 to SC.m) are input to the buffer circuit 502 in accordance with the timing of these signals. The scan signals are converted by the buffer circuit 502 into pixel selection signals (G.1 to G.m) having high current supply capability and are input to scan lines G1 to Gm. Here, an output control signal (G_ENABLE) is input to the buffer circuit 502. Then, the output control signal (G_ENABLE) performs control so as to stop the input of a signal among the pixel selection signals G.1 to G.m to the scan line of a pixel row in which signal writing is to be stopped.

A more detailed structure example is shown in FIG. 5B.

The pulse output circuit 511 includes plural stages of flip-flop circuits (FF) 513 and AND gates 514, and two input terminals of the AND gate 541 are connected to output terminals of adjacent flip-flop circuits (FF) 513. In other words, one redundant flip-flop circuit (FF) 513 with respect to the AND gates 514 is provided in each stage, and outputs from the adjacent flip-flop circuits (FF) 513 are input to the AND gates 514 of respective stages provided relative to the scan lines G1 to Gm.

A clock signal (G_CLK) and an inverted clock signal (G_CLKB) are input to each flip-flop circuit (FF) 513, and a start pulse signal (G_SP) is input to the flip-flop circuit 513 of the first stage. The start pulse signal is delayed for one pulse of the clock signal when input to the flip-flop circuit 513 of the next stage. Therefore, a pulse output from the AND gate 514 in the first row to which the outputs from the redundant flip-flop circuit 513 of the first stage and the flip-flop circuit 513 of the next stage is one pulse of the clock signal. The pulse is input as the scan signal SC.1 to an input terminal of a buffer circuit 515 (Buf.) corresponding to an output control circuit 512 of the first stage. Similarly, an output from the AND gate 514 in i-th row and an output from the AND gate 514 in m-th row are input as scan signals to respective one of input terminals of the buffer circuit 515 of each stage of the output control circuit 512, respectively.

In addition, the buffer circuit 515 of each stage of the output control circuit 512 includes an output control terminal, to which an output control signal (G_ENABLE) is input. The output control signal is converted by the output control circuit 512 into pixel selection signals (G.1 to G.m) having high current supply capability, which are input to the scan lines G1 to Gm. Here, the output control signal (G_ENABLE) is input to each stage of the output control circuit 512. Then, it is determined in accordance with the output control signal (G_ENABLE) whether or not the pixel selection signals (G.1 to G.m) that are generated by improving current supply capability of the scan signals (SC.1 to SC.m) are output to each stage of the output control circuit 512.

Note that an example of a buffer circuit provided with an output control circuit is shown in FIG. 5C. A p-channel transistor 521 and a p-channel transistor 522, and an n-channel transistor 523 and an n-channel transistor 524 are serially connected. A high power supply potential Vdd is set to a source terminal of the p-channel transistor 521, and a low power supply potential Vss is set to a source terminal of the n-channel transistor 524. An output control signal (G_ENABLE) is input to a gate terminal of the n-channel transistor 524, and an inverted signal of the output control signal (G_ENABLE) by an inverter 525 is input to a gate terminal of the p-channel transistor 521. In addition, gate terminals of the p-channel transistor 522 and the n-channel transistor 523 are connected to each other, to which a scan signal (any one of SC.1 to SC.m) is input. Here, since the n-channel transistor 524 and the p-channel transistor 521 are turned on when the output control signal (G_ENABLE) is at an H level, an inverted signal of the scan signal (any one of SC.1 to SC.m) is output from either the p-channel transistor 522 or the n-channel transistor 523. On the other hand, since the n-channel transistor 524 and the p-channel transistor 521 are turned off when the output control signal (G_ENABLE) is at an L level, the signal is not output from the buffer circuit and the scan line connected to the buffer circuit is put in a floating state. Note that the levels of the scan signals (SC.1 to SC.m) and the pixel selection signals (G.1 to G.m) are inverted in the case of FIG. 5C. Therefore, an odd number of inverters, for example one inverter, may be additionally provided in each stage. In this case, the additionally provided inverter may be located on an input side of the buffer circuit shown in FIG. 5C. This is because, when located on an output side of the buffer circuit shown in FIG. 5C, the output to the scan line becomes unstable in the case where the input of the additionally provided inverter is put in a floating state.

In addition, explanation is made on a structure example of another scan line driver circuit applicable to the display device of the present invention.

Figure 7B:
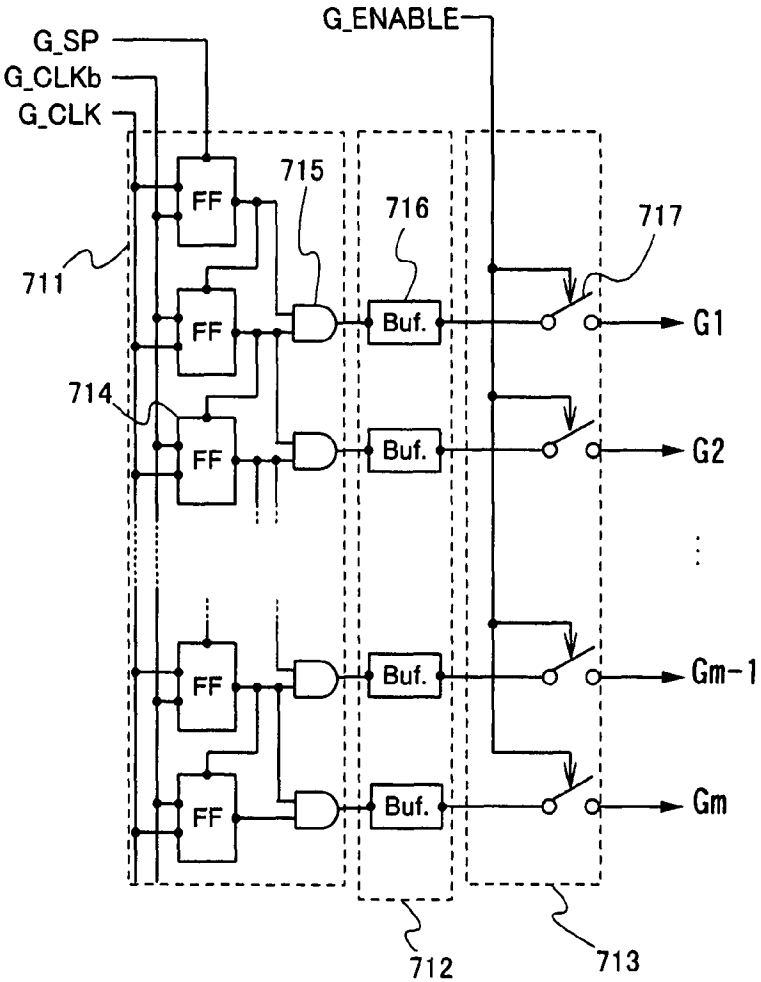
FIGS. 7A and 7B are diagrams explaining a scan line driver circuit applicable to a display device of the present invention.
Figure 7A:
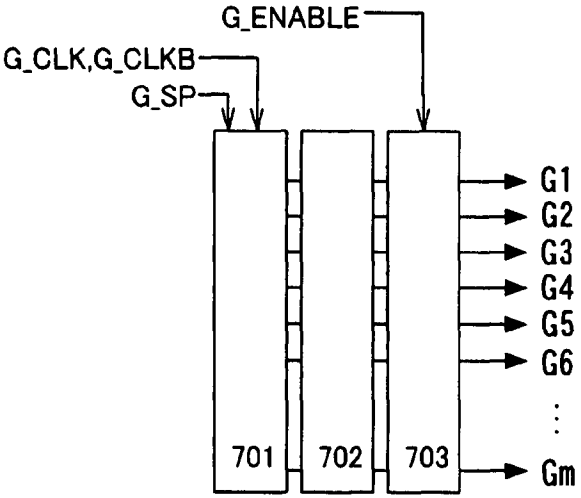

First, the scan line driver circuit shown in FIG. 7A includes a pulse output circuit 701, a buffer circuit 702, and an output control circuit 703. A clock signal (G_CLK), an inverted clock signal (G_CLKB), a start pulse signal (G_SP), and the like are input to the pulse output circuit 701. Then, scan signals (SC.1 to SC.m) are input to the buffer circuit 702 in accordance with the timing of these signals. The scan signals (SC.1 to SC.m) are converted by the buffer circuit 702 into pixel selection signals (G.1 to G.m) having high current supply capability, which are input to the output control circuit 703. Here, an output control signal (G_ENABLE) is input to the output control circuit 703. Then, the output control signal (G_ENABLE) performs control so as to stop the output of a signal among the pixel selection signals G.1 to G.m to the scan line of a pixel row in which signal writing is to be stopped.

A more detailed structure example is shown in FIG. 7B. A pulse output circuit 711 includes plural stages of flip-flop circuits (FF) 714 and AND gates 715, and two input terminals of the AND gate 715 are connected to output terminals of adjacent flip-flop circuits (FF) 714. In other words, one redundant flip-flop circuit (FF) 714 with respect to the AND gates 715 is provided in each stage, and outputs from the adjacent flip-flop circuits (FF) 714 are input to the AND gate 715 of each stage provided relative to scan lines G1 to Gm.

A clock signal (G_CLK) and an inverted clock signal (G_CLKB) are input to each flip-flop circuit (FF) 714, and a start pulse signal (G_SP) is input to the flip-flop circuit 714 of the first stage. The start pulse signal is delayed for one pulse of the clock signal when input to the flip-flop circuit 714 of the next stage. Therefore, a pulse output from the AND gate 715 in the first row to which the outputs from the redundant flip-flop circuit 714 of the first stage and the flip-flop circuit 714 of the next stage is one pulse of the clock signal. The pulse is input as the scan signal SC.1 to an input terminal of a buffer circuit (Buf.) 716 corresponding to the first stage of a buffer circuit 712. Similarly, an output from the AND gate 715 in i-th row and an output from the AND gate 715 in m-th row are input as scan signals to respective one of input terminals of the buffer circuit 716 of each stage of the buffer circuit 712, respectively.

The buffer circuits 716 in respective stages of the buffer circuit 712 and the scan lines G1 to Gm corresponding thereto are connected to each other through switches 717 in respective stages of the output control circuit 713. Each switch 717 includes a control terminal, and an output control signal (G_ENABLE) is input to the control terminal. Then, it is determined in accordance with the output control signal (G_ENABLE) whether or not the pixel selection signals (G.1 to G.m) that are generated by improving current supply capability of the scan signals (SC.1 to SC.m) are output to respective stages of the buffer 712. Here, for example, in the case where the output control signal (G_ENABLE) is at an L level when a pulse of the pixel selection signal G.1 are output from the buffer circuit 716 of the first stage, the switch 717 of the first stage is turned off. Therefore, the scan line G1 connected to the switch 717 of the first stage is put in a floating state. On the other hand, in the case where the output control signal (G_ENABLE) is at an H level when pulses of the pixel selection signals (G.1 to G.m) are output from the buffer circuits 716 of all stages, the switches 717 of all stages are turned on during one vertical period. Therefore, the pixel selection signals (G.1 to G.m) are sequentially input to the scan lines G1 to Gm.

Figure 35B:
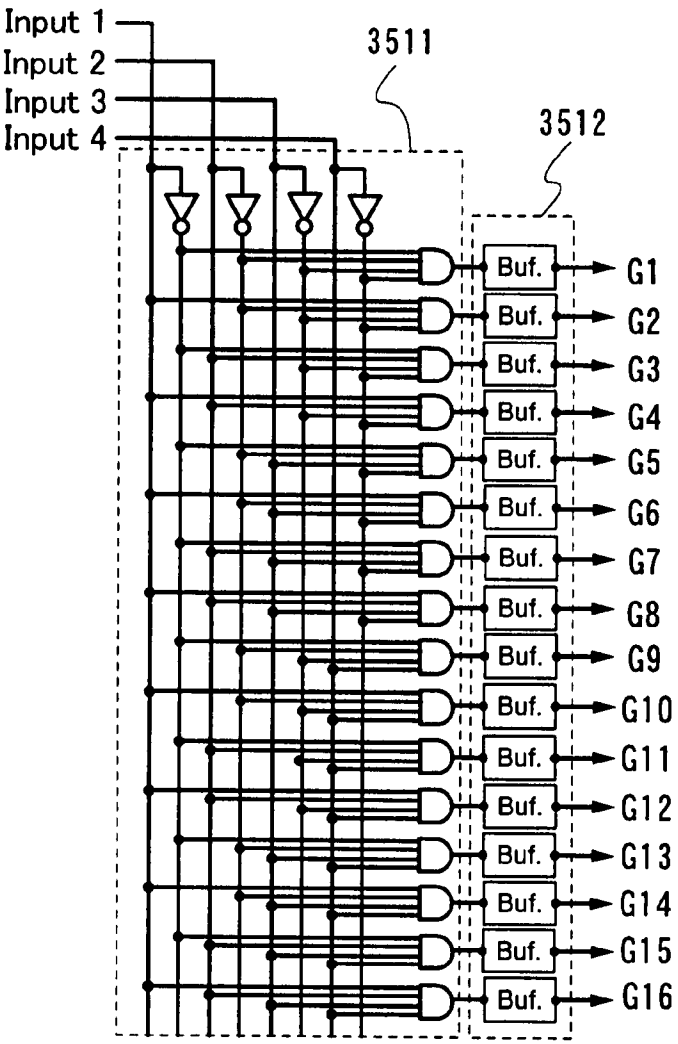
FIGS. 35A and 35B are diagrams explaining a scan line driver circuit applicable to a display device of the present invention.
Figure 35A:
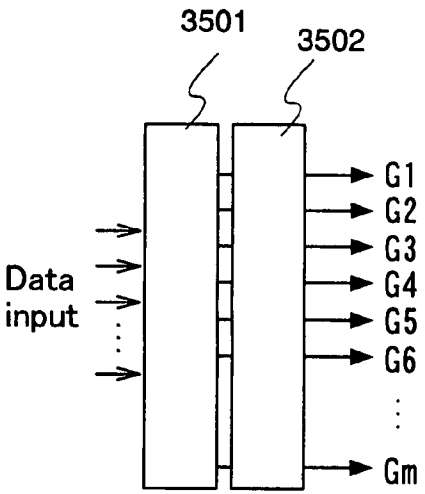

Alternatively, such a structure as shown in FIG. 35A may be used as the scan line driver circuit.

Scan line selection data is input to a decoder circuit 3501, and a pulse signal corresponding to a pixel row selected by the data is output. Then, a signal whose current supply capability is improved by the buffer circuit 3502 is output to any of G1 to Gm as a pixel selection signal.

A more detailed structure is shown in FIG. 35B. Here, description is made on an example of the case of selecting sixteen scan lines in accordance with four items of scan line selection data.

A decoder circuit 3511 includes AND gates 3513 provided to correspond to scan lines G1 to G16 selecting pixel rows. In addition, four items of scan line selection data, Inputs 1 to 4, are input to the decoder circuit 3511. Each AND gate 3513 selects a difference combination of the Input 1 or inverted data thereof, the Input 2 or inverted data thereof, the Input 3 or inverted data thereof, and the Input 4 or inverted data thereof. In this manner, the sixteen scan lines G1 to G16 can be arbitrarily selected in accordance with the four inputs.

Note that the scan line driver circuit of the display device of the present invention is not limited to the above-described structure. For example, it may include a level shifter. Note that the level shifter shifts the level of a signal.

Figure 11B:
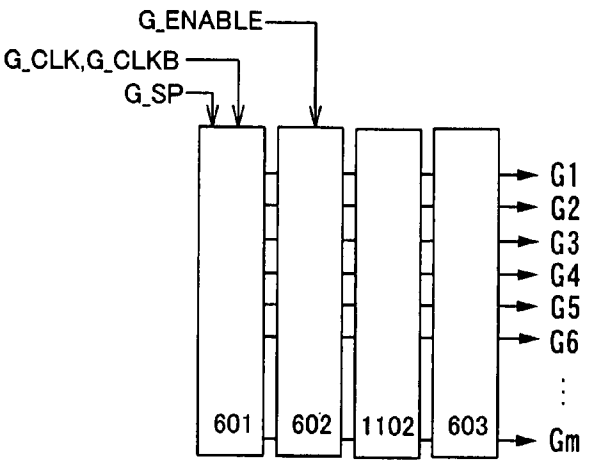
FIGS. 11A to 11D are diagrams explaining a scan line driver circuit applicable to a display device of the present invention.
Figure 11A:
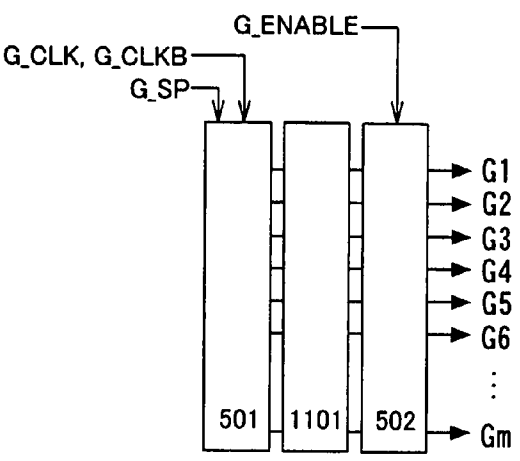

For example, in a structure of FIG. 11A, the output from a pulse output circuit 501 is input to a level shifter 1101, the output from the level shifter 1101 is input to a buffer circuit 502, and a signal selecting a pixel is sequentially input from the buffer circuit 502 to scan lines G1 to Gm. This structure is a structure in which the level shifter 1101 is added to the structure of FIG. 5A. For details, refer to explanation of FIG. 5A.

In addition, in a structure of FIG. 11B, the output from a pulse output circuit 601 is input to an output control circuit 602, the output from the output control circuit 602 is input to a level shifter 1102, the output from the level shifter 1102 is input to a buffer circuit 603, and a signal selecting a pixel is sequentially input from the buffer circuit 603 to scan lines G1 to Gm. This structure is a structure in which the level shifter 1102 is added to the structure of FIG. 6A. For details, refer to explanation of FIG. 6A.

Figure 11D:
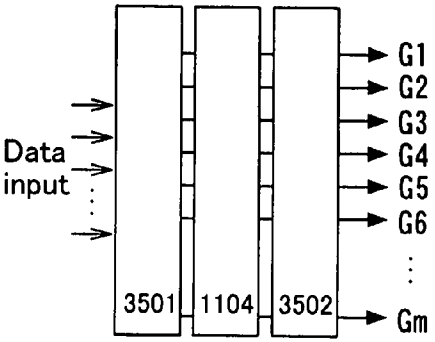
Figure 11C:
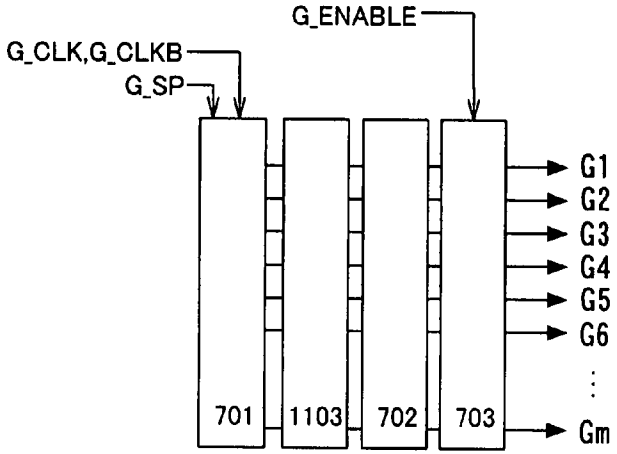

In addition, in a structure of FIG. 11C, the output from a pulse output circuit 701 is input to a level shifter 1103, the output from the level shifter 1103 is input to a buffer circuit 702, the output from the buffer circuit 702 is input to an output control circuit 703, and a signal selecting a pixel is sequentially input from the output control circuit 703 to scan lines G1 to Gm. This structure is a structure in which the level shifter 1103 is added to the structure of FIG. 7A. For details, refer to explanation of FIG. 7A.

In addition, in a structure of FIG. 11D, the output from the decoder circuit 3501 is input to a level shifter 1104, the output from the level shifter 1104 is input to a buffer circuit 3502, and a signal selecting a pixel is sequentially input from the buffer circuit 3502 to scan lines G1 to Gm. This structure is a structure in which the level shifter 1104 is added to the structure of FIG. 35A. For details, refer to explanation of FIG. 35A.

As described above, scan line driver circuits of various structures can be applied to the display device of the present invention. In other words, the scan line driver circuit may have any structure as long as a pixel row connected to one scan line is not selected when a signal to be input to the pixel row is identical with a signal already input to the pixel row. In other words, a signal input to a scan line connected to the pixel row may be a signal at an L level with which a pixel is not selected, or the scan line may be put in a floating state.

Figure 77A:
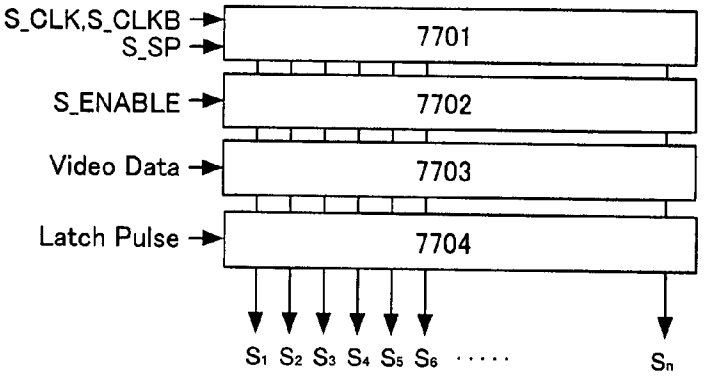
FIGS. 77A and 77B are diagrams explaining a signal line driver circuit applicable to a display device of the present invention.
Figure 77B:
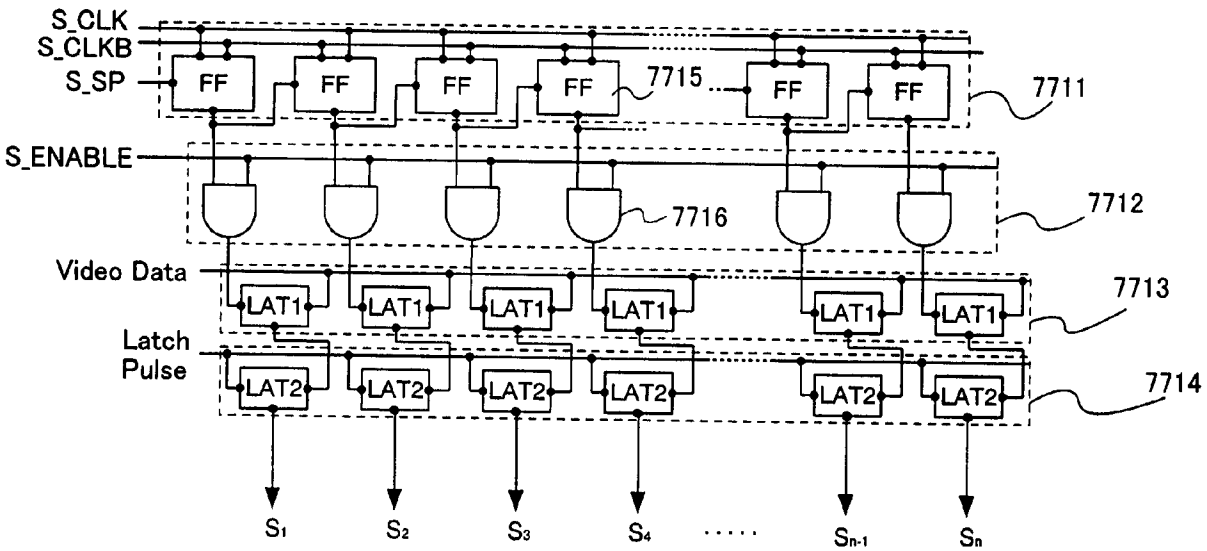

In addition, FIGS. 77A and 77B show a signal line driver circuit having a different structure from that of FIG. 8 described in Embodiment Mode 2, which is applicable to the line sequential display device of the invention.

The signal line driver circuit shown in FIG. 77A includes a pulse output circuit 7701, an output control circuit 7702, a first latch circuit 7703, and a second latch circuit 7704. A clock signal (S_CLK), an inverted clock signal (S_CLKB), and a start pulse signal (S_SP) are input to the pulse output circuit 7701. A sampling pulse is sequentially output in accordance with these signals.

A sampling pulse output from the pulse output circuit 7701 is input to the output control circuit 7702. In addition, an output control signal (S_ENABLE) is input to the output control circuit 7702, and this signal controls whether or not the sampling pulse is input to the first latch circuit 7703.

Here, the output control signal (S_ENABLE) is at an L level when data of a video signal for a single pixel row in which the signal is to be written to a pixel in a certain subframe period in one frame period is identical with data of a video signal for the pixel row in the last subframe period, and the output control signal is at an H level when any one part of the data for a single row is different.

Then, when the output control signal (S_ENABLE) input to the output control circuit 7702 is at an H level, the sampling pulse is output. Therefore, the sampling pulse is input to the first latch circuit 7703, and a video signal (Video Data) is held in the first latch circuit 7703 in accordance with the timing of the signal. When the holding of video signals is completed to the last stage in the first latch circuit 7703, a latch pulse (Latch Pulse) is input to the second latch circuit 7704 in a horizontal flyback period, and the video signal held in the first latch circuit 7703 are simultaneously transferred to the second latch circuit 7704.

On the other hand, the sampling pulse is not output from the output control circuit 7702 when the output control signal (S_ENABLE) is at an L level, and the video signal is not latched in the first latch circuit 7703. Thus, power consumption can be reduced.

Thereafter, the signal input to the second latch circuit 7704 is input to signal lines S1 to Sn.

Note that the video signal is not latched in the first latch circuit 7703 when the output control signal (S_ENABLE) is at an L level. Therefore, the video signal for the preceding row remains input. Thus, data held in the second latch circuit 7704 is also the same as the video signal for the preceding row. However, a signal is not written to a pixel at this time since the pixel is not selected by the scan line driver circuit. Thus, power consumption can be reduced. In addition, since each signal line is already charged and discharged, the signal input to the signal lines S1 to Sn from the second latch circuit 7704 does not consume much power.

FIG. 77B shows a more detailed structure of the signal line driver circuit.

Figure 52:
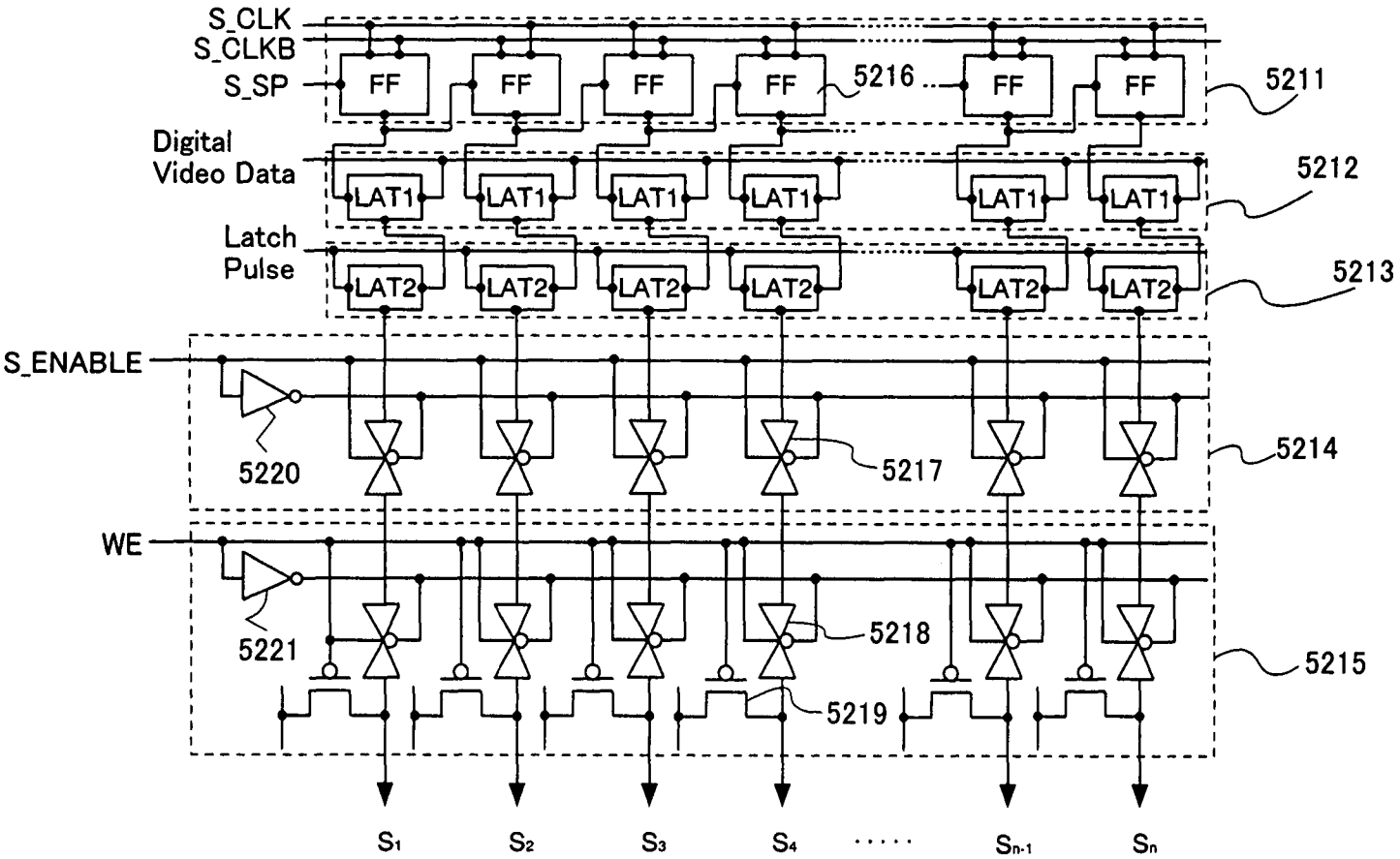
FIG. 52 is a diagram explaining a signal line driver circuit applicable to a display device of the present invention.

A pulse output circuit 7711 is formed using plural stages of flip-flop circuits (FF) 7715 and the like, to which a clock signal (S_CLK), an inverted clock signal (S_CLKB), and a start pulse signal (S_SP) are input. A sampling pulse is sequentially output in accordance with the timing of these signals. Note that in the structure of FIG. 77B, the pulse output circuit 7711 is formed with the flip-flop circuit 7715 having a structure in which the start pulse signal (S_SP) is delayed for one pulse every time it is input to the flip-flop circuit of the next stage; however, the above-described structure such as that of the pulse output circuit 5211 in FIG. 52 may be used.

A sampling pulse output from the pulse output circuit 7711 is input to an output control circuit 7712. In addition, an output control signal (S_ENABLE) is input to the output control circuit 7712, and this signal controls whether or not the sampling pulse is input to the first latch circuit 7713.

Here, the output control signal (S_ENABLE) is at an L level when data of a video signal for a single pixel row in which the signal is to be written to a pixel in a certain subframe period in one frame period is identical with data of a video signal for the pixel row in the last subframe period, and the output control signal is at an H level when any one part of the data for a single row is different.

Then, when the output control signal (S_ENABLE) input to the output control circuit 7712 is at an H level, the sampling pulse is output. Therefore, the sampling pulse is input to a LAT 1 of each stage of the first latch circuit 7713, and a video signal (video Data) is held in the first latch circuit 7713 in accordance with the timing of the signal. When the holding of video signals is completed to the last stage in the first latch circuit 7713, a latch pulse (Latch Pulse) is input to the second latch circuit 7714 in a horizontal flyback period, and the video signals held in the first latch circuit 7713 are simultaneously transferred to the second latch circuit 7714.

On the other hand, when the output control signal (S_ENABLE) is at an L level, the sampling pulse is not output from the output control circuit 7712 and the video signal is not latched in the first latch circuit 7713. Thus, power consumption can be reduced.

Thereafter, the signal input to the second latch circuit 7714 is input to signal lines S1 to Sn.

Note that the video signal is not latched in the first latch circuit 7713 when the output control signal (S_ENABLE) is at an L level. Therefore, the video signal for the preceding row remains input. Thus, data held in the second latch circuit 7714 is also the same as the video signal for the preceding row. However, a signal is not written to a pixel at this time since the pixel is not selected by the scan line driver circuit. Thus, power consumption can be reduced. In addition, since each signal line is already charged and discharged, the signal input to the signal lines S1 to Sn from the second latch circuit 7714 does not consume much power.

Figure 78A:
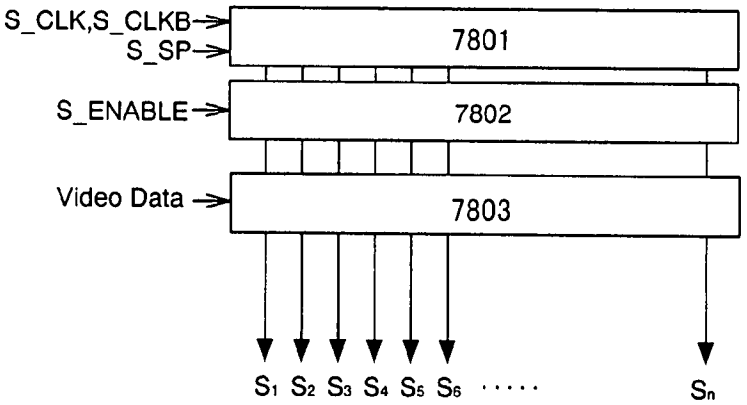
FIGS. 78A and 78B are diagrams explaining a signal line driver circuit applicable to a display device of the present invention.
Figure 78B:
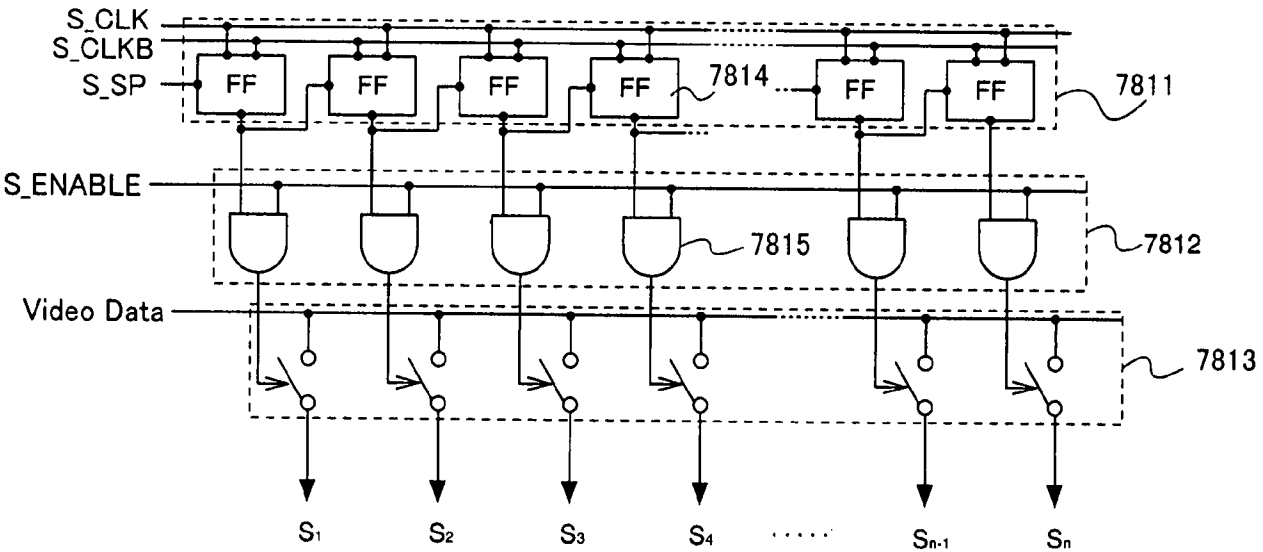

In addition, FIGS. 78A and 78B show a signal line driver circuit having a different structure from that of FIG. 9 described in Embodiment Mode 3, which is applicable to the dot sequential display device of the invention.

The signal line driver circuit shown in FIG. 78A includes a pulse output circuit 7801, an output control circuit 7802, and a switch group 7803. A clock signal (S_CLK), an inverted clock signal (S_CLKB), and a start pulse signal (S_SP) are input to the pulse output circuit 7801. A sampling pulse is sequentially output in accordance with these signals.

A sampling pulse output from the pulse output circuit 7801 is input to the output control circuit 7802. In addition, an output control signal (S_ENABLE) is input to the output control circuit 7802, and this signal controls whether or not the sampling pulse is input to the switch group 7803.

Here, the output control signal (S_ENABLE) is at an L level when data of a video signal for a single pixel row in which a signal is written to a pixel in a certain subframe period in one frame period is identical with data of a video signal for a single row in the last subframe period, and the output control signal is at an H level when any one part of the data for a single row is different.

Then, when the output control signal (S_ENABLE) input to the output control circuit 7802 is at an H level, the sampling pulse is output. Therefore, the sampling pulse is input to the switch group 7803. In accordance with the timing of the signal, a switch of each stage of the switch group 7803 is turned on. When switches to the last stage of the switch group 7803 are turned on, a video signal for a single pixel row is output to signal lines S1 to Sn.

On the other hand, when the output control signal (S_ENABLE) is at an L level, the sampling pulse is not output from the output control circuit 7802 and the switch of each stage of the switch group 7803 remains off without being turned on. Thus, the signal lines S1 to Sn are put in a floating state and are not charged and discharged. Thus, power consumption can be reduced.

FIG. 78B shows a more detailed structure of the signal line driver circuit.

A pulse output circuit 7811 is formed using plural stages of flip-flop circuits (FF) 7814 and the like, to which a clock signal (S_CLK), an inverted clock signal (S_CLKB), and a start pulse signal (S_SP) are input. A sampling pulse is sequentially output in accordance with these signals. Note that in the structure of FIG. 78B, the pulse output circuit 7811 is formed with the flip-flop circuit 7814 having a structure in which the start pulse signal (S_SP) is delayed for one pulse every time it is input to the flip-flop circuit of the next stage; however, the above-described structure such as that of the pulse output circuit 5211 in FIG. 52 may be used.

A sampling pulse output from the pulse output circuit 7811 is input to an output control circuit 7812. In addition, an output control signal (S_ENABLE) is input to the output control circuit 7812, and this signal controls whether or not the sampling pulse is input to a switch group 7813.

Here, the output control signal (S_ENABLE) is at an L level when data of a video signal for a single pixel row in which the signal is to be written to a pixel in a certain subframe period in one frame period is identical with data of a video signal for the pixel row in the last subframe period, and the output control signal is at an H level when any one part of the data for a single row is different.

Then, when the output control signal (S_ENABLE) input to the output control circuit 7812 is at an H level, the sampling pulse is output. Therefore, the sampling pulse turns on a switch of each stage of the switch group 7813. When switches to the last stage of the switch group 7813 are turned on, a video signal for a single pixel row is output to signal lines S1 to Sn.

On the other hand, when the output control signal (S_ENABLE) is at an L level, the sampling pulse is not output from the output control circuit 7812 and the switch of each stage of the switch group 7813 remains off without being turned on. Thus, the signal lines S1 to Sn are put in a floating state and are not charged and discharged. Thus, power consumption can be reduced.

Embodiment Mode 5

In this embodiment mode, explanation is made on a pixel and a driving method thereof applicable to the display device described in Embodiment Mode 1. In other words, explanation is made on a pixel and its driving method of a display device using a time gray scale method.

A pixel structure applicable to the display device of Embodiment Mode 1 is explained. Note that a self-luminous display element such as an EL element is suitable as a display element for the pixels shown in FIGS. 10, 13, 15, 16, 17, 18, 19, 21, 47, 53, and 67. Note that each of them shows only a single pixel, but a plurality of pixels is arranged in matrix in a row direction and a column direction in a pixel portion of the display device.

Figure 10:
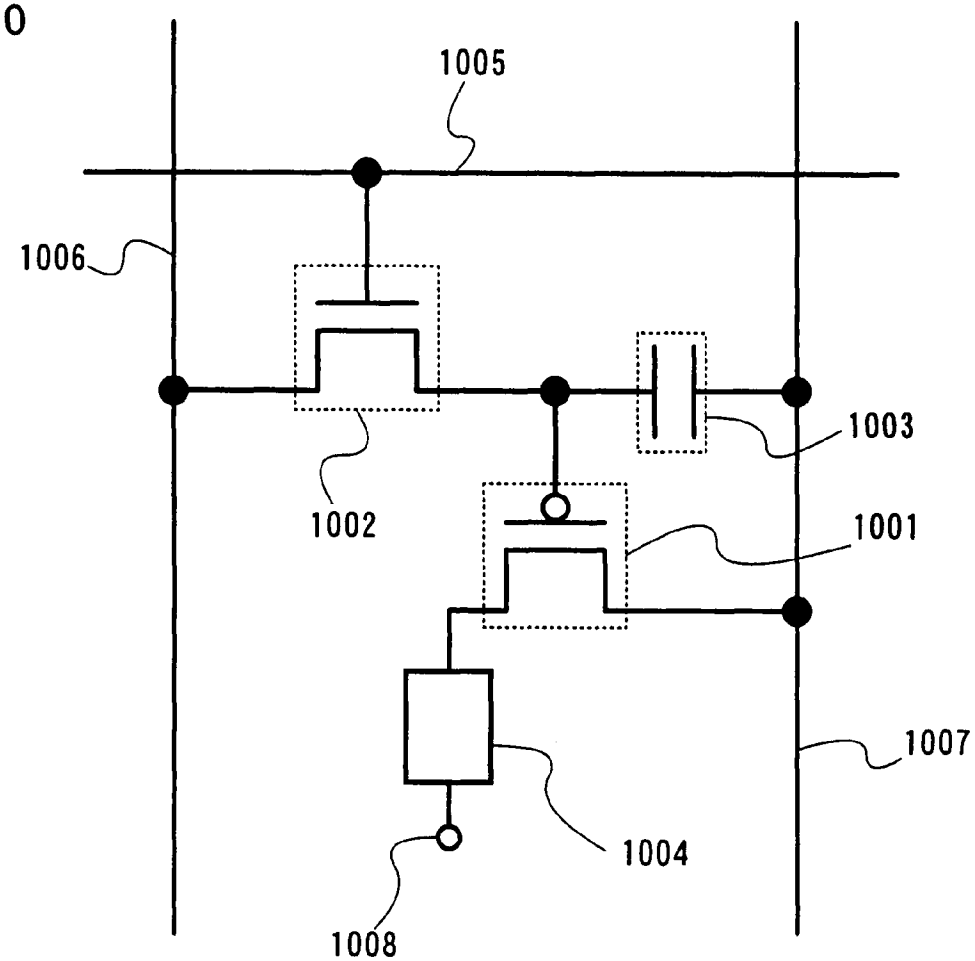
FIG. 10 is a diagram explaining a pixel structure applicable to a display device of the present invention.

The pixel shown in FIG. 10 includes a driver transistor 1001, a switch transistor 1002, a capacitor element 1003, a display element 1004, a scan line 1005, a signal line 1006, and a power source line 1007. A gate terminal of the switch transistor 1002 is connected to the scan line 1005, a first terminal (one of a source terminal and a drain terminal) thereof is connected to the signal line 1006, and a second terminal (the other of the source terminal and the drain terminal) thereof is connected to a gate terminal of the driver transistor 1001. Further, the second terminal of the switch transistor 1002 is connected to the power source line 1007 through the capacitor element 1003. Furthermore, a first terminal (one of a source terminal and a drain terminal) of the driver transistor 1001 is connected to the power source line 1007 and a second terminal (the other of the source terminal and the drain terminal) thereof is connected to a first electrode of the display element 1004. A low power source potential is set to a second electrode 1008 of the display element 1004. Note that a low power source potential is, based on a high power source potential set to the power source line 1007, a potential satisfying the relation of the low power source potential<the high power source potential, and for example, GND, 0 V, or the like may be set as the low power source potential. Since the display element 1004 is made to emit light by applying a potential difference between the high power source potential and the low power source potential to the display element 1004 and making a current to flow to the display element 1004, each potential is set so that the potential difference between the high power source potential and the low power potential is equal to or more than a forward threshold voltage of the display element 1004. Note that the capacitor element 1003 can be omitted by being substituted by gate capacitance of the driver transistor 1001. The gate capacitance of the driver transistor 1001 may be formed in a region where a source region, a drain region, an LDD region, and the like are overlapped with a gate electrode or may be formed between a channel region and a gate electrode.

When the pixel is selected by the scan line 1005, that is, when the switch transistor 1002 is in an on state, a video signal is input from the signal line 1006 to the pixel. Then, a charge for a voltage corresponding to the video signal is accumulated in the capacitor element 1003, and the capacitor element 1003 holds the voltage. This voltage is a voltage between the gate terminal and the first terminal of the driver transistor 1001, which corresponds to a gate-source voltage Vgs of the driver transistor 1001.

In general, operating regions of a transistor can be classified into a linear region and a saturation region. The border is when (Vgs−Vth)=Vds is satisfied in the case where a drain-source voltage is denoted by Vds, a gate-source voltage is denoted by Vgs, and a threshold voltage is denoted by Vth. In the case of satisfying (Vgs−Vth)>Vds, the transistor operates in a linear region and a current value thereof depends on the magnitude of Vds and Vgs. On the other hand, in the case of satisfying (Vgs−Vth)<Vds, the transistor operates in a saturation region, and ideally, a current value thereof hardly varies even if Vds varies. In other words, the current value depends only on the magnitude of Vgs.

Here, in the case of the voltage input voltage drive method, a video signal is inputted to the gate terminal of the driver transistor 1001 such that the driver transistor 1001 is put in either of two states of being sufficiently turned on and turned off. In other words, the driver transistor 1001 is operated in a linear region.

Thus, when the video signal is such a signal as to turn on the driver transistor 1001, the power source potential Vdd set to the power source line 1007 is ideally set to the first electrode of the display element 1004 without any change.

In other words, ideally, a voltage applied to the display element 1004 is made constant, so that the luminance obtained from the display element 1004 is made constant. Then, a plurality of subframe periods is provided in one frame period, the video signal is written to a pixel in each subframe period to control lighting and non-lighting of the pixel in each subframe period, so that a gray scale is expressed depending on the total of subframe periods in which the pixel is lighted.

Figure 13:
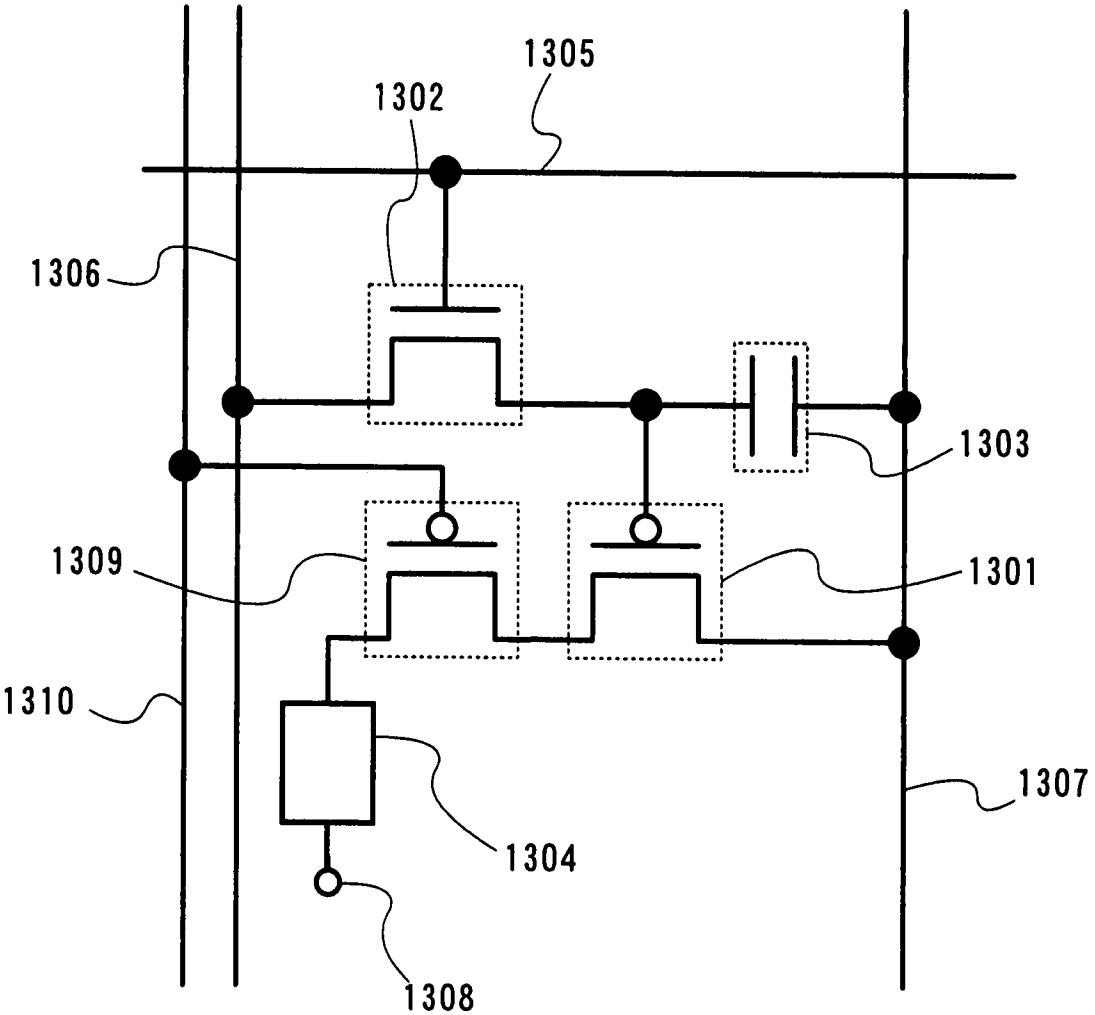
FIG. 13 is a diagram explaining a pixel structure applicable to a display device of the present invention.

Subsequently, a pixel structure of FIG. 13 is explained. The pixel shown in FIG. 13 includes a driver transistor 1301, a switch transistor 1302, a current control transistor 1309, a capacitor element 1303, a display element 1304, a scan line 1305, a signal line 1306, and a power source line 1307, and a wire 1310. A gate terminal of the switch transistor 1302 is connected to the scan line 1305, a first terminal (one of a source terminal and a drain terminal) thereof is connected to the signal line 1306, and a second terminal (the other of the source terminal and the drain terminal) thereof is connected to a gate terminal of the driver transistor 1301. Further, the second terminal of the switch transistor 1302 is connected to the power source line 1307 through the capacitor element 1303. Furthermore, a first terminal (one of a source terminal and a drain terminal) of the driver transistor 1301 is also connected to the power source line 1307 and a second terminal (the other of the source terminal and the drain terminal) thereof is connected to a first terminal (one of a source terminal and a drain terminal) of the current control transistor 1309. A second terminal (the other of the source terminal and the drain terminal) of the current control transistor 1309 is connected to a first electrode of the display element 1304, and a gate terminal thereof is connected to the wire 1310. In other words, the driver transistor 1301 and the current control transistor 1309 are serially connected. Note that a low power source potential is set to a second electrode 1308 of the display element 1304. Note that the low power source potential is, based on a high power source potential set to the power source line 1307, a potential satisfying the relation of the low power source potential<the high power source potential, and for example, GND, 0 V, or the like may be set as the low power source potential.

In this pixel structure, the current control transistor 1309 is operated in a saturation region to supply a constant current to the display element 1304 when the pixel is lighted. In other words, potentials of the wire 1310, the power source line 1307, and the second electrode 1308 are set so that a gate-source voltage Vgs and a drain-source voltage Vds satisfy (Vgs−Vth)<Vds. Note that Vth denotes a threshold voltage of the current control transistor 1309. Therefore, ideally, a current value thereof hardly varies even when Vds varies. In other words, the current value depends only on the magnitude of Vgs; therefore, the current value is determined by the potentials set to the power source line 1307 and the wire 1310. Note that the capacitor element 1303 can be deleted by being substituted by gate capacitance of the driver transistor 1301.

When the pixel is selected by the scan line 1305, that is, when the switch transistor 1302 is in an on state, a video signal is input from the signal line 1306 to the pixel. Then, a charge for a voltage corresponding to the video signal is accumulated in the capacitor element 1303, and the capacitor element 1303 holds the voltage. This voltage is a voltage between the gate terminal and the first terminal of the driver transistor 1301, which corresponds to a gate-source voltage Vgs of the driver transistor 1301.

Then, a video signal is input such that Vgs of the driver transistor 1301 is put in either of two states of being sufficiently turned on and turned off. In other words, the driver transistor 1301 is operated in a linear region.

Thus, when the video signal is such a signal as to turn on the driver transistor 1301, the power source potential Vdd set to the power source line 1307 is ideally set to the first terminal of the current control transistor 1309 without any change. At this time, the first terminal of the current control transistor 1309 is a source terminal, and a current supplied to the display element 1304 is determined by the gate-source voltage of the current control transistor 1309 set by the wire 1310 and the power source line 1307.

In other words, ideally, a current applied to the display element 1304 is made constant, so that the luminance obtained from the display element 1304 is made constant. Then, a plurality of subframe periods is provided in one frame period, the video signal is written to a pixel in each subframe period to control lighting and non-lighting of the pixel in each subframe period, so that a gray scale is expressed depending on the total of subframe periods in which the pixel is lighted.

Figure 15:
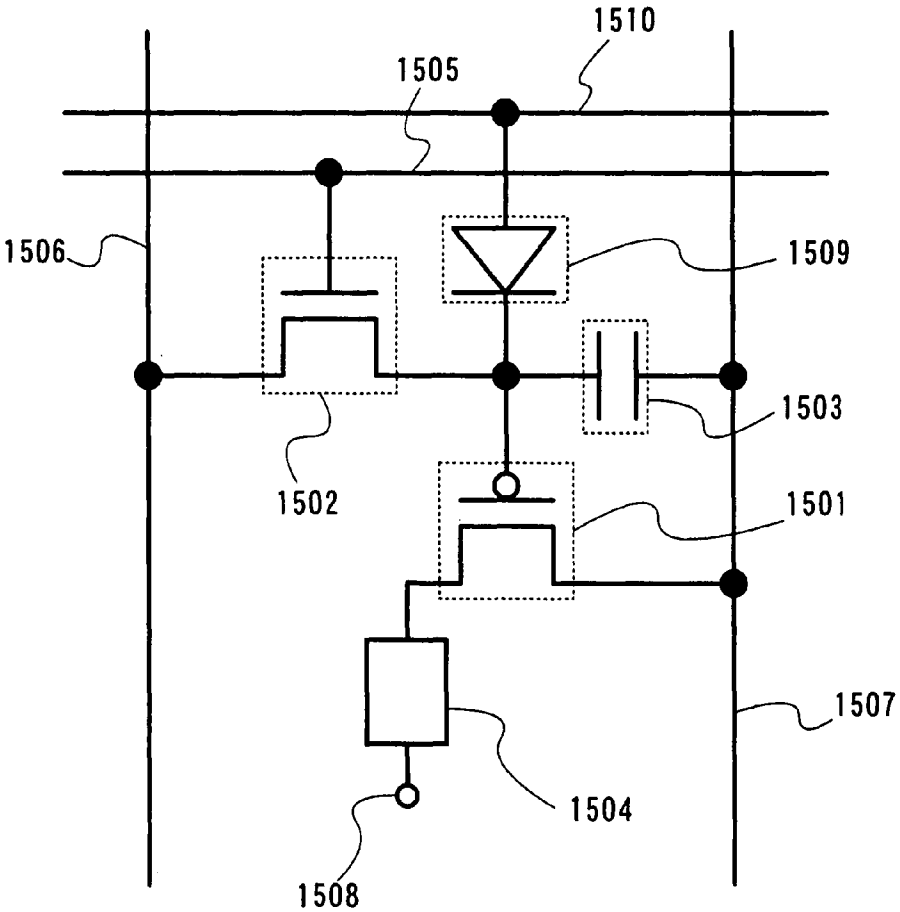
FIG. 15 is a diagram explaining a pixel structure applicable to a display device of the present invention.

Subsequently, a pixel structure of FIG. 15 is explained. The pixel shown in FIG. 15 includes a driver transistor 1501, a switch transistor 1502, a capacitor element 1503, a display element 1504, a first scan line 1505, a signal line 1506, a power source line 1507, a rectifier element 1509, and a second scan line 1510. A gate terminal of the switch transistor 1502 is connected to the first scan line 1505, a first terminal (one of a source terminal and a drain terminal) thereof is connected to the signal line 1506, and a second terminal (the other of the source terminal and the drain terminal) thereof is connected to a gate terminal of the driver transistor 1501. Furthermore, a gate terminal of the driver transistor 1501 is connected to the second scan line 1510 through the rectifier element 1509. In addition, the second terminal of the switch transistor 1502 is connected to the power source line 1507 through the capacitor element 1503. In addition, a first terminal (one of a source terminal and a drain terminal) of the driver transistor 1501 is connected to the power source line 1507, and a second terminal (the other of the source terminal and the drain terminal) thereof is connected to a first electrode of the display element 1504. A low power source potential is set to a second electrode 1508 of the display element 1504. Note that the low power source potential is, based on a high power source potential set to the power source line 1507, a potential satisfying the relation of the low power source potential<the high power source potential, and for example, GND, 0 V, or the like may be set as the low power source potential. Since the display element 1504 is made to emit light by applying a potential difference between the high power source potential and the low power source potential to the display element 1504 and making a current to flow to the display element 1504, each potential is set so that the potential difference between the high power source potential and the low power source potential is equal to or more than a forward threshold voltage of the display element 1504. Note that the capacitor element 1503 can be deleted by being substituted by gate capacitance of the driver transistor 1501.

This pixel structure is a structure in which the rectifier element 1509 and the second scan line 1510 are added to the pixel of FIG. 10. Therefore, the driver transistor 1501, the switch transistor 1502, the capacitor element 1503, the display element 1504, the first scan line 1505, the signal line 1506, and the power source line 1507 correspond to the driver transistor 1001, the switch transistor 1002, the capacitor element 1003, the display element 1004, the scan line 1005, the signal line 1006, and the power source line 1007 of the pixel in FIG. 10, respectively. Since the write operation and the light emission operation are similar, explanation thereof is omitted here.

Erase operation is explained. At the time of erase operation, an H-level signal is input to the second scan line 1510. Then, a current flows to the rectifier element 1509, and a gate potential of the driver transistor 1501, which is held by the capacitor element 1503, can be set to a certain potential. In other words, the potential of the gate terminal of the driver transistor 1501 can be set to a certain potential, and the driver transistor 1501 can be forced to be turned off regardless of the video signal written to the pixel.

Figure 16:
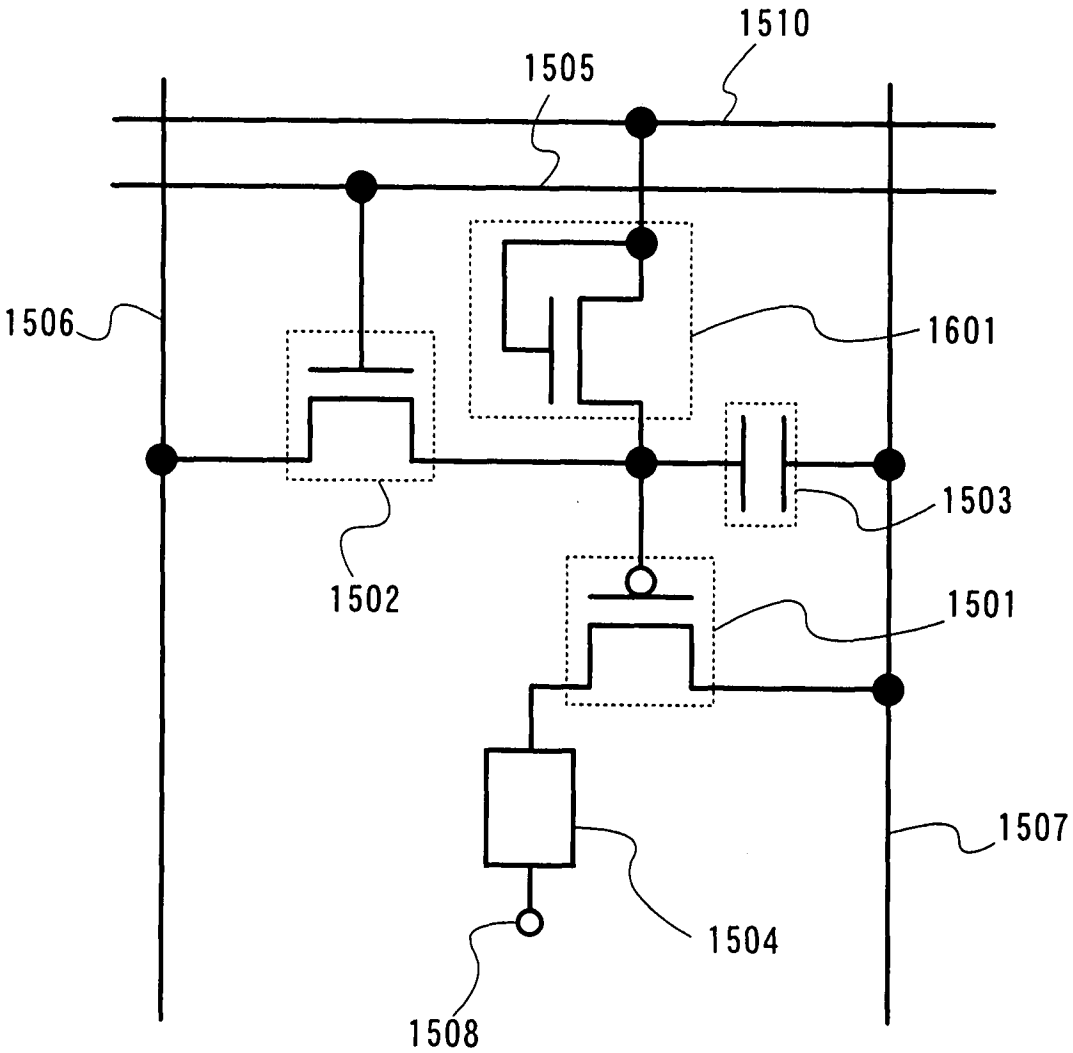
FIG. 16 is a diagram explaining a pixel structure applicable to a display device of the present invention.

Note that a diode-connected transistor can be used as the rectifier element 1509. Furthermore, a PN-junction or PIN-junction diode, a Schottky diode, a diode formed with a carbon nanotube, or the like may be used in place of the diode-connected transistor. The case of applying a diode-connected n-channel transistor is shown in FIG. 16. A first terminal (one of a source terminal and a drain terminal) of a diode-connected transistor 1601 is connected to the gate terminal of the driver transistor 1501, and a second terminal (the other of the source terminal and the drain terminal) of the diode-connected transistor 1601 is connected to the gate terminal and the second scan line 1510. Then, a current does not flow when the second scan line 1510 is at an L level since the gate terminal and the source terminal of the diode-connected transistor 1601 are connected, whereas a current flows to the diode-connected transistor 1601 when an H-level signal is input to the second scan line 1510 since the second terminal of the diode-connected transistor 1601 is the drain terminal. Thus, the diode-connected transistor 1601 exerts a rectifying action.

Figure 17:
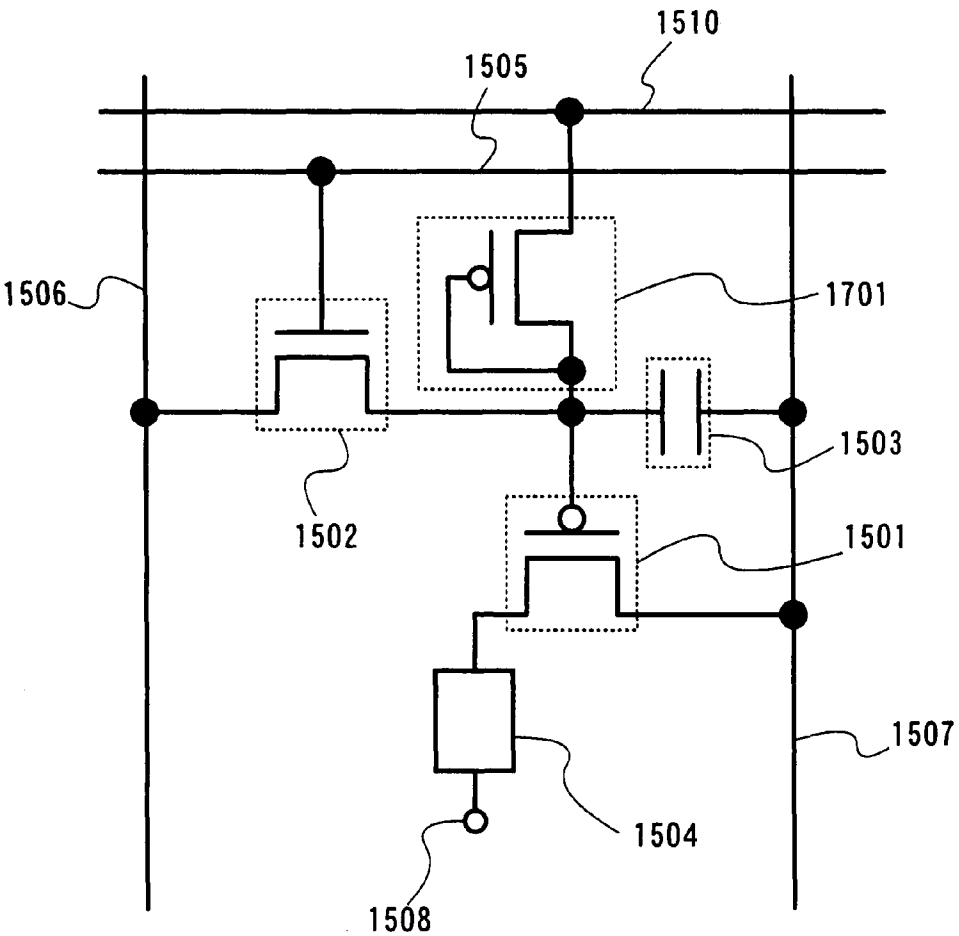
FIG. 17 is a diagram explaining a pixel structure applicable to a display device of the present invention.

In addition, the case of applying a diode-connected p-channel transistor is shown in FIG. 17. A first terminal (one of a source terminal and a drain terminal) of a diode-connected transistor 1701 is connected to the second scan line 1510. In addition, a second terminal (the other of the source terminal and the drain terminal) of the diode-connected transistor 1701 is connected to a gate terminal thereof and the gate terminal of the driver transistor 1501. Then, a current does not flow when the second scan line 1510 is at an L level since the gate terminal and the source terminal of the diode-connected transistor 1701 are connected, whereas a current flows when an H-level signal is input to the second scan line 1510 since the second terminal of the diode-connected transistor 1701 is the drain terminal. Thus, the diode-connected transistor 1701 exerts a rectifying action. Note that an L-level signal to be input to the second scan line 1510 is set to have such a potential not allowing a current to flow to the rectifier element 1509, the diode-connected transistor 1601, and the diode-connected transistor 1701 when a video signal for non-lighting is written to the pixel. In addition, an H-level signal to be input to the second scan line 1510 is set to have such a potential that such a potential as to turn off the driver transistor 1501 can be set to the gate terminal regardless of the video signal written to the pixel.

In addition, an erase transistor may be provided to erase the signal written to the pixel. The pixel shown in FIG. 18 has a structure in which an erase transistor 1809 and a second scan line 1810 are added to the pixel of FIG. 10. Therefore, a driver transistor 1801, a switch transistor 1802, a capacitor element 1803, a display element 1804, a first scan line 1805, a signal line 1806, and a power source line 1807 correspond to the driver transistor 1001, the switch transistor 1002, the capacitor element 1003, the display element 1004, the scan line 1005, the signal line 1006, and the power source line 1007 of the pixel in FIG. 10, respectively. Since the write operation and the light emission operation are similar, explanation thereof is omitted here.

Erase operation is explained. At the time of erase operation, an H-level signal is input to the second scan line 1810. Then, the erase transistor 1809 is turned on, and the potentials of a gate terminal and a first terminal of the driver transistor 1801 can be made equivalent. In other words, a gate-source voltage of the driver transistor 1801 can be 0 V. Note that the potential at an H level of the second scan line 1810 is desirably higher than the potential of the power source line 1807 by the threshold voltage Vth of the erase transistor 1809 or more. In this manner, the driver transistor can be forced to be turned off.

Figure 19:
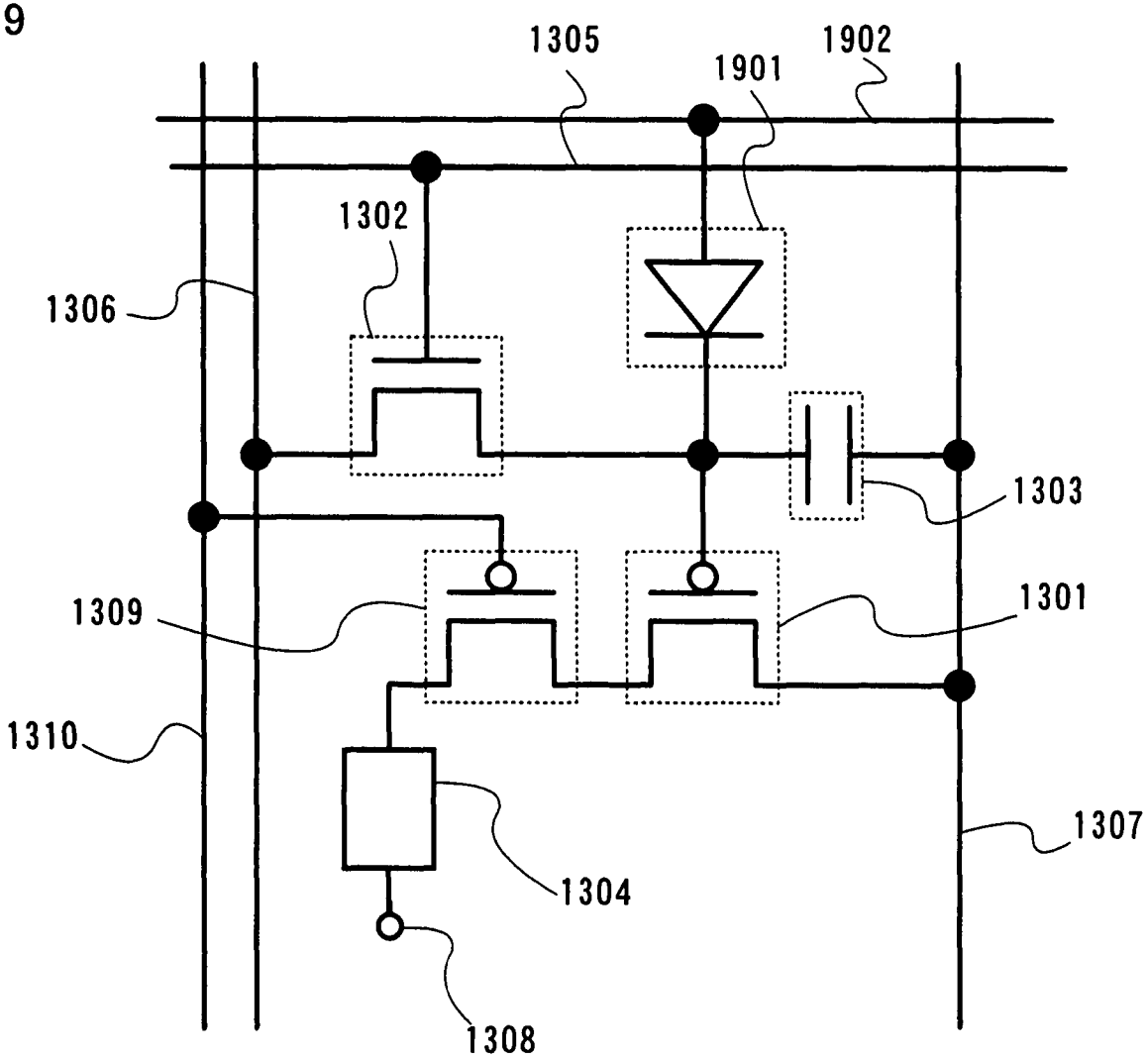
FIG. 19 is a diagram explaining a pixel structure applicable to a display device of the present invention.

In addition, the rectifier element and the erase transistor can be applied to the pixel structure as shown in FIG. 13. As an example, a structure in which a rectifier element is added to the pixel of FIG. 13 is shown in FIG. 19. In the structure of FIG. 19, the gate terminal of the driver transistor 1301 is connected to a second scan line 1902 through a rectifier element 1901. Since the write operation and the light emission operation are similar to explanation of FIG. 13, explanation thereof is omitted here.

Erase operation is explained. At the time of erase operation, an H-level signal is input to the second scan line 1902. Then, a current flows to the rectifier element 1901, and a gate potential of the driver transistor 1301, which is held by the capacitor element 1303, can be set to a certain potential. In other words, the potential of the gate terminal of the driver transistor 1301 can be set to a certain potential, and the driver transistor 1301 can be forced to be turned off regardless of the video signal written to the pixel. In this manner, the pixel can be forced to be in a non-lighting state. Note that a diode-connected n-channel transistor or a diode-connected p-channel transistor can be used as the rectifier element 1901.

Figure 74:
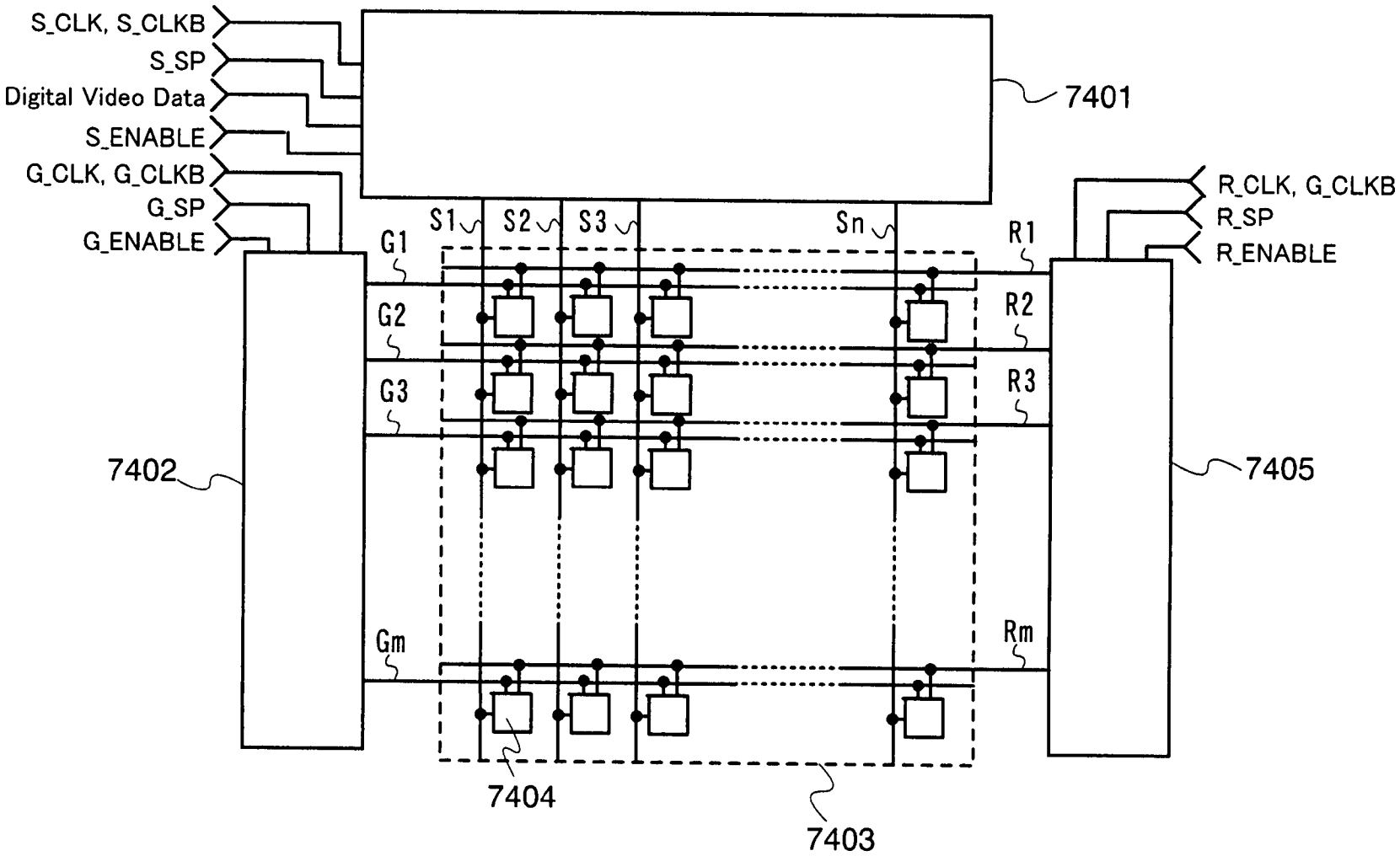
FIG. 74 is a diagram explaining a display device of the present invention.

In the case of inputting a signal for putting the pixel in a non-lighting state to the gate terminal of the driver transistor by providing the second scan line and selecting the second scan line as shown in FIGS. 15 to 19, a structure of a display device, for example, as shown in FIG. 74 can be used.

The display device includes a signal line driver circuit 7401, a first scan line driver circuit 7402, a second scan line driver circuit 7405, and a pixel portion 7403. In addition, a plurality of pixels 7404 is provided in matrix in the pixel portion 7403 relative to signal lines S1 to Sn extended from the signal line driver circuit 7401 in a column direction, and first scan lines G1 to Gm and second scan lines R1 to Rm extended from the first scan line driver circuit 7402 and the second scan line driver circuit 7405 in a row direction, respectively.

Signals such as a clock signal (G_CLK), an inverted clock signal (G_CLKB), and a start pulse signal (G_SP) are input to the first scan line driver circuit 7402. A signal is output to a first scan line Gi (any one of the first scan lines G1 to Gm) in a selected pixel row in accordance with these signals. Then, a pixel row in which signal writing is to be performed is selected.

In addition, signals such as a clock signal (R_CLK), an inverted clock signal (R_CLKB), and a start pulse signal (R_SP) are input to the second scan line driver circuit 7405. A signal is output to a second scan line R1 (any one of the second scan lines R1 to Rm) in a selected pixel row in accordance with these signals. Then, a pixel row in which signal erase is to be performed is selected.

In addition, signals such as a clock signal (S_CLK), an inverted clock signal (S_CLKB), a start pulse signal (S_SP), and a video signal (Digital Video Data) are input to the signal line driver circuit 7401. In accordance with these signals, a video signal corresponding to a pixel in each column is output to each of the signal lines S1 to Sn.

Thus, the video signal input to the signal lines S1 to Sn is written to the pixel 7404 of each column in a pixel row selected by the signal input to the first scan line Gi (any one of the scan lines G6 to Gm). Each pixel row is selected by each of the first scan lines G1 to Gm, and the video signal corresponding to each pixel 7404 is written to all of the pixels 7404. Each pixel 7404 holds data of the video signal written thereto for a certain period. Then, each pixel 7404 can maintain a lighting or non-lighting state by holding the data of the video signal for a certain period.

Here, the display device of this embodiment mode is a display device using a time gray scale method in which the lighting and non-lighting of each pixel 7404 are controlled by signal data written to each pixel 7404 and a gray scale is expressed with the length of light emitting time. Note that a period for displaying an image of one display region completely is referred to as one frame period, and the display device of the present invention includes a plurality of subframes in one frame period. The length of each subframe period in this one frame period may be approximately equal or different. In other words, the lighting and non-lighting of each pixel 7404 are controlled in each subframe period in one frame period, and a gray scale is expressed with a difference in total time of lighting time of each pixel 7404.

In addition, the display device of this embodiment mode includes output control circuits in the signal line driver circuit 7401, the first scan line driver circuit 7402, and the second scan line driver circuit 7405. In other words, the output control circuit of the first scan line driver circuit 7402 or the second scan line driver circuit 7405 does not output a signal selecting a pixel row when data of the video signal for a single pixel row in which signal writing or erasing is performed to a pixel in a certain subframe period in one frame period is identical with data of the video signal for a single row already written to the pixel row. In other words, an L signal for not selecting a pixel row is input to a scan line of the pixel row, or the scan line of the pixel row is put in a floating state. In addition, the output control circuit of the signal line driver circuit 7401 also does not output the video signal. The output from the signal line driver circuit 7401 may be a signal for putting a pixel in a lighting state or may be a signal for putting a pixel in a non-lighting state. Such a signal consuming as little power as possible may be input. Alternatively, the signal lines S1 to Sn may be put in a floating state.

Thus, according to the display device of this embodiment mode, focusing on a certain pixel row, a signal can be prevented from being input to the pixel row when a signal already input to the pixel row is identical with a signal to be input. Therefore, the number of times charging and discharging of the scan line and the signal line are carried out can be reduced, so that power consumption can be reduced.

Figure 21:
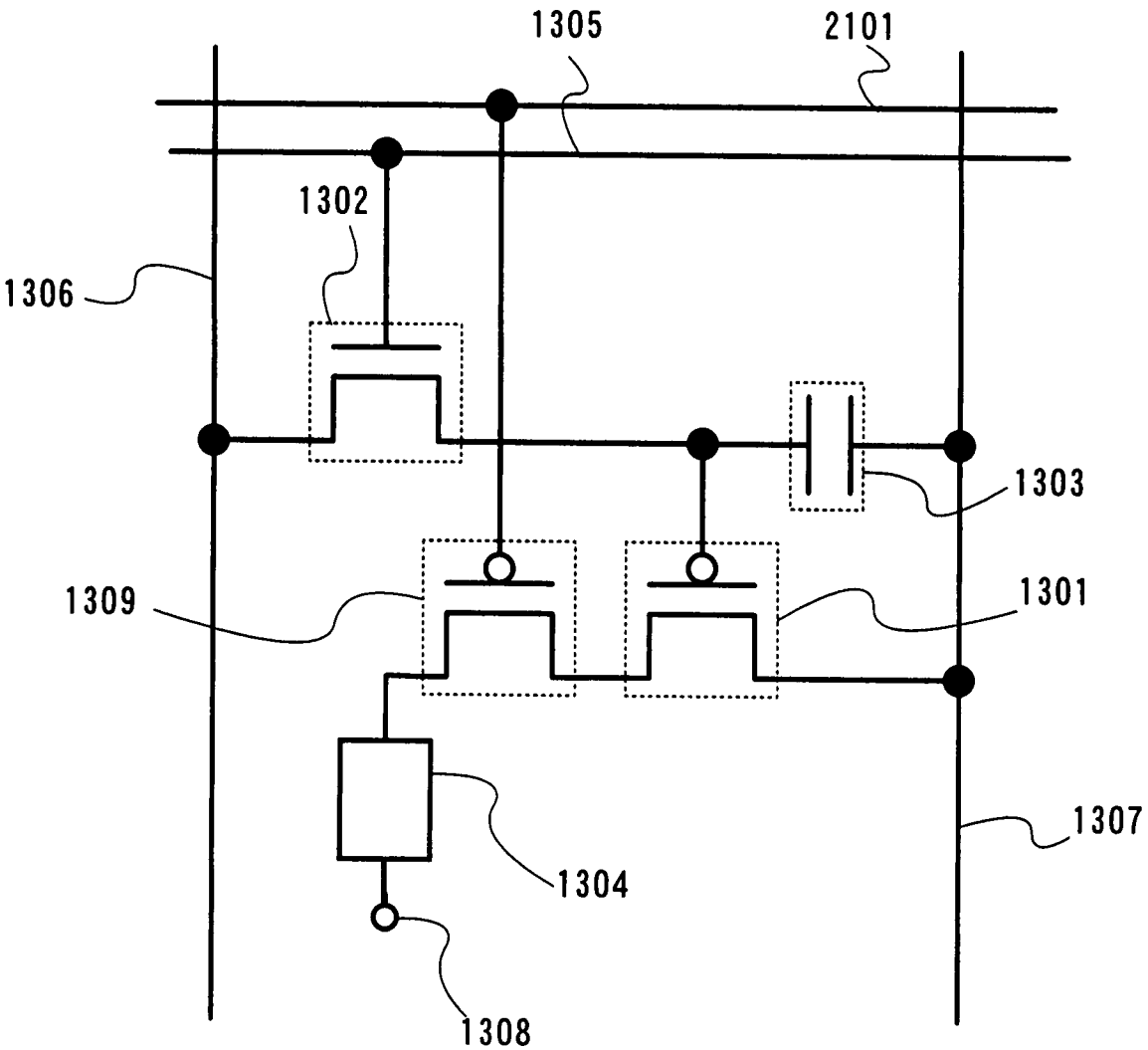
FIG. 21 is a diagram explaining a pixel structure applicable to a display device of the present invention.

In the case of the pixel structure in FIG. 21, the pixel can be forced to be in a non-lighting state without providing a rectifier element. For example, in the pixel structure of FIG. 13, a second scan line 2101 is provided in place of the wire 1310, and the gate terminal of the current control transistor 1309 is connected to the second scan line 2101. In order to force the pixel to be in a non-lighting state regardless of the video signal written to the pixel, an H-level signal is input to the second scan line 2101. Then, the current control transistor 1309 is turned off; therefore, the pixel can be put in a non-lighting state regardless of the video signal written to the pixel. Note that a constant potential is set to the second scan line 2101 and a current flowing to the current control transistor 1309 is made constant, except when the pixel is forced to be in a non-lighting state.

Figure 47:
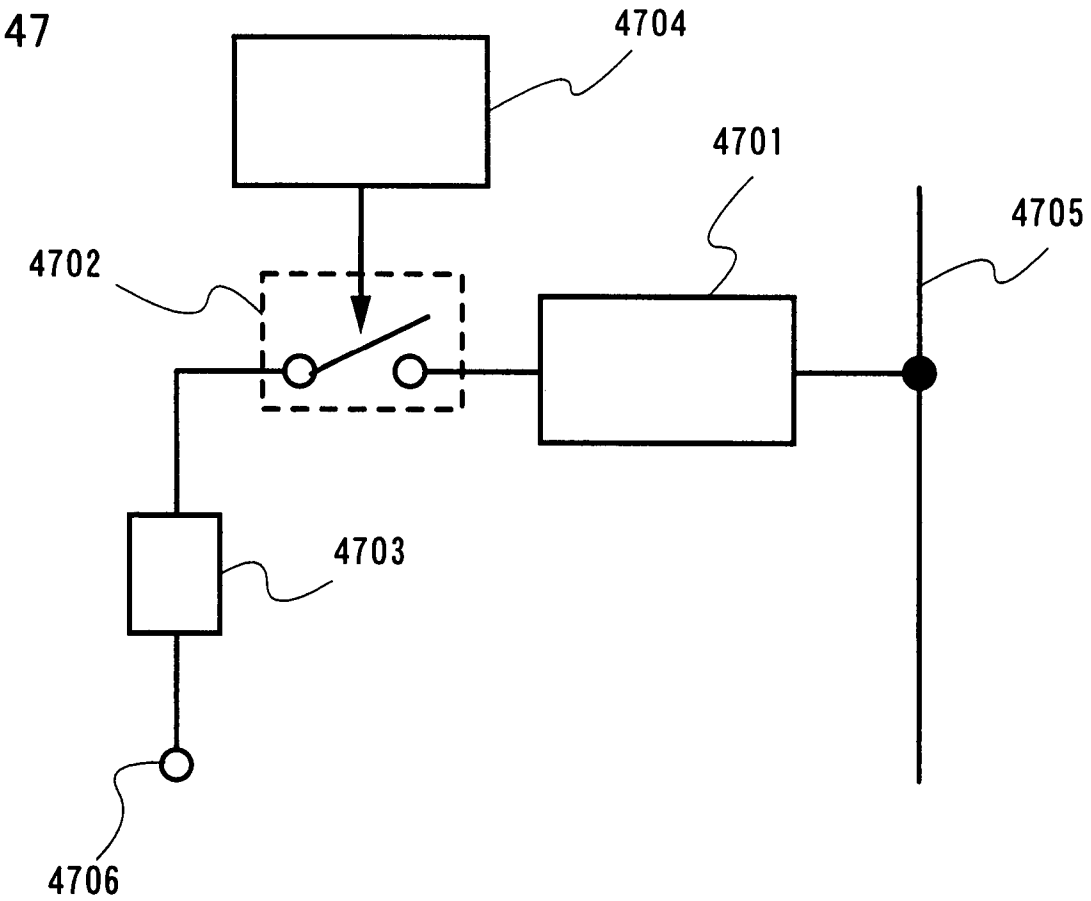
FIG. 47 is a diagram explaining a pixel structure applicable to a display device of the present invention.

Subsequently, the pixel of FIG. 47 is explained. The pixel of FIG. 47 includes a current source circuit 4701, a switch 4702, a display element 4703, a signal holding means 4704, and a power source line 4705.

A pixel electrode of the display element 4703 is connected to the power source line 4705 through the switch 4702 and the current source circuit 4701.

Note that a signal which controls lighting and non-lighting of the pixel is input to the signal holding means 4704, which holds the signal. Then, the switch 4702 is controlled to be turned on or off by this signal.

In addition, potentials set to an opposite electrode 4706 of the display element 4703 and the power source line 4705 are set so as to be able to normally supply a current having a current value programmed in the current source circuit 4701.

According to this pixel structure, a constant current can be continuously supplied to the display element 4703 by programming a constant current value in the current source circuit 4701. Therefore, variations in light emission of each pixel can be improved. In addition, a constant current can be supplied even if a current-voltage characteristic of the display element 4703 changes due to temperature change. Therefore, a change in luminance of the display element 4703 associated with temperature change can be suppressed.

In addition, the display element 4703 deteriorates over time, and the current-voltage characteristic changes. However, since a constant current can be supplied in this pixel structure, a change in luminance of the display element 4703 associated with deterioration over time can be suppressed. In addition, if the deterioration over time proceeds, a current-luminance characteristic changes. In other words, even when a current having the same current value is made to flow, the luminance of the deteriorated display element 4703 is lower than that of the display element 4703 that is not deteriorated. Thus, in this pixel, a decrease in luminance associated with change over time can be suppressed by programming a current value in the current source circuit 4701 in accordance with a change over time.

Figure 53:
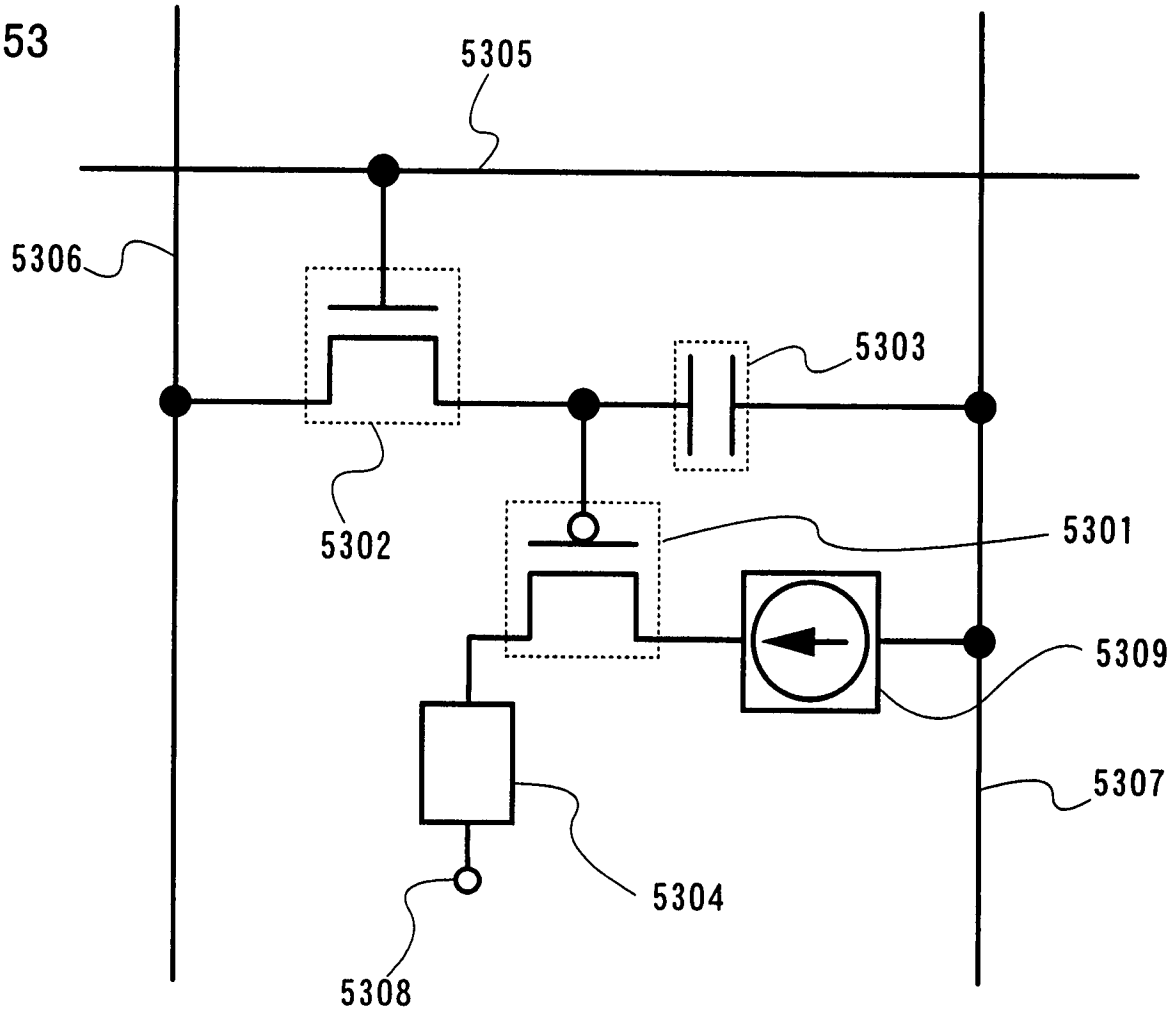
FIG. 53 is a diagram explaining a pixel structure applicable to a display device of the present invention.

An example of a basic structure of the pixel in FIG. 47 is shown in FIG. 53. The pixel includes a driver transistor 5301, a switch transistor 5302, a capacitor element 5303, a display element 5304, a scan line 5305, a signal line 5306, a power source line 5307, and a current source circuit 5309.

A gate terminal of the switch transistor 5302 is connected to the scan line 5305, a first terminal (one of a source terminal and a drain terminal) thereof is connected to the signal line 5306, and a second terminal (the other of the source terminal and the drain terminal) thereof is connected to a gate terminal of the driver transistor 5301. In addition, the second terminal (the other of the source terminal and the drain terminal) of the switch transistor 5302 is connected to the power source line 5307 through the capacitor element 5303. Furthermore, a first terminal (one of a source terminal and a drain terminal) of the driver transistor 5301 is connected to the power source line 5307 through the current source circuit 5309, and a second terminal (the other of the source terminal and the drain terminal) thereof is connected to a first electrode of the display element 5304. A low power source potential is set to a second electrode 5308 of the display element 5304. Note that the low power source potential is, based on a high power source potential set to the power source line 5307, a potential satisfying the relation of the low power source potential<the high power source potential, and for example, GND, 0 V, or the like may be set as the low power source potential. Such a potential being able to make a current having a current value programmed in the current source circuit 5309 to normally flow is set as the high power source potential and the low power source potential. Note that the capacitor element 5303 can be omitted by being substituted by gate capacitance of the driver transistor 5301. The gate capacitance of the driver transistor 5301 may be formed in a region where a source region, a drain region, an LDD region, and the like are overlapped with a gate electrode or may be formed between a channel region and a gate electrode.

The operation of this pixel structure is explained. When the pixel is selected by the scan line 5305, that is, when the switch transistor 5302 is in an on state, a video signal is input from the signal line 5306 to the pixel. Then, a charge is accumulated in the capacitor element 5303, and the capacitor element 5303 holds the gate potential of the driver transistor 5301.

In general, operating regions of a transistor can be classified into a linear region and a saturation region. The border is when (Vgs−Vth)=Vds is satisfied in the case where a drain-source voltage is denoted by Vds, a gate-source voltage is denoted by Vgs, and a threshold voltage is denoted by Vth. In the case of satisfying (Vgs−Vth)>Vds, the transistor operates in a linear region and a current value thereof depends on the magnitude of Vds and Vgs. On the other hand, in the case of satisfying (Vgs−Vth)<Vds, the transistor operates in a saturation region, and ideally, a current value thereof hardly varies even if Vds varies. In other words, the current value depends only on the magnitude of Vgs.

Here, in the case of this structure, the driver transistor 5301 is operated in a linear region. A video signal is inputted to the gate terminal of the driver transistor 5301 such that the driver transistor 5301 is put in either of two states of being sufficiently turned on and turned off.

Thus, when the video signal is such a signal turning on the driver transistor 5301, a current having a current value programmed in the current source circuit 5309 is set to the first electrode of the display element 5304 without any change.

In other words, a current applied to the display element 5304 is made constant, so that the luminance obtained from the display element 5304 is made constant. Then, a plurality of subframe periods is provided in one frame period, the video signal is written to a pixel in each subframe period to control lighting and non-lighting of the pixel in each subframe period, so that a gray scale is expressed depending on the total of subframe periods in which the pixel is lighted.

Figure 67:
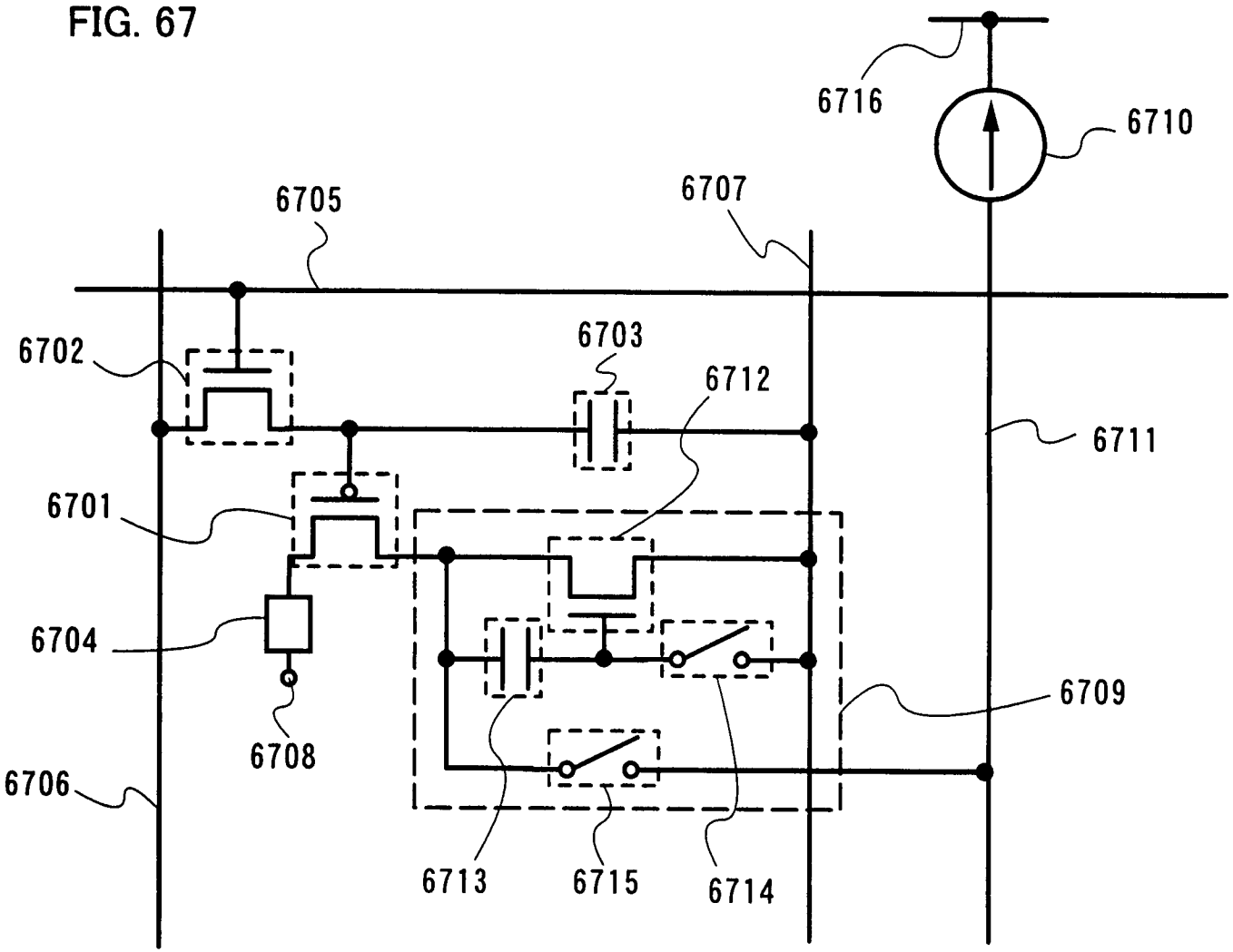
FIG. 67 is a diagram explaining a pixel structure applicable to a display device of the present invention.

Furthermore, a detailed structure example is shown in FIG. 67. The structure includes a driver transistor 6701, a switch transistor 6702, a first capacitor element 6703, a display element 6704, a scan line 6705, a signal line 6706, a power source line 6707, a current source transistor 6712, a second capacitor element 6713, a first switch 6714, and a second switch 6715.

A gate terminal of the switch transistor 6702 is connected to the scan line 6705, a first terminal (one of a source terminal and a drain terminal) thereof is connected to the signal line 6706, and a second terminal (the other of the source terminal and the drain terminal) thereof is connected to a gate terminal of the driver transistor 6701. In addition, the second terminal (the other of the source terminal and the drain terminal) of the switch transistor 6702 is connected to the power source line 6707 through the first capacitor element 6703. Furthermore, a first terminal (one of a source terminal and a drain terminal) of the driver transistor 6701 is connected to a first terminal (one of a source terminal and a drain terminal) of the power source transistor 6712. Then, a second terminal (the other of the source terminal and the drain terminal) of the current source transistor 6712 is connected to the power source line 6707. In addition, the first terminal of the current source transistor 6712 is connected to a current supply line 6711 through the second switch 6715. The second terminal of the current source transistor 6712 is connected to a gate terminal thereof through the first switch 6714. The second capacitor element 6713 is connected between the gate terminal and the first terminal of the current source transistor 6712. In addition, the current supply line 6711 is connected to a wire 6716 through a current source 6710.

In this structure, the current source circuit 6709 including the current source transistor 6712, the second capacitor element 6713, the first switch 6714, and the second switch 6715 corresponds to the current source circuit 5309 of the pixel in FIG. 53. Since the signal writing operation to the pixel and the light emission operation are common, explanation thereof is omitted. Accordingly, programming into the current source circuit 6709 is explained here.

When a current is programmed into the current source circuit 6709, the first switch 6714 and the second switch 6715 are turned on. Then, a current flowing to the current source 6710 is transiently diffused to flow to the second capacitor element 6713 and the current source transistor 6712. In the steady state, the current flowing to the current source 6710 flows to the current source transistor 6712. Then, a charge for a voltage between the gate terminal and the first terminal, in other words, a voltage Vgs between the gate terminal and the source terminal of the current source transistor 6712 for making the current to flow is accumulated in the capacitor element 6713.

In this state, the first switch 6714 and the second switch 6715 are turned off. In this manner, the voltage Vgs between the gate terminal and the source terminal of the current source transistor 6712 is held by the capacitor element 6713. Then, the programming into the current source circuit 6709 is completed. In other words, a current roughly equal to the current flowing to the current source 6710 can be made to flow to the display element 6704 when the driver transistor 6701 is turned on.

Note that various pixels can be applied to the display device of this embodiment mode, and the invention is not limited to the above-described pixel.

Subsequently, explanation is made on a driving method applicable to the display device described in Embodiment Mode 1.

Figure 14:
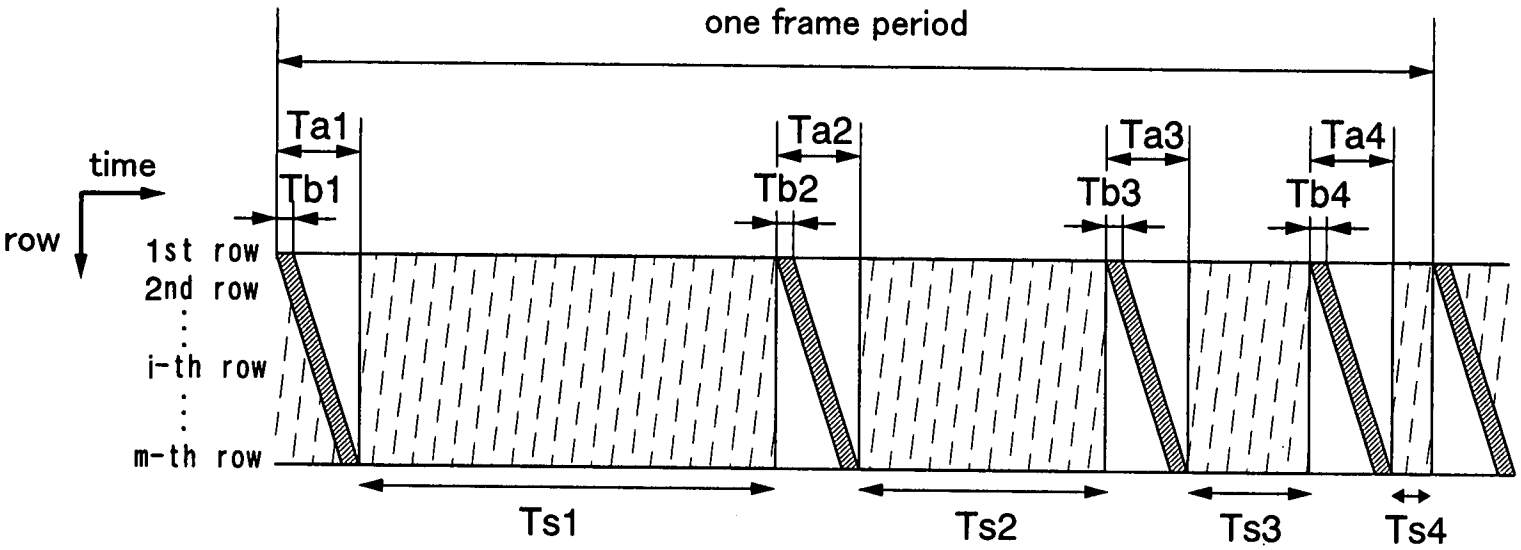
FIG. 14 is a diagram explaining a method for driving a display device of the present invention.

First, a driving method in the case where a signal writing period (address period) to the pixel and a light emission period (sustain period) are separated is explained with reference to FIG. 14. Here, the case of a 4-bit digital time gray scale is explained as an example.

Note that a period for displaying an image of one display region completely is referred to as one frame period. The one frame period includes a plurality of subframe periods, and one subframe period includes an address period and a sustain period. Address periods Ta1 to Ta4 denote time necessary for signal writing to pixels in all rows, and periods Tb1 to Tb4 denote time necessary for signal writing to pixels of a single row (or a single pixel). In addition, sustain periods Ts1 to Ts4 denote time for maintaining a lighting or non-lighting state in accordance with a video signal written to a pixel, and a ratio of lengths thereof is set to satisfy Ts1:Ts2:Ts3:Ts4=$2^3$:$2^2$:$2^1$:$2^0$=8:4:2:1. A gray scale is expressed depending on which sustain period light emission is performed in.

Operation is explained. First, in the address period Ta1, a pixel selection signal is input to scan lines sequentially from the first row to select a pixel. Then, a video signal is input to the pixel from a signal line when the pixel is selected. When the video signal is written to the pixel, the pixel holds the signal until a signal is input again. In accordance with the written video signal, lighting and non-lighting of each pixel in the sustain period Ts1 are controlled. In a similar manner, the video signal is input to the pixel in the address periods Ta2, Ta3, and Ta4, and lighting and non-lighting of each pixel in the sustain periods Ts2, Ts3, and Ts4 are controlled in accordance with the video signal. In each subframe period, a pixel is not lighted during an address period, a sustain period begins after the address period ends, and the pixel to which a signal for lighting is written is lighted.

Here, in the display device of the present invention, in the case where a video signal input in an address period in the preceding subframe period is identical in pixels of a single row with a video signal input in a subsequent subframe period, signal writing to the pixels of a single row is stopped in the subsequent subframe period.

Note that signal data is compared in the first subframe period in one frame period with that for pixels in the same row in the last subframe period in one frame period before. When data of a signal for pixels in the row is identical, the signal is not written to the pixels in the row in the first subframe period in one frame period.

Accordingly, charging and discharging with a charge can be reduced, so that power consumption can be reduced.

For example, charging and discharging with a charge of wire cross capacitance of a scan line connected to the pixels in the row and gate capacitance of a transistor connected to the scan line can be omitted by preventing a signal selecting a pixel from being input to the scan line in the subsequent frame period. Therefore, a signal not selecting a pixel may be kept being input to the scan line, or the scan line may be put in a floating state.

In addition, in the subsequent subframe period, power consumption can be reduced by putting a signal line in a floating state or inputting such a potential as to reduce charging and discharging with a charge into the signal line in a signal writing period to the pixels in the row. As such a potential as to reduce charging and discharging with a charge, a signal written right before to pixels of a single row may be input to the signal line without any change.

Note that the case of expressing a 4-bit gray scale is explained here, but the number of bits and gray scale levels are not limited thereto. In addition, it does not take the order of lighting to be Ts1, Ts2, Ts3, and Ts4, and the order may be random or light emission may be performed with the sustain period divided into a plurality periods.

Note that such a driving method can be used for a display device including, for example, the pixel shown in FIG. 10 or the pixel shown in FIG. 13. In the address periods Ta1 to Ta4, potentials of the second electrode 1008 of the display element 1004 or the second electrode 1308 of the display element 1304 may be set higher than that in the sustain period, and may be set to be equal to or lower than a forward threshold voltage of the display element 1004 or the display element 1304. Alternatively, the second electrode 1308 of the display element 1304 may be put in a floating state.

Subsequently, a driving method in the case where the signal writing period (address period) to the pixel and the light emission period (sustain period) are not separated is explained. In other words, a pixel in a row in which write operation of a video signal is completed holds the signal until next signal writing (or erasure) to the pixel is performed. A period from write operation to next signal writing operation to the pixel is referred to as data hold time. Then, during the data hold time, the pixel is put in a lighting or non-lighting state in accordance with a video signal written to the pixel. The same operation is performed to the last row, and then, the address period ends. Then, operation proceeds to signal writing operation in a next subframe period sequentially from a row in which the data hold time ends.

In the case of a driving method in which the pixel is put in a lighting or non-lighting period in accordance with a video signal written to the pixel immediately after signal writing operation is completed and data hold time starts, a signal cannot be input to two rows at the same time and address periods need to be prevented from overlapping. Therefore, even if the data hold time is attempted to be made shorter than the address period, the data hold time cannot be made short. As a result, it becomes difficult to perform high level gray scale display.

Thus, the data hold time is set to be shorter than the address period by providing an erase period. A drive method in the case of setting the data hold time shorter than the address period by providing an erase period is explained using FIG. 20A.

In the address period Ta1, a scan signal is input to a scan line sequentially from the first row to select a pixel. Then, when the pixel is selected, a video signal is input to the pixel from a signal line. When the video signal is input to the pixel, the pixel holds the signal until a signal is input again. In accordance with the written video signal, lighting and non-lighting of each pixel in the sustain period Ts1 are controlled. In other words, in a row in which write operation of the video signal is completed, the pixel is immediately put in a lighting or non-lighting state in accordance with the written video signal. The same operation is performed to the last row, and the address period Ta1 ends. Then, operation proceeds to signal writing operation in a next subframe period sequentially from a row in which the data hold time ends. In a similar manner, a video signal is input to a pixel in the address periods Ta2, Ta3, and Ta4, and lighting and non-lighting of each pixel in the sustain periods Ts2, Ts3, and Ts4 are controlled in accordance with the video signal. Then, the termination of the sustain period Ts4 is set by the start of erase operation. This is because, when the signal written to the pixel is erased in erasing time Te of each row, the pixel is forced to be in a non-lighting state regardless of the video signal written to the pixel in the address period until signal writing is performed to a next pixel. In other words, the data hold time ends from a pixel in a row where the erasing time Te starts.

Thus, a display device having data hold time shorter than an address period, a high level gray scale, and a high duty ratio (ratio of a lighting period to one frame period) can be provided without separating the address period and the sustain period. In addition, the reliability of the display element can be improved since instantaneous luminance can be lowered.

Here, in the display device of the present invention, signal writing to pixels of a single row is stopped when data of a video signal for a single pixel row in which the signal is to be written to a pixel in a certain subframe period in one frame period is identical with data of a video signal for the pixel row already written thereto. In other words, such a driving method is suitable when performing high level gray scale display. When high level gray scale display is performed, the number of times signal writing to the pixel is carried out is increased. Thus, power consumption can be reduced by reducing the number of times charging and discharging are carried out as in the case of the display device of the present invention.

Note that the case of expressing a 4-bit gray scale is explained here, but the number of bits and gray scale levels are not limited thereto. In addition, it does not take the order of lighting to be Ts1, Ts2, Ts3, and Ts4, and the order may be random or light emission may be performed with the sustain period divided into a plurality periods.

Figure 18:
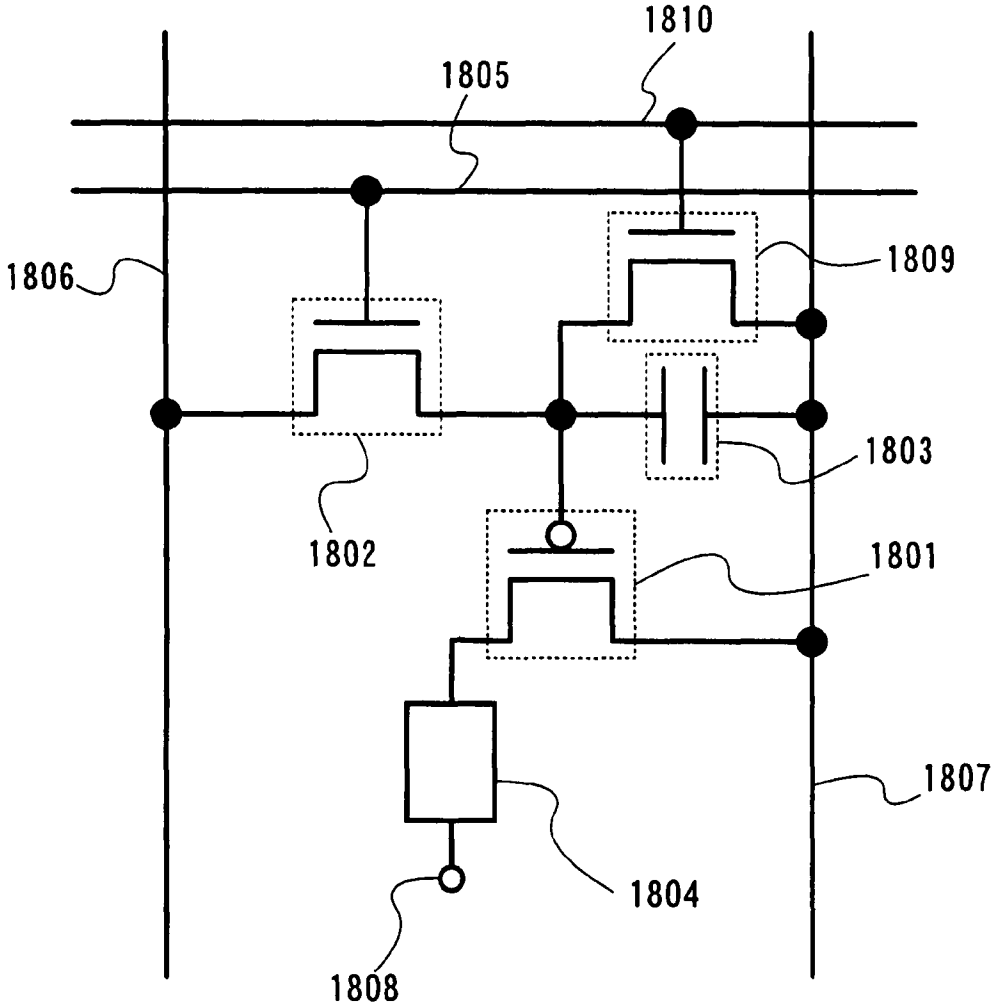
FIG. 18 is a diagram explaining a pixel structure applicable to a display device of the present invention.

Erase operation for starting the above-described erasing time can be performed by selecting a pixel by inputting a signal to the second scan line 1510 in the structures of FIGS. 15 to 17, the second scan line 1810 in the structure of FIG. 18, or the second scan line 1902 in the structure of FIG. 19.

An example of the display device having such a pixel is shown in FIG. 74. The display device includes the signal line driver circuit 7401, the first scan line driver circuit 7402, the second scan line driver circuit 7405, and the pixel portion 7403, and in the pixel portion 7403, pixels 7404 are arranged in matrix relative to the first scan lines G1 to Gm, the second scan lines R1 to Rm, and the signal lines S1 to Sn.

Note that the first scan line Gi (any one of the first scan lines G1 to Gm) corresponds to the first scan line 1505 of FIG. 15, 16, or 17, the first scan line 1805 of FIG. 18, or the first scan line 1305 of FIG. 19. The second scan line R1 (any one of the second scan lines R1 to Rm) corresponds to the second scan line 1510 of FIG. 15, 16, or 17, the second scan line 1810 in FIG. 18, or the second scan line 1902 of FIG. 19. The signal line Sj (any one of the signal lines S1 to Sn) corresponds to the first signal line 1506 of FIG. 15, 16, or 17, the signal line 1806 of FIG. 18, or the signal line 1306 of FIG. 19.

Signals such as a clock signal (G_CLK), an inverted clock signal (G_CLKB), a start pulse signal (G_SP), and an output control signal (G_ENABLE) are input to the first scan line driver circuit 7402. In accordance with these signals, a signal is output to the first scan line Gi (any one of the first scan lines G1 to Gm) of a pixel row to be selected.

Signals such as a clock signal (R_CLK), an inverted clock signal (R_CLKB), a start pulse signal (R_SP), and an output control signal (R_ENABLE) are input to the second scan line driver circuit 7405. In accordance with these signals, a signal is output to the second scan line R1 (any one of the second scan lines R1 to Rm) of a pixel row to be selected.

In addition, signals such as a clock signal (S_CLK), an inverted clock signal (S_CLKB), a start pulse signal (S_SP), a video signal (Digital Video Data), and an output control signal (R_ENABLE) are input to the signal line driver circuit 7401. Then, in accordance with these signals, a video signal corresponding to a pixel of each column is output to each of the signal lines S1 to Sn.

Thus, the video signal input to the signal lines S1 to Sn is written to the pixel 7404 in each column of a pixel row selected by the signals input to the first scan line Gi (any one of the first scan lines G1 to Gm). Then, each pixel row is selected by each of the first scan lines G1 to Gm, and video signals corresponding to respective pixels 7404 are written to all of the pixels 7404. Each pixel 7404 holds data of the video signal written thereto for a certain period. Each pixel 7404 can maintain a lighting or non-lighting state by holding the data of the video signal for a certain period.

In addition, a signal for putting the pixel in a non-lighting state (also referred to as an erasing signal) is written to the pixel 7404 of each column in a pixel row selected by the signals input to the second scan line R1 (one of the first scan lines R1 to Rm). Then, a non-lighting period can be set by selecting each pixel row by each of the second scan lines R1 to Rm. For example, in FIG. 20, erasing time Te is one gate selection period (one horizontal period) in the second scan line R1.

In addition, the display device of the present invention includes output control circuits in the signal line driver circuit 7401, the first scan line driver circuit 7402, and the second scan line driver circuit 7405.

In other words, information showing whether or not data of the video signal for a single pixel row in which the video signal is to be written to a pixel in a certain subframe period in one frame period is identical with data of a signal (a video signal or an erasing signal) for the pixel row already written thereto is transmitted to the first scan line driver circuit 7402 by an output control signal (G_ENABLE) and to the signal line driver circuit 7401 by an output control signal (S_ENABLE). This erasing signal puts pixels of a single row selected by the second scan line driver circuit in the preceding subframe period in a non-lighting state. When data is identical, the output control circuit of the first scan line driver circuit 7402 does not output a signal selecting the pixel row. In other words, an L signal for not selecting the pixel row is input to a first scan line of the pixel row, or the first scan line of the pixel row is put in a floating state. In addition, the output control circuit of the signal line driver circuit 7401 also does not output the video signal. The output from the signal line driver circuit 7401 may be a signal for putting a pixel in a lighting state or may be a signal for putting a pixel in a non-lighting state. Such a signal consuming as little power as possible may be input. Further, the signal lines S1 to Sn may be put in a floating state.

In the case where data of a signal for pixels of a single row already written to the pixel row in which a signal is to be erased in a certain subframe period in one frame period is for non-lighting, the information is transmitted to the second scan line driver circuit 7405 by the output control signal (G_ENABLE). Then, the output control circuit of the second scan line driver circuit 7405 is prevented from outputting a signal selecting the pixel row. In other words, an L signal for not selecting the pixel row is input to a second scan line of the pixel row, or the second scan line of the pixel row is put in a floating state. The output control circuit of the signal line driver circuit 7401 is also prevented from outputting the video signal.

Thus, according to the display device of the present invention, focusing on a certain pixel row, a signal can be prevented from being input to the pixel row when a signal already input to the pixel row is identical with a signal to be input. Therefore, the number of times charging and discharging of the scan line and the signal line are carried out can be reduced, so that power consumption can be reduced.

Figure 20A:
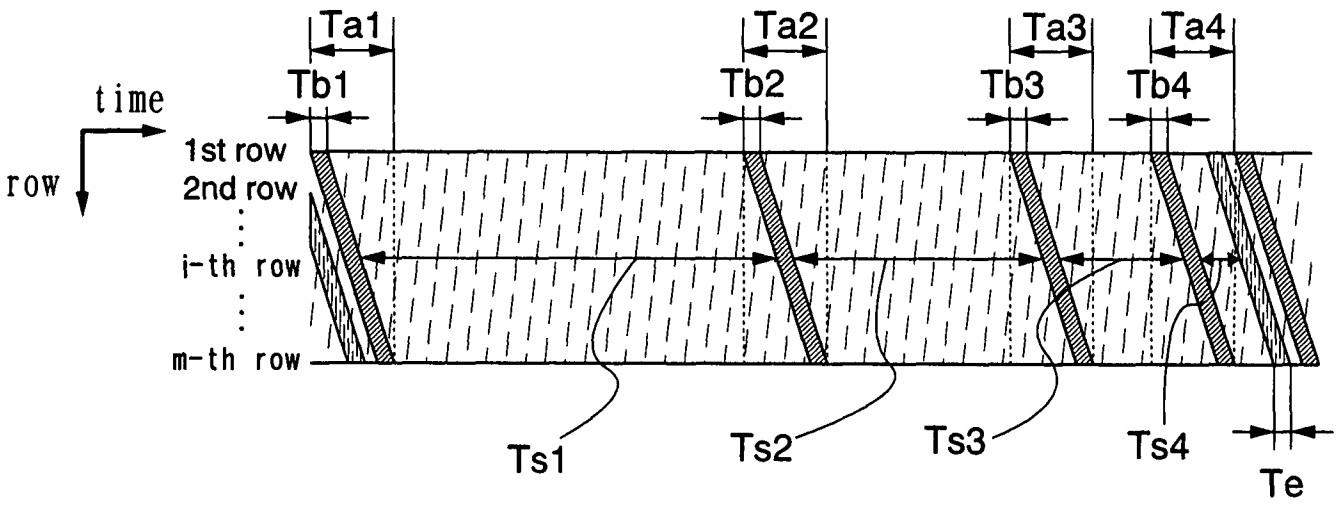
FIGS. 20A and 20B are diagrams explaining a method for driving a display device of the present invention.
Figure 20B:
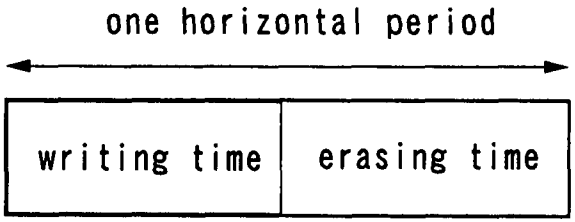
Figure 37:
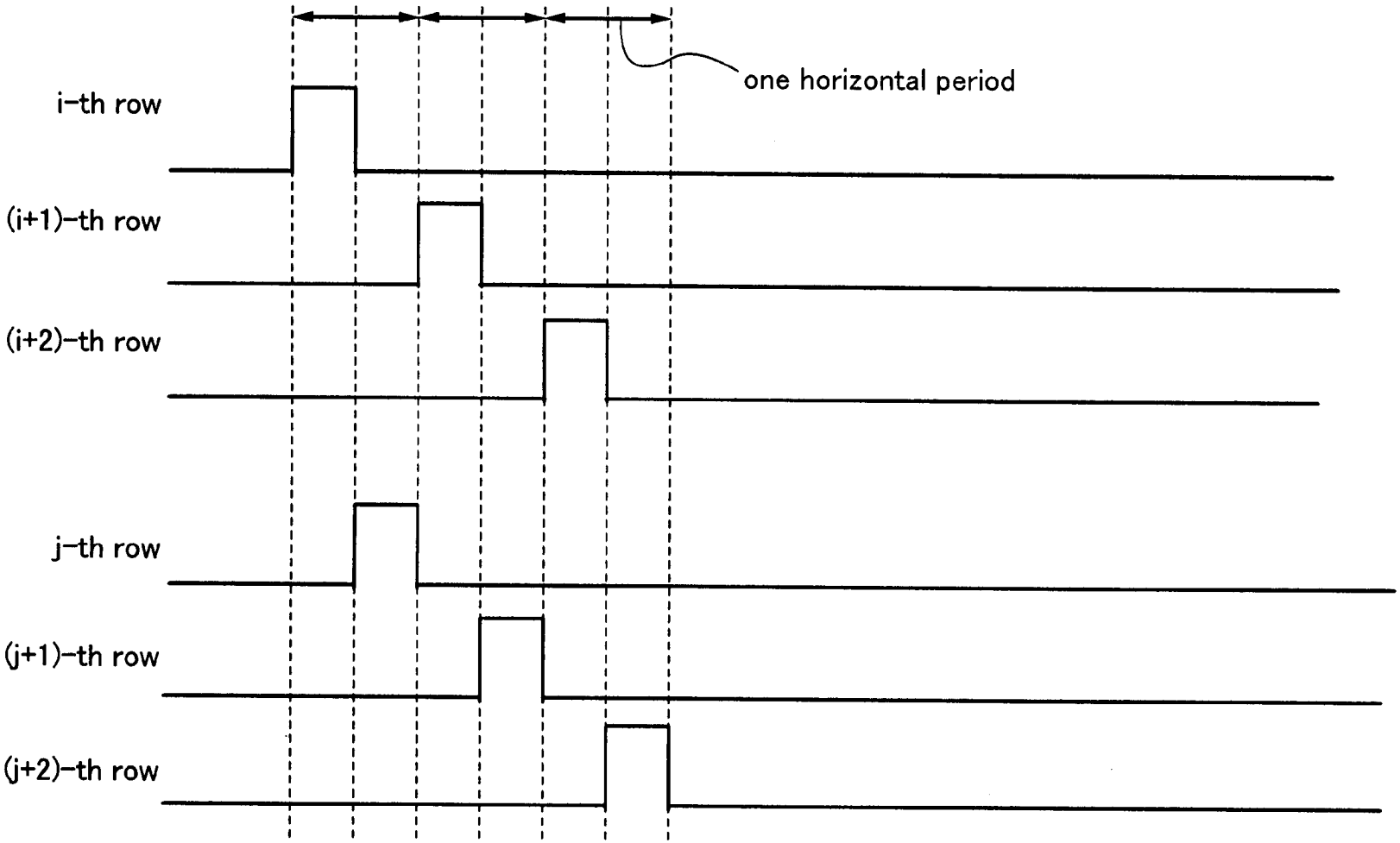
FIG. 37 is a diagram explaining a method for driving a display device of the present invention.

In addition, a gray scale in the case where data hold time is shorter than the address period as in FIG. 20A can be expressed with the pixel structure in FIG. 10 by providing writing time for write operation and erasing time for erase operation in one horizontal period as shown in FIG. 20B. For example, one horizontal period is divided into two periods as shown in FIG. 37. Here, explanation is made assuming that the former half is write time and the latter half is erasing time. In the divided horizontal period, each scan line 1005 is selected, and at that time, a corresponding signal is input to the signal line 1006. For example, i-th row is selected in the former half of a certain horizontal period and j-th row is selected in the latter half. Then, operation can be performed as if two rows are selected at the same time in one horizontal period. In other words, the video signals are written to pixels from the signal line 1006 in the writing time Tb1 to Tb4 using writing time that is the former half of each one horizontal period. Then, a pixel is not selected in erasing time that is the latter half of the one horizontal period at this time. In addition, an erasing signal is input to a pixel from the signal line 1006 in erasing time Te using erasing time that is the latter half of another horizontal period. In writing time that is the former half of one horizontal period at this time, a pixel is not selected. In accordance with that, a display device having a high aperture ratio can be provided and a yield can be improved.

Here, in the display device of the present invention, video signal writing to pixels of a single row is stopped when data of a video signal for a single pixel row in which the signal is to be written to a pixel in a certain subframe period in one frame period is identical with data of a signal (a video signal or an erasing signal) for the pixel row already input thereto. When data of a signal (a video signal or an erasing signal) for a single pixel row in which the erasing signal is to be input to a pixel is a signal for putting the pixel in a non-lighting state, the input of the erasing signal to the pixels of a single row is stopped. When high level gray scale display is performed, the number of times signal writing or erasing to the pixel is carried out is increased. However, the display device of the present invention can reduce power consumption by reducing the number of times charging and discharging are carried out. In other words, such a driving method is suitable when performing high level gray scale display.

Figure 75:
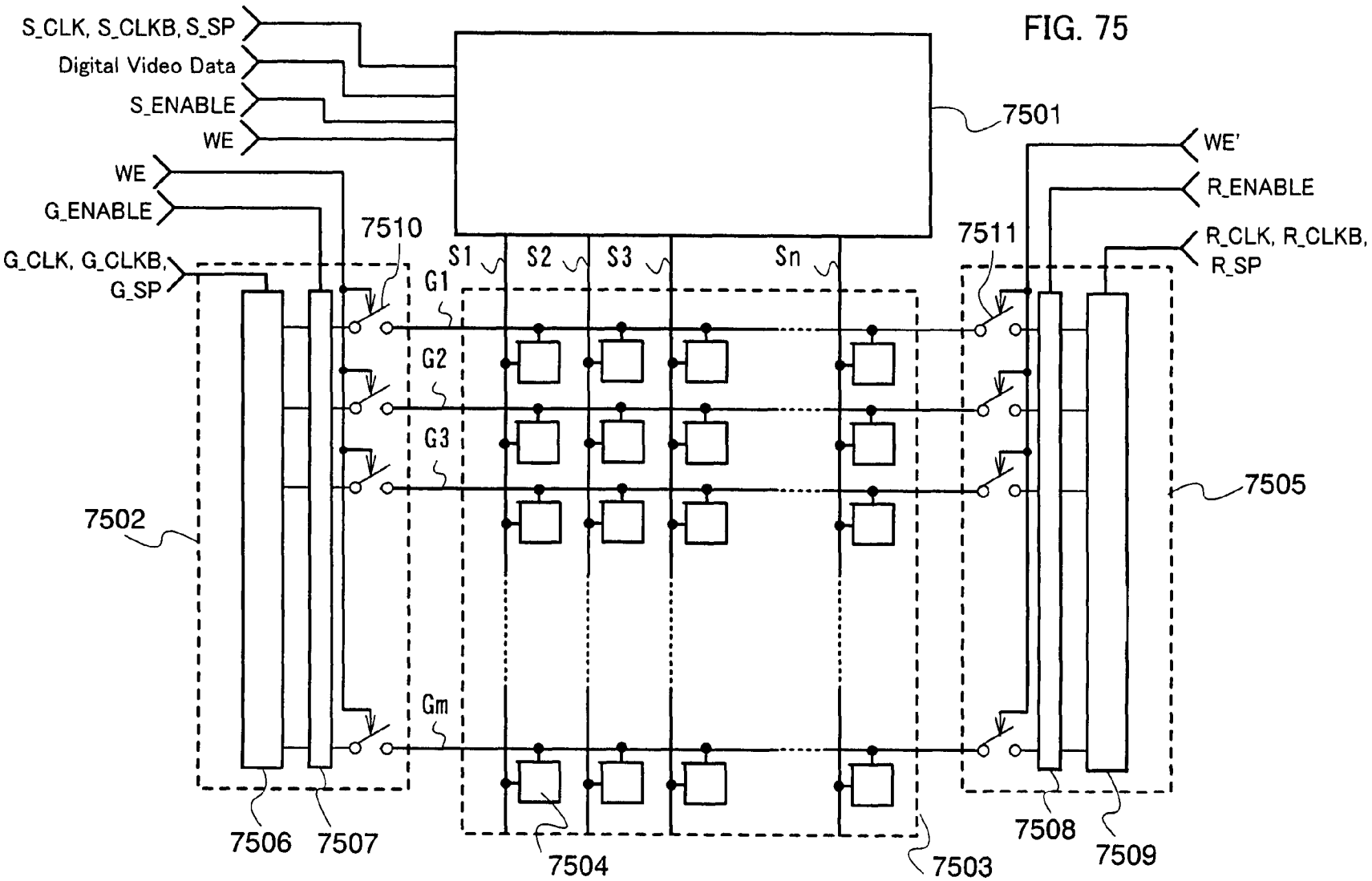
FIG. 75 is a diagram explaining a display device of the present invention.

An example of a display device including such a pixel is shown in FIG. 75. The display device includes a signal line driver circuit 7501, a first scan line driver circuit 7502, a second scan line driver circuit 7505, and a pixel portion 7503, and in the pixel portion 7503, pixels 7504 are arranged in matrix relative to scan lines G1 to Gm and signal lines S1 to Sn.

The first scan line driver circuit 7502 includes a pulse output circuit 7506, an output control circuit 7507, and a switch group 7510.

The second scan line driver circuit 7505 includes a pulse output circuit 7509, an output control circuit 7508, and a switch group 7511.

Note that a scan line Gi (any one of the scan lines G1 to Gm) corresponds to the scan line 1005 of FIG. 10, and a signal line Sj (any one of the signal lines S1 to Sn) corresponds to the signal line 1006 of FIG. 10.

Signals such as a clock signal (G_CLK), an inverted clock signal (G_CLKB), a start pulse signal (G_SP), an output control signal (G_ENABLE), and a control signal (WE) are input to the first scan line driver circuit 7502. In accordance with these signals, a signal selecting a pixel is output to a first scan line Gi (any one of the first scan lines G1 to Gm) of a pixel row to be selected. Note that the signal at this time is a pulse output in the former half of one horizontal period as shown in the timing chart of FIG. 37.

Signals such as a clock signal (R_CLK), an inverted clock signal (R_CLKB), a start pulse signal (R_SP), an output control signal (R_ENABLE), and a control signal (WE') are input to the second scan line driver circuit 7505. In accordance with these signals, a signal is output to a second scan line R1 (any one of the second scan lines R1 to Rm) of a pixel row to be selected. Note that the signal at this time is a pulse output in the latter half of one horizontal period as shown in the timing chart of FIG. 37.

In addition, signals such as a clock signal (S_CLK), an inverted clock signal (S_CLKB), a start pulse signal (S_SP), a video signal (Digital Video Data), and an output control signal (S_ENABLE) are input to the signal line driver circuit 7501. In accordance with these signals, a video signal corresponding to a pixel of each column is output to each of the signal lines S1 to Sn.

Thus, the video signal input to the signal lines S1 to Sn is written to the pixel 7504 in each column of a pixel row selected by the signals input to the scan line Gi (any one of the scan lines G1 to Gm) from the first scan line driver circuit 7502. Then, each pixel row is selected by each of the scan lines G1 to Gm, and video signals corresponding to respective pixels 7504 are written to all pixels 7504. Each pixel 7504 holds data of the video signal written thereto for a certain period. Each pixel 7504 can maintain a lighting or non-lighting state by holding the data of the video signal for a certain period.

In addition, a signal for putting the pixel in a non-lighting state (also referred to as an erasing signal) is written from the signal lines S1 to Sn to the pixel 7504 of each column in a pixel row selected by the signals input to the scan line Gi (one of the scan lines G1 to Gm) from the second scan line driver circuit 7505. Then, a non-lighting period can be set by selecting each pixel row by each of the scan lines G1 to Gm. For example, time for which the pixels in i-th row are selected by the signal input to the scan line Gi from the second scan line driver circuit 7505 is erasing time Te in FIG. 20.

In addition, the display device of the present invention includes output control circuits in the signal line driver circuit 7501, the first scan line driver circuit 7502, and the second scan line driver circuit 7505. In other words, a signal showing whether or not data of a signal (a video signal or an erasing signal) for a single pixel row in which the signal is to be written to a pixel in a certain subframe period in one frame period is identical with data of a signal (a video signal or an erasing signal) for the pixel row already written thereto is input to the first scan line driver circuit 7502 by an output control signal (G_ENABLE), to the second scan line driver circuit 7505 by an output control signal (R_ENABLE), and to the signal line driver circuit 7501 by an output control signal (S_ENABLE). When data is identical, the output control circuits of the first scan line driver circuit 7502 and the second scan line driver circuit 7505 are prevented from outputting a signal selecting the pixel row. In other words, an L signal for not selecting a pixel row is input to a scan line of the pixel row, or the scan line of the pixel row is put in a floating state. In addition, the output control circuit of the signal line driver circuit 7501 is also prevented from outputting the video signal. The output from the signal line driver circuit 7501 may be a signal for putting a pixel in a lighting state or may be a signal for putting a pixel in a non-lighting state. Such a signal consuming as little power as possible may be input. Further, the signal lines S1 to Sn may be put in a floating state.

Thus, according to the display device of the present invention, focusing on a certain pixel row, a signal can be prevented from being input to the pixel row when a signal already input to the pixel row is identical with a signal to be input. Therefore, the number of times charging and discharging of the scan line and the signal line are carried out can be reduced, so that power consumption can be reduced.

Note that the pixel structure of the display device of the present invention is not limited to the structures described above, and various pixel structures can be applied. In addition, the driving method of the present invention is also not limited to the driving methods described above, and various driving methods can be applied.

Note that according to the display device of the present invention, signal writing to pixels of a single row is stopped when data of a signal for a single pixel row in which the signal is to be written is identical with data of a signal for a single row already written to the pixel row. Therefore, the number of times charging and discharging are carried out can be reduced, so that power consumption can be reduced.

In particular, power consumption can further be reduced when the number of subframes is increased to perform high level gray scale display.

Figure 51:
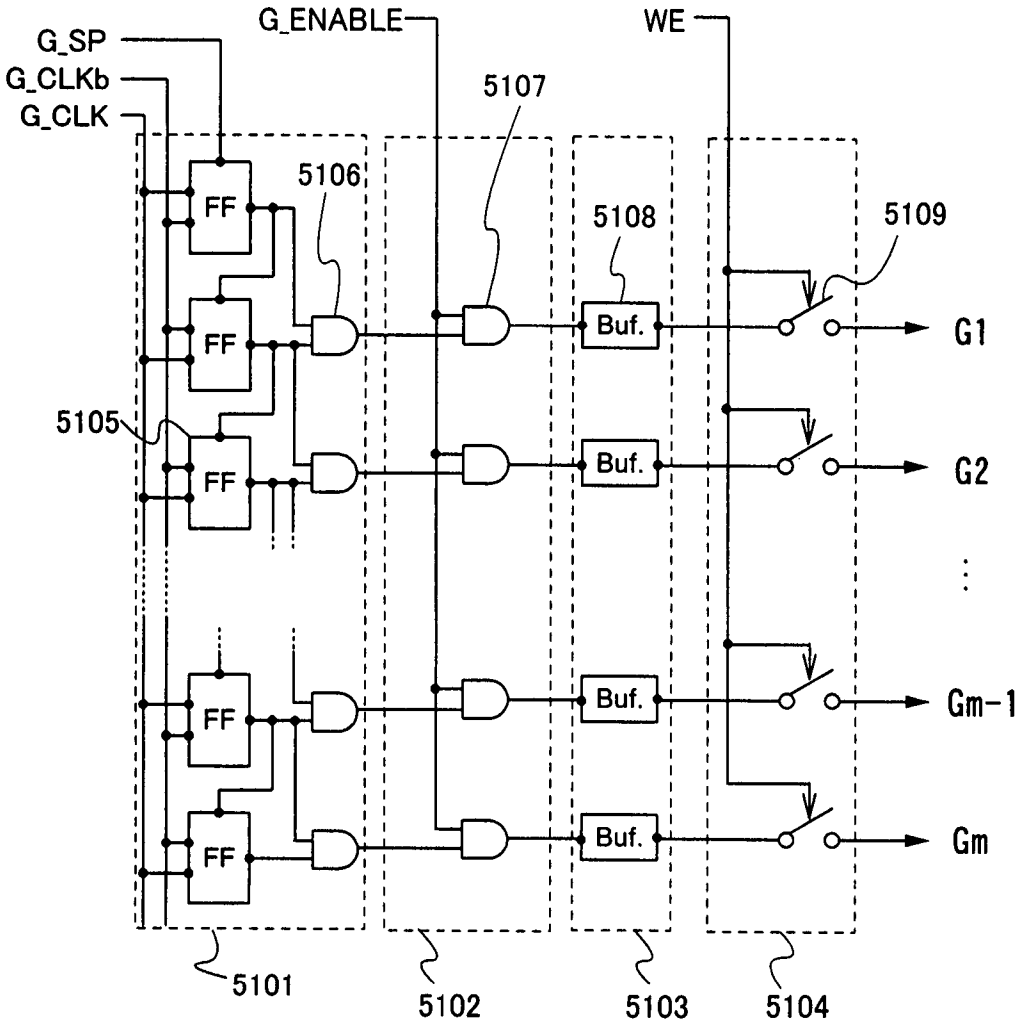
FIG. 51 is a diagram explaining a scan line driver circuit applicable to a display device of the present invention.

Note that the structure of FIG. 51 can be applied to the scan line driver circuit of the display device of this embodiment mode.

The scan line driver circuit shown in FIG. 51 includes a pulse output circuit 5101, an output control circuit 5102, a buffer circuit 5103, and a switch group 5104. The pulse output circuit 5101 includes plural stages of flip-flop circuits (FF) 5105 and AND gates 5106, and two input terminals of the AND gate 5106 are connected to output terminals of adjacent flip-flop circuits (FF) 5105. In other words, one redundant flip-flop circuit (FF) 5105 with respect to the AND gates 5106 is provided in each stage, and outputs from adjacent flip-flop circuits (FF) 5105 are input to the AND gate 5106 of each stage provided relative to scan lines G1 to Gm.

A clock signal (G_CLK) and an inverted clock signal (G_CLKB) are input to each flip-flop circuit (FF) 5105, and a start pulse signal (G_SP) is input to the flip-flop circuit 5105 of the first stage. The start pulse signal is delayed for one pulse of the clock signal when input to the flip-flop circuit 5105 of the next stage. Therefore, a pulse output from the AND gate 5106 of the first row to which the outputs from the redundant flip-flop circuit 5105 of the first stage and the flip-flop circuit 5105 of the next stage are input is one pulse of the clock signal. This pulse is input as a scan signal SC.1 to one of input terminals of the AND gate 5107 corresponding to the first stage of the output control circuit 5102. Similarly, the output from the AND gate 5106 in i-th row and the output from the AND gate 5106 in m-th row are input as scan signals to respective one of input terminals of the AND gates 5707 of respective stages of the output control circuit 5102. An output control signal (G_ENABLE) is input to the other input terminal of the AND gate 5106 of the output control circuit 5102. In accordance with the output control signal (G_ENABLE), it is determined whether or not a scan signal is output. Here, for example, in the case where the output control signal (G_ENABLE) is at an L level when a pulse of the scan signal is output from the AND gate 5106 in the first stage, the output from the AND gate 5107 of the first stage is at an L level. On the other hand, in the case where the output control signal (G_ENABLE) is at an H level when a pulse of the scan signal is output from the AND gates 5106 of all stages, the pulse of the scan signal is sequentially output from the output control circuit 5102.

The scan signal output from the output control circuit 5102 is input to a buffer 5108 of each stage of the buffer circuit 5103 and is output as a pixel selection signal having high current supply capability.

The pixel selection signal output from the buffer circuit 5103 is supplied to the scan lines G1 to Gm through the switch group 5104 in the former half or latter half of one horizontal period. In other words, a switch 5109 of each stage of the switch group 5104 is turned on in the former half or latter half of one horizontal period.

Embodiment Mode 6

In this embodiment mode, explanation is made on a main structure of the display device of the present invention. First, explanation is made with reference to a block diagram of FIG. 2. This structure is a display device which stops signal writing to a pixel when data of a video signal for a single pixel row in which the signal is to be written to a pixel in a certain subframe period in one frame period is identical with data of a video signal for the pixel row in the last subframe period.

When an analog video signal (Analog Video Data) is input to an analog digital converter circuit 201, it is converted into a digital video signal (Digital Video Data), and the digital video signal is input to a memory write selection circuit 202 from the analog digital converter circuit 201.

In the memory write selection circuit 202, a digital video signal for one frame is divided into data for each subframe and written to either a frame memory A 203 or a frame memory B 204 in accordance with a signal input from a display controller 207. Note that SF1, SF2, and SF3 are shown as subframes in each of the frame memory A 203 and the frame memory B 204 in FIG. 2, but the number of subframes is not limited thereto.

In addition, a determination circuit 205 compares data of video signals input to pixels of a single row corresponding to subframe periods having preceding and following timing to write video signals to pixels in each of the frame memory A 203 and the frame memory B 204 in accordance with a signal input from the display controller 207. Then, a write control signal showing whether or not data of video signals input to the pixels of a single row matches is input to a memory read selection circuit 206 and the display controller 207.

In accordance with a signal from the display controller 207, the memory read selection circuit 206 reads the digital video signal for one frame which is written to either the frame memory A 203 or the frame memory B 204 and inputs the video signal to the display controller 207. Here, in the case where a signal showing that data of video signals input to pixels of a single row corresponding to subframe periods having preceding and following timing to write the video signals to the pixels match is input to the memory read selection circuit 206, the memory read selection circuit 206 stops the reading of the video signal for pixels of a single row in a subsequent subframe period among the digital video signals for one frame written to either the frame memory A 203 or the frame memory B 204, regardless of the signal from the display controller 207.

In addition, the display controller 207 inputs start pulse signals (G_SP, S_SP), clock signals (G_CLK, S_CLK), output control signals (G_ENABLE, S_ENABLE), a drive voltage, a video signal (Digital Video Data), and the like to a display 208.

In other words, the display controller 207 is prevented from outputting the start pulse signal (S_SP) corresponding to a pixel row in which the signal is to be written to a pixel so as to be prevented from outputting a sampling pulse which converts a video signal for the pixel row from serial data to parallel data in the case where data of a video signal for the pixel row in a certain subframe period in one frame period is identical with data of a video signal for the pixel row in the last subframe period. In addition, the display controller 207 inputs to the display 208 the output control signals (G_ENABLE, S_ENABLE) for controlling whether or not a scan signal from a scan line driver circuit and a video signal from a signal line driver circuit are output.

Figure 2:
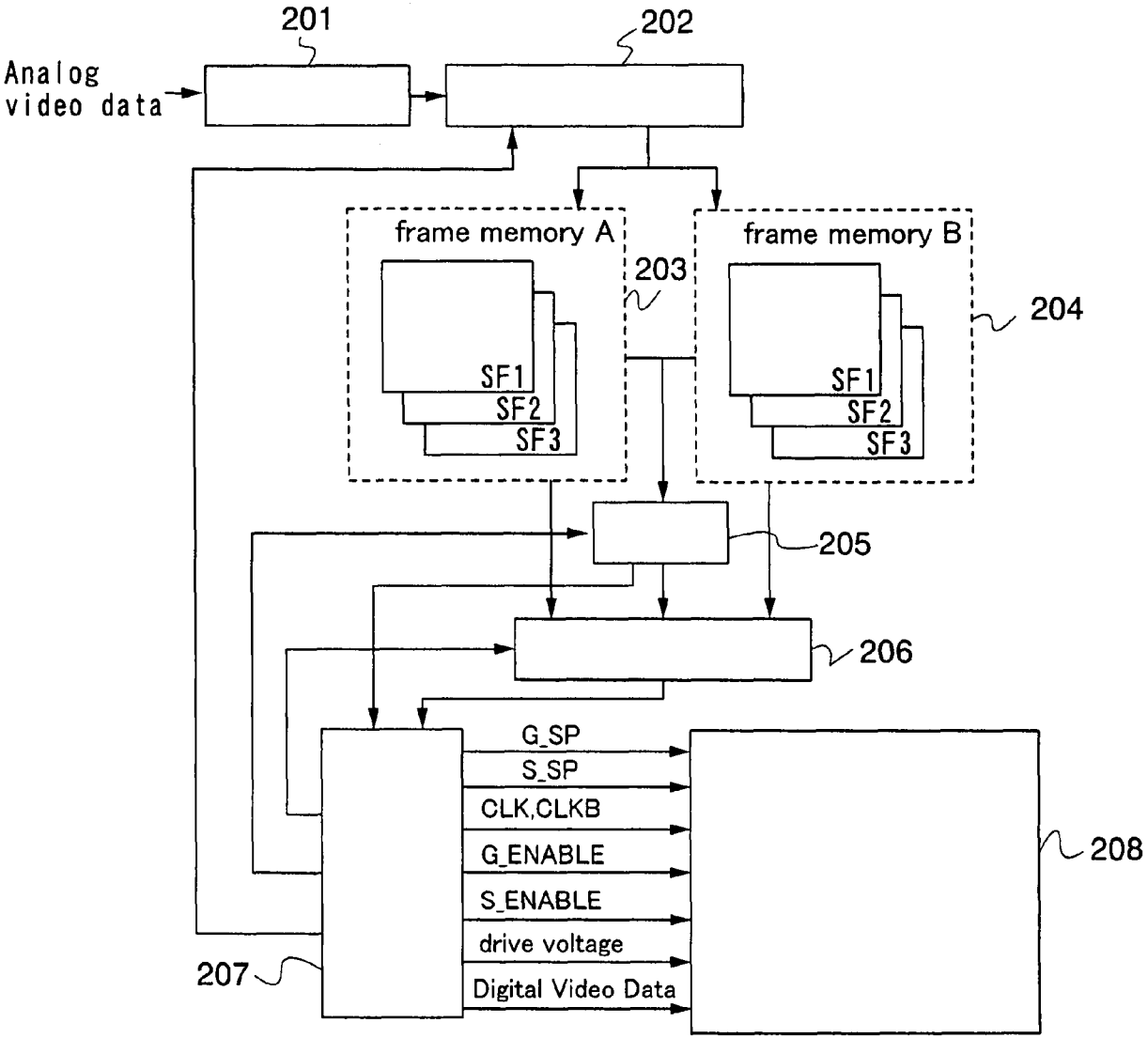
FIG. 2 is a diagram explaining a main structure of a display device of the present invention.

Note that the display 208 in FIG. 2 corresponds to a display panel in which a pixel portion where pixels are arranged in matrix and a peripheral driver circuit (such as a scan line driver circuit and a signal line driver circuit) of the pixel portion are formed on a substrate. Note that, in the display panel, the peripheral driver circuit may be formed on an IC chip and mounted on a substrate by COG (Chip On Glass) or the like, or the peripheral driver circuit is integrated with the pixel portion on the substrate. Note that the IC chip means a chip in which an electronic circuit is formed with an element including a semiconductor element on the surface of a semiconductor substrate or an insulating substrate, or inside a semiconductor substrate. Note that an IC chip which is manufactured by baking a circuit pattern on a silicon wafer is also referred to as a semiconductor chip.

Next, a main structure of another display device is explained. Explanation is made with reference to a block diagram shown in FIG. 23.

When an analog video signal (Analog Video Data) is input to an analog digital converter circuit 2301, it is converted into a digital video signal (Digital Video Data), and the digital video signal is input to a memory write selection circuit 2302 from the analog digital converter circuit 2301.

In the memory write selection circuit 2302, the digital video signal for one frame is divided into data for each subframe and is written to either a frame memory A 2303 or a frame memory B 2304 in accordance with a signal input from a display controller 2307. Note that SF1, SF2, and SF3 are shown as subframes in each of the frame memory A 2303 and the frame memory B 2304 in FIG. 23, but the number of subframes is not limited thereto.

In accordance with a signal from the display controller 2307, a memory read selection circuit 2306 reads the digital video signal for one frame which is written to either the frame memory A 2303 or the frame memory B 2304 and inputs the video signal to a line memory 2309.

A signal showing data of which subframe and which pixel row of either the frame memory A 2303 or the frame memory B 2304 is input to the line memory 2309 is input to a determination circuit 2305 from the display controller 2307. In accordance with the signal, data of pixels of a single row is compared with data of the pixels in the same row in the preceding subframe. Then, a write control signal showing whether or not data of video signals input to the pixels of a single row matches is input to the line memory 2309 and the display controller 2307.

The data of the video signal input to pixels of a single row is input to the display controller 2307 from the line memory 2309. Here, in the case where a signal showing that the data of a pixel row input to the line memory 2309 matches data written to the pixel row in the preceding subframe is input to the line memory 2309 by the determination circuit 2305, the line memory 2309 does not input the video signal for pixels of a single row to the display controller 2307.

In addition, the display controller 2307 inputs start pulse signals (G_SP, S_SP), clock signals (G_CLK, S_CLK), output control signals (G_ENABLE, S_ENABLE), a drive voltage, a video signal (Digital Video Data), and the like to a display 2308.

In other words, the display controller 2307 is prevented from outputting the start pulse signal (S_SP) corresponding to a pixel row in which the signal is to be written to a pixel so as to be prevented from outputting a sampling pulse which converts the video signal for the pixel row from serial data into parallel data in the case where data of a video signal for a single pixel row in a certain subframe period in one frame period is identical with data of a video signal for the pixel row in the last subframe period. In addition, the display controller 2307 inputs to the display 2308 the output control signals (G_ENABLE, S_ENABLE) for controlling whether or not a scan signal from a scan line driver circuit and a video signal from a signal line driver circuit are output. When data of the video signal is identical with data of a video signal for a single row in the last subframe period, the data of the video signal is not input to the display 2308.

Figure 23:
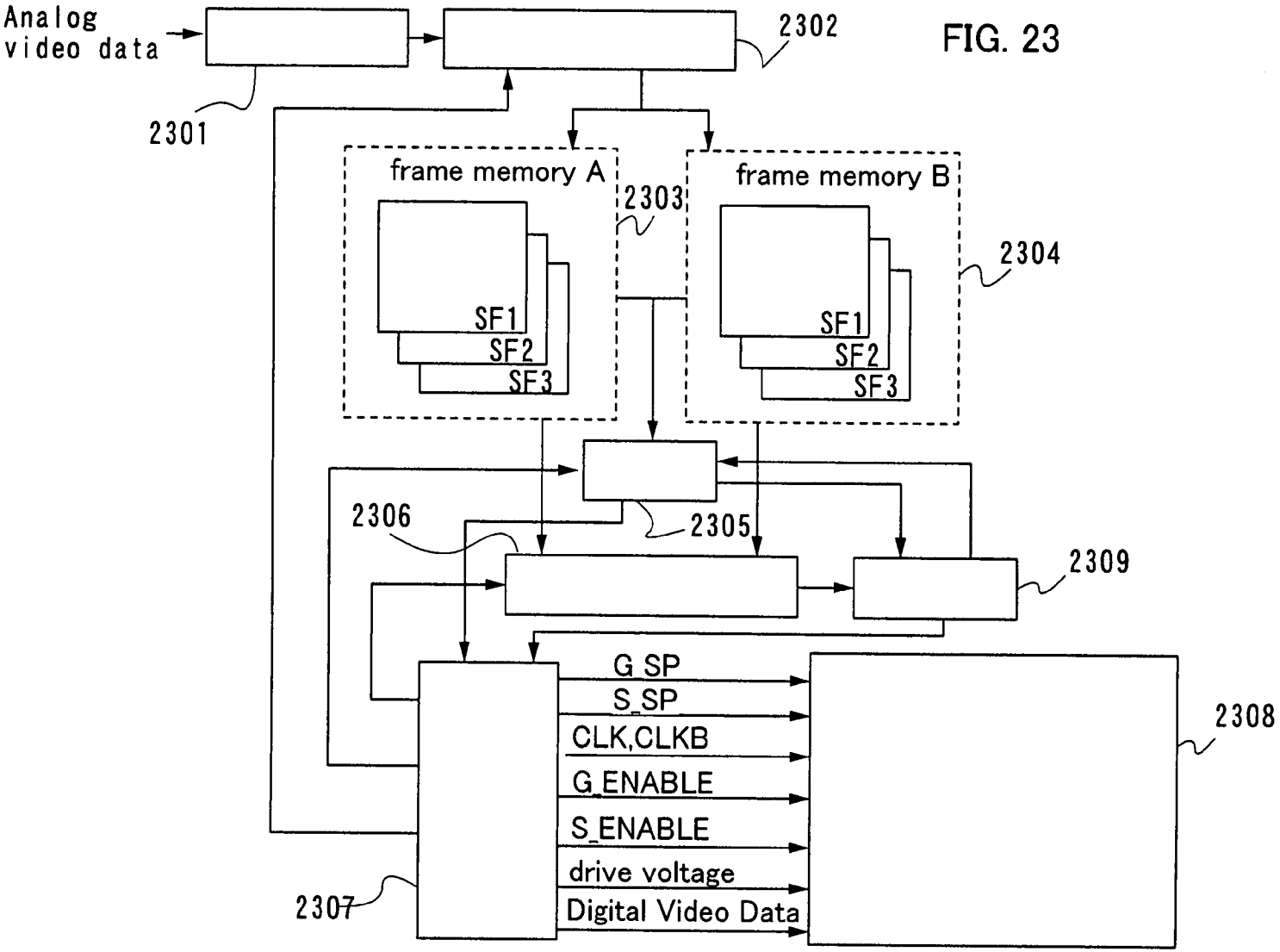
FIG. 23 is a diagram explaining a main structure of a display device of the present invention.

Note that a block diagram showing the main structure of the display device of the present invention is not limited to the structures shown in FIGS. 2 and 23. Any structure that stops the input of a signal to a pixel when a signal to be input to the pixel is identical with a signal already input to the pixel, can be employed. Therefore, the signal input to the pixel here is not limited to the video signal, and it may be a signal which forces a pixel to be in a non-lighting state (erasing signal).

Embodiment Mode 7

In this embodiment mode, explanation is made on a circuit structure applicable to the determination circuit 205 of FIG. 2 and the determination circuit 2305 of FIG. 23 described in Embodiment Mode 6.

Figure 38:
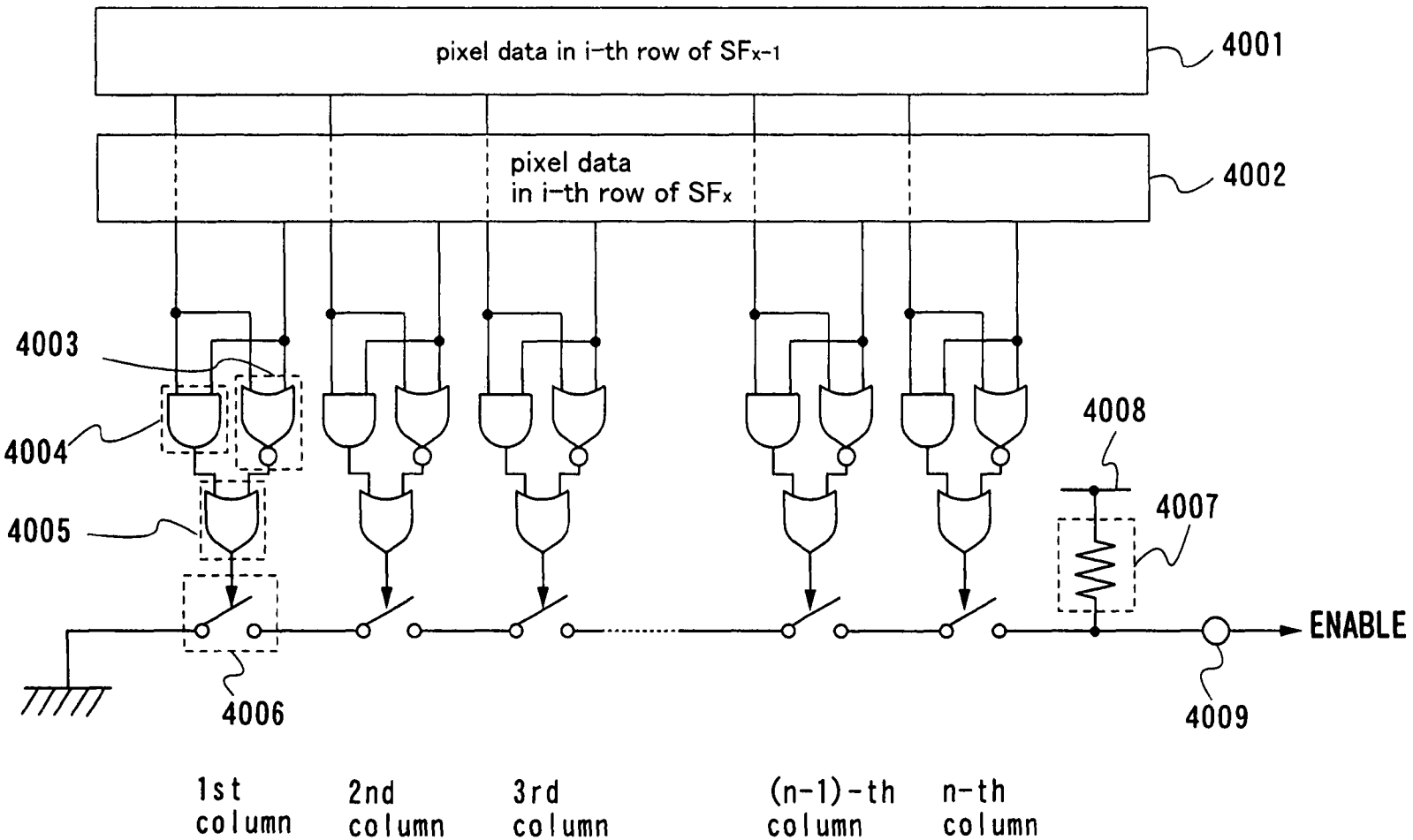
FIG. 38 is a diagram showing an example of a determination circuit.

An example of a determination circuit is shown in FIG. 38. Switches 4006 of the same number as pixel columns are connected in series. An L-level potential (here, GND) is set to one end of the serially connected switches 4006, and the other end is connected to an output terminal 4009. In addition, a wire 4008 to which an H-level potential (for example, a power source potential Vdd) is set is connected between the other end of the serially connected switches 4006 and the output terminal 4009 through a pull-up resistor 4007. Accordingly, when all of the serially connected switches 4006 are turned on, an output control signal (ENABLE) output from the output terminal 4009 is an L-level signal. On the other hand, when any of the serially connected switches 4006 is turned off, the output control signal (ENABLE) output from the output terminal 4009 is an H-level signal.

Data of video signals for the same pixel row and the same pixel column in preceding and following subframes are input to each of NOR gates 4003. In addition, data of video signals for the same pixel row and the same pixel column in preceding and following subframes are also input to each of AND gates 4004. Then, each output from the NOR gate 4003 and the AND gate 4004 is input to an OR gate 4005. According to the output from the OR gate 4005, switch 4006 is controlled to be turned on or off.

In other words, a comparison result of pixel data of j-th column among pixel data 4001 in i-th row of SFx−1 and pixel data 4002 in i-th row of SFx is determined by whether the switch 4006 corresponding to a pixel in j-th column is turned on or off. In other words, when the switch 4006 corresponding to the pixel in j-th column is turned on, pixel data of j-th column among the pixel data 4001 in i-th row of SFx−1 and the pixel data 4002 in i-th row of SFx match. Then, in the case of mismatch, the switch 4006 corresponding to the pixel of j-th column is turned off. In other words, the output control signal (ENABLE) is at an L level only in the case where data of all pixel columns of the pixel data 4001 in i-th row of SFx−1 and the pixel data 4002 in i-th row of SFx match, and the output control signal (ENABLE) is at an H level in the case where data of any pixel column is mismatched.

Figure 39:
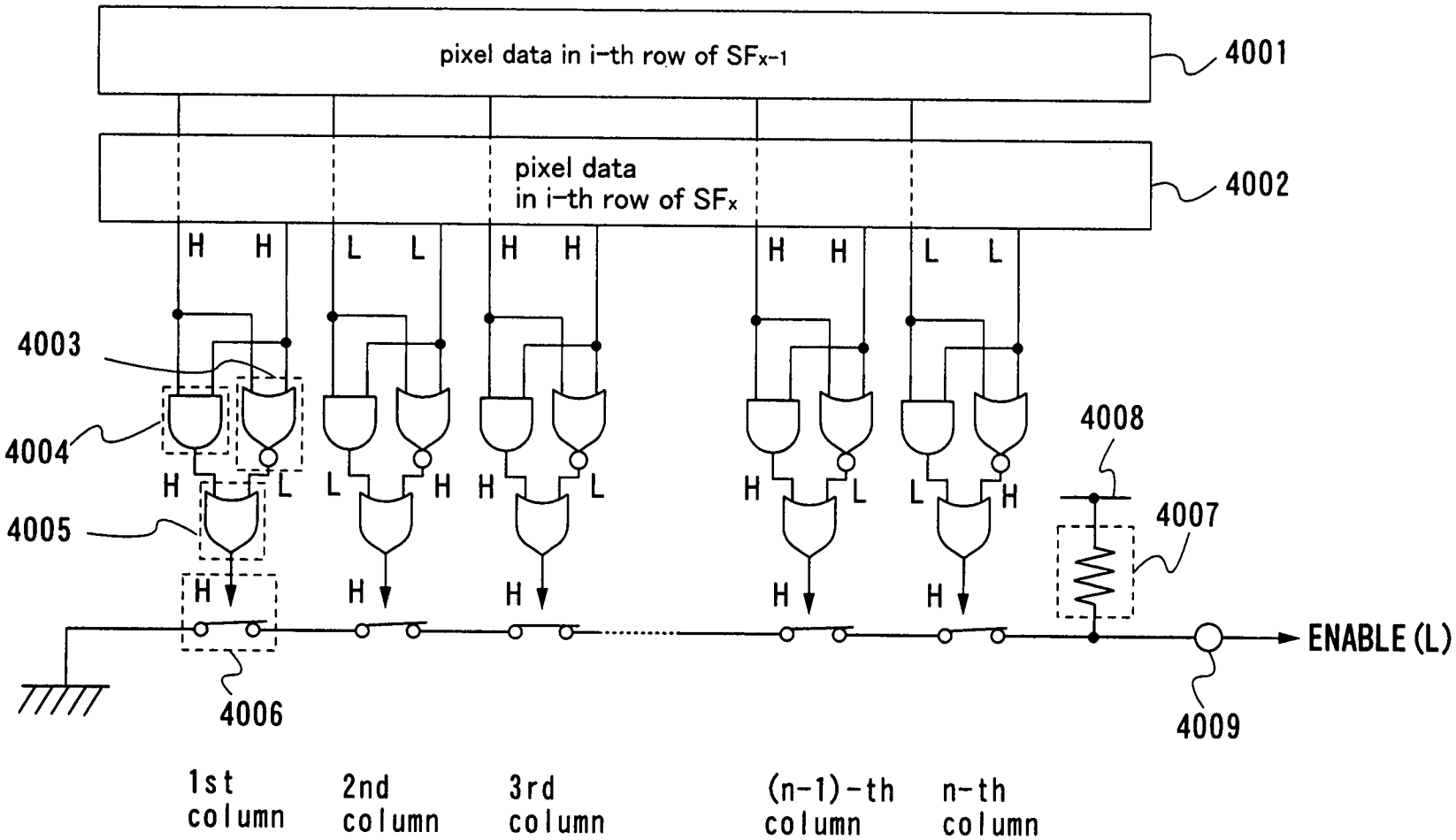
FIG. 39 is a diagram explaining operation of a determination circuit.

The operation of the determination circuit is explained in more detail. First, explanation is made on the case where the pixel data 4001 in i-th row of SFx−1 and the pixel data 4002 in i-th row of SFx match in all columns. In FIG. 39, it is assumed that the pixel data 4001 in i-th row of SFx−1 and the pixel data 4002 in i-th row of SFx are at an H level and an H level in the first column; at an L level and an L level in the second column; at an H level and an H level in the third column; . . . ; at an H level and an H level in (n−1)-th column; and at an L level and an L level in n-th column, respectively. In other words, the pixel data 4001 in i-th row of SFx−1 and the pixel data 4002 in i-th row of SFx match in all columns.

The pixel data are both at an H level in the first column; therefore, an H level is input to both input terminals of the NOR gate 4003 and the AND gate 4004. Then, the output from the NOR gate 4003 is at an L level and the output from the AND gate 4004 is at an H level. Accordingly, an H-level signal and an L-level signal are input to an input terminal of the OR gate 4005, so that the output from the OR gate 4005 is at an H level. Then, the switch 4006 in the first column is turned on by the H-level signal output from the OR gate. Further, the pixel data are both at an L level in the second column; therefore, an L level is input to both input terminals of the NOR gate 4003 and the AND gate 4004. Then, the output from the NOR gate 4003 is at an H level, and the output from the AND gate 4004 is at an L level. Accordingly, an H-level signal and an L-level signal are input to an input terminal of the OR gate 4005, so that the output from the OR gate is at an H level. Then, the switch 4006 in the second column is turned on by the H-level signal output from the OR gate. Similarly, the switches 4006 in all columns are turned on, and an output control signal (ENABLE) of the output terminal 4009 is at an L level.

Figure 40:
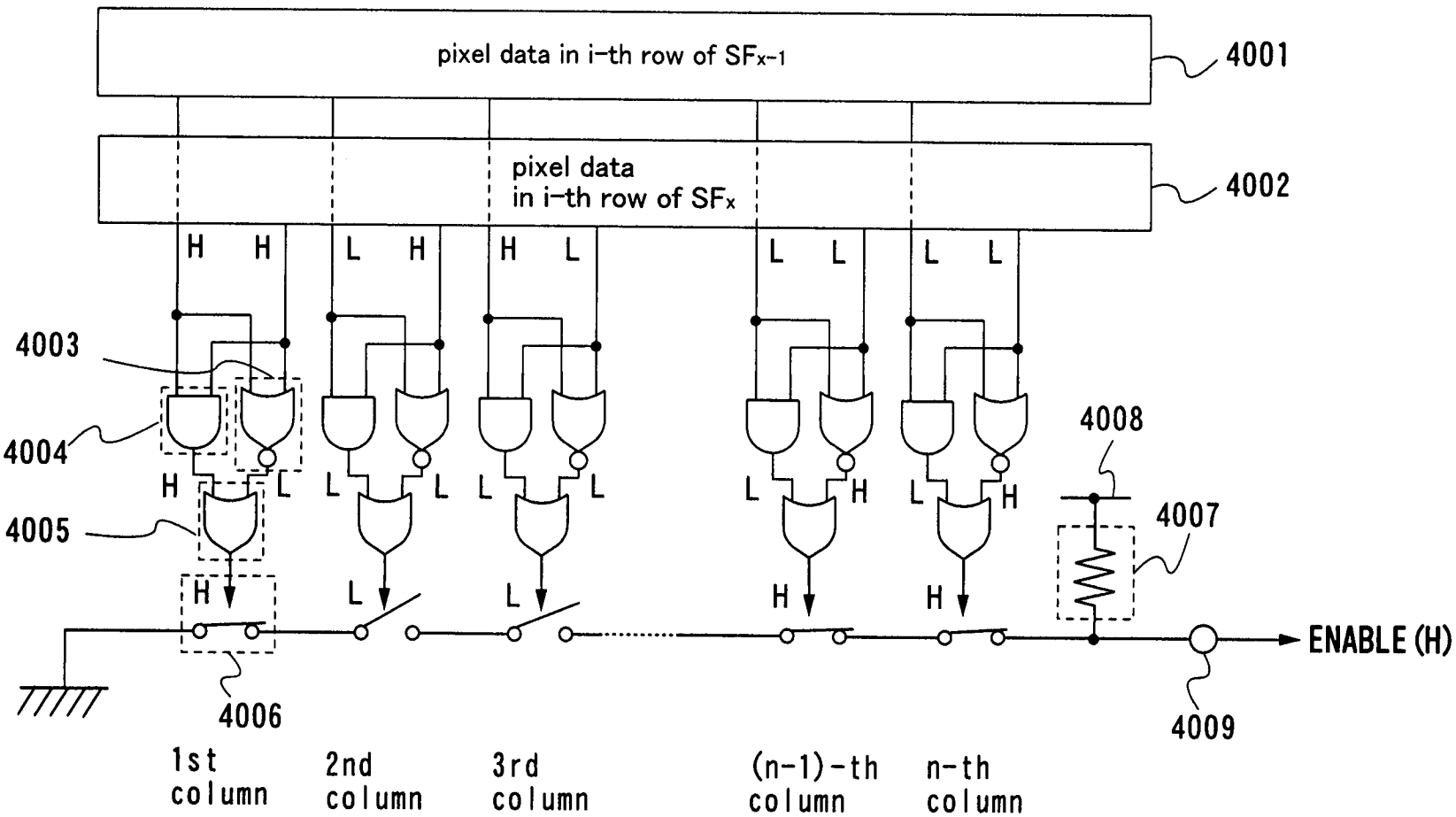
FIG. 40 is a diagram explaining operation of a determination circuit.

Subsequently, explanation is made on the case where the pixel data 4001 in i-th row of SFx−1 and the pixel data 4002 in i-th row of SFx are mismatched in any one column. In FIG. 40, it is assumed that the pixel data 4001 in i-th row of SFx−1 and the pixel data 4002 in i-th row of SFx are at an H level and an H level in the first column; at an L level and an H level in the second column; at an H level and an L level in the third column; . . . ; at an L level and an L level in (n−1)-th column; and at an L level and an L level in n-th column, respectively. In other words, pixel data of at least the second column and the third column among the pixel data 4001 in i-th row of SFx−1 and the pixel data 4002 in i-th row of SFx are mismatched.

The pixel data are both at an H level in the first column; therefore, an H level is input to both input terminals of the NOR gate 4003 and the AND gate 4004. Then, the output from the NOR gate 4003 is at an L level and the output from the AND gate 4004 is at an H level. Accordingly, an H-level signal and an L-level signal are input to an input terminal of the OR gate 4005, so that the output from the OR gate is at an H level. Then, the switch 4006 in the first column is turned on by the H-level signal output from the OR gate. On the other hand, the pixel data in i-th row of SFx−1 is at an L level and the pixel data in i-th row of SFx is at an H level in the second column; therefore, an L level and an H level are input to input terminals of the NOR gate 4003 and the AND gate 4004, respectively. Then, the output from the NOR gate 4003 is at an L level, and the output from the AND gate 4004 is at an L level. Accordingly, an L-level signal is input to both input terminals of the OR gate 4005, so that the output from the OR gate 4005 is at an L level. Then, the switch 4006 in the second column is turned off by an L-level signal output from the OR gate. Also in the third column, the pixel data in i-th row of SFx−1 is at an H level and the pixel data in i-th row of SFx is at an L level, so that the output from the OR gate 4005 is at an L level. Then, the switch 4006 in the third column is turned off by the L-level signal output from the OR gate 4005. Accordingly, the switches 4006 at least in the second column and the third column are turned off, and an output control signal (ENABLE) of the output terminal 4009 is at an H level.

Note that the structure of FIG. 38 is merely an example, and the structure of the determination circuit is not limited thereto.

Figure 73:
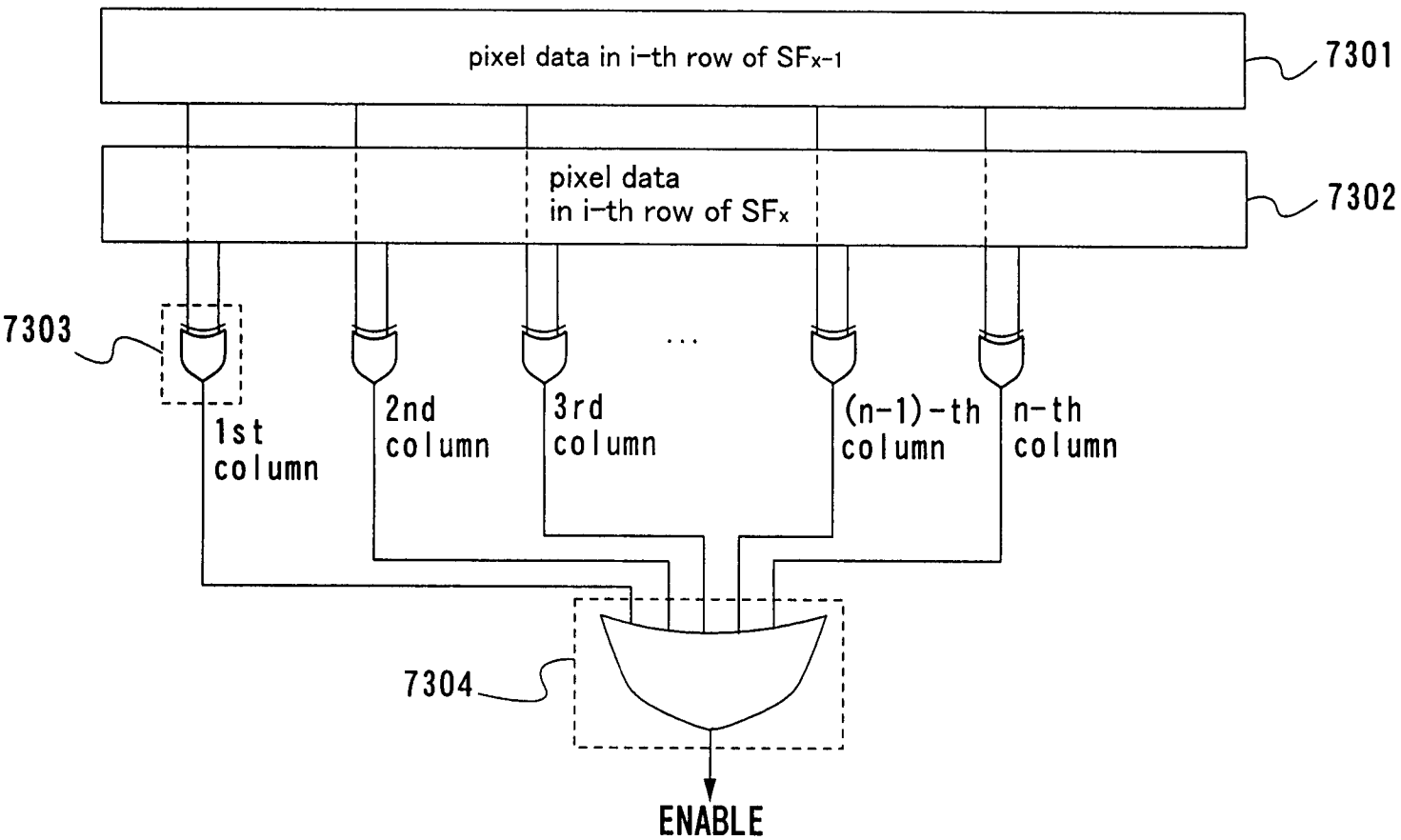
FIG. 73 is a diagram showing an example of a determination circuit.

Therefore, the determination circuit may have the structure as in FIG. 73.

Data of video signals of the same pixel row and the same pixel column in preceding and following subframes are input to two input terminals of the OR gates 7303 of the same number as the pixel rows. Then, the outputs from the OR gates 7303 are each input to input terminals of the AND gates 7304, which are the same number as the OR gates. According to the output from the AND gate, the switch 7305 is controlled to be turned on or off.

In other words, a comparison result of pixel data of j-th column among pixel data 7301 in i-th row of SFx−1 and pixel data 7302 in i-th row of SFx is determined by the output from the OR gate 7303 corresponding to a pixel in j-th column. In other words, when the output from the OR gate 7303 corresponding to the pixel in j-th column is at an H level, pixel data of j-th column among the pixel data 7301 in i-th row of SFx−1 and the pixel data 7302 in i-th row of SFx match. In the case of mismatch, the output from the OR gate 7303 corresponding to the pixel of j-th column is at an L level. Then, only when the output from the OR gate 7303 corresponding to columns of all pixels is at an H level, the output from the AND gate 7304 is at an H level and the switch 7305 is turned on. In other words, the output control signal (ENABLE) is at an L level only in the case where data of all pixel columns among the pixel data 7301 in i-th row of SFx−1 and the pixel data 7302 in i-th row of SFx match, and the output control signal (ENABLE) is at an H level in the case where data of any pixel column are mismatched.

Note that the determination circuit described in this embodiment mode is merely an example, and the invention in not limited thereto.

Embodiment Mode 8

In this embodiment mode, a structure of a display panel used for a display device is explained with reference to FIGS. 36A and 36B.

In this embodiment mode, a display panel applicable to the display device of the present invention is explained with reference to FIGS. 36A and 36B. Note that FIG. 36A is a top view showing a display panel, and FIG. 36B is a cross-sectional view of FIG. 36A taken along line A-A'. The display panel includes a signal line driver circuit 3601, a pixel portion 3602, a second scan line driver circuit 3603, and a first scan line driver circuit 3606 which are indicated by dotted lines. It also includes a sealing substrate 3604 and a sealant 3605, and a portion surrounded by the sealant 3605 is a space 3607.

Note that a wire 3608 is a wire for transmitting a signal to be inputted to the second scan line driver circuit 3603, the first scan line driver circuit 3606, and the signal line driver circuit 3601 and receives a video signal, a clock signal, a start signal, and the like through an FPC (flexible printed circuit) 3609 that serves as an external input terminal. An IC chip (a semiconductor chip provided with a memory circuit, a buffer circuit, or the like) 3619 is mounted by COG (Chip On Glass) or the like at the junction of the FPC 3609 and the display panel. Note that only the FPC is shown here, but a printed wiring board (PWB) may be attached to the FPC. The display device in this specification includes not only a display panel itself but also a display panel with an FPC or a PWB attached thereto. In addition, it also includes a display panel on which an IC chip or the like is mounted.

Next, a cross-sectional structure is explained with reference to FIG. 36B. The pixel portion 3602 and its peripheral driver circuits (the second scan line driver circuit 3603, the first scan line driver circuit 3606, and the signal line driver circuit 3601) are formed on a substrate 3610; here, the signal line driver circuit 3601 and the pixel portion 3602 are shown.

Note that as the signal line driver circuit 3601, a CMOS circuit is formed using an n-channel TFT 3620 and a p-channel TFT 3621. In this embodiment mode, the display panel in which the peripheral driver circuits are integrated on the substrate is described; however, the invention is not limited to this. All or part of the peripheral driver circuits may be formed on an IC chip or the like and mounted by COG or the like.

The pixel portion 3602 includes a plurality of circuits each forming a pixel which includes a switching TFT 3611 and a driver TFT 3612. Note that a source electrode of the driver TFT 3612 is connected to a first electrode 3613. An insulator 3614 is formed to cover end portions of the first electrode 3613. Here, a positive type photosensitive acrylic resin film is used.

The insulator 3614 is formed to have a curved surface with a curvature at an upper end portion or a lower end portion thereof in order to make the coverage favorable. For example, in the case of using positive type photosensitive acrylic as a material of the insulator 3614, the insulator 3614 is preferably formed to have a curved surface with a curvature radius (0.2 μm to 3 μm) only at the upper end portion. Either a negative type which becomes insoluble in an etchant by light irradiation or a positive type which becomes soluble in an etchant by light irradiation can be used as the insulator 3614.

A layer 3616 containing an organic compound and a second electrode 3617 are formed on the first electrode 3613. Here, a material having a high work function is preferably used as a material used for the first electrode 3613 which functions as an anode. For example, the first electrode 3613 can be formed using a single-layer film such as an indium tin oxide (ITO) film, an indium zinc oxide (IZO) film, a titanium nitride film, a chromium film, a tungsten film, a Zn film, or a Pt film; a laminated layer of a titanium nitride film and a film containing aluminum as its main component; a three-layer structure of a titanium nitride film, a film containing aluminum as its main component, and a titanium nitride film; or the like. When the first electrode 3613 has a laminated structure, it can have low resistance as a wire and form a favorable ohmic contact. Further, the first electrode can function as an anode.

In addition, the layer 3616 containing an organic compound is formed by an evaporation method using an evaporation mask or an ink-jet method. A metal complex belonging to Group 4 of the Periodic Table is used for part of the layer 3616 containing an organic compound, and besides, a material which can be used in combination may be either a low molecular material or a high molecular material. In addition, as a material used for the layer containing an organic compound, a single layer or a laminated layer of an organic compound is often used generally. In addition, this embodiment also includes a structure in which an inorganic compound is used for part of the film formed of an organic compound. Moreover, a known triplet material can also be used.

As a material used for the second electrode (cathode) 3617 which is formed on the layer 3616 containing an organic compound, a material having a low work function (Al, Ag, Li, Ca, or an alloy thereof such as MgAg, MgIn, AlLi, $CaF_2$, or $Ca_3N_2$) may be used. In the case where light generated in the layer 3616 containing an organic compound is transmitted through the second electrode 3617, a laminated layer of a metal thin film with a thin thickness and a transparent conductive film (indium tin oxide (ITO), an alloy of indium oxide and zinc oxide ($In_2O_3$—ZnO), zinc oxide (ZnO), or the like) is preferably used as the second electrode (cathode) 3617.

By attaching the sealing substrate 3604 to the substrate 3610 with the sealant 3605, a structure is obtained in which a display element 3618 is provided in the space 3607 surrounded by the substrate 3610, the sealing substrate 3604, and the sealant 3605. Note that there is also a case where the space 3607 is filled with the sealant 3605 as well as an inert gas (such as nitrogen or argon).

Note that an epoxy-based resin is preferably used as the sealant 3605. The material preferably allows as little moisture and oxygen as possible to penetrate. As the sealing substrate 3604, a plastic substrate formed of FRP (Fiberglass-Reinforced Plastics), PVF (polyvinyl fluoride), Myler, polyester, acrylic, or the like can be used besides a glass substrate or a quartz substrate.

The display panel can be obtained as described above.

Figure 36A:
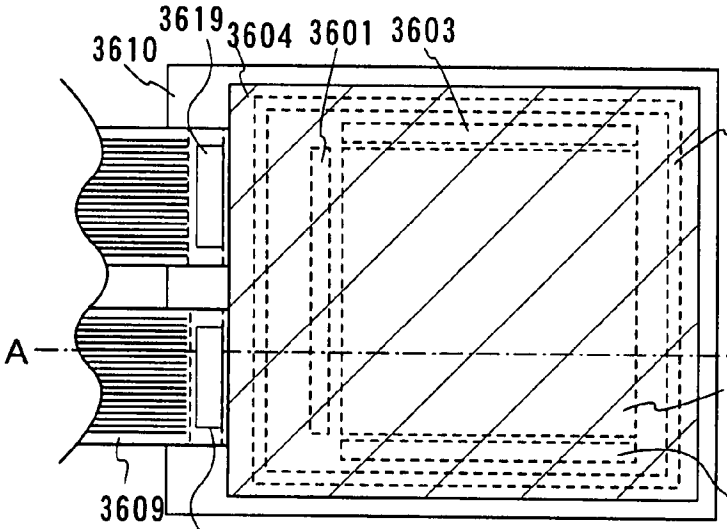
FIGS. 36A and 36B are diagrams explaining a display panel of the present invention.
Figure 36B:
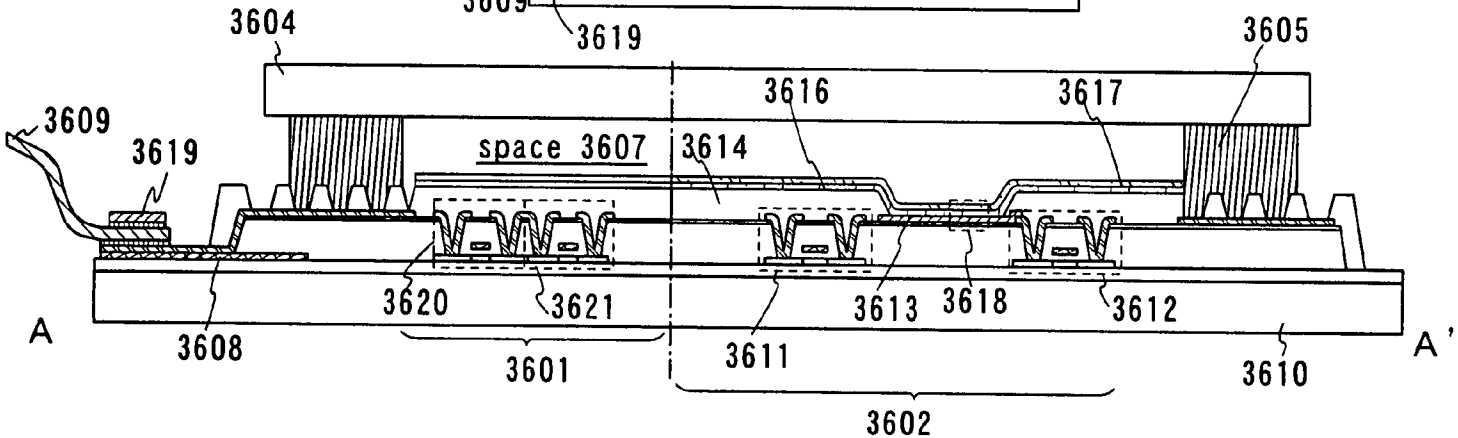

By integrating the signal line driver circuit 3601, the pixel portion 3602, the second scan line driver circuit 3603, and the first scan line driver circuit 3606 as shown in FIGS. 36A and 36B, cost of the display device can be reduced.

Figure 42B:
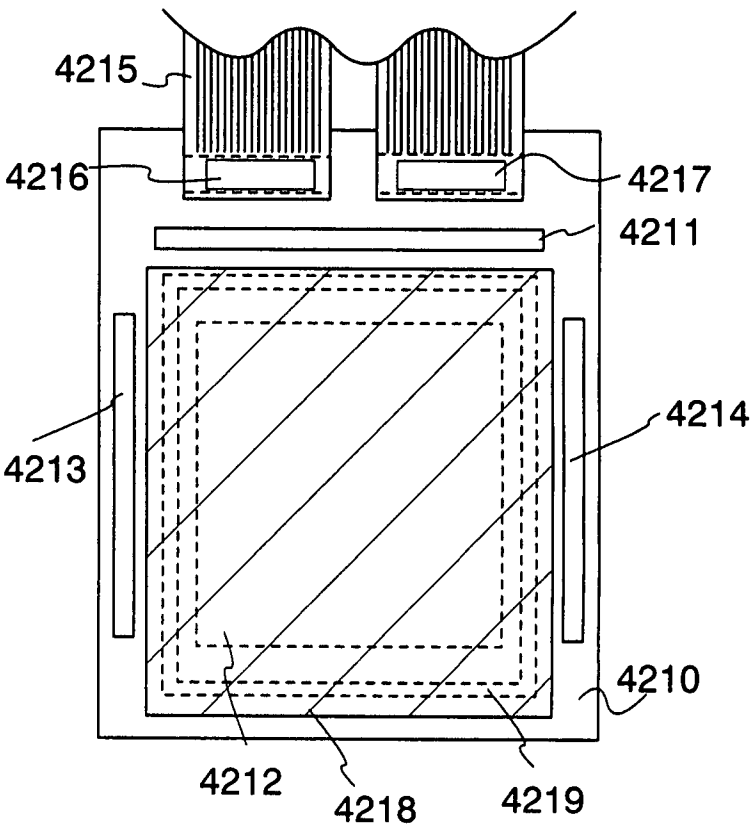
FIGS. 42A and 42B are diagrams explaining a display panel of the present invention.
Figure 42A:
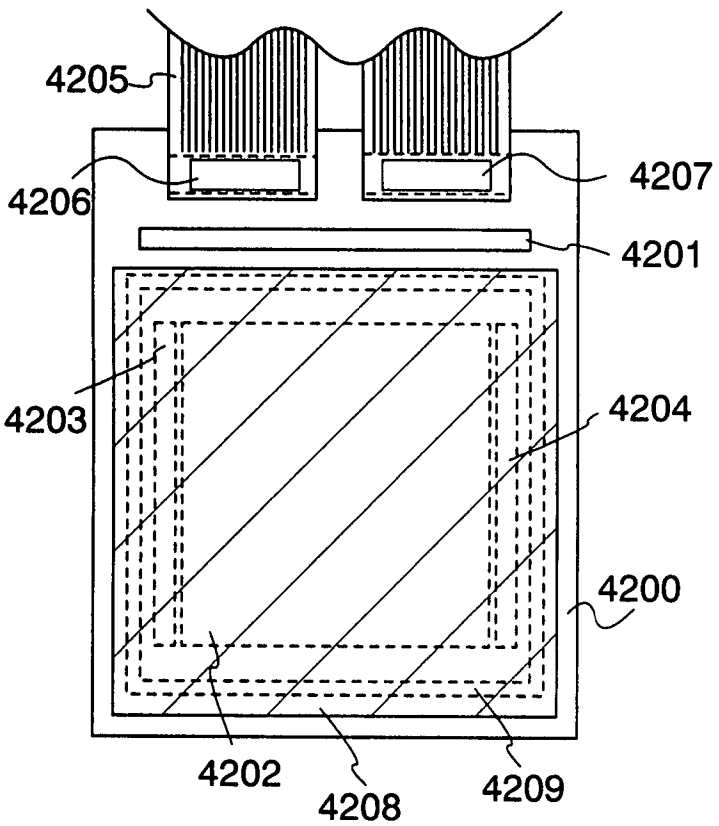

Note that the structure of the display panel is not limited to a structure in which the signal line driver circuit 3601, the pixel portion 3602, the second scan line driver circuit 3603, and the first scan line driver circuit 3606 are integrated as shown in FIG. 36A, and a structure may be employed in which a signal line driver circuit 4201 shown in FIG. 42A corresponding to the signal line driver circuit 3601 is formed on an IC chip and mounted on a display panel by COG or the like. Note that a substrate 4200, a pixel portion 4202, a second scan line driver circuit 4203, a first scan line driver circuit 4204, an FPC 4205, an IC chip 4206, an IC chip 4207, a sealing substrate 4208, and a sealant 4209 of FIG. 42A correspond to the substrate 3610, the pixel portion 3602, the second scan line driver circuit 3603, the first scan line driver circuit 3606, the FPC3609, the IC chip 3619, the IC chip 3619, the sealing substrate 3604, and the sealant 3605 of FIG. 36A.

In other words, only a signal line driver circuit which requires high speed operation is formed on an IC chip using a CMOS or the like to reduce power consumption. In addition, higher-speed operation and lower power consumption can be achieved by using a semiconductor chip of a silicon wafer or the like as the IC chip.

Furthermore, cost reduction can be achieved by integrating the first scan line driver circuit 4203 and the second scan line driver circuit 4204 with the pixel portion 4202.

Thus, cost of a high-definition display device can be reduced. In addition, a substrate area can be used efficiently by mounting an IC chip provided with a functional circuit (a memory circuit or a buffer circuit) on a connection portion of the FPC 3609 and the substrate 3610.

In addition, a structure may be employed in which a signal line driver circuit 4211, a second scan line driver circuit 4214, and a first scan line driver circuit 4213 of FIG. 42B corresponding to the signal line driver circuit 3601, the second scan line driver circuit 3603, and the first scan line driver circuit 3606 of FIG. 36A are formed on an IC chip and mounted on a display panel by COG or the like. In this case, power consumption of a high-definition display device can further be reduced. Therefore, polysilicon is preferably used for a semiconductor layer of a transistor used in a pixel portion to provide a display device which consumes lower power. Note that a substrate 4210, a pixel portion 4212, an FPC 4215, an IC chip 4216, an IC chip 4217, a sealing substrate 4218, and a sealant 4219 of FIG. 42B correspond to the substrate 3610, the pixel portion 3602, the FPC 3609, the IC chip 3619, the IC chip 3619, the sealing substrate 3604, and the sealant 3605 of FIG. 36A, respectively.

In addition, cost reduction can be performed by using amorphous silicon for a semiconductor layer of a transistor of the pixel portion 4212. Furthermore, a large-sized display panel can be manufactured.

Figure 41B:
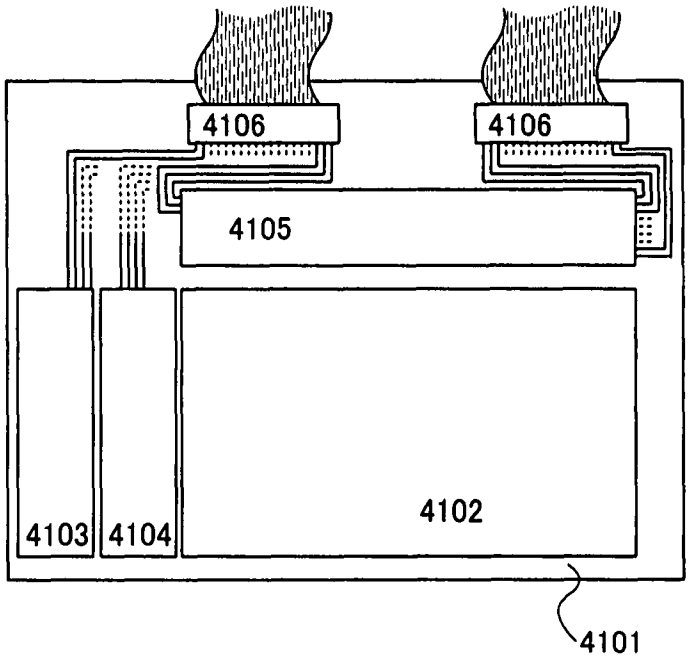
FIGS. 41A and 41B are diagrams explaining a display panel of the present invention.
Figure 41A:
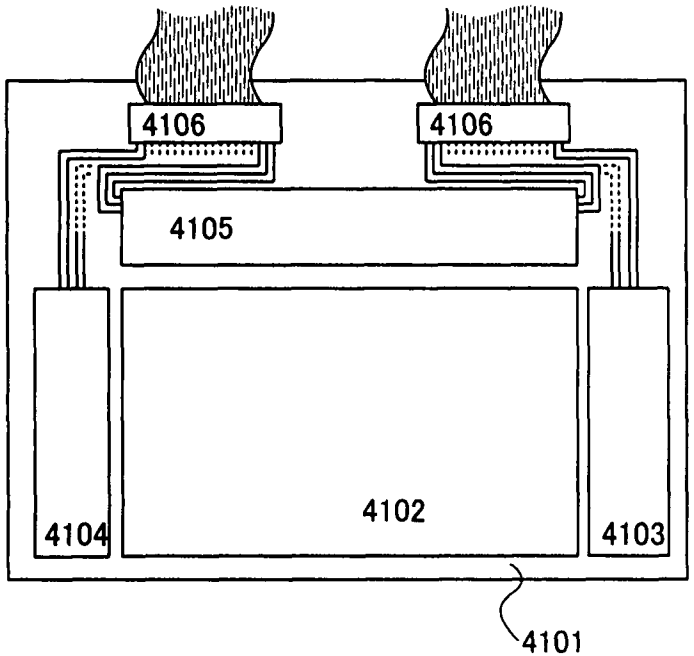

The structure of the above-described display panel is shown in a schematic diagram of FIG. 41A. The display panel includes a pixel portion 4102 in which a plurality of pixels is arranged on a substrate 4101, and also includes a second scan line driver circuit 4103, a first scan line driver circuit 4104, and a signal line driver circuit 4105 in the vicinity of the pixel portion 4102.

A signal to be input to the second scan line driver circuit 4103, the first scan line driver circuit 4104, and the signal line driver circuit 4105 is supplied from outside through a flexible printed circuit (FPC) 4106.

Although not shown, an IC chip may be mounted on the FPC 4106 by COG (Chip On Glass), TAB (Tape Automated Bonding), or the like. In other words, part of a memory circuit, a buffer circuit, and the like of the second scan line driver circuit 4103, the first scan line driver circuit 4104, and the signal line driver circuit 4105, which are hard to be integrated with the pixel portion 4102, may be formed on an IC chip and mounted on a display device.

Here, in the display device of the present invention, the second scan line driver circuit 4103 and the first scan line driver circuit 4104 may be provided on one side of the pixel portion 4102 as shown in FIG. 41B. Note that the display device shown in FIG. 41B is different from the display device shown in FIG. 41A only in the arrangement of the second scan line driver circuit 4103; therefore, the same reference numerals are used. In addition, the second scan line driver circuit 4103 and the first scan line driver circuit 4104 may perform a similar function as one driver circuit, or either of them may be used. In other words, the structure may be appropriately changed in accordance with a pixel structure or a driving method.

Further, the first scan line driver circuit and the second scan line driver circuit, and the signal line driver circuit are not necessarily provided in a row direction and a column direction of the pixel, respectively. For example, a peripheral driver circuit 4301 formed on an IC chip as shown in FIG. 43A may have functions of the second scan line driver circuit 4214, the first scan line driver circuit 4213, and the signal line driver circuit 4211 shown in FIG. 42B. Note that a substrate 4300, a pixel portion 4302, an FPC 4304, an IC chip 4305, an IC chip 4306, a sealing substrate 4307, and a sealant 4308 of FIG. 43A correspond to the substrate 3610, the pixel portion 3602, the FPC 3609, the IC chip 3619, the IC chip 3619, the sealing substrate 3604, and the sealant 3605 of FIG. 36A, respectively.

Figure 43B:
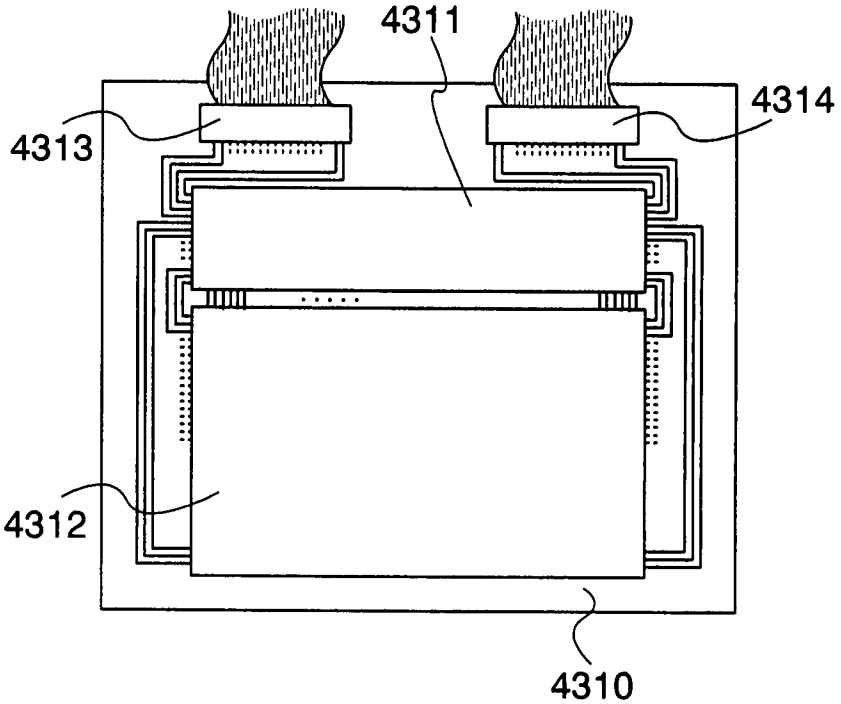
FIGS. 43A and 43B are diagrams explaining a display panel of the present invention.
Figure 43A:
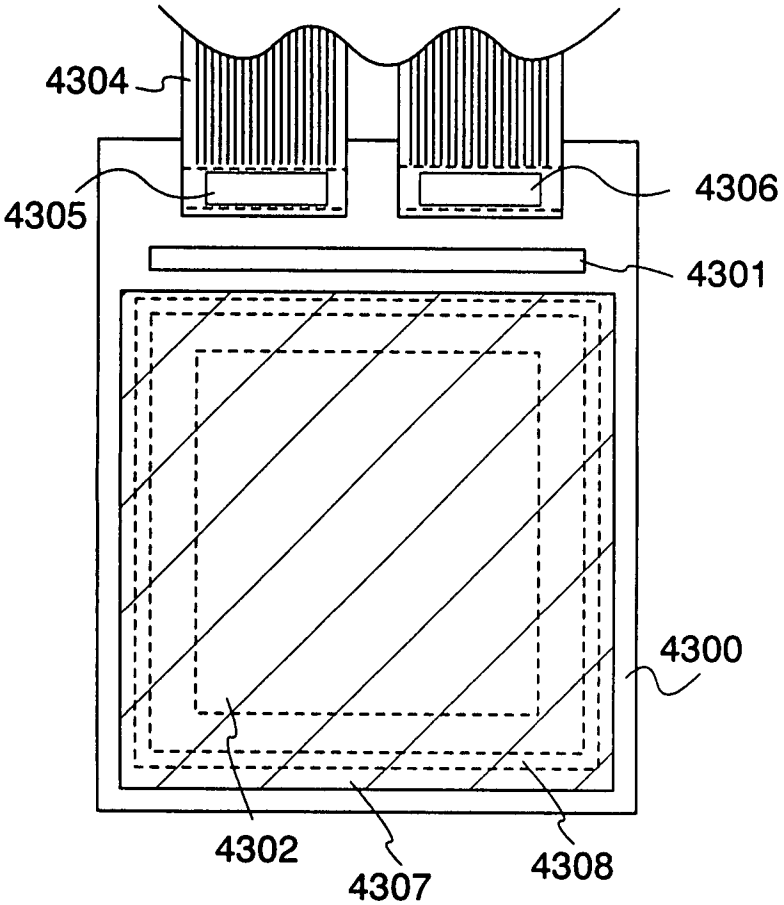

Note that a schematic diagram explaining the connecting of a signal line of the display device of FIG. 43A is shown in FIG. 43B. The display device includes a substrate 4310, a peripheral driver circuit 4311, a pixel portion 4312, an FPC 4313, and an FPC 4314. A signal and a power source potential from outside are input to the peripheral driver circuit 4311 through the FPC 4313. Then, the output from the peripheral driver circuit 4311 is input to a scan line in a row direction and a signal line in a column direction connected to a pixel included in the pixel portion 4312.

Figure 44A:
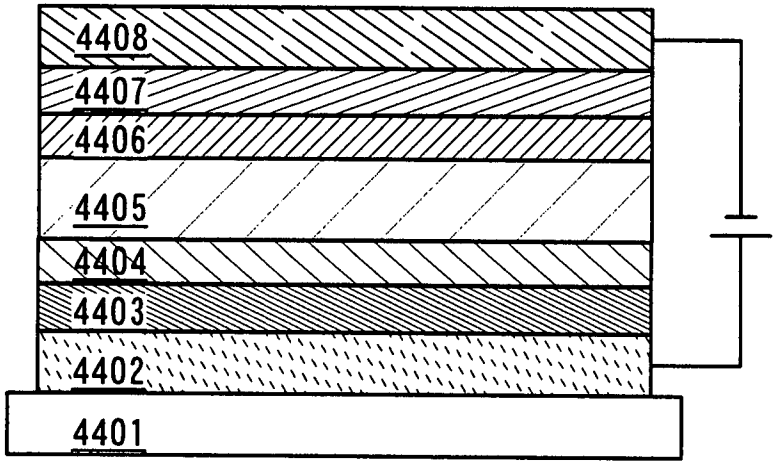
FIGS. 44A and 44B are diagrams explaining a light emitting element applicable to a display device of the present invention.
Figure 44B:
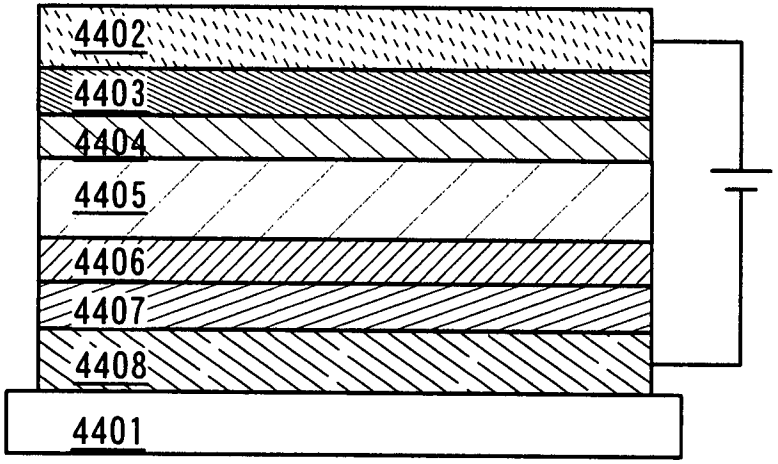

Furthermore, an example of a display element applicable to the display element 3618 is shown in FIGS. 44A and 44B. In other words, a structure of a display element applicable to the pixel described in Embodiment Mode 1 is explained with reference to FIGS. 44A and 44B.

The display element of FIG. 44A has an element structure in which an anode 4402, a hole injecting layer 4403 formed of a hole injecting material, a hole transporting layer 4404 formed of a hole transporting material, a light emitting layer 4405, an electron transporting layer 4406 formed of an electron transporting material, an electron injecting layer 4407 formed of an electron injecting material, and a cathode 4408 are laminated on a substrate 4401. Here, the light emitting layer 4405 may be formed of only one kind of a light emitting material; however, it may be formed of two or more kinds of materials. In addition, an element structure of the invention is not limited to this structure.

In addition to the laminated structure of respective functional layers shown in FIG. 44A, there is a wide range of variation in element structure, such as an element using a high molecular compound or a high-efficiency element in which a light emitting layer is formed using a triplet light emitting material that emits light from a triplet excited state. In addition, the element structure of the invention is also applicable to a white display element realized by controlling a carrier recombination region with a hole blocking layer to divide a light emitting region into two regions, or the like.

In a manufacturing method of the element of the invention shown in FIG. 44A, a hole injecting material, a hole transporting material, and a light emitting material are evaporated in this order on the substrate 4401 provided with the anode 4402 (ITO). Then, an electron transporting material and an electron injecting material are evaporated, and the cathode 4408 is lastly formed by evaporation.

Suitable materials for the hole injecting material, the hole transporting material, the electron transporting material, the electron injecting material, and the light emitting material are listed below.

As the hole injecting material, a porphyrin compound, phthalocyanine (hereinafter referred to as "$H_2Pc$"), copper phthalocyanine (hereinafter referred to as "CuPc"), or the like is effective among organic compounds. In addition, a material which has a smaller value of an ionization potential than that of the hole transporting material to be used and has a hole transporting function can also be used as the hole injecting material. There is also a chemically-doped conductive high molecular compound, which includes polyethylenedioxythiophene (hereinafter referred to as "PEDOT") doped with polystyrene sulfonate (hereinafter referred to as "PSS"), polyaniline, and the like. In addition, an insulating high molecular compound is also effective in planarization of the anode, and polyimide (hereinafter referred to as "PI") is often used. Further, an inorganic compound is also used, which includes an ultrathin film of aluminum oxide (hereinafter referred to as "alumina") as well as a thin film of metal such as gold or platinum.

A material that is most widely used as the hole transporting material is an aromatic amine-based compound (in other words, a compound having a bond of benzene ring-nitrogen). A widely-used material includes 4,4'-bis(diphenylamino)-biphenyl (hereinafter referred to as "TAD"), a derivative thereof such as 4,4'-bis[N-(3-methylphenyl)-N-phenyl-amino]-biphenyl (hereinafter referred to as "TPD") or 4,4'-bis[N-(1-naphthyl)-N-phenyl-amino]-biphenyl (hereinafter referred to as "α-NPD"), and besides, a star burst aromatic amine compound such as 4,4',4"-tris(N,N-diphenyl-amino)-triphenylamine (hereinafter referred to as "TDATA") or 4,4',4"-tris[N-(3-methylphenyl)-N-phenyl-amino]-triphenylamine (hereinafter referred to as "MTDATA").

As the electron transporting material, a metal complex is often used, which includes a metal complex having a quinoline skeleton or a benzoquinoline skeleton such as Alq, BAlq, tris(4-methyl-8-quinolinolato)aluminum (hereinafter referred to as "Almq"), or bis(10-hydroxybenzo[h]-quinolinato)beryllium (hereinafter referred to as "Bebq"), and besides, a metal complex having an oxazole-based or a thiazole-based ligand such as bis[2-(2-hydroxyphenyl)-benzoxazolato]zinc (hereinafter referred to as "$Zn(BOX)_2$") or bis[2-(2-hydroxyphenyl)-benzothiazolato]zinc (hereinafter referred to as "$Zn(BTZ)_2$"). Further, other than the metal complex, an oxadiazole derivative such as 2-(4-biphenylyl)-5-(4-tert-butylphenyl)-1,3,4-oxadiazole (hereinafter referred to as "PBD") or OXD-7, a triazole derivative such as TAZ or 3-(4-tert-butylphenyl)-4-(4-ethylphenyl)-5-(4-biphenylyl)-1,2,4-triazole (hereinafter referred to as "p-EtTAZ"), and a phenanthroline derivative such as bathophenanthroline (hereinafter referred to as "BPhen") or BCP have an electron transporting property.

As the electron injecting material, the above-described electron transporting materials can be used. In addition, an ultrathin film of an insulator such as metal halide including calcium fluoride, lithium fluoride, cesium fluoride, and the like, or alkali metal oxide including lithium oxide, and the like is often used. Further, an alkali metal complex such as lithium acetyl acetonate (hereinafter referred to as "Li(acac)") or 8-quinolinolato-lithium (hereinafter referred to as "Liq") is also effective.

As the light emitting material, other than the above-described metal complex such as Alq, Almq, BeBq, BAlq, $Zn(BOX)_2$, or $Zn(BTZ)_2$, various fluorescent pigments are effective. The fluorescent pigments include 4,4'-bis(2,2-diphenyl-vinyl)-biphenyl which is blue, 4-(dicyanomethylene)-2-methyl-6-(p-dimethylaminostyryl)-4H-pyran which is red-orange, and the like. In addition, a triplet light emitting material is also possible, which is mainly a complex with platinum or iridium as central metal. As the triplet light emitting material, tris(2-phenylpyridine)iridium, bis(2-(4'-tryl)pyridinato-N,$C^{2'}$)acetylacetonato iridium (hereinafter referred to as "$acacIr(tpy)_2$"), 2,3,7,8,12,13,17,18-octaethyl-21H,23H-porphyrin-platinum, and the like are known.

By combining the above-described materials that have respective functions, a highly reliable display element can be manufactured.

In addition, a display element having layers laminated in reverse order of that in FIG. 44A can also be used by changing the polarity of a driver transistor having the pixel structure described in Embodiment Mode 1 so as to be an n-channel transistor, and reversing the magnitude of a potential of an opposite electrode of a display element and a potential set to a power source line. In other words, in an element structure, the cathode 4408, the electron injecting layer 4407 formed of an electron injecting material, the electron transporting layer 4406 formed of an electron transporting material, the light emitting layer 4405, the hole transporting layer 4404 formed of a hole transporting material, the hole injecting layer 4403 formed of a hole injecting material, and the anode 4402 are sequentially laminated on the substrate 4401.

In addition, in order to extract light emission of the display element, at least one of the anode and the cathode may be transparent. Then, a TFT and a display element are formed on a substrate. There are display elements having a top emission structure in which light emission is extracted through the surface opposite to the substrate, having a bottom emission structure in which light emission is extracted through the surface on the substrate side, and having a dual emission structure in which light emission is extracted through the surface opposite to the substrate and the surface on the substrate side. The pixel configuration of the invention can be applied to a display element having any of the emission structures.

A display element having the top emission structure is described with reference to FIG. 45A.

On a substrate 4500, a driver TFT 4501 is formed with a base film 4505 interposed therebetween, and a first electrode 4502 is formed in contact with a source electrode of the driver TFT 4501. A layer 4503 containing an organic compound and a second electrode 4504 are formed thereon.

Note that the first electrode 4502 is an anode of the display element, and the second electrode 4504 is a cathode of the display element. In other words, the display element is formed in a region where the layer 4503 containing an organic compound is sandwiched between the first electrode 4502 and the second electrode 4504.

Here, the first electrode 4502 which functions as an anode is preferably formed using a material having a high work function. For example, a single-layer film such as a titanium nitride film, a chromium film, a tungsten film, a Zn film, or a Pt film, a laminated layer of a titanium nitride film and a film containing aluminum as its main component, or a three-layer structure of a titanium nitride film, a film containing aluminum as its main component, and a titanium nitride film, or the like can be used. Note that when the first electrode 4502 has a laminated structure, it can have low resistance as a wire, form a good ohmic contact, and function as an anode. By using a light-reflective metal film, an anode which does not transmit light can be formed.

The second electrode 4504 which functions as a cathode is preferably formed using a laminated layer of a metal thin film formed of a material having a low work function (Al, Ag, Li, Ca, or an alloy thereof such as MgAg, MgIn, AlLi, $CaF_2$, or $Ca_3N_2$) and a transparent conductive film (indium tin oxide (ITO), indium zinc oxide (IZO), zinc oxide (ZnO), or the like). By using the thin metal film and the transparent conductive film as described above, a cathode which can transmit light can be formed.

Figure 45A:
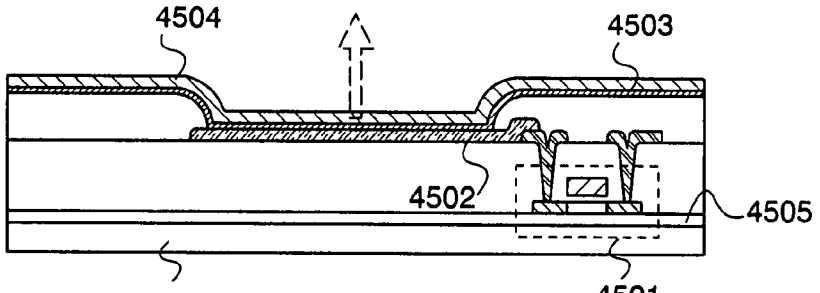
FIGS. 45A to 45C are diagrams explaining a display panel of the present invention.

Thus, light of the display element can be extracted from a top surface as indicated by an arrow in FIG. 45A. In other words, in the case of applying the display element to the display panel shown in FIGS. 36A and 35B, light is emitted toward the substrate 3610 side. Therefore, when a display element having a top emission structure is used for the display device, a substrate which transmits light is used as the sealing substrate 3604.

In addition, in the case of providing an optical film, the optical film may be provided on the sealing substrate 3604.

Note that the first electrode 4502 can be formed using a metal film formed of a material having a low work function such as MgAg, MgIn, or AlLi to function as a cathode. Further, the second electrode 4504 can be formed using a transparent conductive film such as an indium tin oxide (ITO) film or an indium zinc oxide (IZO) film. Consequently, according to this structure, the transmittance of the top emission can be improved.

A display element having the bottom emission structure is described with reference to FIG. 45B. Description is made using the same reference numerals as those in FIG. 45A since the structure except for its emission structure is identical.

Here, the first electrode 4502 which functions as an anode is preferably formed using a material having a high work function. For example, a transparent conductive film such as an indium tin oxide (ITO) film or an indium zinc oxide (IZO) film can be used. By using a transparent conductive film, an anode which can transmit light can be formed.

The second electrode 4504 which functions as a cathode can be formed using a metal film formed of a material having a low work function (Al, Ag, Li, Ca, or an alloy thereof such as MgAg, MgIn, AlLi, $CaF_2$, or $Ca_3N_2$). By using a light-reflective metal film as described above, a cathode which does not transmit light can be formed.

Figure 45B:
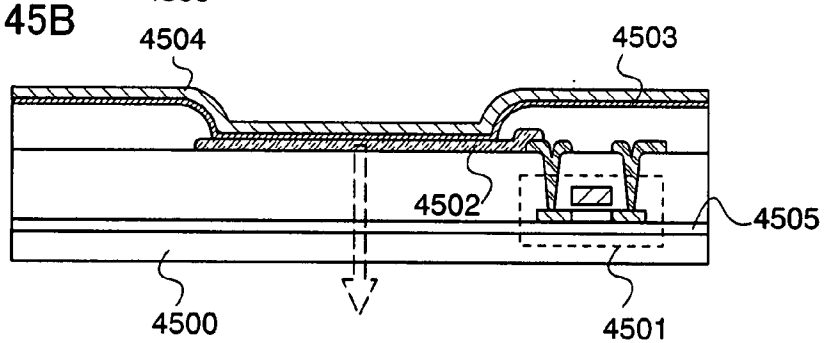

Thus, light of the display element can be extracted from a bottom surface as indicated by an arrow in FIG. 45B. In other words, in the case of applying the display element to the display panel shown in FIGS. 36A and 36B, light is emitted toward the substrate 3610 side. Therefore, when the display element having a bottom emission structure is used for the display device, a substrate which transmits light is used as the substrate 3610.

In addition, in the case of providing an optical film, the optical film may be provided on the substrate 3610.

A display element having the dual emission structure is explained with reference to FIG. 45C. Description is made using the same reference numerals as those in FIG. 45A since the structure except for its emission structure is identical.

Here, the first electrode 4502 which functions as an anode is preferably formed using a material having a high work function. For example, a transparent conductive film such as an indium tin oxide (ITO) film or an indium zinc oxide (IZO) film can be used. By using a transparent conductive film, an anode which can transmit light can be formed.

The second electrode 4504 which functions as a cathode is preferably formed using a laminated layer of a metal thin film formed of a material having a low work function (Al, Ag, Li, Ca, or an alloy thereof such as MgAg, MgIn, AlLi, $CaF_2$, or $Ca_3N_2$) and a transparent conductive film (indium tin oxide (ITO), an alloy of indium oxide and zinc oxide ($In_2O_3$—ZnO), zinc oxide (ZnO), or the like). By using the thin metal film and the transparent conductive film as described above, a cathode which can transmit light can be formed.

Figure 45C:
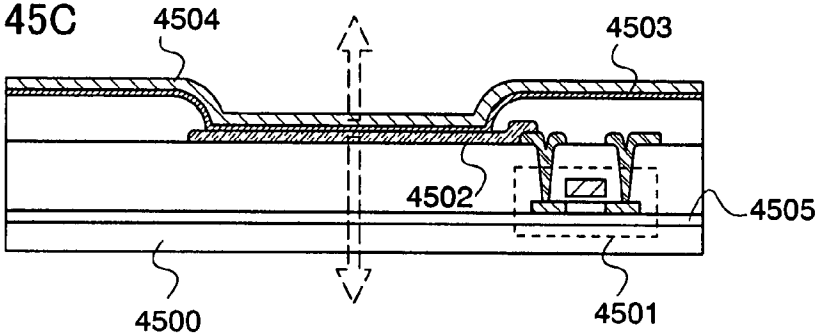

Thus, light of the display element can be extracted from both surfaces as indicated by arrows in FIG. 45C. In other words, in the case of applying the display element to the display panel shown in FIGS. 36A and 36B, light is emitted toward the substrate 3610 side and the sealing substrate 3604 side. Therefore, when the display element having a dual emission structure is used for the display device, substrates which transmit light are used as both the substrate 3610 and the sealing substrate 3604.

In addition, in the case of providing an optical film, the optical film may be provided on both the substrate 3610 and the sealing substrate 3604.

In addition, the invention can be applied to a display device which achieves full-color display by using a white display element and a color filter.

Figure 46:
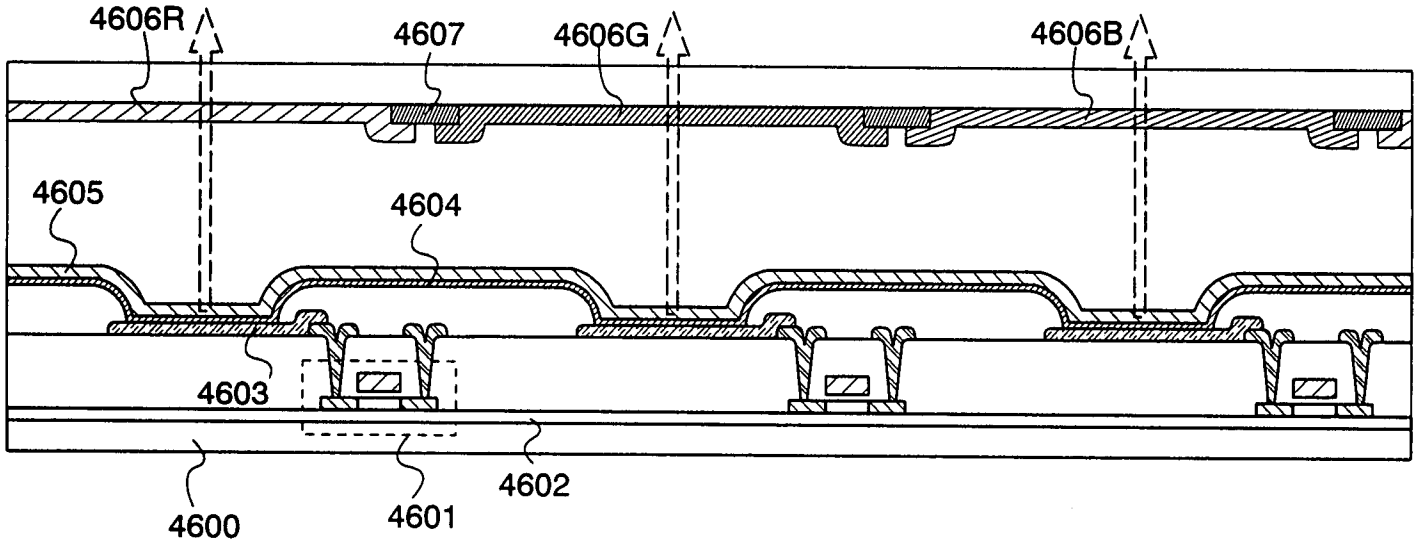
FIG. 46 is a diagram explaining a display panel of the present invention.

As shown in FIG. 46, a base film 4602 is formed on a substrate 4600, a driver TFT 4601 is formed thereon, and a first electrode 4603 is formed in contact with a source electrode of the driver TFT 4601. A layer 4604 containing an organic compound and a second electrode 4605 are formed thereon.

Note that the first electrode 4603 is an anode of the display element, and the second electrode 4605 is a cathode of the display element. In other words, the display element is formed in a region where the layer 4604 containing an organic compound is sandwiched between the first electrode 4603 and the second electrode 4605. White light is emitted with the structure shown in FIG. 46. A red color filter 4606R, a green color filter 4606G, and a blue color filter 4606B are provided above the display elements respectively to achieve full-color display. In addition, a black matrix (also referred to as a "BM") 4607 which separates these color filters is provided.

The above-described structures of the display element can be used in combination and can be appropriately applied to the display device of the invention. In addition, the structure of the display panels described above and the display element are merely examples, and another structure can be naturally applied to the display device of the invention.

Embodiment Mode 9

The present invention can be applied to various electronic devices. Specifically, it can be applied to a display portion of an electronic device. Examples of such an electronic device are as follows: a camera such as a video camera or a digital camera, a goggle type display (a head-mounted display), a navigation system, a sound reproducing device (such as a car audio or an audio component), a computer, a game machine, a portable information terminal (such as a mobile computer, a mobile phone, a portable game machine, or an electronic book), an image reproducing device provided with a recording medium reading portion (specifically, a device which can reproduce a recording medium such as a digital versatile disc (DVD) and includes a light emitting device capable of displaying images thereof), and the like.

Figure 26A:
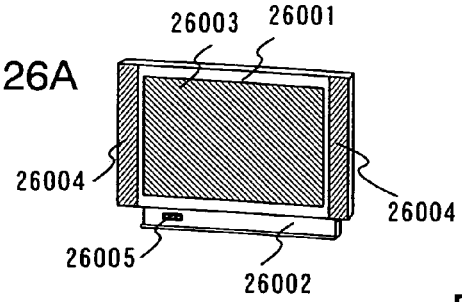
FIGS. 26A to 26H are diagrams explaining an electronic device to which a display device of the present invention can be applied.

FIG. 26A shows a light emitting device, which includes a chassis 26001, a support 26002, a display portion 26003, a speaker portion 26004, a video input terminal 26005, and the like. The display device of the present invention can be used for the display portion 26003. Note that the light emitting device includes in its category all light emitting devices used for displaying information, for example, for a personal computer, for TV broadcast reception, or for advertisement display. The light emitting device using the present invention for the display portion 26003 can reduce power consumption.

Figure 26B:
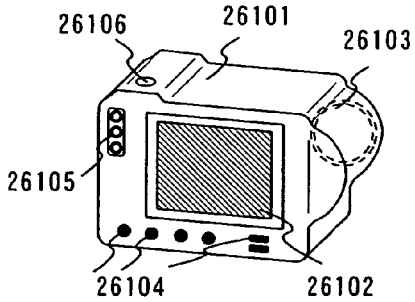

FIG. 26B shows a camera, which includes a main body 26101, a display portion 26102, an image receiving portion 26103, an operation key 26104, an external connection port 26105, a shutter 26106, and the like.

The camera using the present invention for the display portion 26102 can reduce power consumption.

Figure 26C:
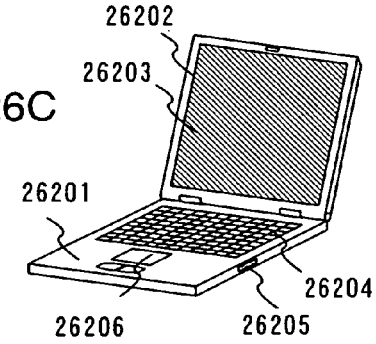

FIG. 26C shows a computer, which includes a main body 26201, a chassis 26202, a display portion 26203, a keyboard 26204, an external connection port 26205, a pointing mouse 26206, and the like. The computer using the present invention for the display portion 26203 can reduce power consumption.

Figure 26D:
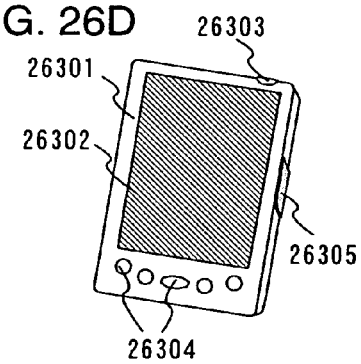

FIG. 26D shows a mobile computer, which includes a main body 26301, a display portion 26302, a switch 26303, an operation key 26304, an infrared port 26305, and the like. The mobile computer using the present invention for the display portion 26302 can reduce power consumption.

Figure 26E:
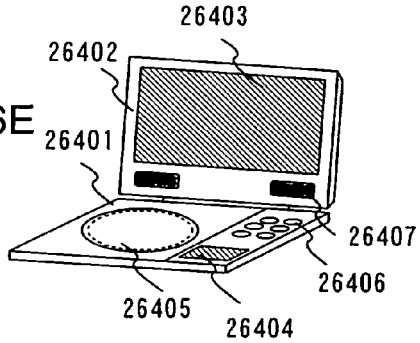

FIG. 26E shows a portable image reproducing device provided with a recording medium reading portion (specifically, a DVD reproducing device), which includes a main body 26401, a chassis 26402, a display portion A 26403, a display portion B 26404, a recording medium (DVD or the like) reading portion 26405, an operation key 26406, a speaker portion 26407, and the like. The display portion A 26403 mainly displays image information, and the display portion B 26404 mainly displays character information. The image reproducing device using the present invention for the display portion A 26403 and the display portion B 26404 can reduce power consumption.

Figure 26F:
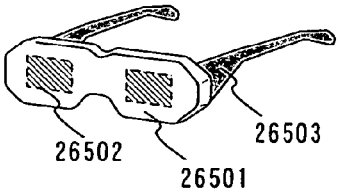

FIG. 26F shows a goggle type display, which includes a main body 26501, a display portion 26502, an arm portion 26503, and the like. The goggle type display using the present invention for the display portion 26502 can reduce power consumption.

Figure 26G:
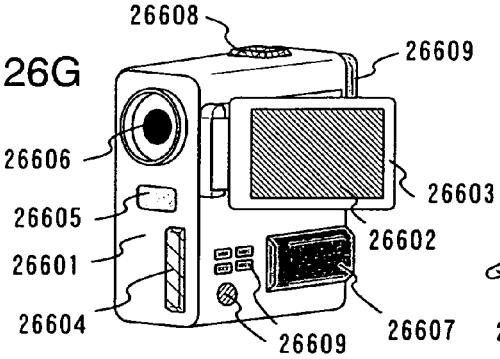

FIG. 26G shows a video camera, which includes a main body 26601, a display portion 26602, a chassis 26603, an external connection port 26604, a remote control receiving portion 26605, an image receiving portion 26606, a battery 26607, an audio input portion 26608, an operation key 26609, and the like. The video camera using the present invention for the display portion 26602 can reduce power consumption.

Figure 26H:
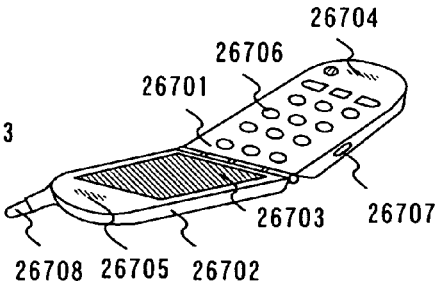

FIG. 26H shows a mobile phone, which includes a main body 26701, a chassis 26702, a display portion 26703, an audio input portion 26704, an audio output portion 26705, an operation key 26706, an external connection port 26707, an antenna 26708, and the like.

In recent years, a mobile phone is provided with a game function, a camera function, an electronic money function, or the like, and the need for a high-value added mobile phone has been increased. While a mobile phone becomes multifunctional and the frequency of use is increased, long time use with once charge is required. The mobile phone using the present invention for the display portion 26703 can reduce power consumption. Thus, long time use becomes possible.

As described above, the present invention can be applied to all electronic devices.

Embodiment Mode 10

In this embodiment mode, explanation is made on a display device in which a pixel portion is divided into a plurality of regions and signal writing to pixels can be separately performed in each region. In other words, signal writing may be performed from a driver in each region.

Figure 24:
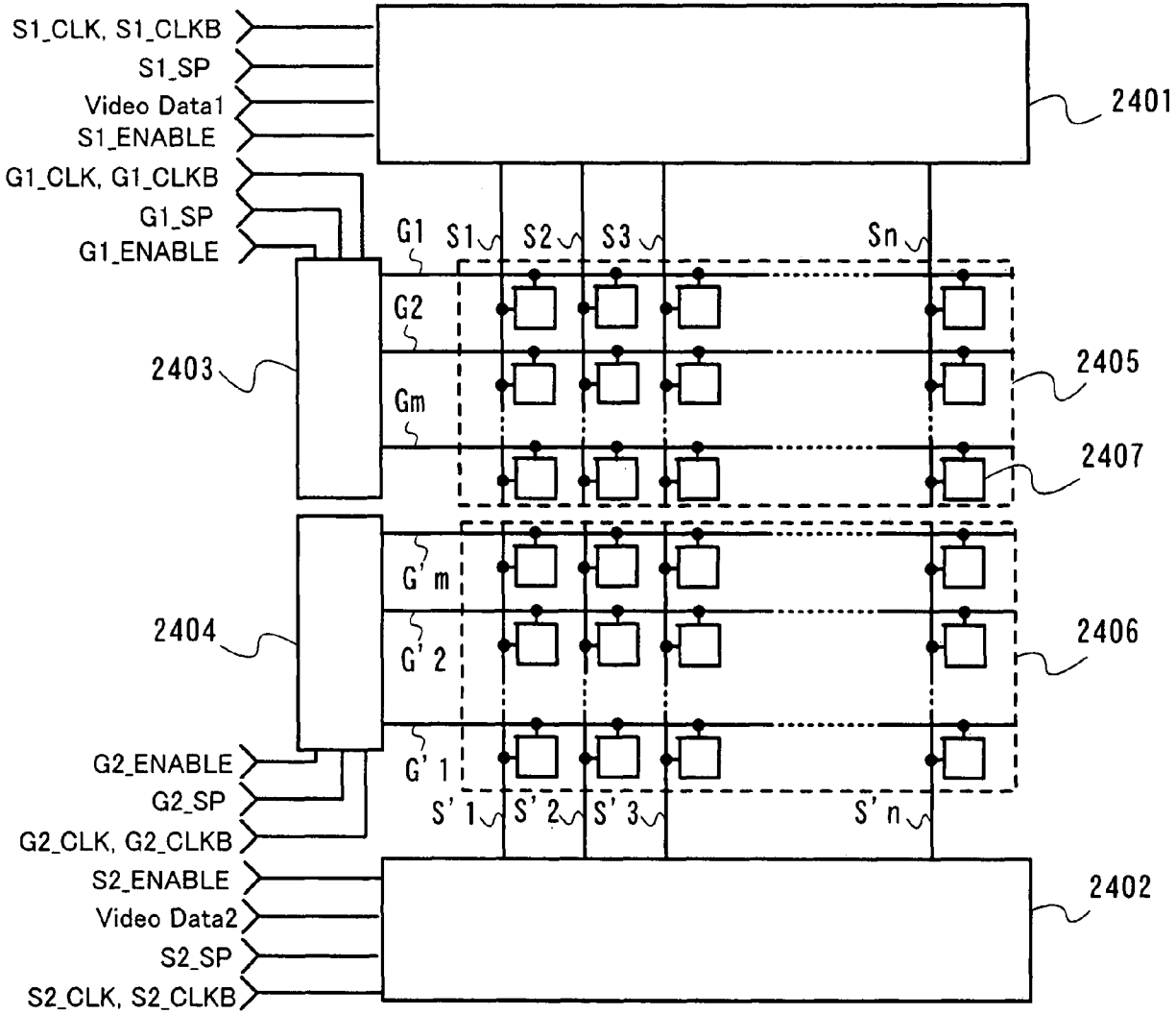
FIG. 24 is a diagram explaining a display device of the present invention.

FIG. 24 shows an example of a display device in which a pixel portion is divided into two regions and signal writing can be performed by different driver circuits.

The display device shown in FIG. 24 includes a first pixel region 2405, a second pixel region 2406, a scan line driver circuit 2403 selecting a pixel row of the first pixel region 2405, a signal line driver circuit 2401 inputting a video signal to the first pixel region 2405, a scan line driver circuit 2404 selecting a pixel row of the second pixel region 2406, and a signal line driver circuit 2402 inputting a video signal to the first pixel region 2406.

In the first pixel region 2405, pixels 2407 are arranged in matrix relative to scan lines G1 to Gm and signal lines S1 to Sn. In the second pixel region 2406, pixels 2407 are arranged in matrix relative to scan lines G'1 to G'm and signal lines S'1 to S'n.

A clock signal (G1_CLK), an inverted clock signal (G1_CLKB), a start pulse signal (G1_SP), an output control signal (G1_ENABLE), and the like are input to the scan line driver circuit 2403 to select a pixel row to which a signal is to be written. Then, a clock signal (S1_CLK), an inverted clock signal (S1_CLKB), a start pulse signal (S1_SP), an output control signal (S1_ENABLE), a video signal (Digital Video Data 1), and the like are input to the signal line driver circuit 2401 to input the video signal to the pixel row selected by the scan line driver circuit 2403. Note that pixel row selection is performed by inputting a scan signal to the scan lines G1 to Gm, and video signal input to the pixel row is performed by inputting the video signal to each of the signal lines S1 to Sn.

Note that in the case where a video signal input in an address period in the preceding subframe period is identical with a video signal to be input in a subsequent subframe period in pixels of a single row, the signal is prevented from being written to the pixels of a single row in the subsequent subframe period. Therefore, output control signals (G1_ENABLE, S1_ENABLE) showing whether or not the video signal input in an address period in the preceding subframe period is identical with the video signal input in a subsequent subframe period in the pixels of a single row are separately input to the scan line driver circuit 2403 and the signal line driver circuit 2401.

A clock signal (G2_CLK), an inverted clock signal (G2_CLKB), a start pulse signal (G2_SP), an output control signal (G2_ENABLE), and the like are input to the scan line driver circuit 2404 to select a pixel row to which a signal is to be written. In addition, a clock signal (S2_CLK), an inverted clock signal (S2_CLKB), a start pulse signal (S2_SP), an output control signal (S2_ENABLE), a video signal (Digital Video Data 2), and the like are input to the signal line driver circuit 2402 to input the video signal to the pixel row selected by the scan line driver circuit 2404. Note that pixel row selection is performed by inputting a scan signal to the scan lines G'1 to G'm, and video signal input to the pixel row is performed by inputting a video signal to each of the signal lines S'1 to S'n.

Note that in the case where a video signal input in an address period in the preceding subframe period is identical with a video signal to be input in a subsequent subframe period in pixels of a single row, the signal is prevented from being written to the pixels of a single row in the subsequent subframe period. Therefore, output control signals (G2_ENABLE, S2_ENABLE) showing whether or not the video signal input in an address period in the preceding subframe period is identical with the video signal to be input in a subsequent subframe period in the pixels of a single row are separately input to the scan line driver circuit 2404 and the signal line driver circuit 2402.

Although the video signals are separately written to the first pixel region 2405 and the second pixel region 2406, both the first pixel region 2405 and the second pixel region 2406 display an image as one display portion. In other words, data of an image as one display portion is divided into the video signal (Digital Video Data 1) and the video signal (Digital Video Data 2), which are input to respective signal line driver circuits.

Since a signal writing period can be shortened by dividing the pixel portion as in this structure, a display device which can improve to high definition and perform high level gray scale display can be provided.

Note that power consumption is increased with an increase in the number of times signal writing is carried out, in association with improvements in definition and level of gray scale of display. However, in the case where a video signal input in an address period in the preceding subframe period is identical with a video signal to be input in a subsequent subframe period in pixels of a single row, the display device of the present invention prevents signal writing to the pixels of a single row in the subsequent subframe period. Therefore, the display device of the present invention can reduce power consumption.

In addition, the structure of this embodiment mode is preferably applied to a high display capacity display device (a display device having a large number of display pixels) since signal writing can be separately performed to pixels in each pixel region. In other words, as display capacity is increased, time required for writing to pixels of all rows. However, if signal writing is separately performed in each pixel region as in the structure of this embodiment mode, time required for writing to all pixels can be shortened as the number of divided regions is increased.

Embodiment 1

Figures 12A, 12B:
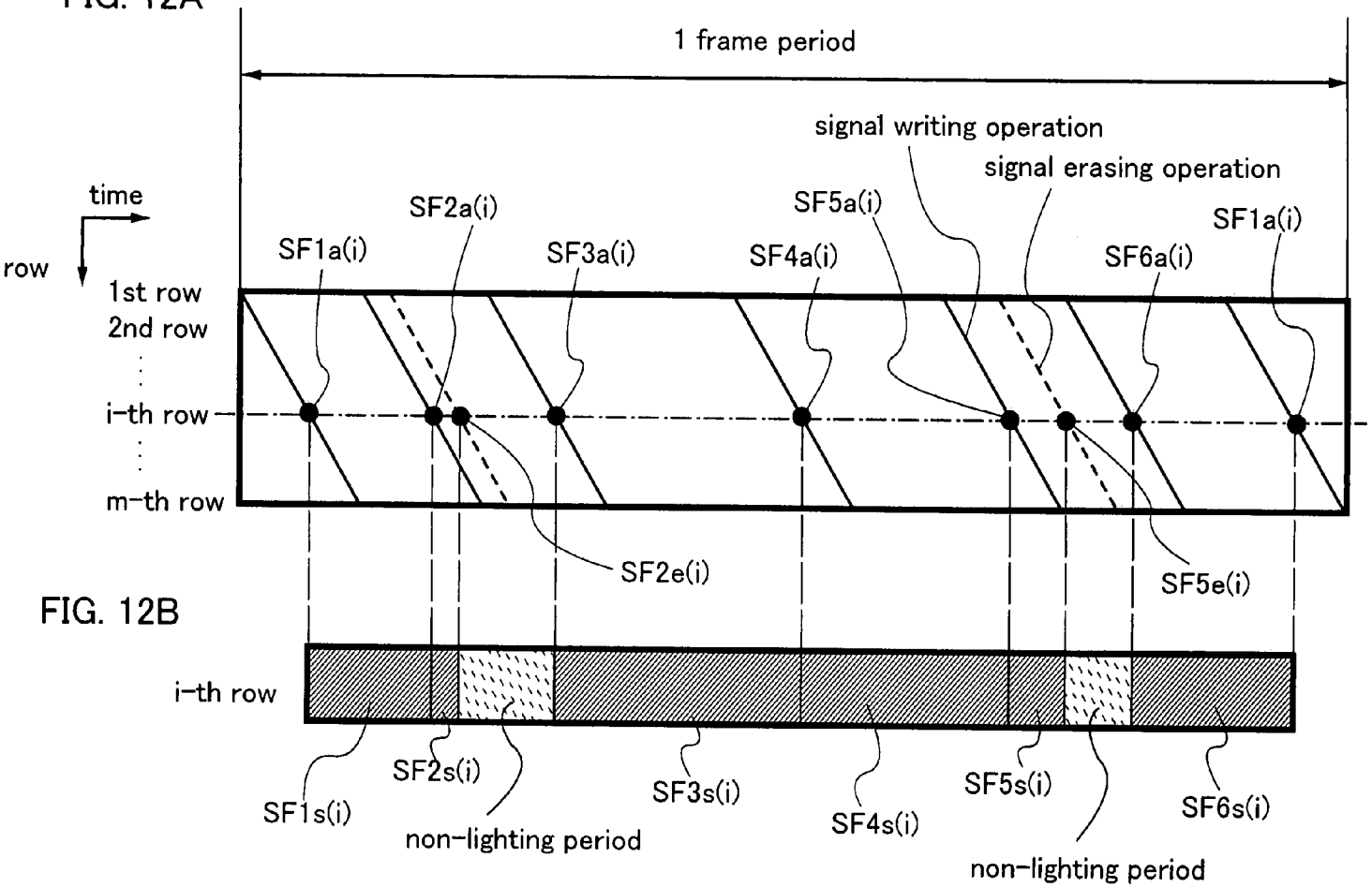
FIGS. 12A and 12B are diagrams explaining a method for driving a display device of the present invention.

In this embodiment, detailed explanation is made with reference to FIGS. 12A and 12B on the display device described in Embodiment Mode 1 in which a video signal is not input to a pixel in the case where data of the video signal for a single pixel row in which the signal is to be written to a pixel in a certain subframe period in one frame period is identical with data for the pixel row already written thereto. FIG. 12A shows signal writing operation and signal erasing operation in a certain one frame period using a horizontal direction as a time axis and a vertical direction as a pixel row axis.

Here, explanation is made focusing on a pixel row in i-th row. In the pixel row in i-th row, a signal writing time in a first subframe period is denoted by SF1*a*(*i*), and signal writing times in second, third, fourth, fifth, and sixth subframe periods are denoted by SF2*a*(*i*), SF3*a*(*i*), SF4*a*(*i*), SF5*a*(*i*), and SF6*a*(*i*), respectively. In addition, explanation is made with reference to FIG. 12B on a lighting period and a non-lighting period focusing on a pixel in i-th row. When attention is focused on i-th row, a signal writing time to a pixel is extremely shorter than a data hold period; therefore, the signal writing time is omitted in FIG. 12B. When a signal is written in SF1*a*(*i*), operation proceeds to a data hold period SF1*s*(*i*) in the first subframe period. Then, the signal writing time SF2*a*(*i*) in the second subframe period starts, and the data hold period SF1*s*(*i*) terminates. When a signal is written to a pixel according to the signal writing time SF2*a*(*i*), a data hold period SF2*s*(*i*) in the second subframe period starts, and the data hold period SF2*s*(*i*) terminates by signal erasing operation. The period of time after the signal of the pixel in i-th row is erased by erase operation until a signal writing time SF3*a*(*i*) in the third subframe period starts is a non-lighting period. In a similar manner, a data hold period SF3*s*(*i*) in the third subframe period is the time period after a signal is written to a pixel according to the signal writing time SF3*a*(*i*) in the third subframe period until the signal writing time SF4*a*(*i*) in the fourth subframe period. A data hold period SF4*s*(*i*) in the fourth subframe period is the time period after a signal is written to a pixel according to signal writing time SF4*a*(*i*) in the fourth subframe period until the signal writing time SF5*a*(*i*) in the fifth subframe period. A data hold period SF5*s*(*i*) in the fifth subframe period is the time period after a signal is written to a pixel according to the signal writing time SF5*a*(*i*) in the fifth subframe period until a signal of the pixel in i-th row is erased by signal erasing operation. A data hold period SF6*s*(*i*) in the sixth subframe period is the time period after a signal is written to a pixel according to the signal writing time SF6*a*(*i*) in the sixth subframe period until the signal writing time SF1*a*(*i*) in the first subframe period in a next frame period.

Here, if data of a video signal for all pixels of a single row in SF1*a*(*i*) is identical with data of a video signal for all pixels of a single row in SF2*a*(*i*), signal writing to the pixels in i-th row is stopped in SF2*a*(*i*). In addition, if data of a video signal for all pixels of a single row in SF3*a*(*i*) is data putting the pixels in a non-lighting state, signal writing to the pixels in i-th row is stopped in SF3*a*(*i*). Similarly, if data of a video signal for all pixels of a single row in SF4*a*(*i*) is identical with data of a video signal for all pixels of a single row in SF3*a*(*i*), signal writing to the pixels in i-th row is stopped in SF4*a*(*i*). If data of a video signal for all pixels of a single row in SF5*a*(*i*) is identical with data of a video signal for all pixels of a single row in SF4*a*(*i*), signal writing to the pixels in i-th row is stopped in SF5*a*(*i*). If data of a video signal for all pixels of a single row in SF6*a*(*i*) is data putting the pixels in a non-lighting state, signal writing to the pixels in i-th row is stopped in SF6*a*(*i*).

As described above, in the case where signals (a video signal and an erasing signal) input in the last subframe matches data of a video signal for pixels of a single row, signal writing to the pixel row in the subframe period is stopped. For example, a signal of a scan line driver circuit selecting the pixel row is prevented from being output. In other words, an L signal for not selecting the pixel row is input to a scan line of the pixel row, or the scan line of the pixel row is put in a floating state. In addition, a signal line driver circuit is also prevented from outputting a video signal. The output from the signal line driver circuit may be a signal for putting a pixel in a lighting state or a signal for putting a pixel in a non-lighting state. Such a signal consuming as little power as possible may be input. Alternatively, a signal line may be put in a floating state.

This makes it possible to reduce the number of times charging and discharging are carried out and to reduce power consumption.

Embodiment 2

In this embodiment, detailed explanation is made with reference to FIGS. 12A and 12B on the display device described in Embodiment Mode 1 in which a signal of a pixel row is not erased when data of a video signal for a single pixel row in which signal erasing in a pixel is to be performed in a certain subframe period in one frame period is data putting the pixel in a non-lighting state. FIG. 12A shows signal writing operation and signal erasing operation in a certain one frame period using a horizontal direction as a time axis and a vertical direction as a pixel row axis.

Here, explanation is made focusing on a pixel row in i-th row. In the pixel row in i-th row, a signal writing time in a first subframe period is denoted by SF1*a*(*i*), and signal writing times in second, third, fourth, fifth, and sixth subframe periods are denoted by SF2*a*(*i*), SF3*a*(*i*), SF4*a*(*i*), SF5*a*(*i*), and SF6*a* (i), respectively. In addition, a signal erasing time in the second subframe period is denoted by SF2*e*(i), and a signal erasing time in the fifth subframe period is denoted by SF5*e* (i). In addition, explanation is made on a lighting period and a non-lighting period focusing on a pixel in i-th row with reference to FIG. 12B. When attention is focused on i-th row, signal writing time to a pixel is extremely shorter than a data hold period; therefore, the signal writing time is omitted in FIG. 12B. When a signal is written in SF1*a*(*i*), operation proceeds to a data hold period SF1*s*(*i*) in the first subframe period. Then, the signal writing time SF2*a*(*i*) in the second subframe period starts, and the data hold period SF1*s*(*i*) terminates. When a signal is written to a pixel according to the signal writing time SF2*a*(*i*), a data hold period SF2*s*(*i*) in the second subframe period starts, and the data hold period SF2*s* (*i*) terminates by signal erasing operation. The period of time after the signal of the pixel in i-th row is erased by erase operation until a signal writing time SF3*a*(*i*) in the third subframe period starts is a non-lighting period. In a similar manner, a data hold period SF3*s*(*i*) in the third subframe period is the time period after a signal is written to a pixel according to the signal writing time SF3*a*(*i*) in the third subframe period until the signal writing time SF4*a*(*i*) in the fourth subframe period. A data hold period SF4*s*(*i*) in the fourth subframe period is the time period after a signal is written to a pixel according to signal writing time SF4*a*(*i*) in the fourth subframe period until the signal writing time SF5*a*(*i*) in the fifth subframe period. A data hold period SF5*s*(*i*) in the fifth subframe period is the time period after a signal is written to a pixel according to the signal writing time SF5*a*(*i*) in the fifth subframe period until a signal of the pixel in i-th row is erased by signal erasing operation. A data hold period SF6*s*(*i*) in the sixth subframe period is the time period after a signal is written to a pixel according to the signal writing time SF6*a*(*i*) in the sixth subframe period until the signal writing time SF1*a*(*i*) in the first subframe period in a next frame period.

Here, if data of a video signal for all pixels of a single row in SF2*a*(*i*) is data putting the pixels in a non-lighting state, signal erasing of the pixels in i-th row is stopped in SF2*e*(i). In addition, if data of a video signal for all pixels of a single row in SF5*a*(*i*) is data putting the pixels in a non-lighting state, signal erasing of the pixels in i-th row is stopped in SF5*e*(i).

In the case of erasing a signal as described above, when data of a video signal input right before to pixels of a single row is data putting the pixels in a non-lighting state, signal erasing of the pixel row is stopped. For example, a signal of a scan line driver circuit selecting the pixel row is prevented from being output. In other words, an L signal for not selecting the pixel row is input to a scan line of the pixel row, or the scan line of the pixel row is put in a floating state. From a signal line driver circuit, a video signal for the pixel row may be kept being input or it may be an erasing signal. Such a signal consuming as little power as possible may be input. Alternatively, a signal line may be put in a floating state.

This makes it possible to reduce the number of times charging and discharging are carried out and to reduce power consumption.

Embodiment 3

In this embodiment, detailed explanation is made with reference to FIGS. 12A and 12B the display device described in Embodiment Mode 1 in which a video signal is not input to a pixel in the case where data of the video signal for a single pixel row in which the signal is to be written to a pixel in a certain subframe period in one frame period is identical with data for the pixel row already written to the pixel, and further, signal erasing of a pixel row is not performed in the case where data of a video signal for a single pixel row in which signal erasing of the pixels is to be performed is data putting the pixels in a non-lighting state.

Here, explanation is made focusing on a pixel row in i-th row. In the pixel row in i-th row, a signal writing time in a first subframe period is denoted by SF1*a*(*i*), and signal writing times in second, third, fourth, fifth, and sixth subframe periods are denoted by SF2*a*(*i*), SF3*a*(*i*), SF4*a*(*i*), SF5*a*(*i*), and SF6*a*(*i*), respectively. In addition, a signal erasing time in the second subframe period is denoted by SF2*e*(i), and a signal erasing time in the fifth subframe period is denoted by SF5*e* (i). In addition, explanation is made with reference to FIG. 12B on a lighting period and a non-lighting period focusing on a pixel in i-th row. When attention is focused on i-th row, a signal writing time to a pixel is extremely shorter than a data hold period; therefore, the signal writing time is omitted in FIG. 12B. When a signal is written in SF1*a*(*i*), operation proceeds to a data hold period SF1*s*(*i*) in the first subframe period. Then, the signal writing time SF2*a*(*i*) in the second subframe period starts, and the data hold period SF1*s*(*i*) terminates. When a signal is written to a pixel according to the signal writing time SF2*a*(*i*), a data hold period SF2*s*(*i*) in the second subframe period starts, and the data hold period SF2*s* (*i*) terminates by signal erasing operation. The period of time after the signal of the pixels in i-th row is erased by erase operation until a signal writing time SF3*a*(*i*) in the third subframe period starts is a non-lighting period. In a similar manner, a data hold period SF3*s*(*i*) in the third subframe period is the time period after a signal is written to a pixel according to the signal writing time SF3*a*(*i*) in the third subframe period until the signal writing time SF4*a*(*i*) in the fourth subframe period. A data hold period SF4*s*(*i*) in the fourth subframe period is the time period after a signal is written to a pixel according to signal writing time SF4*a*(*i*) in the fourth subframe period until the signal writing time SF5*a*(*i*) in the fifth subframe period. A data hold period SF5*s*(*i*) in the fifth subframe period is the time period after a signal is written to a pixel according to the signal writing time SF5*a*(*i*) in the fifth subframe period until a signal of the pixels in i-th row is erased by signal erasing operation. A data hold period SF6*s*(*i*) in the sixth subframe period is the time period after a signal is written to a pixel according to the signal writing time SF6*a*(*i*) in the sixth subframe period until the signal writing time SF1*a*(*i*) in the first subframe period in a next frame period.

Here, if data of a video signal for all pixels of a single row in SF1*a*(*i*) is identical with data of a video signal for all pixels of a single row in SF2*a*(*i*), signal writing to the pixels in i-th row is stopped in SF2*a*(*i*). In addition, if data of a video signal for all pixels of a single row in SF3*a*(*i*) is data putting the pixels in a non-lighting state, signal writing to the pixels in i-th row is stopped in SF3*a*(*i*). Similarly, if data of a video signal for all pixels of a single row in SF4*a*(*i*) is identical with data of a video signal for all pixels of a single row in SF3*a*(*i*), signal writing to the pixels in i-th row is stopped in SF4*a*(*i*). If data of a video signal for all pixels of a single row in SF5*a*(*i*) is identical with data of a video signal for all pixels of a single row in SF4*a*(*i*), signal writing to the pixels in i-th row is stopped in SF5*a*(*i*). If data of a video signal for all pixels of a single row in SF6*a*(*i*) is data putting the pixels in a non-lighting state, signal writing to the pixels in i-th row is stopped in SF6*a*(*i*).

In addition, if data of a video signal for all pixels of a single row in SF2*a*(*i*) is data putting the pixels in a non-lighting state, signal erasing of the pixels in i-th row is stopped in SF2*e*(i). In addition, if data of a video signal for all pixels of a single row in SF5*a*(*i*) is data-putting the pixels in a non-lighting state, signal erasing of the pixels in i-th row is stopped in SF5*e*(i).

As described above, in the case where signals (a video signal and an erasing signal) input in the last subframe matches data of a video signal for pixels of a single row, signal writing to the pixel row in the subframe period is stopped. For example, a signal of a scan line driver circuit selecting the pixel row is prevented from being output. In other words, an L signal for not selecting the pixel row is input to a scan line of the pixel row, or the scan line of the pixel row is put in a floating state. In addition, a signal line driver circuit is also prevented from outputting a video signal. The output from the signal line driver circuit may be a signal for putting a pixel in a lighting state or a signal for putting a pixel in a non-lighting state. Such a signal consuming as little power as possible may be input. Alternatively, a signal line may be put in a floating state. Furthermore, in the case of erasing a signal, when data of a video signal input right before to pixels of a single row is data putting the pixels in a non-lighting state, signal erasing of the pixel row is stopped. For example, a signal of a scan line driver circuit selecting the pixel row is prevented from being output. In other words, an L signal for not selecting the pixel row is input to a scan line of the pixel row, or the scan line of the pixel row is put in a floating state. From a signal line driver circuit, a video signal for the pixel row may be kept being input or it may be an erasing signal. Such a signal consuming as little power as possible may be input. Alternatively, a signal line may be put in a floating state.

This makes it possible to reduce the number of times charging and discharging are carried out and to reduce power consumption.

Note that in the case where a non-lighting state continues, a signal is not input to a pixel once a signal is input to the pixel. Therefore, in that case, a signal may be input regularly before the signal input to the pixel leaks to cause wrong display. Note that it is desirable to keep inputting a signal that puts a pixel in a non-lighting state to a signal line in order to reduce signal leakage. In the case where lighting continues, a signal of a pixel is rewritten when an erasing signal is input; therefore, there is no problem.

Embodiment 4

In this embodiment, explanation is made on a more suitable driving method of the display device described in Embodiment Mode 1.

The display device of the present invention is suitable for a driving method using a time gray scale method for expressing a gray scale by a difference in total time of light emitting time of each pixel by dividing one frame period into a plurality of subframe periods and controlling lighting and non-lighting of each pixel in each subframe period; in particular, for a driving method expressing a gray scale by sequentially adding the number of times lighting is carried out in each subframe period. In other words, the number of subframes to perform lighting is increased as the gray scale level is increased. Therefore, in a subframe in which lighting is performed at a low gray scale level, lighting is performed also at a high gray scale level. Such a gray scale method is referred to as an "overlapped time gray scale method".

Figures 22A, 22B:
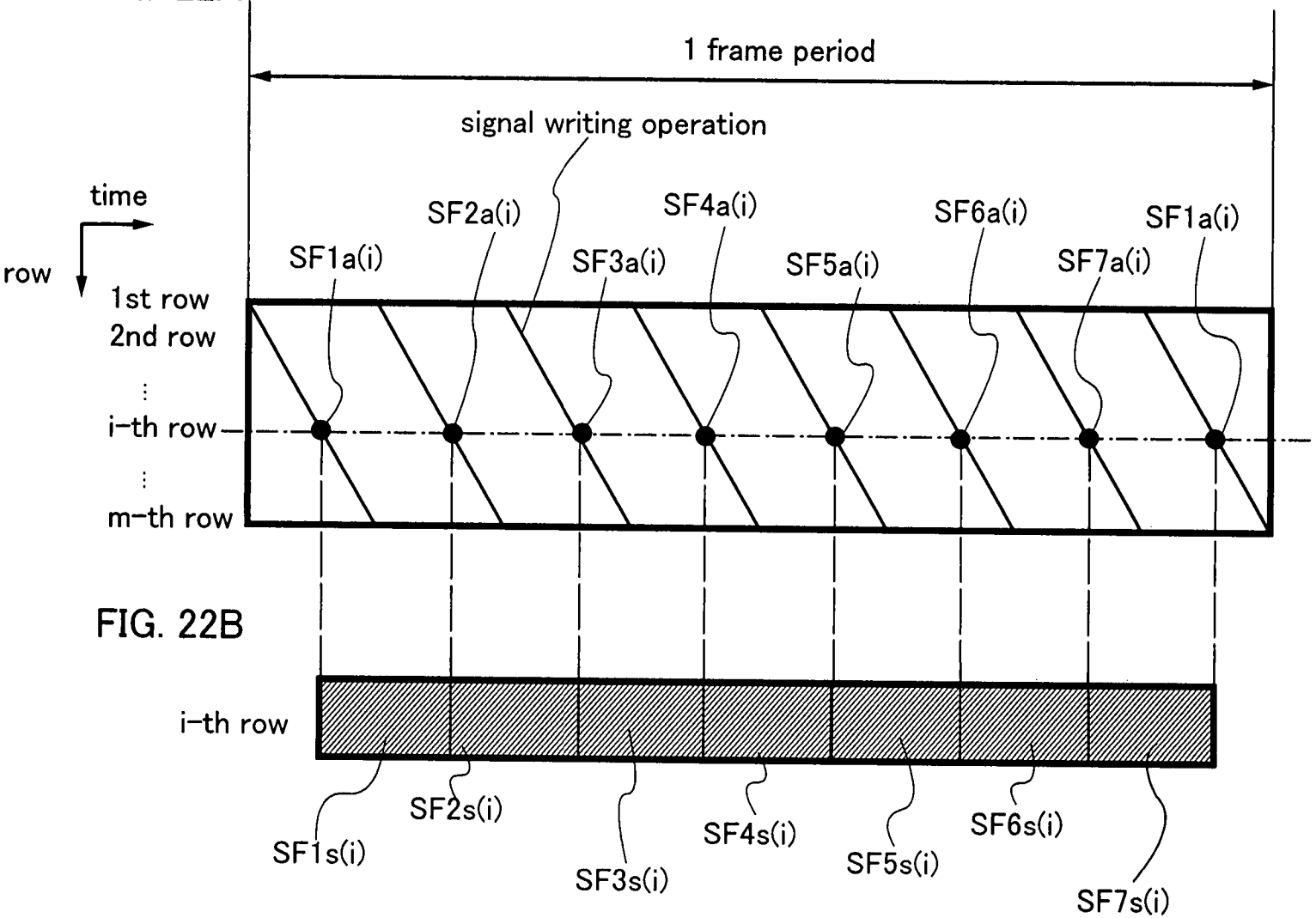
FIGS. 22A and 22B are diagrams explaining a method for driving a display device of the present invention.

The case of expressing a 3-bit gray scale with an overlapped time gray scale method is explained with reference to FIGS. 22A and 22B. FIG. 22A shows signal writing operation in a certain frame period using a horizontal direction as a time axis and a vertical direction as a pixel row axis. In order to express a 3-bit gray scale, one frame period is divided into seven subframes.

Note that explanation is made here focusing on a pixel row in i-th row. In the pixel row in i-th row, a signal writing time in a first subframe period is denoted by SF1*a*(*i*), and signal writing times in second, third, fourth, fifth, sixth, and seventh subframe periods are denoted by SF2*a*(*i*), SF3*a*(*i*), SF4*a*(*i*), SF5*a*(*i*), SF6*a*(*i*), and SF7*a*(*i*), respectively.

In addition, explanation is made on a lighting period focusing on a pixel in i-th row with reference to FIG. 22B. When attention is focused on i-th row, a signal writing time to a pixel is extremely shorter than a data hold period; therefore, the signal writing time is omitted in FIG. 22B. When a signal is written in SF1*a*(*i*), operation proceeds to a data hold period SF1*s*(*i*) in the first subframe period. Then, the signal writing time SF2*a*(*i*) in the second subframe period starts, and the data hold period SF1*s*(*i*) terminates. Similarly, when signal writing is performed in each subframe period, a data hold period starts and the data hold period terminates by signal writing in a next subframe. In this manner, data hold periods SF2*s*(*i*), SF3*s*(*i*), SF4*s*(*i*), SF5*s*(*i*), SF6*s*(*i*), and SF7*s*(*i*) in the second, third, fourth, fifth, sixth, and seventh subframe periods are set, respectively. The data hold periods SF1*s*(*i*), SF2*s*(*i*), SF3*s*(*i*), SF4*s*(*i*), SF5*s*(*i*), SF6*s*(*i*), and SF7*s*(*i*), which are set as described above, each have an equal length of time.

Here, if data of a video signal for all pixels of a single row in SF1*a*(*i*) is identical with data of a video signal for all pixels of a single row in SF2*a*(*i*), signal writing to the pixels in i-th row is stopped in SF2*a*(*i*). If data of a video signal for all pixels of a single row in SF3*a*(*i*) is identical with data of a video signal for all pixels of a single row in SF2*a*(*i*), signal writing to the pixels in i-th row is stopped in SF3*a*(*i*). If data of a video signal for all pixels of a single row in SF4*a*(*i*) is identical with data of a video signal for all pixels of a single row in SF3*a*(*i*), signal writing to the pixels in i-th row is stopped in SF4*a*(*i*). If data of a video signal for all pixels of a single row in SF5*a*(*i*) is identical with data of a video signal for all pixels of a single row in SF4*a*(*i*), signal writing to the pixels in i-th row is stopped in SF5*a*(*i*). If data of a video signal for all pixels of a single row in SF6*a*(*i*) is identical with data of a video signal for all pixels of a single row in SF5*a*(*i*), signal writing to the pixels in i-th row is stopped in SF6*a*(*i*). If data of a video signal for all pixels of a single row in SF7*a*(*i*) is identical with data of a video signal for all pixels of a single row in SF6*a*(*i*), signal writing to the pixels in i-th row is stopped in SF7*a*(*i*).

As described above, in the case where a signal (video signal) input in the last subframe matches data of a video signal for pixels of a single row, signal writing to the pixel row in the subframe period is stopped. For example, a signal of a scan line driver circuit selecting the pixel row is prevented from being output. In other words, an L signal for not selecting the pixel row is input to a scan line of the pixel row, or the scan line of the pixel row is put in a floating state. In addition, a signal line driver circuit is also prevented from outputting a video signal. The output from the signal line driver circuit may be a signal for putting a pixel in a lighting state or a signal for putting a pixel in a non-lighting state. Such a signal consuming as little power as possible may be input. Alternatively, a signal line may be put in a floating state.

This makes it possible to reduce the number of times charging and discharging are carried out and to reduce power consumption.

This is because, particularly when an overlapped time gray scale method is employed, lighting or non-lighting is continuously performed at any gray scale level and the probability of data matching of video signals for pixels of a single row in preceding and following subframes is drastically increased.

Here, FIG. 27 shows a diagram explaining lighting or non-lighting in each subframe period at each gray scale level. A subframe with a circle mark (○) denotes a lighting state and a subframe with an X-mark (x) denotes a non-lighting state. Then, a gray scale is expressed by adding a subframe in which lighting is performed at each gray scale level. At gray scale level 0, non-lighting is performed in SF1 to SF7. At gray scale level 1, lighting is performed only in SF1 and non-lighting is performed in SF2 to SF7. At gray scale level 2, lighting is performed in SF1 and SF2 and non-lighting is performed in SF3 to SF7; at level 3, lighting in SF1 to SF3 and non-lighting in SF4 to SF7; at level 4, lighting in SF1 to SF4 and non-lighting in SF5 to SF7; at level 5, lighting in SF1 to SF5 and non-lighting in SF6 and SF7; at level 6, lighting in SF1 to SF6 and non-lighting in SF7; and at level 7, lighting in all of SF1 to SF7.

Therefore, it is found that lighting is repeated in each subframe period at a high gray scale level, and non-lighting is repeated in each subframe period at a low gray scale level. Thus, the display device of the present invention can drastically reduce power consumption when the entire display screen is bright as shown in FIG. 31A, when the entire display screen is dark as shown in FIG. 31B, and when the screen includes an extremely bright display and an extremely dark display as shown in FIG. 31C.

Figure 31A:
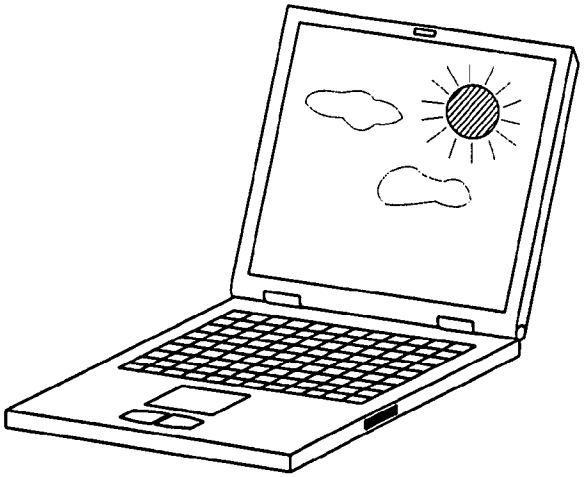
FIGS. 31A to 31C are diagrams explaining a method for driving a display device of the present invention.

For example, when all pixels in a certain pixel row are at gray scale level 5 to 7 in the case where the display screen is bright on the whole as shown in FIG. 31A, all pixels in the pixel row are in a lighting state in SF1 to SF5. Thus, it is in SF6 when a signal is written again to the pixel row after writing a signal to the pixel row in SF1. In other words, four times of signal writing to the pixel row can be omitted.

Figure 31B:
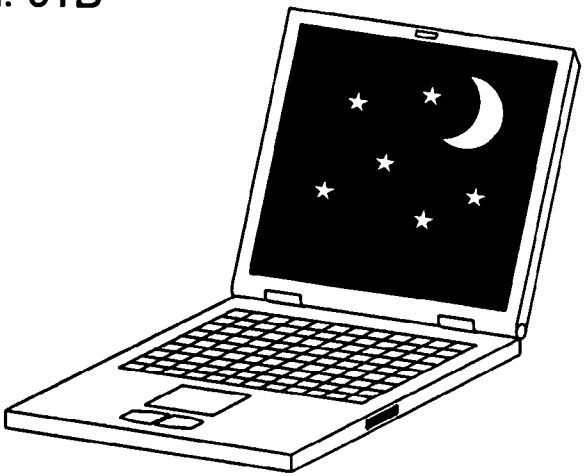

For example, when all pixels in a certain pixel row are at gray scale level 0 to 2 in the case where the display screen is dark on the whole as shown in FIG. 31B, all pixels in the pixel row are in a non-lighting state in SF3 to SF7. Thus, a signal does not need to be written again to the pixel row after writing a signal to the pixel row in SF3. In other words, four times of signal writing to the pixel row can be omitted.

Figure 31C:
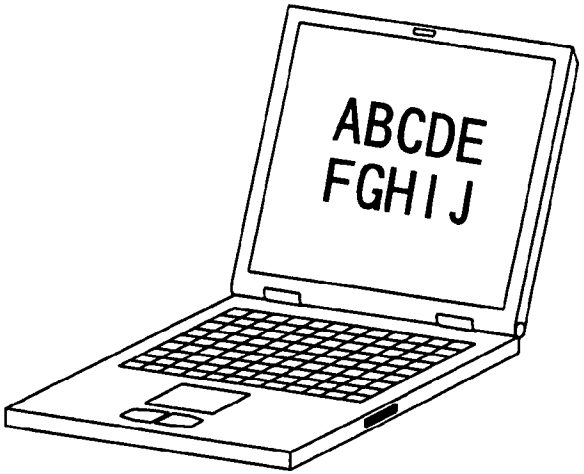

For example, when all pixels in a certain pixel row are at gray scale level 0, 1, 6, and 7 when the display screen includes an extremely bright display and an extremely dark display as shown in FIG. 31C, the pixels in the pixel row are all in a lighting state or in a non-lighting state in SF2 to SF6. Thus, it is in SF7 when a signal is written again to the pixel row after writing a signal to the pixel row in SF2. In other words, four times of signal writing to the pixel row can be omitted.

Note that FIG. 31A shows the case of displaying daytime sky on a sunny day on a display screen of a personal computer, but this is merely an example. Therefore, the present invention is not limited thereto.

In addition, FIG. 31B shows the case of displaying night-time sky on a display screen of a personal computer, but this is merely an example. Therefore, the present invention is not limited thereto.

In addition, FIG. 31C shows the case of displaying characters on a display screen of a personal computer, but this is merely an example. Therefore, the present invention is not limited thereto.

Note that when an overlapped time gray scale method is used as shown in FIG. 27, lighting and non-lighting in subframe periods are switched only once in one frame period; therefore, the probability of matching of data in pixels of a single pixel row is high in preceding and following subframe periods even at an intermediate gray scale level. Thus, the number of times charging and discharging are carried out can be reduced, so that power consumption can be reduced.

In addition, a pseudo contour can also be reduced by using such a driving method. This is because, at a gray scale level higher than a certain gray scale level, a pixel is lighted in each of subframe periods in which the pixel is lighted at a certain gray scale level and a lower level. Thus, it is possible to prevent an eye from sensing inaccurate brightness at a transition point between gray scale levels even if a visual axis is moved.

In addition, a weighted center of light emission can be located at the center by changing the selection order of subframes selected with respect to gray scale level. An example thereof is shown in FIG. 32. At gray scale level 0, non-lighting is performed in SF1 to SF7. At gray scale level 1, lighting is performed only in SF4 and non-lighting is performed in SF1 to SF3 and SF5 to SF7. At gray scale level 2, lighting is performed in SF3 and SF4 and non-lighting is performed in SF1, SF2, SF5 to SF7; at level 3, lighting in SF3 to SF5 and non-lighting in SF1, SF2, SF6, and SF7; at level 4, lighting in SF2 to SF5 and non-lighting in SF1, SF6, and SF7; at level 5, lighting in SF2 to SF6 and non-lighting in SF1 and SF7; at level 6, lighting in SF1 to SF6 and non-lighting in SF7; and at level 7, lighting in all of SF1 to SF7. In other words, a subframe period for which lighting is performed at a low gray scale is started from a middle subframe period, and a subframe closer to the middle subframe is selected for a subframe period in which lighting is performed as a gray scale level rises. By selecting subframes as described above, a weighted center of light emission can be located at the center and a clear display can be performed.

If lighting times in all subframe periods are equally weighted, the number of subframes needs to be increased to perform high level gray scale display. Thus, in order to perform high level gray scale display without increasing the number of subframes, bits are divided into regions such as a higher-order bit, a middle-order bit, and a lower-order bit, and lighting times are equally weighted in each region. For example, explanation is made with reference to FIG. 28 on the case where a higher-order bit is 2 bits, a middle-order bit is 2 bits, and a lower-order bit is 1 bit.

Lighting times of the higher-order bit, the middle-order bit, and the lower-order bit are weighted to be 8:2:1. In addition, the number of subframes of the higher-order 2 bits is three (SF1 to SF3), which enables expression of 2 bits, that is, four gray scale levels. The number of subframes of the middle-order 2 bits is three (SF4 to SF6), which enables expression of 2 bits, that is, four gray scale levels. Further, the number of subframes of the lower-order 1 bit is one (SF7), which enables expression of 1 bit, that is, two gray scale levels. Thus, 5 bits, that is, 32 gray scale levels can be expressed with seven subframes in total (three subframes of the higher-order bit, three subframes of the middle-order bit, and one subframe of the lower-order bit).

Also in the case shown in FIG. 28, in the case where a signal (video signal) input in the last subframe matches data of a video signal for pixels of a single row, signal writing to the pixel row in the subframe period is stopped. In this case, for example, in the case where all pixels in a certain pixel row are at gray scale level 0 to 7, at gray scale level 24 to 31, or at gray scale level 0 to 7 and 24 to 31, all pixels in this pixel row remain in a lighting state or non-lighting state and do not change in SF1 to SF3. Therefore, signal writing to the pixel row in SF2 and SF3 can be omitted. Thus, the number of times charging and discharging are carried out can be reduced, and power consumption can be reduced. Furthermore, in the case where all pixels are at gray scale level 0 or 1, at gray scale level 30 or 31, or at gray scale level 0 or 1 and 30 or 31, all pixels in this pixel row remain in a lighting or non-lighting state and do not change in SF1 to SF6. Therefore, signal writing to the pixel row in SF2 to SF6 can be omitted. Thus, the number of times charging and discharging are carried out can be drastically reduced, and power consumption can be reduced. In other words, power consumption can be drastically reduced when the gray scale level of the entire screen is substantially biased toward a high gray scale level, a low gray scale level, or a high gray scale level and a low gray scale level.

Here, FIG. 30A shows lighting and non-lighting of each subframe in the case where the gray scale level of a certain pixel row is at 28 to 31. Explanation is made assuming that the certain pixel row includes 10 columns. In SF1 to SF7, a subframe circled by a circle mark (○) is a subframe in which lighting is performed. Note that a pixel column 1 is at gray scale level 28; a pixel column 2, at level 31; a pixel column 3, at level 29; a pixel column 4, at level 28; a pixel column 5, at level 30; a pixel column 6, at level 31; a pixel column 7, at level 29; a pixel column 8, at level 30; a pixel column 9, at level 28; and a pixel column 10, at level 30. Then, lighting is performed in all pixel columns in SF1 to SF5 as shown in FIG. 30A; therefore, signal writing to the pixel row can be omitted in SF2 to SF5. Thus, power consumption can be reduced.

In addition, the number of subframes does not need to be increased to express many gray scale levels; therefore, an increase in power consumption associated with higher level gray scale display can be prevented.

Note that an overlapped time gray scale method can be applied to the higher-order bit, and a digital time gray scale method can be applied to the lower-order bit. Explanation is made with reference to FIG. 29. In other words, lighting time of the higher-order 2 bits is weighted to be 8 when those of the lower-order 3 bits are weighted to be 4:2:1. The number of subframes of the higher-order 2 bits is three (SF1 to SF3). This makes it possible to express 2 bits, that is, 4 gray scale levels. The number of subframes of the lower-order 3 bits is three (SF4 to SF6), which enables to express a 3-bit gray scale. Thus, 5 bits, that is, 32 gray scale levels can be expressed with six subframes in total (three subframes of the higher-order bit and three subframes of the lower-order bit).

Consequently, also in the case shown in FIG. 29, in the case where a signal (video signal) input in the last subframe matches data of a video signal for pixels of a single row, signal writing to the pixel row in the subframe period is stopped. In this case, in the case where all pixels in a certain pixel row are at gray scale level 0 to 7, at gray scale level 24 to 31, or at gray scale level 0 to 7 and 24 to 31, all pixels in this pixel row remain in a lighting state or non-lighting state and do not change in SF1 to SF3. Therefore, signal writing to the pixel row in SF2 and SF3 can be omitted.

Here, FIG. 30B shows lighting and non-lighting of each subframe in the case where the gray scale level of a certain pixel row is at 0 to 3 and 28 to 31. Explanation is made assuming that the certain pixel row includes 10 columns. In SF1 to SF6, a subframe circled by a circle mark (○) is a subframe in which lighting is performed. Note that it is assumed that a pixel column 1 is at gray scale level 28; a pixel column 2, at level 31; a pixel column 3, at level 29; a pixel column 4, at level 28; a pixel column 5, at level 3; a pixel column 6, at level 1; a pixel column 7, at level 0; a pixel column 8, at level 2; a pixel column 9, at level 28; and a pixel column 10, at level 30. Then, all pixel columns are kept in a lighting or non-lighting state in SF1 to SF4 as shown in FIG. 30B; therefore, signal writing to the pixel row can be omitted in SF2 to SF4. Thus, power consumption can be reduced.

Thus, the number of times charging and discharging are carried out can be reduced, and power consumption can be reduced. Note that the number of subframes can be reduced by combining an overlapped time gray scale method with a digital time gray scale method as shown in FIG. 29.

Embodiment 5

In this embodiment, a structure is employed in which, when data of a video signal for a pixel row to which the signal is to be written all matches data of a video signal for a pixel row to which a signal is written right before, the data of the video signal for the pixel row to which the signal is to be written is not written to a signal line driver circuit. In other words, in a line sequential display device which writes a signal to pixels row by row, a video signal to a pixel row that matches data of a video signal written to a pixel row right before is not input to a signal line driver circuit, and a signal is written to the pixel row using the data of the video signal for the pixel row right before. Alternatively, the writing is performed at the same time as signal writing to a pixel right before. Power consumption can further be reduced by combining this with the driving method of the display device described in Embodiment Mode 1.

Figure 25:
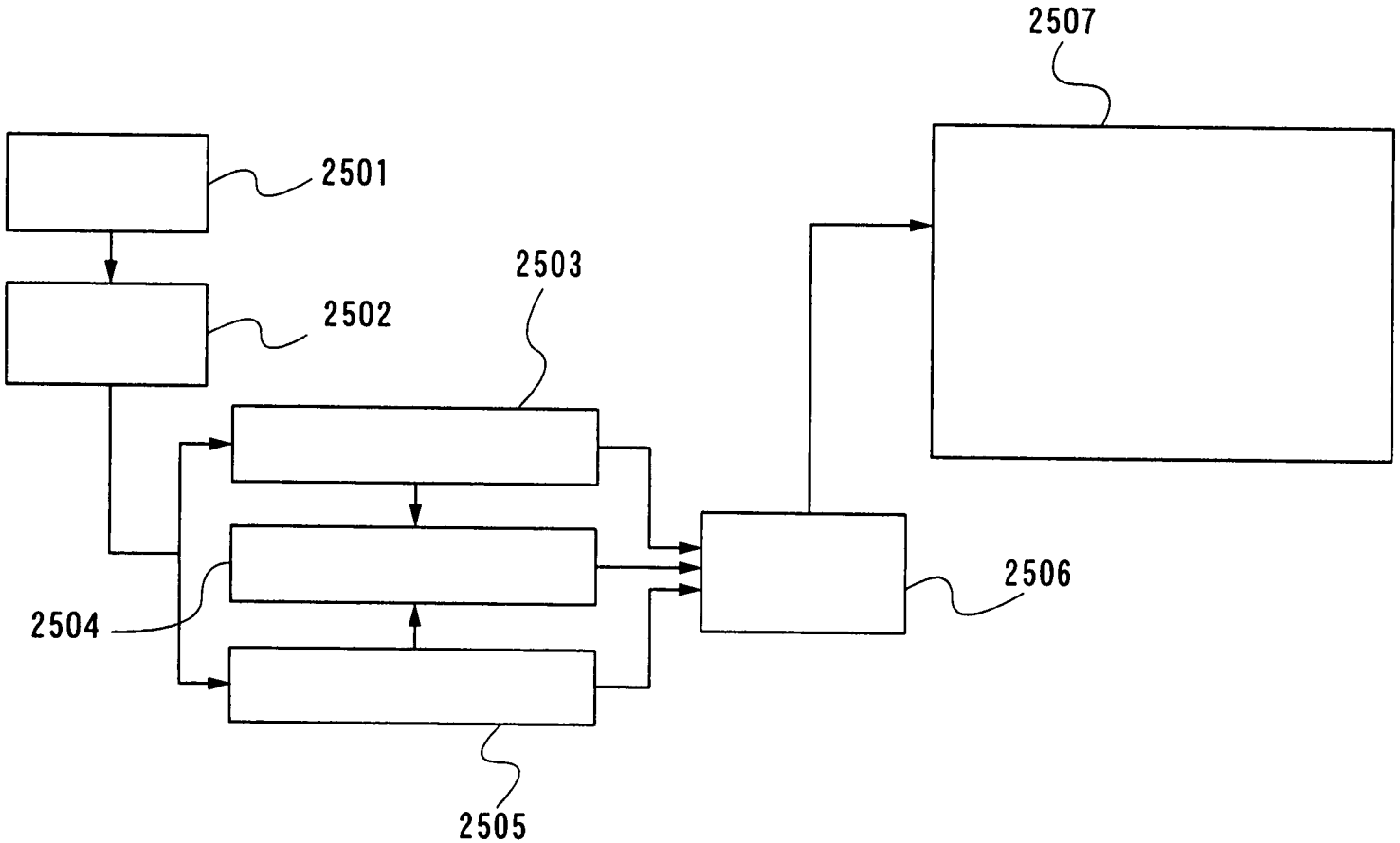
FIG. 25 is a diagram explaining a main structure of a display device of the present invention.

A display device of this embodiment is explained with reference to FIG. 25. Data of a video signal to be written to a pixel is read from a frame memory by a memory read selection circuit 2501. The data of the video signal is read for pixels in each row of a subframe and input to a first shift register 2503 or a second shift register 2505 by an input register selection circuit 2502. In other words, the data of a video signal for pixels of a single row is alternately input to the first shift register 2503 and the second shift register 2505.

In addition, a determination circuit 2504 compares data of video signals for pixels of a single row input to the first shift register 2503 and the second shift register 2505. Then, an output control signal (SR_ENABLE), which shows whether or not the data of video signals for pixels of a single row input to the first shift register 2503 and the second shift register 2505 match, is input to an output register selection circuit 2506.

In addition, the output register selection circuit 2506 reads the data of a video signal for pixels of a single row which is written earlier to either the first shift register 2503 or the second shift register 2505, and inputs the data to a display 2507. Note that in the case where, when the data of a video signal for pixels of a single row is input to one of the first shift register 2503 and the second shift register 2505, the data matches data of a video signal for pixels of a single row input to the other, the output control signal (SR_ENABLE) showing the result is input to the output register selection circuit 2506; therefore, the data of pixels in the row is not input to the display 2507 from the output register selection circuit 2506.

Note that the structure shown in FIG. 38 can be used for the determination circuit 2504.

Note that such a structure as in this embodiment can be used in combination with the structure in FIG. 2. The read selection circuit 2501 in FIG. 25 corresponds to the read selection circuit 206 in FIG. 2. Further, the display 2507 corresponds to the display 208 in FIG. 2.

According to the structure of this embodiment, the first shift register 2503 and the second shift register 2505 are required for the display controller 207. However, if these are formed on the same IC chip, load capacitance, wire resistance, contact resistance, or the like is extremely lower than that of a signal line driver circuit arranged on a substrate with a pixel portion. Thus, power consumption can be reduced more drastically than the case of inputting data of a video signal to a signal line driver circuit in a display.

Embodiment 6

In this embodiment, explanation is made on a new driving method of a display device including a pixel formed with a current-drive display element of which luminance changes depending on current.

Figures 65A, 65B:
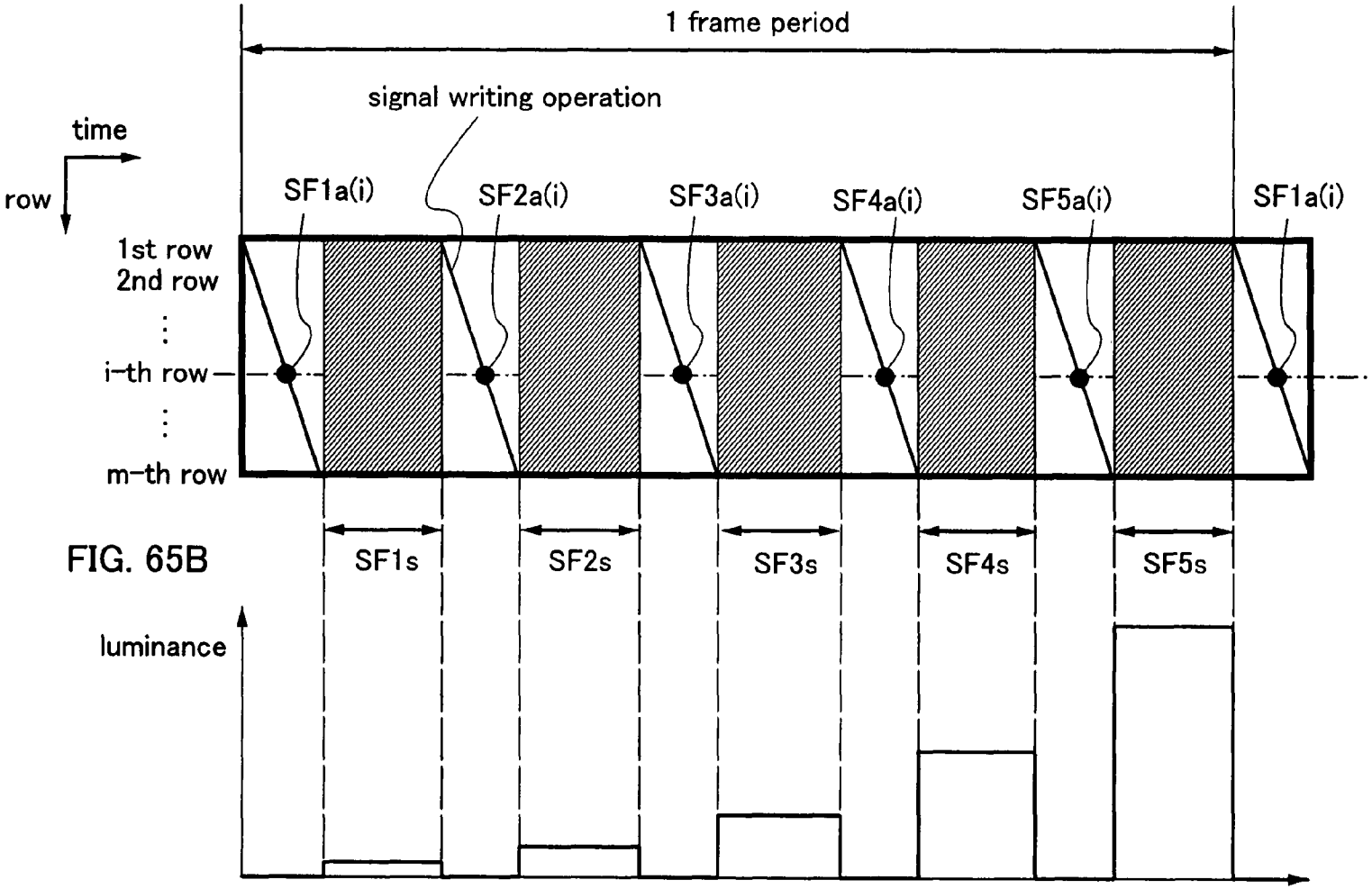
FIGS. 65A and 65B are diagrams explaining a method for driving a display device of the present invention.

A basic structure of a driving method of this embodiment is explained with reference to FIG. 65A. FIG. 65A shows a signal writing period (address period) and a data hold period (sustain period) in a certain one frame period using a horizontal direction as a time axis and a vertical direction as a pixel row axis. Note that according to this driving method, one frame period is divided into a plurality of subframe periods, a video signal is written to a pixel in each subframe period, and lighting and non-lighting of the pixel is controlled in each subframe period to express a gray scale.

A period for which signal writing operation is completed from the first row to m-th row that is the last row is an address period in each subframe period. Then, a period from the completion of the address period to a next subframe period is a sustain period.

This driving method changes luminance of emitted light obtained from a display element in each sustain period of each subframe period as shown in FIG. 65B. Here, a sustain period of a subframe period SF1 is denoted by SF1*s*; a sustain period of a subframe period SF2, SF2*s*; a sustain period of a subframe period SF3, SF3*s*; a sustain period of a subframe period SF4, SF4*s*; and a sustain period of a subframe period SF5, SF5*s*. Note that the length of each sustain period is approximately equal. Here, the intensity of light emitted from a pixel in SF1*s*, SF2*s*, SF3*s*, SF4*s*, and SF5*s* is each denoted by SF1*d*, SF2*d*, SF3*d*, SF4*d*, and SF5*d*. Then, if SF1*d*:SF2*d*:SF3*d*:SF4*d*:SF5*d*=1:2:4:8:16 is satisfied, 32 gray scale levels can be expressed by selecting lighting or non-lighting of a pixel in each subframe period.

Therefore, according to this structure, a sustain period in a subframe period corresponding to the LSB can be made long even in the case of expressing a high level gray scale since the length of each sustain period in each subframe period is approximately equal.

Also in this structure, in the case where data of a video signal for a single row in a pixel row in which the signal is to be written to a pixel in a certain subframe period in one frame period is identical with data of a video signal for the pixel row in the last subframe period, signal writing to the pixel row is stopped.

Here, explanation is made focusing on a pixel row in i-th row. In the pixel row in i-th row, a signal writing time in a first subframe period is denoted by SF1*a*(*i*), and signal writing times in second, third, fourth, and fifth subframe periods are denoted by SF2*a*(*i*), SF3*a*(*i*), SF4*a*(*i*), and SF5*a*(*i*), respectively.

Here, if data of a video signal for all pixels of a single row in SF1*a*(*i*) is identical with data of a video signal for all pixels of a single row in SF2*a*(*i*), signal writing to the pixels in i-th row is stopped in SF2*a*(*i*). In addition, if data of a video signal for all pixels of a single row in SF3*a*(*i*) is data putting the pixels in a non-lighting state, signal writing to the pixels in i-th row is stopped in SF3*a*(*i*). Similarly, if data of a video signal for all pixels of a single row in SF4*a*(*i*) is identical with data of a video signal for all pixels of a single row in SF3*a*(*i*), signal writing to the pixels in i-th row is stopped in SF4*a*(*i*). If data of a video signal for all pixels of a single row in SF5*a*(*i*) is identical with data of a video signal for all pixels of a single row in SF4*a*(*i*), signal writing to the pixels in i-th row is stopped in SF5*a*(*i*).

Thus, the number of times charging and discharging are carried out can be reduced at the time of signal writing to the pixels, and power consumption can be reduced.

In addition, high level gray scale display can be easily performed by combining the driving method of this embodiment and a digital time gray scale method. Explanation is made with reference to FIG. 66A.

Figures 66A, 66B:
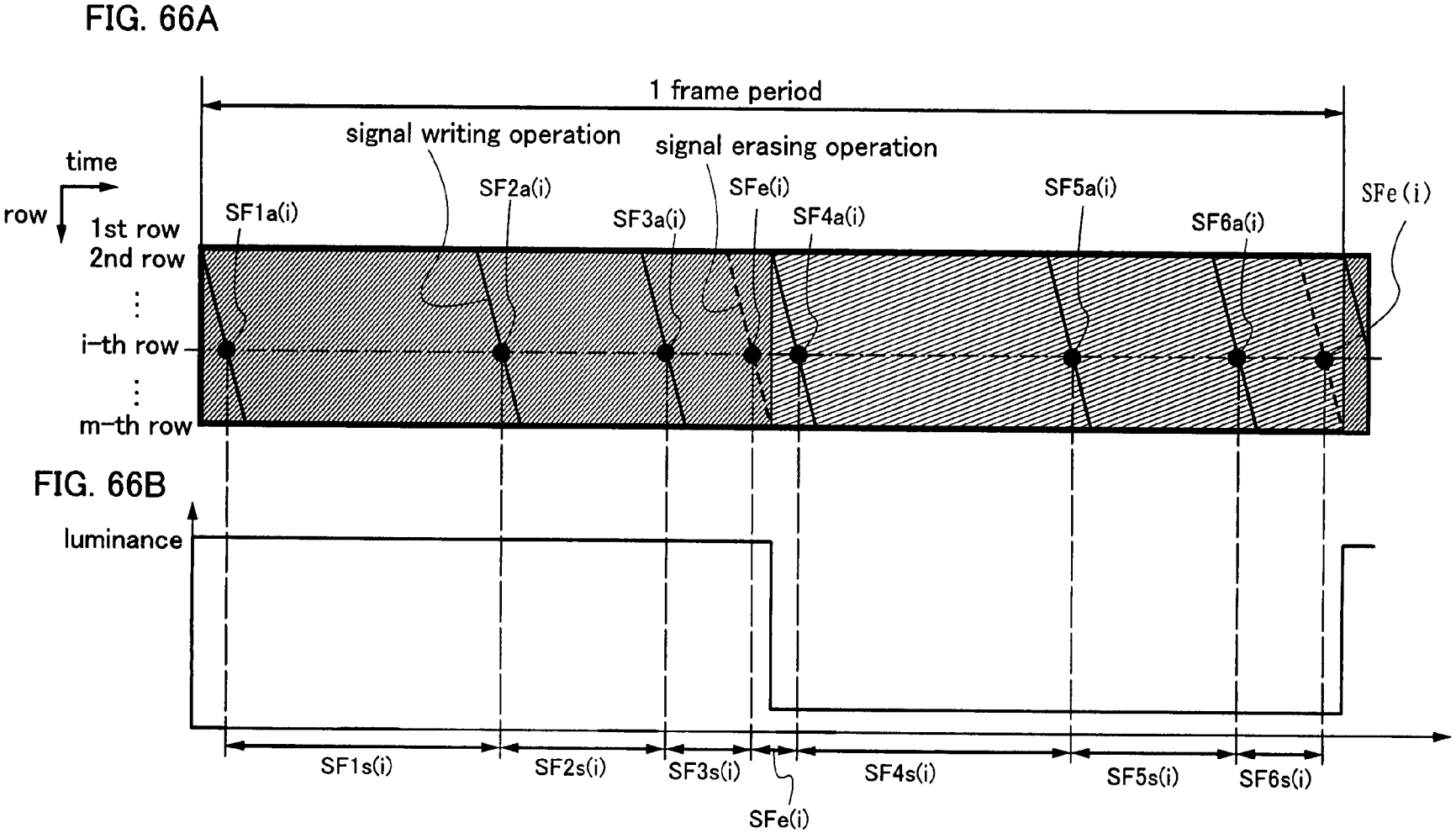
FIGS. 66A and 66B are diagrams explaining a method for driving a display device of the present invention.

FIG. 66A shows signal writing operation and signal erasing operation in a certain one frame period using a horizontal direction as a time axis and a vertical direction as a pixel row axis.

Here, explanation is made focusing on a pixel row in i-th row. In the pixel row in i-th row, a signal writing time in a first subframe period is denoted by SF1*a*(*i*), and signal writing times in second, third, fourth, fifth, and sixth subframe periods are denoted by SF2*a*(*i*), SF3*a*(*i*), SF4*a*(*i*), SF5*a*(*i*), and SF6*a* (i), respectively. In addition, the intensity of light emitted from a pixel in one frame period is explained with reference to FIG. 66B. When a signal is written in SF1*a*(*i*), operation proceeds to a data hold period SF1*s*(*i*) in the first subframe period. Then, the signal writing time SF2*a*(*i*) in the second subframe period starts, and the data hold period SF1*s* (*i*) terminates. When a signal is written to a pixel according to the signal writing time SF2*a*(*i*), a data hold period SF2*s*(*i*) in the second subframe period starts. Then, the signal writing time SF3*a*(*i*) in the third subframe period starts, and the data hold period SF2*s*(*i*) terminates. When a signal is written to a pixel according to the signal writing time SF3*a*(*i*), a data hold period SF3*s*(*i*) in the third subframe period starts, and the data hold period SF3*s*(*i*) terminates by signal erasing operation. The period of time after the signal of the pixels in i-th row is erased by erase operation until the signal writing time SF4*a*(*i*) in the fourth subframe period starts is a non-lighting period. When a signal is subsequently written in SF4*a*(*i*), operation proceeds to a data hold period SF4*s*(*i*) in the fourth subframe period. Then, the signal writing time SF5*a*(*i*) in the fifth subframe period starts, and the data hold period SF4*s*(*i*) terminates. When a signal is written to a pixel according to the signal writing time SF5*a*(*i*), a data hold period SF5*s*(*i*) in the fifth subframe period starts. Then, the signal writing time SF6*a*(*i*) in the sixth subframe period starts, and the data hold period SF6*s*(*i*) terminates. When a signal is written to a pixel according to the signal writing time SF6*a*(*i*), a data hold period SF6*s*(*i*) in the sixth subframe period starts, and the data hold period SF6*s*(*i*) terminates by signal erasing operation. The period of time after the signal of the pixels in i-th row is erased by erase operation until the signal writing time SF1*a*(*i*) in the first subframe period of a subsequent frame period starts is a non-lighting period.

Here, in FIGS. 66A and 66B, the lengths of subframes are set to satisfy SF1*s*(*i*):SF2*s*(*i*):SF3*s*(*i*):SF4*s*(*i*):SF5*s*(*i*):SF6*s*(*i*)=4:2:1:4:2:1. In addition, the light emission intensity of a pixel during SF1*s*(*i*), SF2*s*(*i*), and SF3*s*(*i*) is set to eight times the light emission intensity of the pixel in SF4*s*(*i*), SF5*s*(*i*), and SF6*s*(*i*). Then, when that in the sixth subframe period is regarded as 1, brightness in a lighting state of each subframe period in one frame period is 2, 4, 8, 16, and 32 for the fifth, fourth, third, second, and first subframe periods. Therefore, display can be performed with 64 gray scale levels. Note that the length of the longest subframe period is approximately four times that of the shortest subframe period at this time. Therefore, the shortest subframe period can be made far longer than the shortest subframe period in the case of expressing 64 gray scale levels by a normal digital time gray scale method. Accordingly, high level gray scale display can be performed without erasing a signal of a pixel.

Figure 64:
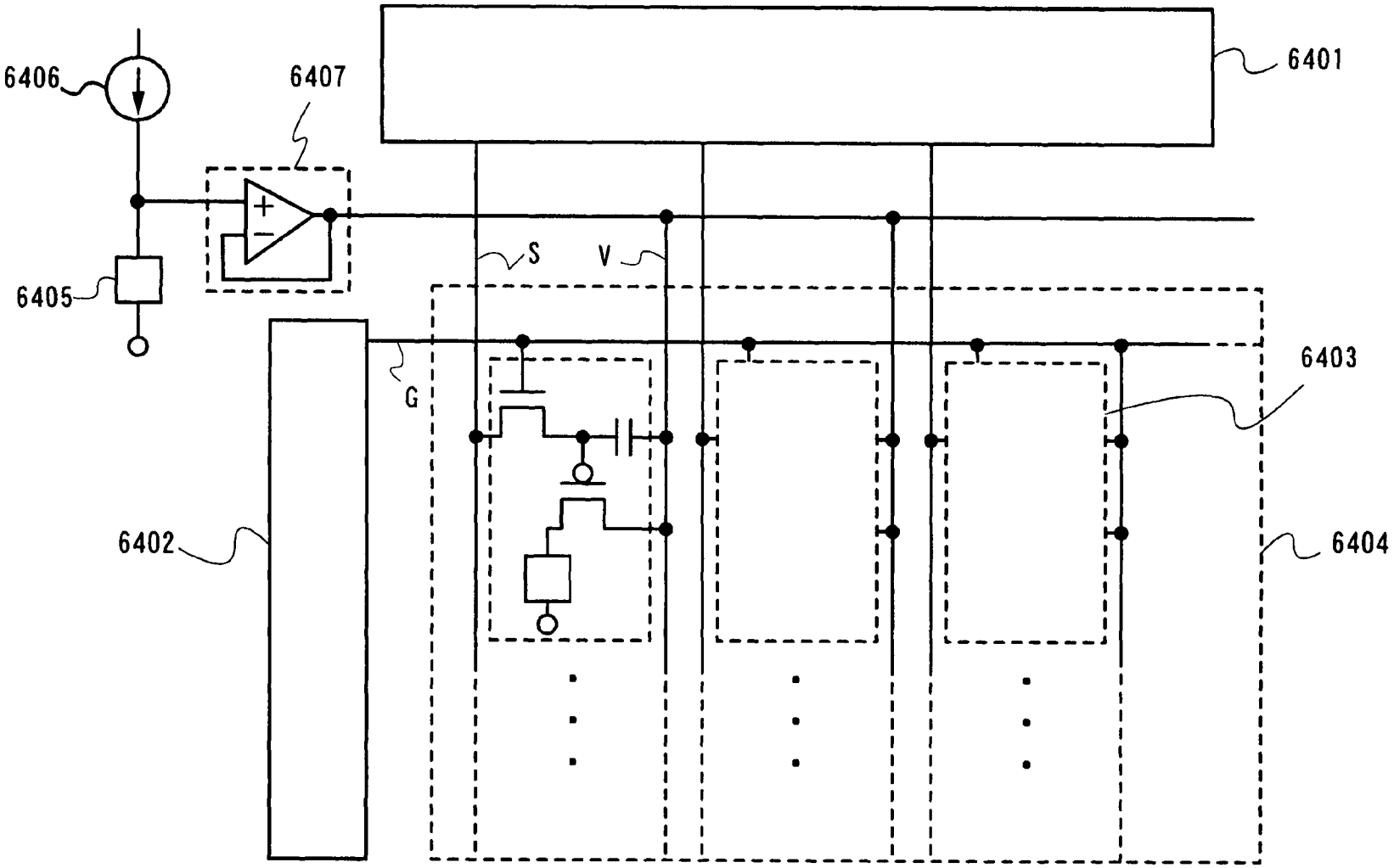
FIG. 64 is a diagram explaining a display device of the present invention.

In addition, FIG. 64 shows a structure example of a display device which can change the light emission intensity of a pixel in each subframe period.

The display device shown in FIG. 64 includes a signal line driver circuit 6401, a scan line driver circuit 6402, and a pixel portion 6403. In addition, in the pixel portion 6403, a plurality of pixels 6404 is arranged in matrix relative to a signal line S extended in a column direction from the signal line driver circuit 6401 and a scan line G extended in a row direction from the scan line driver circuit 6402. Note that the pixel in FIG. 10 is used for the pixel 6404 as an example. The power source line 1007 of the pixel in FIG. 10 corresponds to a power source line V of the display device shown in FIG. 64.

Further, the display device includes a monitor element 6405, a current source 6406, and a buffer amplifier 6407. The monitor element 6405 is supplied with an arbitrary current from the current source 6406. Then, a voltage is generated between both of the electrodes of the monitor element 6405. In other words, if the voltage is applied between the both electrodes of the monitor element 6405, the current supplied from the current source 6406 flows to the monitor element 6405. Accordingly, a display element of a lighting pixel can have a desired light emission intensity by supplying the monitor element 6405 with a desirable current to feed to the display element of the pixel, and applying the voltage generated in the monitor element 6405 to the display element of the pixel.

Thus, the same potential can be set to an opposite electrode of the monitor element 6405 and an opposite electrode of the display element. The potential of a pixel electrode of the monitor element 6405 is input to an input terminal of the buffer amplifier 6407. Then, an approximately equal potential is output from an output terminal of the buffer amplifier 6407. This potential is set to the power source line V. When a driver transistor is turned on, a voltage which is a potential difference between the potential set to the power source line V and the opposite electrode is applied to the display element of the pixel. Therefore, arbitrary light emission intensity can be set. In other words, in the case of applying the display device to the driving method of this embodiment, a current value flowing to the current source 6406 is set to obtain desired light emission intensity in each subframe period.

Embodiment 7

In this embodiment, explanation is made on a structure of a pixel in the case of using a display element in which luminance of the pixel changes depending on an applied voltage and a display device including the pixel, and a suitable driving method thereof. A liquid crystal element is particularly suitable for the display element described in this embodiment.

Figure 54:
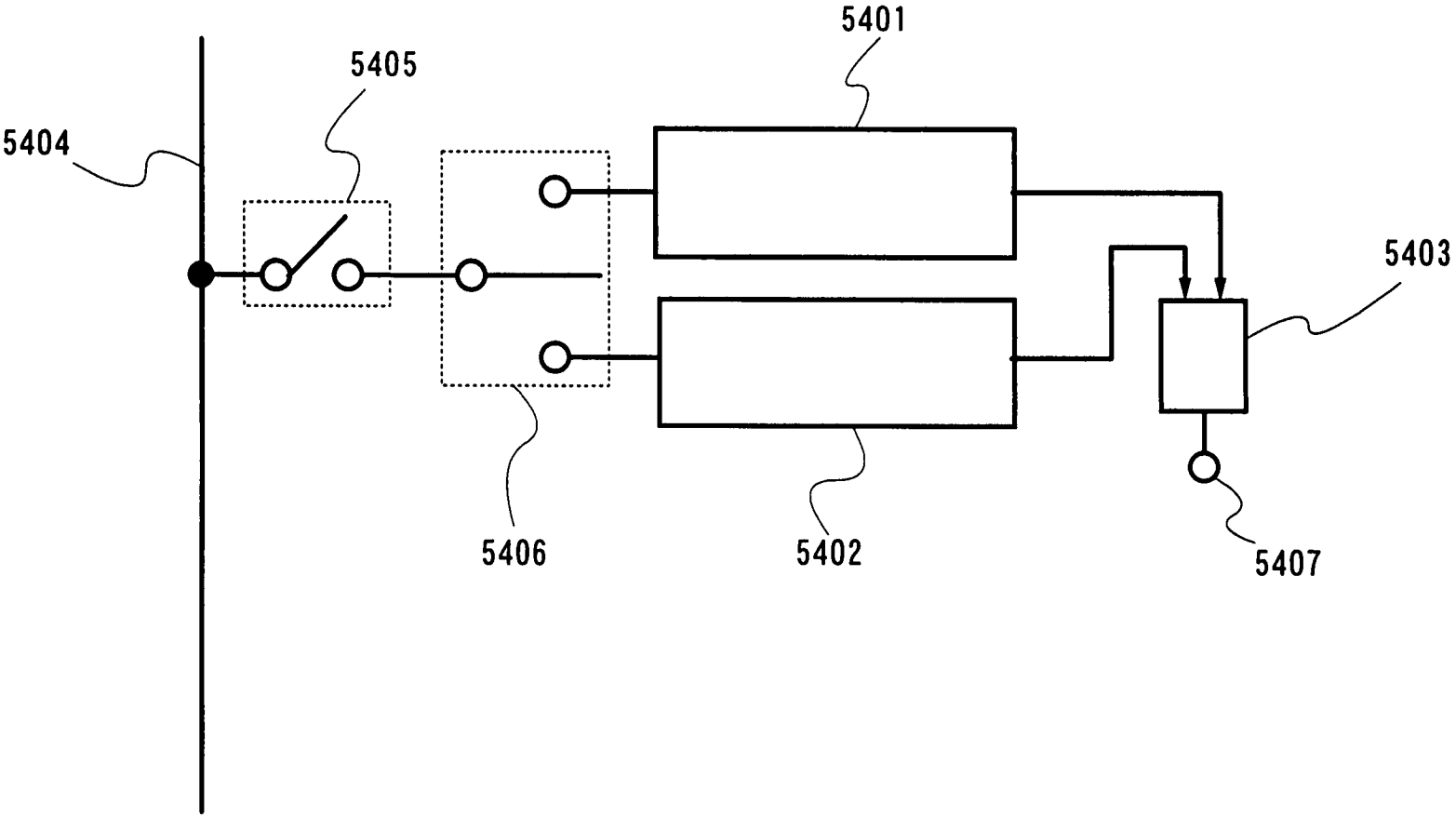
FIG. 54 is a diagram explaining a pixel structure applicable to a display device of the present invention.

First, FIG. 54 shows a basic structure of a pixel. The pixel includes an analog voltage holding circuit 5401, a digital signal memory circuit 5402, a display element 5403, a signal line 5404, a first switch 5405, and a second switch 5406.

In the case of this structure, the first switch 5405 is turned on in selecting the pixel.

In the case of displaying a moving image, the analog voltage holding circuit 5401 is selected by the second switch 5406. Then, an analog voltage corresponding to a video signal is input to the analog voltage holding circuit 5401 from the signal line 5404.

The analog voltage holding circuit 5401 holds this analog voltage and applies the voltage to the display element 5403. In this manner, a gray scale of the pixel is expressed in accordance with the analog voltage. Then, an analog voltage is input to the analog voltage holding circuit 5401 from the signal line 5404 in each one frame period.

In the case of displaying a still image, the digital signal memory circuit 5402 is selected by the second switch 5406. Then, a digital signal corresponding to a video signal is input to the digital signal memory circuit 5402 from the signal line 5404.

The digital signal memory circuit 5402 stores this digital signal and sets a potential of a pixel electrode of the display element 5403. In this manner, lighting and non-lighting of the display element 5403 are controlled in accordance with a potential difference between a potential input from the digital signal memory circuit 5402 and an opposite electrode 5407 of the display element 5403.

Note that in the case of displaying a still image, a gray scale can be expressed using an area gray scale method or the like.

The case of using an area gray scale method is explained with reference to FIGS. 55 and 56.

Figure 55:
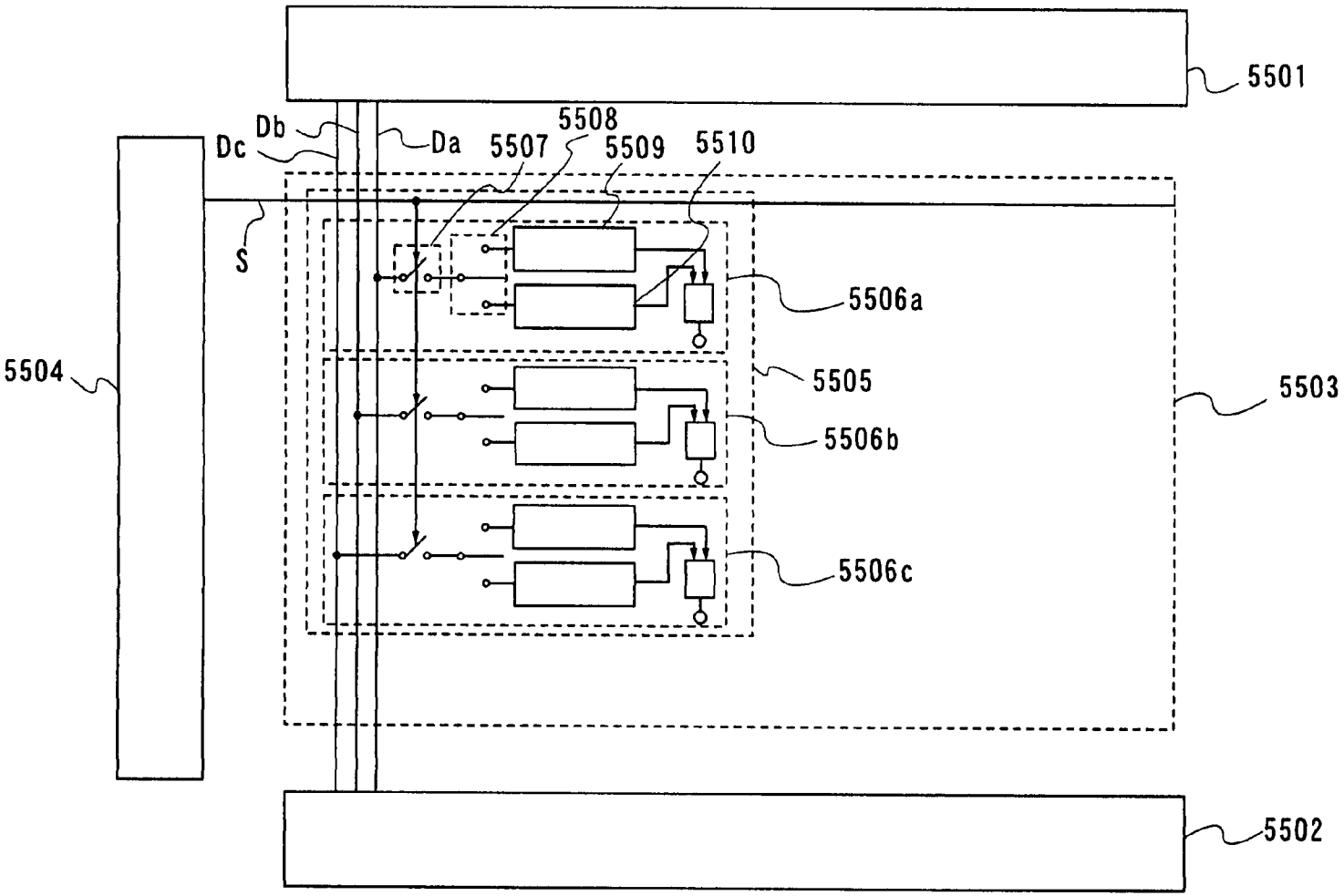
FIG. 55 is a diagram explaining a display device of the present invention.

A display device in FIG. 55 includes a first signal line driver circuit 5501, a second signal line driver circuit 5502, a pixel portion 5503, and a scan line driver circuit 5504, and in the pixel portion 5503, pixels 5505 are arranged in matrix relative to a scan line and a signal line.

Each of the pixels 5505 includes a sub-pixel 5506*a*, a sub-pixel 5506*b*, and a sub-pixel 5506*c*. Lighting regions of the sub-pixels are weighted. For example, the sizes of the lighting regions are set to satisfy 22:21:20. This makes it possible to perform 3-bit display, that is, display with 8 gray scale levels.

Note that a first switch 5507 of the sub-pixel 5506*a* is connected to a signal line Da, a first switch 5507 of the sub-pixel 5506*b* is connected to a signal line Db, and a first switch 5507 of the sub-pixel 5506*c* is connected to a signal line Dc. By a signal input to a scan line S from the scan line driver circuit 5504, the first switches 5507 of the sub-pixel 5506*a*, the sub-pixel 5506*b*, and the sub-pixel 5506*c* are controlled to be turned on or off. In other words, the first switch 5507 is in an on state in a selected pixel. Then, an analog voltage or a digital signal is written to the analog voltage holding circuit 5509 or the digital signal memory circuit 5510 from each signal line.

In other words, in the case of moving image display, a signal is input to the scan line S to turn on the first switch 5507, and the analog voltage holding circuit 5509 is selected by the second switch 5508. Analog voltages corresponding to video signals are input from the first signal line driver circuit 5501 to the signal line Da, the signal line Db, and the signal line Dc. Then, the analog voltage is held in the analog voltage holding circuit 5509 of each sub-pixel. Note that the analog voltages input to the signal line Da, the signal line Db, and the signal line Dc at this time are approximately equal to each other. Therefore, a gray scale can be expressed depending on the amount of the analog voltage.

On the other hand, in the case of still image display, a signal is input to the scan line S to turn on the first switch 5507, and the digital signal memory circuit 5510 is selected by the second switch 5508. A digital signal corresponding to a video signal is input from the second signal line driver circuit 5502 to the signal line Da, the signal line Db, and the signal line Dc. Then, the digital signal is stored in the digital signal memory circuit 5510 of each sub-pixel. Note that a signal of each bit corresponding to the size of the lighting region of each sub-pixel is input as the digital signal input to each of the signal line Da, the signal line Db, and the signal line Dc at this time.

Therefore, a gray scale can be expressed by selecting lighting and non-lighting of each sub-pixel by the digital signal.

Figure 56:
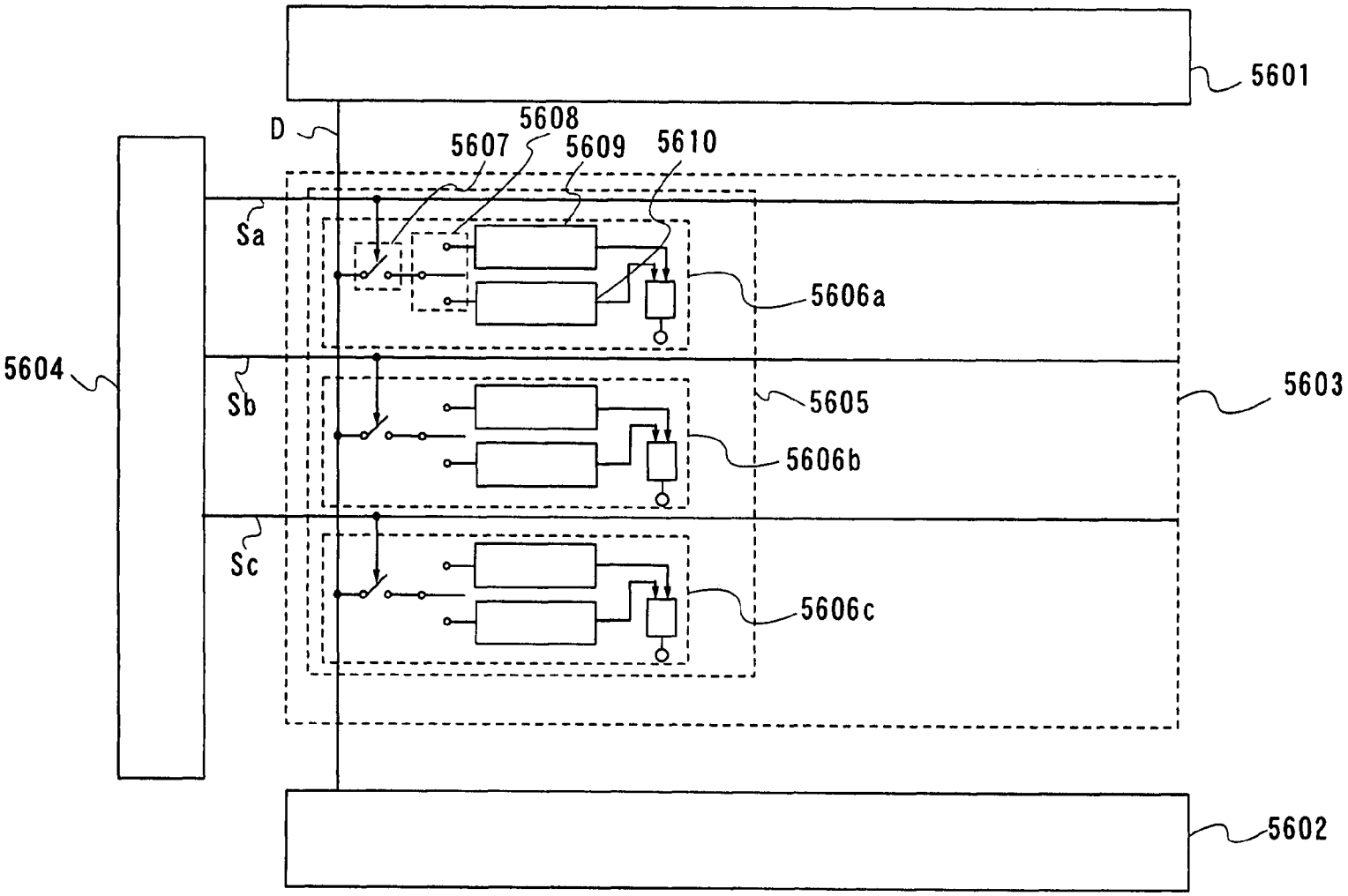
FIG. 56 is a diagram explaining a display device of the present invention.

Next, a structure in FIG. 56 is explained. A display device in FIG. 56 includes a first signal line driver circuit 5601, a second signal line driver circuit 5602, a pixel portion 5603, and a scan line driver circuit 5604, and in the pixel portion 5603, pixels 5605 are arranged in matrix relative to a scan line and a signal line.

Each of the pixels 5605 includes a sub-pixel 5606*a*, a sub-pixel 5606*b*, and a sub-pixel 5606*c*. Lighting regions of the sub-pixels are weighted. For example, the sizes of the lighting regions are set to satisfy 22:21:20. This makes it possible to perform 3-bit display, that is, display with 8 gray scale levels.

Note that first switches 5607 of the sub-pixel 5606*a*, the sub-pixel 5606*b*, and the sub-pixel 5606*c* are connected to a signal line D. Then, the first switch 5607 of the sub-pixel 5606*a* is controlled to be turned on or off by a signal input to a scan line Sa from the scan line driver circuit 5604; that of the first switch 5607 of the sub-pixel 5606*b*, by a signal input to a scan line Sb from the scan line driver circuit 5604; and that of the first switch 5607 of the sub-pixel 5606*c*, by a signal input from the scan line driver circuit 5604 to a scan line Sc. In other words, the first switch 5607 is in an on state in a selected pixel. Then, an analog voltage or a digital signal is written to the analog voltage holding circuit 5609 or the digital signal memory circuit 5610 from a corresponding signal line.

In other words, in the case of moving image display, signals are sequentially input to the scan line Sa, the scan line Sb, and the scan line Sc to turn on the first switch 5607 of each sub-pixel, and the analog voltage holding circuit 5609 is selected by the second switch 5608. An analog voltage corresponding to a video signal is input from the first signal line driver circuit 5601 to the signal line D. Then, the analog voltage is sequentially held in the analog voltage holding circuit 5609 of each sub-pixel. Note that the analog voltages input to the signal line D while each sub-pixel is selected are approximately equal to each other. Therefore, a gray scale can be expressed depending on the amount of the analog voltage.

On the other hand, in the case of still image display, signals are sequentially input to the scan line Sa, the scan line Sb, and the scan line Sc to turn on the first switch 5607 of each sub-pixels, and the digital signal memory circuit 5610 is selected by the second switch 5608. A digital signal corresponding to a video signal is input from the second signal line driver circuit 5602 to the signal line D. Then, the digital signal is sequentially stored in the digital signal memory circuit 5610 of each sub-pixel. Note that a digital signal of each bit corresponding to the size of the lighting region of each sub-pixel is input while each sub-pixel is selected. Therefore, a gray scale can be expressed by selecting lighting or non-lighting of each sub-pixel by the digital signal.

When part of an image is rewritten in the case of still image display, the display device of the present invention stops signal writing to a pixel row in which rewriting is not performed.

In other words, in the case where data of a video signal for a pixel row in one frame before matches data of a pixel row in which writing is to be performed, the scan line driver circuit includes an output control means which prevents the pixel row from being selected.

Figure 57:
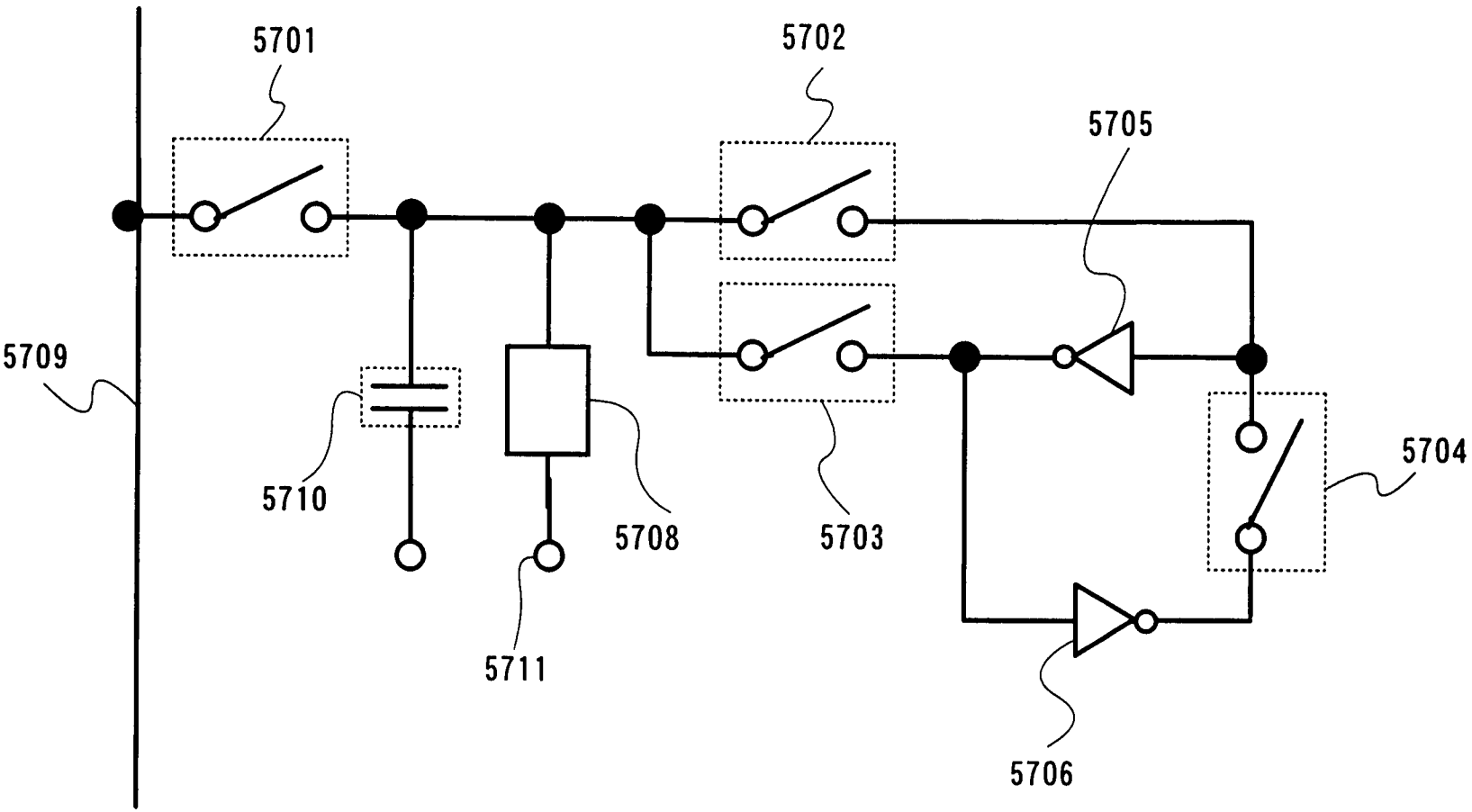
FIG. 57 is a diagram explaining a pixel structure applicable to a display device of the present invention.

In addition, FIG. 57 shows a structure example of a pixel including an analog voltage holding circuit and a digital signal memory circuit. The pixel includes a pixel selection switch 5701, a first switch 5702, a second switch 5703, a third switch 5704, a first inverter 5705, a second inverter 5706, a display element 5708, a signal line 5709, and a capacitor element 5710.

The pixel selection switch 5701 is turned on in writing a signal to the pixel.

Here, in the case of display a moving image, the first switch 5702 and the second switch 5703 are turned off. Note that the third switch 5704 may be in either an on state or an off state. Then, an analog voltage corresponding to a video signal is input from the signal line 5709, and a charge for the analog voltage is accumulated in the capacitor element 5710. By turning off the pixel selection switch 5701, the analog voltage is held in the capacitor element 5710.

In this manner, a gray scale is expressed in accordance with the analog voltage.

On the other hand, in the case of displaying a still image, the first switch 5702 is turned on first, and then, the second switch 5703 is turned off. The third switch 5704 is turned on from an off state. A digital signal corresponding to a video signal is input to the first inverter 5705 from the signal line 5709, and the output from the first inverter 5705 is input to the second inverter 5706. Then, the output from the second inverter 5706 is input to the capacitor element 5710 and the display element 5708. Even if the pixel selection switch 5701 is turned off, the output from the second inverter 5706 can be kept being input to a pixel electrode of the display element 5708. Note that the first switch 5702 and the third switch 5704 may be simultaneously turned on in the case where the digital signal has high drive capability.

Figure 58A:
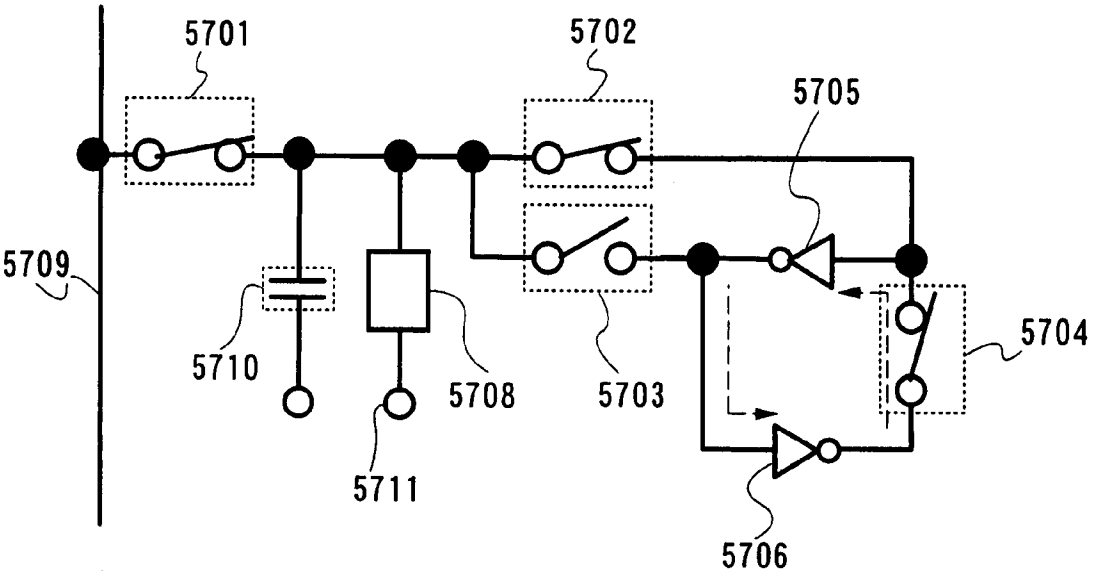
FIGS. 58A and 58B are diagrams explaining operation of a pixel structure applicable to a display device of the present invention.
Figure 58B:
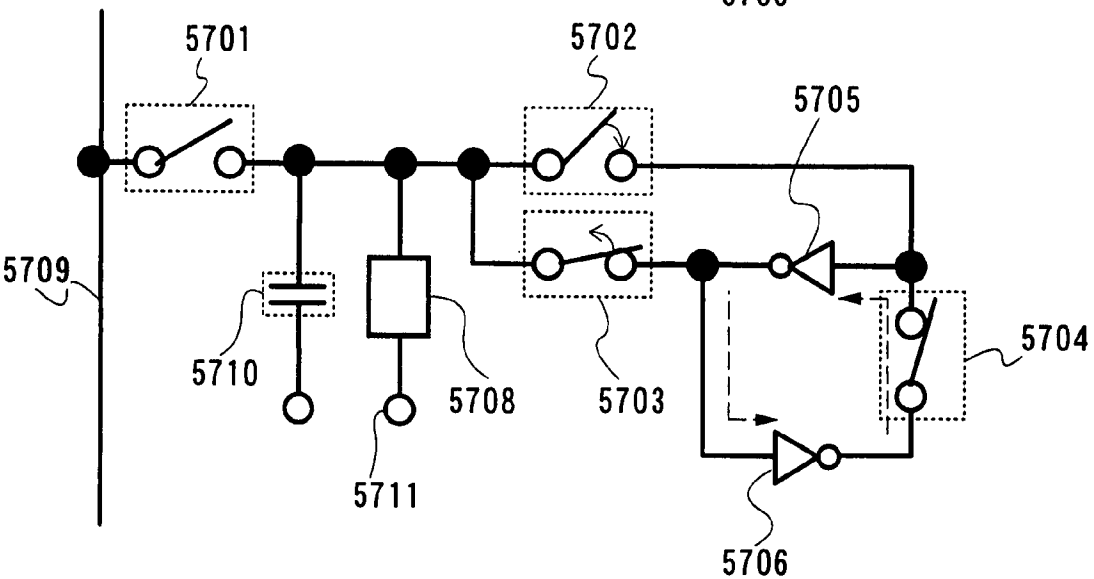

When the digital signal is written to the pixel, the digital signal is stored as shown in FIGS. 58A and 58B. In other words, the output from the first inverter 5705 sets the input of the second inverter 5706 as indicated by an arrow, and the output from the second inverter 5706 sets the input of the first inverter 5705. Therefore, the digital signal written to the pixel can be kept stored.

In the case of applying a liquid crystal element to the display element 5708, burn-in or the like is caused in the liquid crystal element when a DC voltage is applied to the liquid crystal element for a long time. Therefore, a voltage applied to the liquid crystal element is preferably inverted regularly. Thus, the first switch 5702 and the second switch 5703 are alternately turned on and off as shown in FIGS. 58A and 58B with the pixel selection switch 5701 turned off and the third switch 5704 turned on. In addition, a potential set to an opposite electrode 5711 is also changed according to the regularized on/off timing of first switch 5702 and the second switch 5703. In a white display pixel, an AC voltage is applied to the display element 5708. On the other hand, in a black display pixel, a voltage applied to the display element 5708 is set to be equal to or lower than a threshold voltage of the liquid crystal element.

Figure 59:
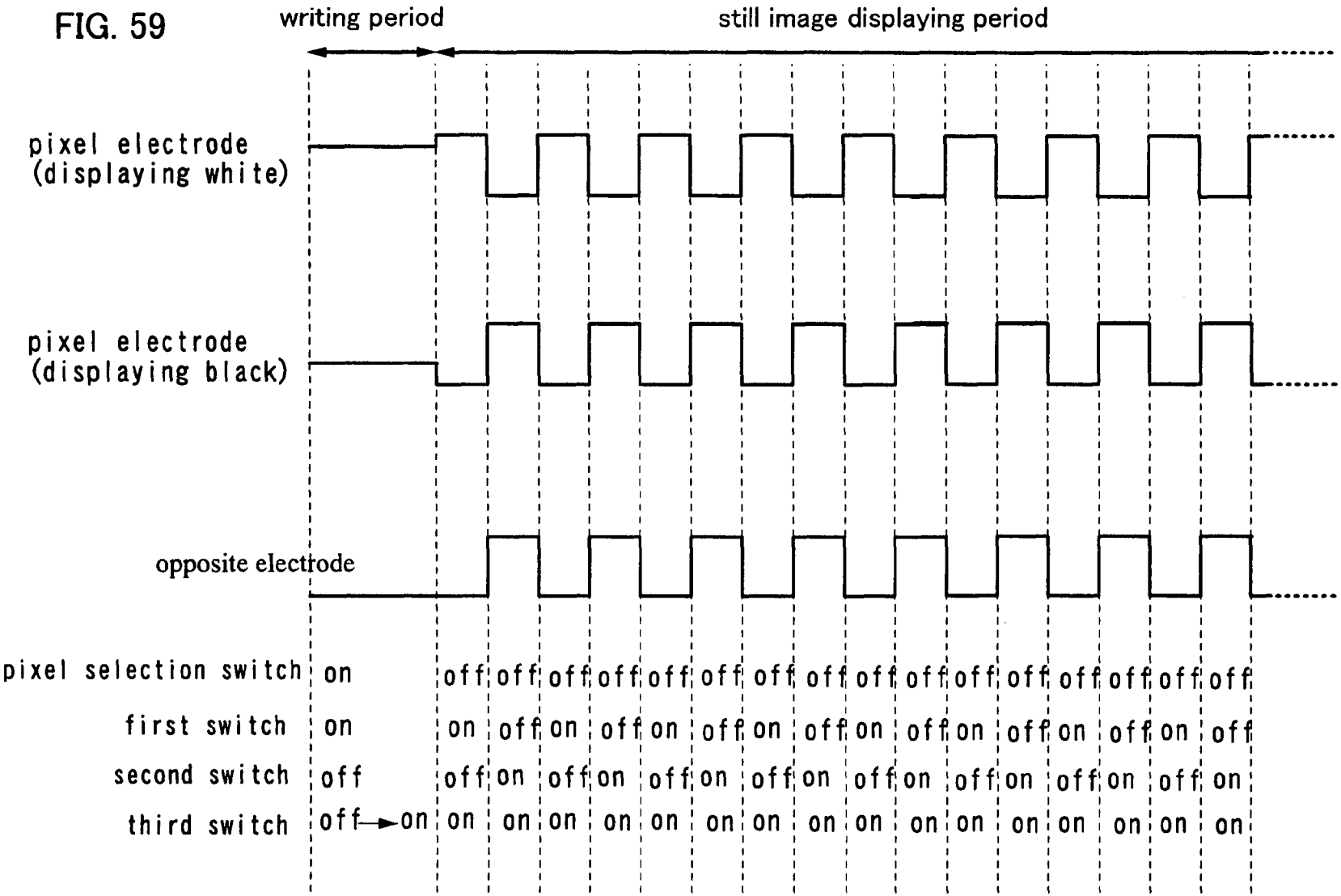
FIG. 59 is a diagram explaining operation of a pixel structure applicable to a display device of the present invention.

For example, explanation is made with reference to FIG. 59 on the case where the pixel is put in a lighting state (white display) when a digital signal (Digital Video Data) input from the signal line 5709 is High (also referred to as an H level) and the pixel is put in a non-lighting state (black display) when the digital signal (Digital Video Data) is Low (also referred to as an L level). At this time, a potential set to the opposite electrode 5711 is set at an L level in a signal writing period to the pixel. In a writing period (referring to time for writing a signal to a selected pixel in the signal writing period to the pixel), the third switch 5704 is turned on from off with the pixel selection switch 5701 turned on, the first switch 5702 turned on, and the second switch 5703 turned off. Then, in a still image displaying period, the pixel selection switch 5701 is turned off and the third switch is turned on.

As shown in FIG. 59, in a pixel to which a High digital signal (Digital Video Data) is input from the signal line 5709 in the writing period (referring to time for writing a signal to a selected pixel in the signal writing period to the pixel), the first switch 5702 is turned on and the second switch 5703 is turned off in the still image displaying period. When the output at an H level from the second inverter 5706 is input to a pixel electrode of the display element 5708, a potential at an L level is set to the opposite electrode 5711 of the display element 5708. In addition, a potential at an H level is set to the opposite electrode 5711 of the display element 5708 when the first switch 5702 is turned off, the second switch 5703 is turned on, and the output at an L level from the first inverter 5705 is input to the pixel electrode of the display element 5708. Thus, an AC voltage can be kept being applied to the display element 5708.

On the other hand, in a pixel to which a Low digital signal (Digital Video Data) is input from the signal line 5709 in the writing period (referring to time for writing a signal to a selected pixel in the signal writing period to the pixel), the first switch 5702 is turned on and the second switch 5703 is turned off in the still image displaying period. When the output at an L level from the second inverter 5706 is input to the pixel electrode of the display element 5708, a potential at an L level is set to the opposite electrode 5711 of the display element 5708. In addition, a potential at an H level is set to the opposite electrode 5711 of the display element 5708 when the first switch 5702 is turned off, the second switch 5703 is turned on, and the output at an H level from the first inverter 5705 is input to the pixel electrode of the display element 5708. Thus, a voltage applied to the display element 5708 can be set to be equal to or lower than a threshold voltage of the liquid crystal element.

In the case of displaying a still image, a gray scale can be expressed using an area gray scale method or the like.

The case of applying an area gray scale method is briefly explained with reference to FIG. 60. A pixel includes a sub-pixel 6000*a*, a sub-pixel 6000*b*, and a sub-pixel 6000*c*. Lighting regions of the sub-pixels are weighted. For example, the sizes of the lighting regions are set to satisfy 20:21:22. This makes it possible to perform 3-bit display, that is, display with 8 gray scale levels.

Figure 60:
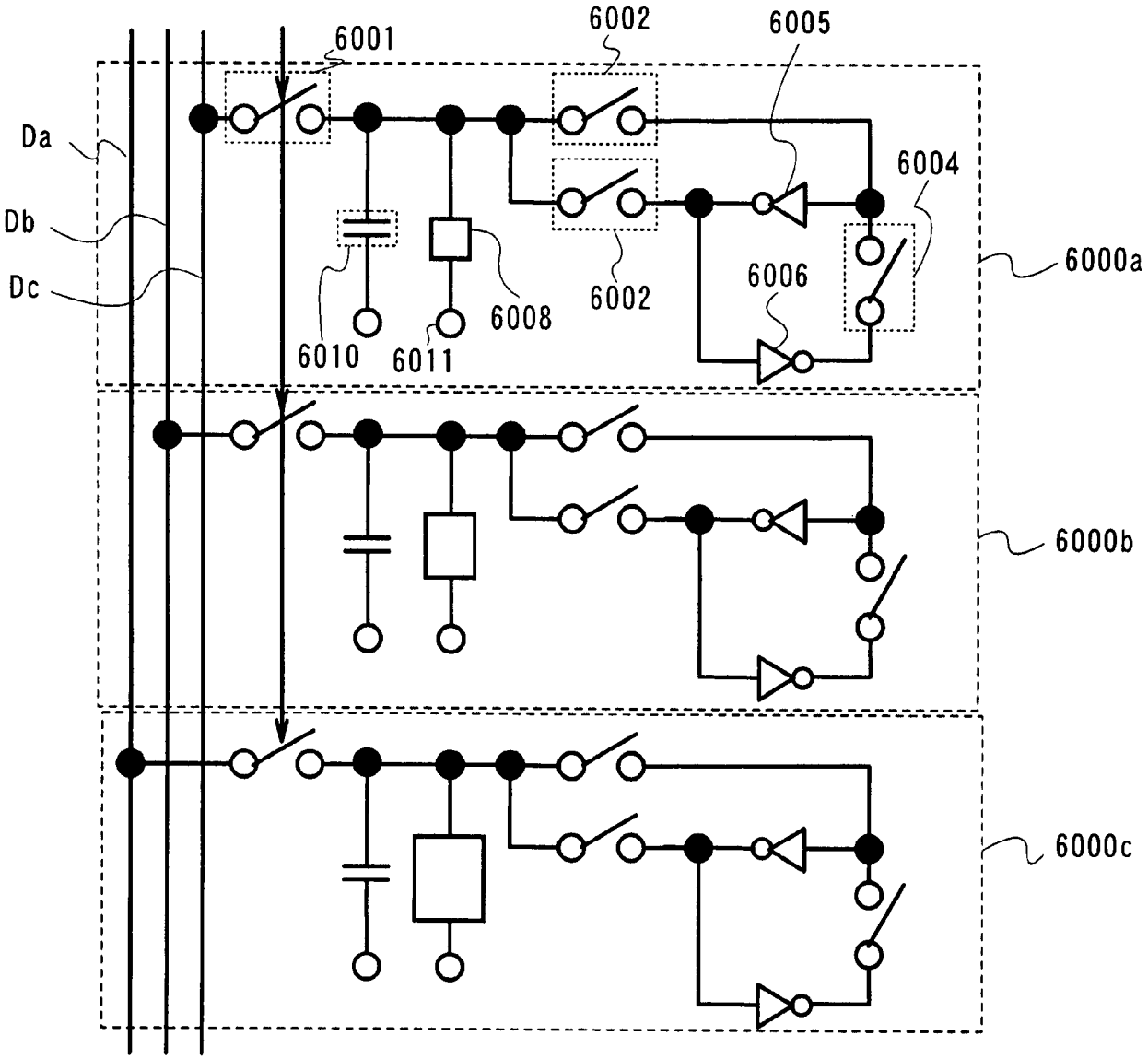
FIG. 60 is a diagram explaining a pixel structure applicable to a display device of the present invention.

Note that a pixel selection switch 6001, a first switch 6002, a second switch 6003, a third switch 6004, a first inverter 6005, a second inverter 6006, a display element 6008, and a capacitor element 6010 in FIG. 60 correspond to the pixel selection switch 5701, the first switch 5702, the second switch 5703, the third switch 5704, the first inverter 5705, the second inverter 5706, the display element 5708, and the capacitor element 5710 of the pixel in FIG. 57, respectively. In FIG. 60, a signal line is provided for each sub-pixel as the signal line 5709 shown in FIG. 57. In other words, a pixel selection switch 6001 of the sub-pixel 6000*a* is connected to a signal line Da; a pixel selection switch 6001 of the sub-pixel 6000*b*, to a signal line Db; and a pixel selection switch 6001 of the sub-pixel 6000*c*, to a signal line Dc. Then, a digital signal of each bit corresponding to the size of the lighting region of each sub-pixel is input from each signal line. Therefore, a gray scale can be expressed by selecting lighting or non-lighting of each sub-pixel by the digital signal.

Figure 61:
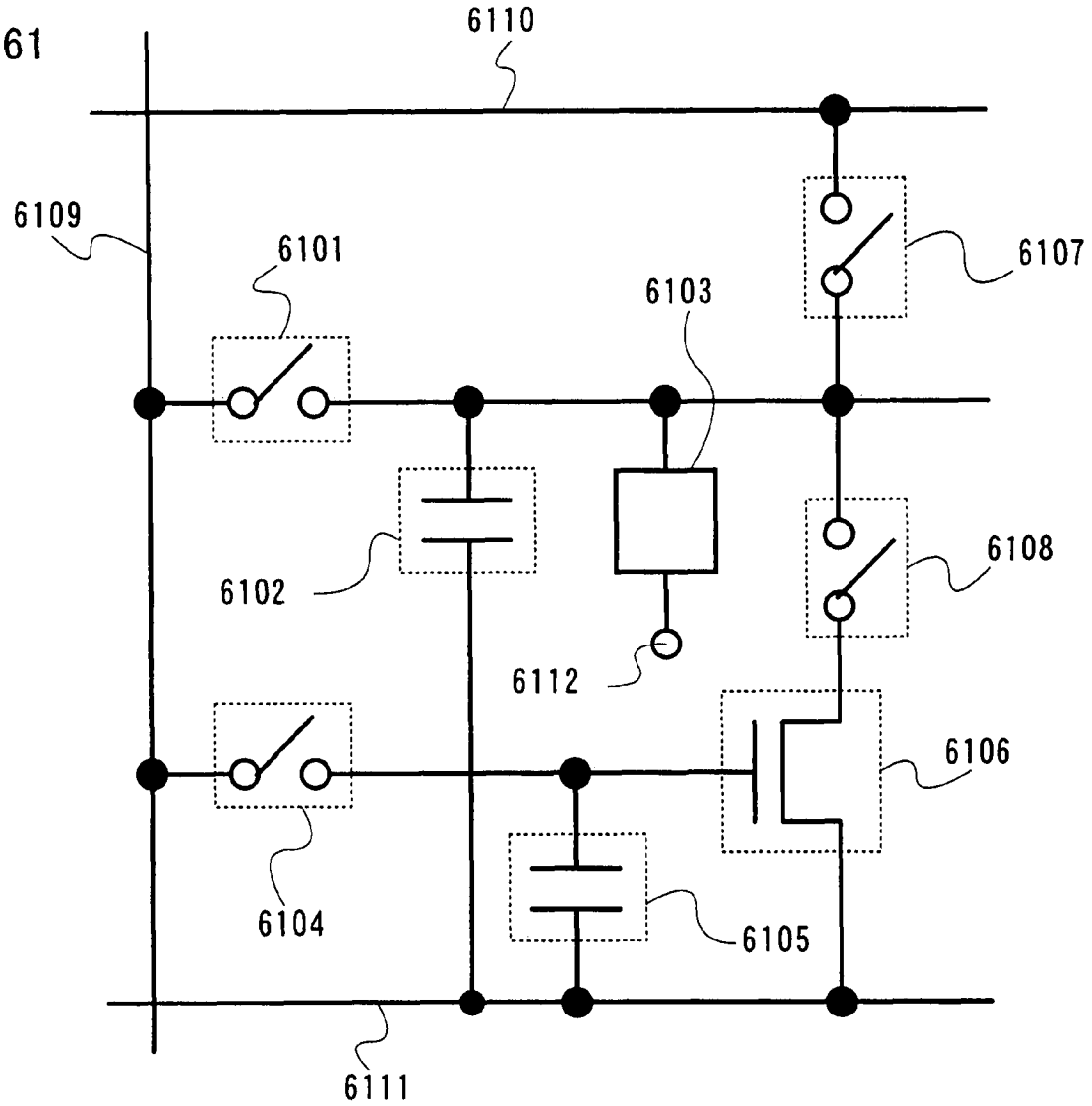
FIG. 61 is a diagram explaining a pixel structure applicable to a display device of the present invention.

Subsequently, FIG. 61 shows another structure example of a pixel including an analog voltage holding circuit and a digital signal memory circuit. The pixel includes a first pixel selection switch 6101, a second pixel selection switch 6104, a first capacitor element 6102, a second capacitor element 6105, a display element 6103, a transistor 6106, a first switch 6107, a second switch 6108, a signal line 6109, a first power source line 6110, and a second power source line 6111. Vrefh and Vrefl are alternately set to the first power source line 6110, and Vcom is set to the second power source line 6111. Here, Vrefh satisfies (Vrefh>Vcom) and (Vrefh−Vcom)> $V_{LCD}$, and Vrefl satisfies (Vrefl<Vcom) and (Vcom−Vrefl)> $V_{LCD}$. When Vrefh or Vrefl is set to one electrode of the display element 6103 and Vcom is set to the other electrode, a voltage equal to or higher than a threshold voltage $V_{LCD}$ is applied to the display element 6103. In addition, a potential approximately equal to that of the second power source line 6111 is set to an opposite electrode 6112 of the display element 6103. In other words, when Vcom is set to a pixel electrode of the display element 6103, a potential difference between a potential of the pixel electrode and a potential of the opposite electrode is set to be equal to or lower than a threshold voltage $V_{LCD}$ of the display element 6103.

Figure 62:
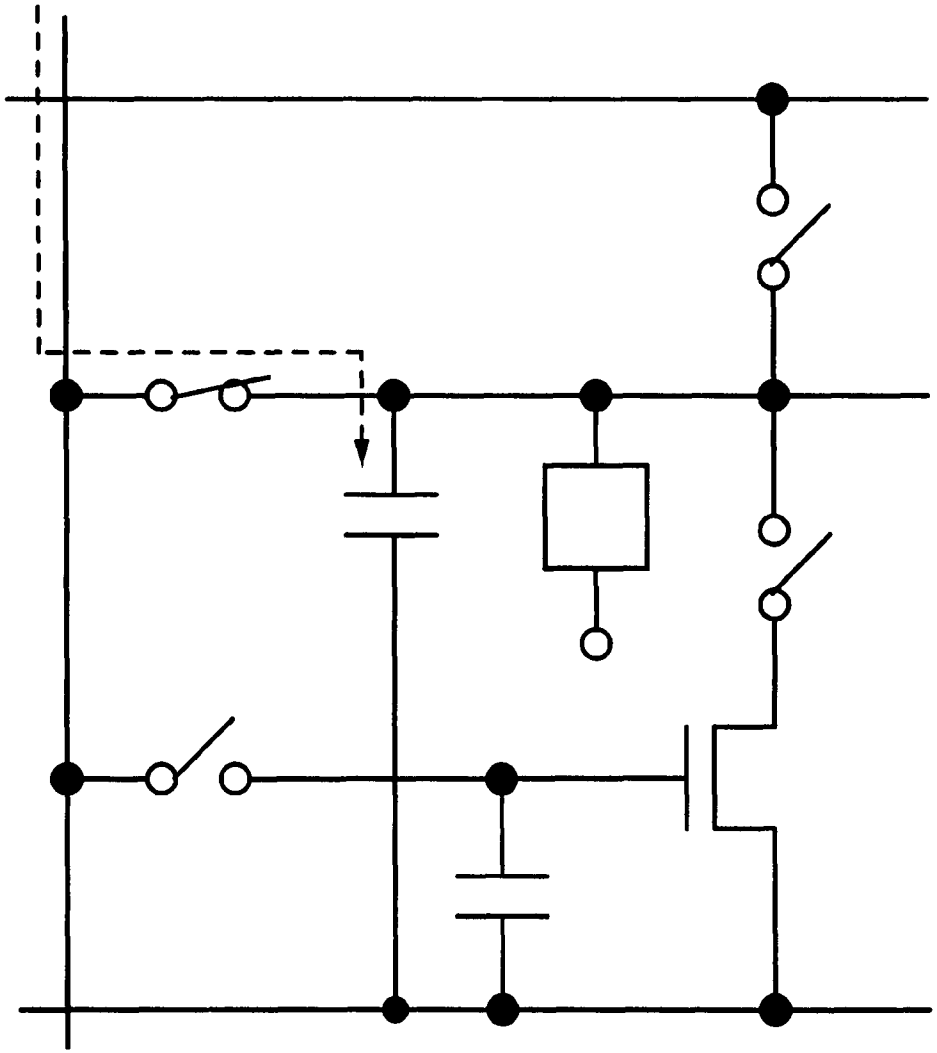
FIG. 62 is a diagram explaining operation of a pixel structure applicable to a display device of the present invention.

Operation of the pixel is explained. In the case of moving image display, the first pixel selection switch 6101 is turned on, and the second pixel selection switch 6104, the first switch 6107, and the second switch 6108 are turned off as shown in FIG. 62. Then, an analog potential in accordance with a gray scale level of the pixel is input to the signal line 6109. This analog potential corresponds to a video signal. Note that the pixel in FIG. 62 has the same structure as that of the pixel in FIG. 61, so refer to FIG. 61 for the reference numerals.

Figure 63A:
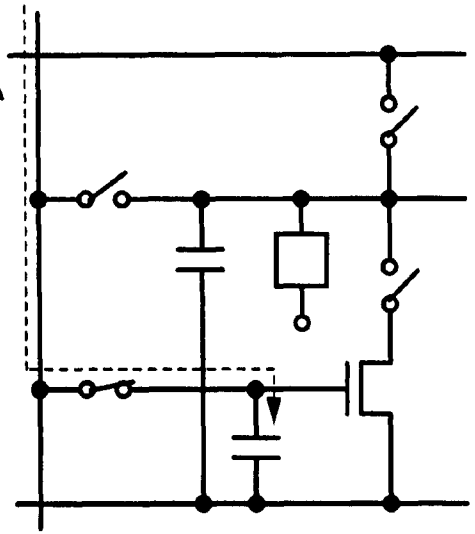
FIGS. 63A to 63D are diagrams explaining operation of a pixel structure applicable to a display device of the present invention.

Subsequently, the case of still image display is explained. In the case of still image display, the second pixel selection switch 6104 is turned on first, and then, the first pixel selection switch 6101, the first switch 6107, and the second switch 6108 are turned off. Then, a digital signal is input to the signal line 6109. This digital signal corresponds to a video signal. Then, the signal is written to the second capacitor element 6105 as shown in FIG. 63A.

Figure 63B:
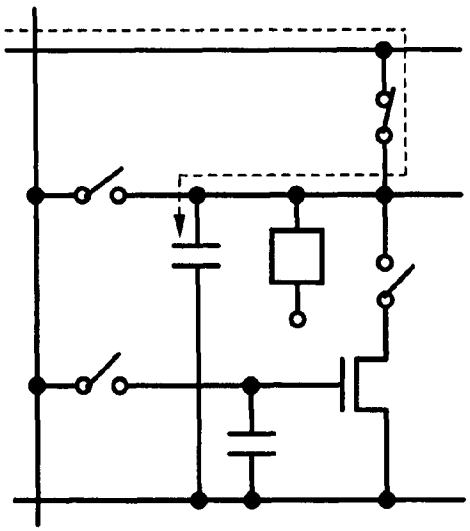

Next, the second pixel selection switch 6104 is turned off, and the first switch 6107 is turned on while the first pixel selection switch 6101 and the second switch 6108 are turned off. Then, a potential Vrefh of the first power source line 6110 is set to one electrode of the first capacitor element 6102 as shown in FIG. 63B. In addition, a potential Vcom of the second power source line 6111 is set to the other electrode of the first capacitor element 6102; therefore, a charge for a potential difference (Vrefh-Vcom) is accumulated in the capacitor element 6102. Note that a power source potential Vrefh is set to the pixel electrode of the display element 6103 at this time.

Subsequently, the first switch 6107 is turned off and the second switch 6108 is turned on while the first pixel selection switch 6101 and the second pixel selection switch 6104 turned off. Then, the transistor 6106 is controlled to be turned on or off in accordance with a digital signal written to the second capacitor element 6105.

Figure 63C:
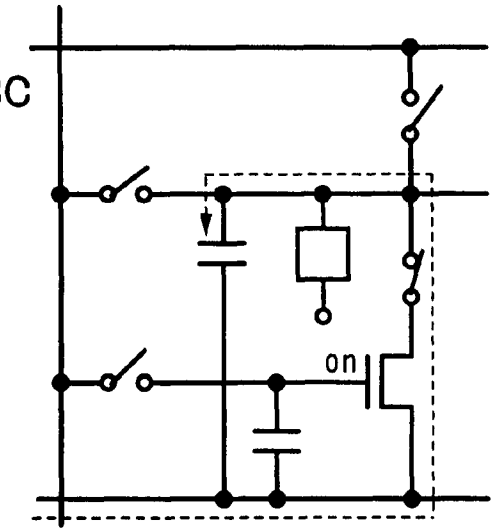
Figure 63D:
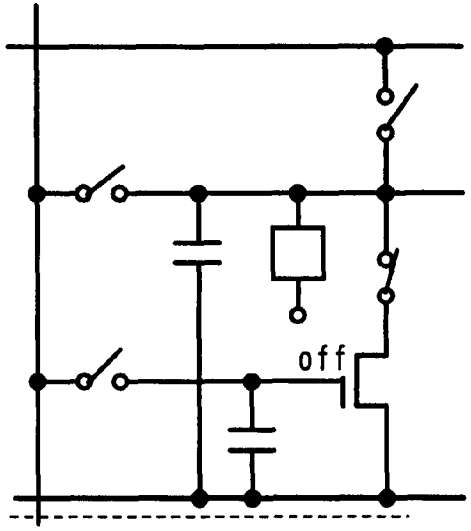

In other words, the transistor 6106 is turned on when the digital signal written to the second capacitor element 6105 is at an H level. Therefore, the potential Vcom of the second power source line 6111 is set to both electrodes of the first capacitor element 6102 as shown in FIG. 63C. Then, a potential of Vcom is set to the pixel electrode of the display device 6103. Note that a voltage is hardly applied to the display element 6103 at this time since a potential approximately equal to Vcom is set to the opposite electrode 6112 of the display element 6103. Accordingly, the pixel is put in a non-lighting state. On the other hand, the transistor 6106 is turned off when the digital signal written to the second capacitor element 6105 is at an L level. Therefore, the first capacitor element 6102 holds the voltage as shown in FIG. 63D.

Accordingly, since a potential set to the pixel electrode of the display element 6103 is kept at Vrefh, the pixel is put in a lighting state.

Subsequently, similar operation is performed in a next frame period with a potential of Vrefl set to the first power source line 6110. Then, a reverse bias voltage of that applied to the display element 6103 in the last frame period is applied to the display element 6103 of a lighting pixel. Thus, the direction of bias applied to the display element 6103 can be changed by changing the potential set to the first power source line 6110 in each frame period. Therefore, burn-in of the display element 6103 can be prevented.

Note that it is acceptable as long as the digital signal held in the second capacitor element 6105 can control the transistor 6106 to be turned on or off. Therefore, normal operation can be performed even if the charge accumulated in the second capacitor element 6105 is slightly discharged. Accordingly, periodic rewriting of a digital signal to the pixel may be performed every several frame periods or ten-odd frame periods. Thus, power consumption can be reduced.

Note that signal rewriting to the pixel is performed separately from the periodic rewriting of a digital signal to the pixel when part of an image is changed in the case of still image display. In this case, the display device of the present invention performs the signal rewriting to the pixel separately from the periodic rewriting only in a pixel row including a pixel in which a lighting or non-lighting state changes. In other words, when data of a video signal for a pixel row in which the signal is to be written to the pixel is identical with data of a digital signal already written to the pixel, a scan line driver circuit does not select the pixel row.

Therefore, power consumption can further be reduced.

Note that the pixel structure applicable to the display device of the present invention is not limited to those described above. Further, for the digital signal memory circuit, a static random access memory (SRAM) may be used as shown in FIG. 57 or a dynamic random access memory (DRAM) may be used as shown in FIG. 61. Alternatively, a combination thereof may be used.

Embodiment 8

Figure 50:
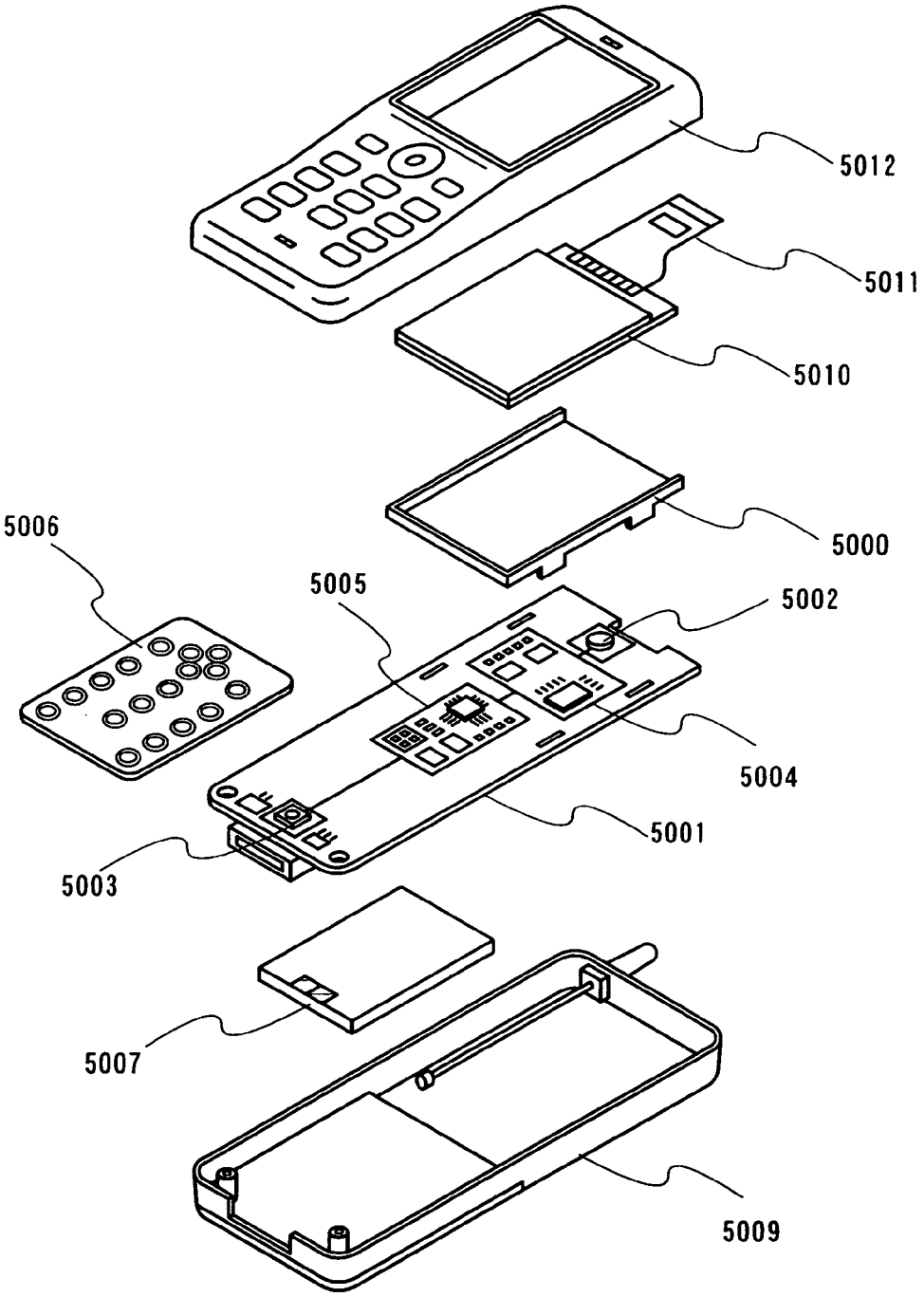
FIG. 50 is a diagram explaining an electronic device to which a display device of the present invention can be applied.

In this embodiment, a structure example of a mobile phone including the display device of the present invention in a display portion is explained with reference to FIG. 50.

A display panel 5010 is incorporated in a housing 5000 so as to be detachable. The shape and size of the housing 5000 can be appropriately changed in accordance with the size of the display panel 5010. The housing 5000 to which the display panel 5010 is fixed is fitted in a printed circuit board 5001 and assembled as a module.

The display panel 5010 is connected to the printed circuit board 5001 through an FPC 5011. The printed circuit board 5001 is provided with a speaker 5002, a microphone 5003, a transmitting and receiving circuit 5004, and a signal processing circuit 5005 including a CPU, a controller, and the like. Such a module, an input means 5006, and a buttery 5007 are combined and stored using a chassis 5009. A pixel portion of the display panel 5010 is arranged so as to be seen from a window formed in the chassis 5012.

In the display panel 5010, the pixel portion and part of peripheral driver circuits (a driver circuit having a low operation frequency among a plurality of driver circuits) may be formed using TFTs in an integrated manner on a substrate, and another part of the peripheral driver circuits (a driver circuit having a high operation frequency among the plurality of driver circuits) may be formed on an IC chip. The IC chip may be mounted on the display panel 5010 by COG (Chip On Glass). The IC chip may alternatively be connected to a glass substrate using TAB (Tape Automated Bonding) or a printed circuit board. Note that FIG. 42A shows an example of constitution of a display panel where part of peripheral driver circuits is integrated with a pixel portion on a substrate and an IC chip on which the another part of peripheral driver circuits is formed is mounted by COG or the like. By employing the above-described structure, power consumption of the display device can be reduced and operating time per charge of the mobile phone can be made longer. In addition, cost reduction of the mobile phone can be achieved.

Alternatively, in order to further reduce power consumption, a pixel portion may be formed using a TFT on a substrate, all peripheral driver circuits may be formed on an IC chip, and then, the IC chip may be mounted on a display panel by COG (Chip On Glass) or the like as shown in FIG. 42B.

The structure described in this embodiment is an example of a mobile phone, and the display device of the invention can be applied not only to the mobile phone having the above-described structure but also to mobile phones having various kinds of structures.

Embodiment 9

Figure 48:
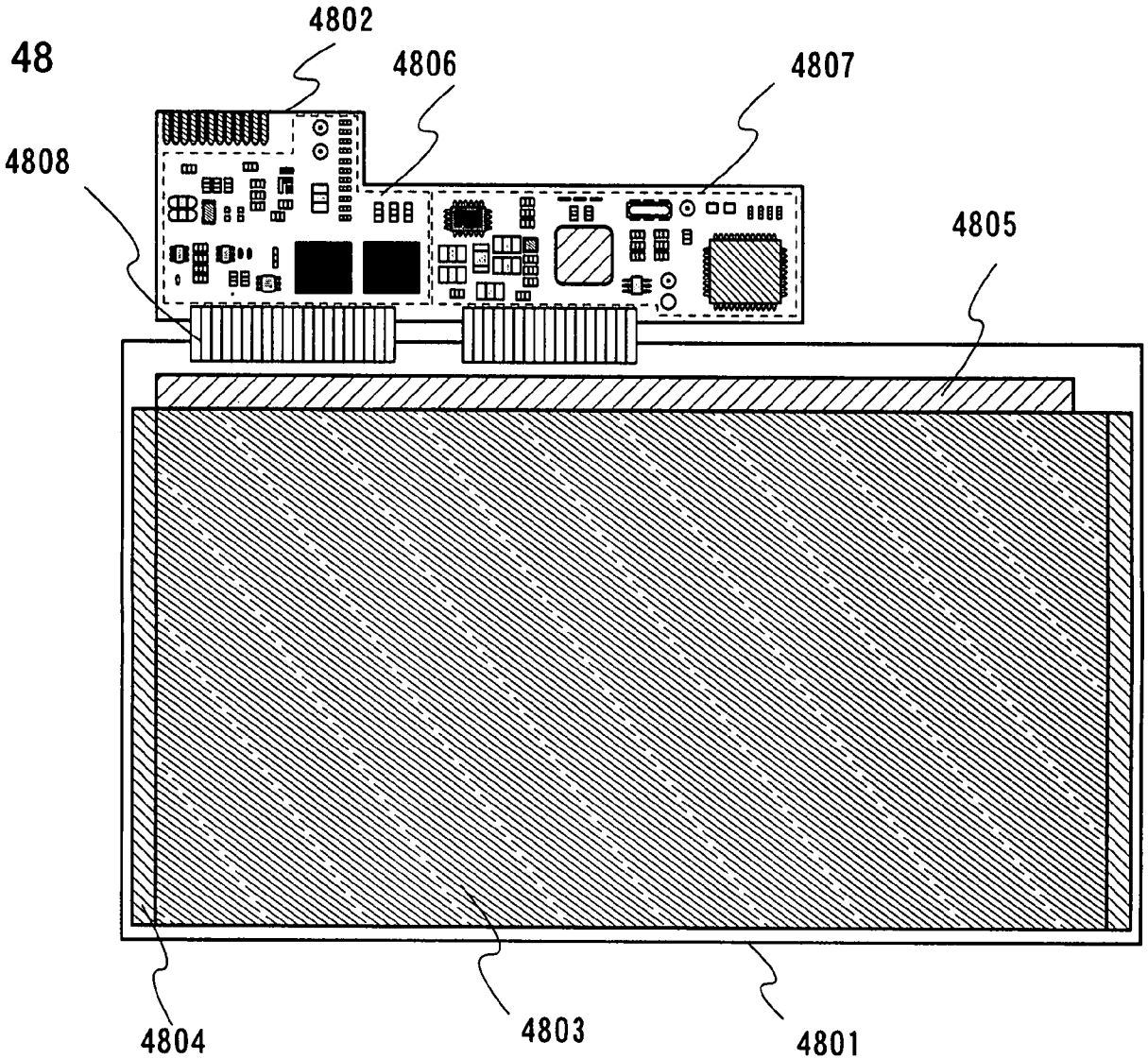
FIG. 48 is a diagram explaining an electronic device to which a display device of the present invention can be applied.

FIG. 48 shows an EL module in which a display panel 4801 and a circuit board 4802 are combined. The display panel 4801 includes a pixel portion 4803, a scan line driver circuit 4804, and a signal line driver circuit 4805. On the circuit board 4802, for example, a control circuit 4806, a signal dividing circuit 4807, and the like are formed. The display panel 4801 and the circuit board 4802 are connected to each other by a connection wiring 4808. As the connection wiring, an FPC or the like can be used.

In the display panel 4801, the pixel portion and part of peripheral driver circuits (a driver circuit having a low operation frequency among a plurality of driver circuits) may be formed using TFTs in an integrated manner on a substrate, and another part of the peripheral driver circuits (a driver circuit having a high operation frequency among the plurality of driver circuits) may be formed on an IC chip. The IC chip may be mounted on the display panel 4801 by COG (Chip On Glass) or the like. The IC chip may alternatively be mounted on the display panel 4801 by using TAB (Tape Automated Bonding) or a printed circuit board. Note that FIG. 42 shows an example of constitution of a display panel where part of peripheral driver circuits is integrated with a pixel portion on a substrate and an IC chip on which another part of the peripheral driver circuits is formed is mounted by COG or the like.

In order to further reduce power consumption, a pixel portion may be formed using TFTs on a glass substrate, and all peripheral driver circuits may be formed on an IC chip, which may be mounted on a display panel by COG (Chip On Glass) or the like. Note that FIG. 42B shows an example of constitution where a pixel portion is formed on a substrate and an IC chip provided with a peripheral driver circuit is mounted on the substrate by COG or the like.

Figure 49:
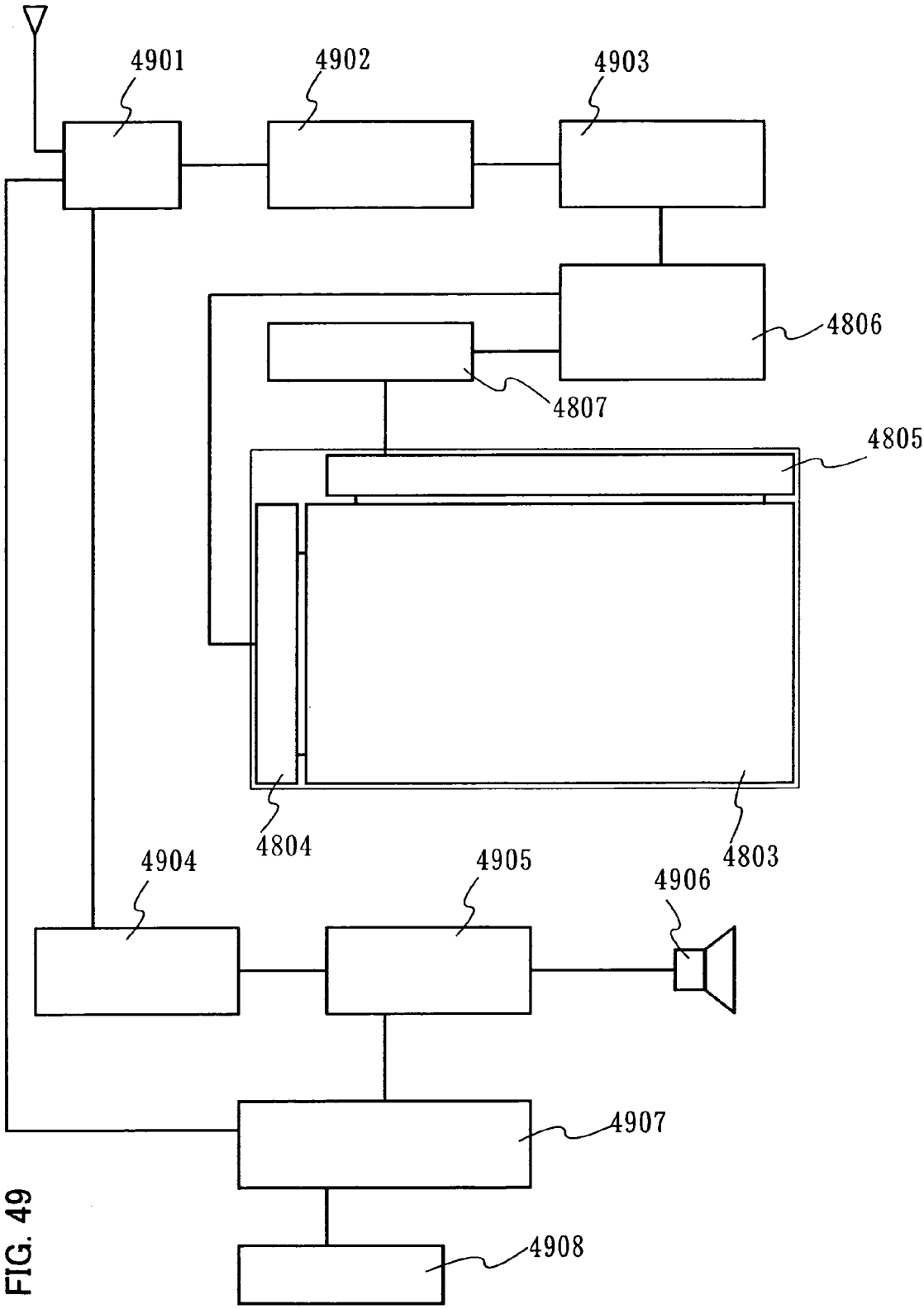
FIG. 49 is a diagram explaining an electronic device to which a display device of the present invention can be applied.

An EL TV receiver can be completed with this EL module. FIG. 49 is a block diagram showing main constitution of an EL TV receiver. A tuner 4901 receives a video signal and an audio signal. The video signal is processed by a video signal amplifier circuit 4902, a video signal processing circuit 4903 for converting a signal output from the video signal amplifier circuit 4902 into a color signal corresponding to each color of red, green and blue, and a control circuit 4806 for converting the video signal into the input specification of a driver circuit.

The control circuit 4806 outputs respective signals to the scan line side and the signal line side. In the case of driving in a digital manner, constitution may be adopted in which the signal dividing circuit 4807 is provided on the signal line side to supply an input digital signal divided into m pieces.

The audio signal among the signals received by the tuner 4901 is transmitted to an audio signal amplifier circuit 4904, the output of which is supplied to a speaker 4906 through an audio signal processing circuit 4905. A control circuit 4907 receives control information of a receiving station (reception frequency) or sound volume from an input portion 4908 and transmits signals to the tuner 4901 and the audio signal processing circuit 4905.

By incorporating the EL module in FIG. 48 into the chassis 26001, a TV receiver can be completed as shown in FIG. 26A. The display portion 26003 is formed with the EL module. In addition, the speaker 26004, the video input terminal 26005, and the like are provided appropriately.

Naturally, the present invention is not limited to the TV receiver, and can be applied to various uses as a large-sized display medium such as an information display board at a train station, an airport, or the like, or an advertisement display board on the street, as well as a monitor of a personal computer.

This application is based on Japanese Patent Application serial no. 2005-148801 filed in Japan Patent Office on May 20, 2005, the contents of which are hereby incorporated by reference.

What is claimed is:

1. An active matrix EL display device comprising:

a pixel portion which includes a plurality of pixels, a plurality of signal lines and a plurality of scan lines;

a signal line driver circuit comprising a pulse output circuit, a first latch circuit, a second latch circuit, and an output control circuit which is electrically connected to the signal lines; and a scan line driver circuit which is electrically connected to the scan lines, a determination circuit configured to compare data of a first video signal input to pixels of a single row during a subframe period with data of a second video signal input to the pixels of the single row during a subsequent period to write video signals to the pixels;

wherein each of the plurality of pixels includes an EL element, wherein the scan line driver circuit does not output a selecting pulse to select a pixel row to a scan line corresponding to the pixel row when a signal to be written to the pixel row is identical with a signal stored in the pixel row, wherein the output control circuit does not output a video signal held in the second latch circuit to the signal lines to make the signal lines in a floating state when a signal to be written to the pixel row is identical with a signal stored in the pixel row, wherein a frame period is divided into a plurality of subframe periods according to an overlapped time gray scale method, wherein the overlapped time gray scale method is a driving method expressing a gray scale by a difference in total time of light emitting time of each pixel by dividing one frame period into a plurality of subframe periods and controlling lighting and non-lighting of each pixel in each subframe period, wherein the overlapped time gray scale method is a driving method expressing a gray scale by sequentially adding the number of times lighting is carried out in each subframe period, wherein each subframe period has a signal writing time and a data hold period, wherein a first data hold period in one of the subframe periods and a second data hold period in a subsequent subframe period is substantially the same, wherein a first luminance of emitted light from a pixel in the first data hold period and a second luminance of emitted light from the pixel in the second data hold period are different from each other, and wherein inputting a clock signal and an inverted clock signal to the signal line driver circuit is stopped when the signal to be written to the pixel row is identical with the signal stored in the pixel row.

2. An active matrix EL display device according to claim 1, wherein the scan line driver circuit comprises an output control circuit which controls whether or not a selecting pulse is output to a scan line.

3. An active matrix EL display device according to claim 1, wherein the signal line driver circuit comprises an output control circuit which controls whether or not a signal line is put in a floating state.

4. An active matrix EL display device according to claim 1, wherein inputting a video signal input to the signal line driver circuit is stopped when the signal to be written to the pixel row is identical with the signal stored in the pixel row.

5. An electronic device comprising the active matrix EL display device according to claim 1 in a display portion.

* * * * *

UNITED STATES PATENT AND TRADEMARK OFFICE

CERTIFICATE OF CORRECTION

PATENT NO. : 8,847,861 B2
APPLICATION NO. : 11/430129
DATED : September 30, 2014
INVENTOR(S) : Hajime Kimura It is certified that error appears in the above-identified patent and that said Letters Patent is hereby corrected as shown below:

In the Specification:

Column 19, Line 21; Change "(video Data)" to --(Video Data)--.

Column 20, Line 35; Change "(video Data)" to --(Video Data)--.

Column 28, Line 30; Change "(video Data)" to --(Video Data)--.

Column 29, Lines 35 to 36; Change "(video Data)" to --(Video Data)--.

Column 35, Line 11; Change "(video Data)" to --(Video Data)--.

Column 35, Line 46; Change "lines S to" to --lines S1 to--.

Column 35, Line 66; Change "lines S to" to --lines S1 to--.

Column 35, Line 67; Change "lines S to" to --lines S1 to--.

Column 45, Line 17; Change "(video Data)" to --(Video Data)--.

Column 51, Line 60; Change "line R1" to --line Ri--.

Column 52, Line 6; Change "lines G6 to Gm)." to --lines G1 to Gm).--.

Column 58, Line 16; Change "line R1" to --line Ri--.

Column 58, Line 33; Change "line R1" to --line Ri--.

Column 58, Line 55; Change "line R1" to --line Ri--.

Column 58, Line 60; Change "line R1." to --line Ri.--.

Column 60, Line 49; Change "line R1" to --line Ri--.

In the Claims:

Column 98, Line 15, Claim 1; Change "of each" to --of the each--.

Column 98, Line 19, Claim 1; Change "in each" to --in the each--.

Column 98, Line 31, Claim 1; Change "signal to" to --signal input to--.

Signed and Sealed this
Twelfth Day of May, 2015

Michelle K. Lee

Michelle K. Lee
*Director of the United States Patent and Trademark Office*